US006293400B1

(12) United States Patent
Arai et al.

(10) Patent No.: US 6,293,400 B1
(45) Date of Patent: Sep. 25, 2001

(54) ARTICLE TRANSPORTING/STORING APPARATUS AND ARTICLE TRANSPORTED BY THE APPARATUS

(75) Inventors: Tomoaki Arai, Tokyo; Sakae Ishikawa, Kanagawa; Satoshi Ishihara, Saitama; Isamu Tanaka, Tokyo, all of (JP)

(73) Assignee: Ricoh Company, Ltd., Tokyo (JP)

( * ) Notice: Subject to any disclaimer, the term of this patent is extended or adjusted under 35 U.S.C. 154(b) by 0 days.

(21) Appl. No.: 09/290,551

(22) Filed: Apr. 12, 1999

(30) Foreign Application Priority Data

| | | |
|---|---|---|
| Apr. 10, 1998 | (JP) | 10-116178 |
| Mar. 5, 1999 | (JP) | 11-059508 |
| Mar. 8, 1999 | (JP) | 11-060697 |
| Mar. 9, 1999 | (JP) | 11-062447 |
| Mar. 15, 1999 | (JP) | 11-067645 |
| Mar. 15, 1999 | (JP) | 11-067858 |
| Mar. 17, 1999 | (JP) | 11-071890 |

(51) Int. Cl.[7] ..... B65D 19/00
(52) U.S. Cl. ..... 206/386; 208/600
(58) Field of Search ..... 206/386, 597, 206/600; 108/55.1

(56) References Cited

U.S. PATENT DOCUMENTS

| | | | | |
|---|---|---|---|---|
| 2,700,521 | * | 1/1955 | Lapham . | |
| 4,002,126 | * | 1/1977 | Bell et al. . | |
| 5,429,236 | * | 7/1995 | Evans | 206/386 |
| 5,694,638 | | 12/1997 | Maruyama et al. . | |
| 6,079,560 | * | 7/2000 | Champion | 206/386 |

FOREIGN PATENT DOCUMENTS

| | | |
|---|---|---|
| 41 16 171 | 11/1992 | (DE) . |
| 0 648 684 | 4/1995 | (EP) . |
| 2 265 624 | 10/1975 | (FR) . |
| 2 660 910 | 10/1991 | (FR) . |
| 806054 | 12/1958 | (GB) . |
| 1137244 | 12/1968 | (GB) . |
| 2 053 143 | 2/1981 | (GB) . |
| 2 307 220 | 5/1997 | (GB) . |
| 51-49880 | 4/1976 | (JP) . |
| 55-31622 | 3/1980 | (JP) . |
| 57-105230 | 6/1982 | (JP) . |
| 63-29562 | 2/1988 | (JP) . |
| 63-152460 | 10/1988 | (JP) . |
| 1-176060 | 12/1989 | (JP) . |
| 6-286752 | 10/1994 | (JP) . |
| 11-62447 | 3/1999 | (JP) . |
| WO 99/03743 | 1/1999 | (WO) . |

* cited by examiner

*Primary Examiner*—David T. Fidei
(74) *Attorney, Agent, or Firm*—Oblon, Spivak, McClelland, Maier & Neustadt, P.C.

(57) ABSTRACT

First and second coupling members are provided between two adjoining supports so that a space between the two supports detachably attached to corners of a pallet with an article placed thereon can be freely adjusted.

44 Claims, 105 Drawing Sheets

ARTICLE TRANSPORTING/STORING APPARATUS AND ARTICLE TRANSPORTED BY THE APPARATUS

FIELD OF THE INVENTION

The present invention relates to an article transporting/storing apparatus for transporting or storing industrial products such as electric equipment, components thereof, construction materials, furniture or other various types of article as well as to the article transported by this apparatus.

BACKGROUND OF THE INVENTION

As this type of article transporting/storing apparatus, an apparatus comprising a pallet for placing article thereon, four supports attached to four corners of the pallet in the vertically erected state to an article-loading surface thereof, and coupling members for coupling and fixing the adjoining supports to each other has been widely used. To transport an article with this type of article transporting/storing apparatus, the article is accommodated in a space surrounded by the four supports and is placed on the pallet, and the article is transported together with the article transporting/storing apparatus. When storing the article accommodated in the article transporting/storing apparatus in a warehouse or the like, a plurality of the article transporting/storing apparatuses can be piled up on each other to effectively utilize a space in the warehouse.

However, size of the article to be transported and stored with this type of article transporting/storing apparatus varies from large ones to small ones, but the conventional type of article transporting/storing apparatus has a fixed space capacity for accommodating an article or article therein. Therefore, an article having a fixed size can be transported or stored with an article transporting/storing apparatus having a size suited to the article's size, but an article having a size larger than that can be accommodated in the article transporting/storing apparatus can nor be transported nor be stored. Further, if it is tried to transport or store an article far smaller than that can be accommodated in the article transporting/storing apparatus, the transportation efficiency is quite low, and a space in a warehouse is inefficiently used, which is not desirable.

SUMMARY OF THE INVENTION

It is an object of the present invention to provide an article transporting/storing apparatus capable of efficiently transporting or storing article and also to provide an article which can be efficiently transported with this article transporting/storing apparatus.

The article transporting/storing apparatus according to the present invention comprises pallet for placing the article to be transported or stored, for example four supports which are detachably attached to a surface the pallet on which the article is placed (article-loading surface). These supports stand almost vertical with respect to the article-loading surface of the pallet. A coupling unit couples any two adjoining supports to each other in such a way that the space (distance) between any two adjoining supports can be adjusted. When transporting or storing an article, a pallet of size suitable to the size of the article is selected, the spaces between the supports is adjusted according to the size of the pallet. Then the supports are fixed to the pallet and the article to be transported or stored is placed on the article-loading surface of the pallet. Thus, an article having a different size can be transported or stored by the article transporting/storing apparatus having a size suited to that of the article.

The coupling unit comprises two joints (first and second) and two coupling members (first and second). When the supports are attached to the pallet, the two coupling members cross each other, one end of the first coupling member is rotatably connected to the first joint of a support (first) of the two adjoining supports and the other end is rotatably connected to the second joint of the other support (second) of the two adjoining supports, and one end of the second coupling member is rotatably connected to the second joint of the first support of the two adjoining supports and the other end is rotatably connected to the first joint of the second support of the two adjoining supports. Therefore, a space between the supports can be easily adjusted by pulling the supports apart or by pressing the supports towards each other.

The coupling unit may comprise three joints (first, second, and third) and two coupling members (first and second). When the supports are attached to the pallet, the two coupling members cross each other, the joints are provided in the order of first, third and second from the top to bottom of the support. One end of the first coupling member is rotatably connected to the first joint of a support (first) of the two adjoining supports and the other end is rotatably connected to the third joint of the other support (second) of the two adjoining supports. One end of the second coupling member is rotatably connected to the second joint of the first support of the two adjoining supports and the other end is rotatably connected to the first joint of the second support of the two adjoining supports. While the third joint of the first support is connected to a first joint of the forth support through a coupling member, and the third joint of the second support is connected to a first joint of a third support through a coupling member. Therefore, a space between the supports can be easily adjusted by pulling the supports apart or by pressing the supports towards each other. Further, a space between adjoining supports and a space between supports that do not adjoin each other can be adjusted differently so that the size of the pallet need not be a square.

Other objects and features of this invention will become understood from the following description with reference to the accompanying drawings.

DESCRIPTION OF THE PREFERRED EMBODIMENTS

Now detailed description is made for embodiments of the present invention with reference to the related drawings.

Figure 1:
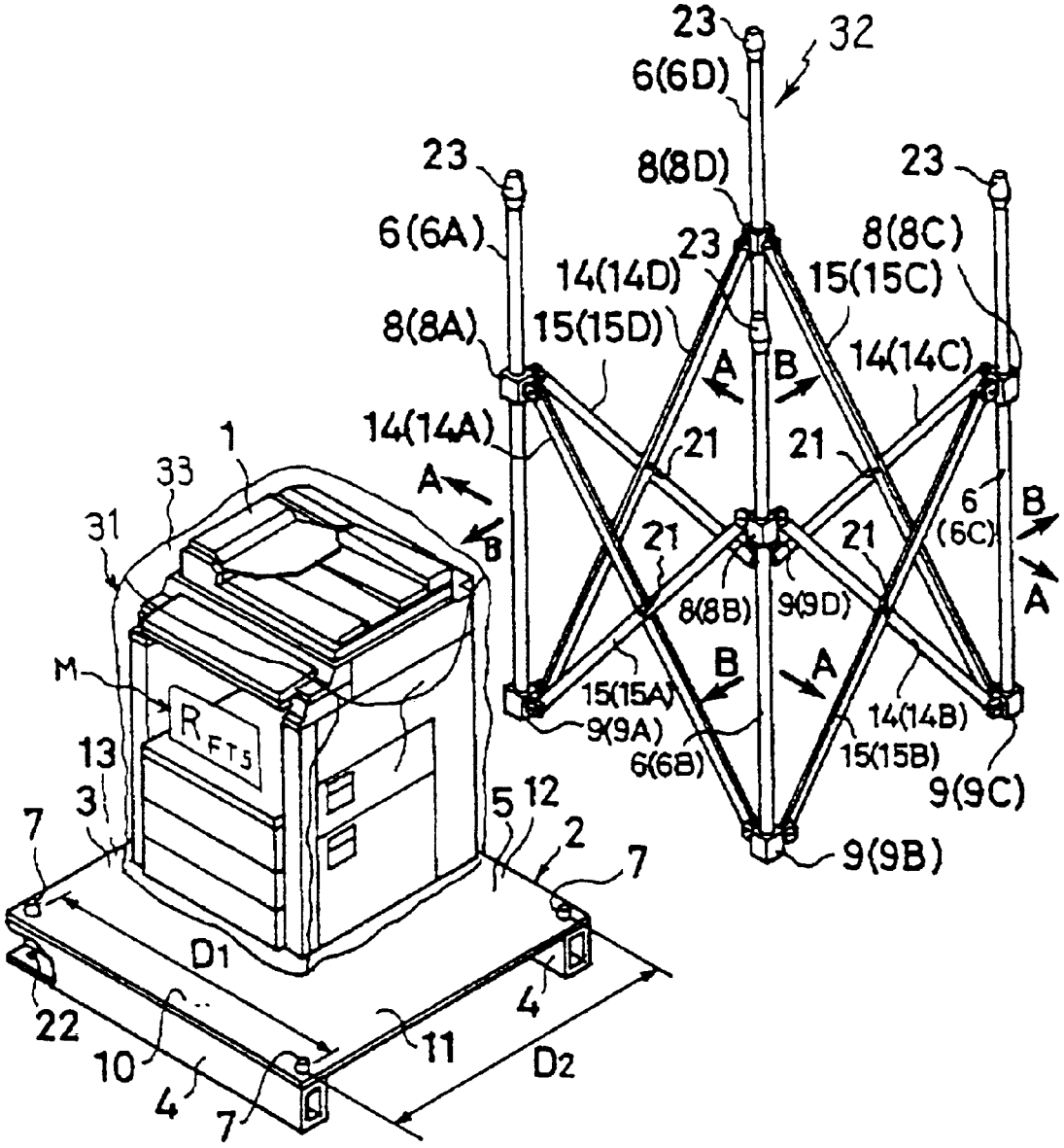
FIG. 1 is a perspective view showing an example of the article transporting/storing apparatus according to the present invention.

FIG. 1 is a perspective view showing an example of the article transporting/storing apparatus according to the present invention. The article transporting/storing apparatus shown in this figure has a pallet 2 on which an article 1 comprising, for instance, a copying machine, is placed. The pallet 2 shown in FIG. 1 comprises a deck board 3 comprising a rectangular flat plate, and two leg sections 4 each comprising a square bar fixed to a bottom surface of the deck board contrary to an article-loading place 5 thereof. The pallet 2 is made from a material with high rigidity as a metal like steel or wood or hard resin. The deck board 3 and the leg sections 4 may be welded or may be fixed to each other with an adhesive, or they may be fixed with each other with the help of screws. Any pallet having a form other than a square may also be used.

The article 1 placed on the pallet 2 is movably and detachably fixed to the pallet 2 with the help of nut and bolt not shown herein. Further, in the example shown in FIG. 1 the article 1 on the pallet 2 is covered with a cover 31 so as to protect the article 1, however this cover 31 may be omitted.

The cover 31 covers at least a portion of the article 1 on the pallet 2, and functions as a protection cover for protecting the article 1, for instance, when something strikes the article 1, and also for preventing foreign materials or dust from being deposited on the article 1. The cover 31 shown in FIG. 1 comprises, for instance, a flexible bag 33 made from a resin sheet or a resin film made of such a material as polyethylene, and envelops the article 1 on the pallet 2. Information M concerning the article 1 is displayed on the cover 31. For instance, like in the example shown in FIG. 1, "R" indicating a manufacturer of the article 1, "FT5" indicating a product name of the article 1, and remarks that indicate the necessity to prevent the article 1 from becoming wet by rain, namely a care mark (not shown herein) are displayed on the cover 31. The information may directly be written on the cover 31, or a sheet with the information printed or written thereon may be adhered to the cover 31.

Figure 3:
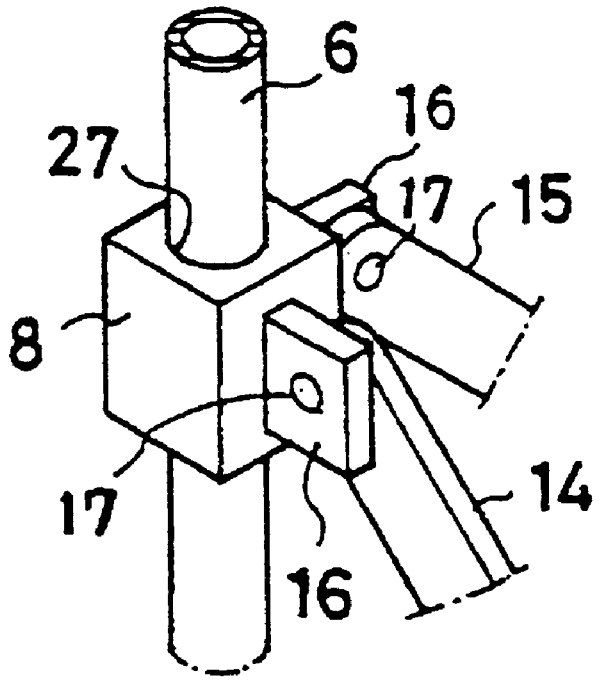
FIG. 3 is an enlarged perspective view of the first joint shown in FIG. 1 and a coupling member coupled thereto.
Figure 4:
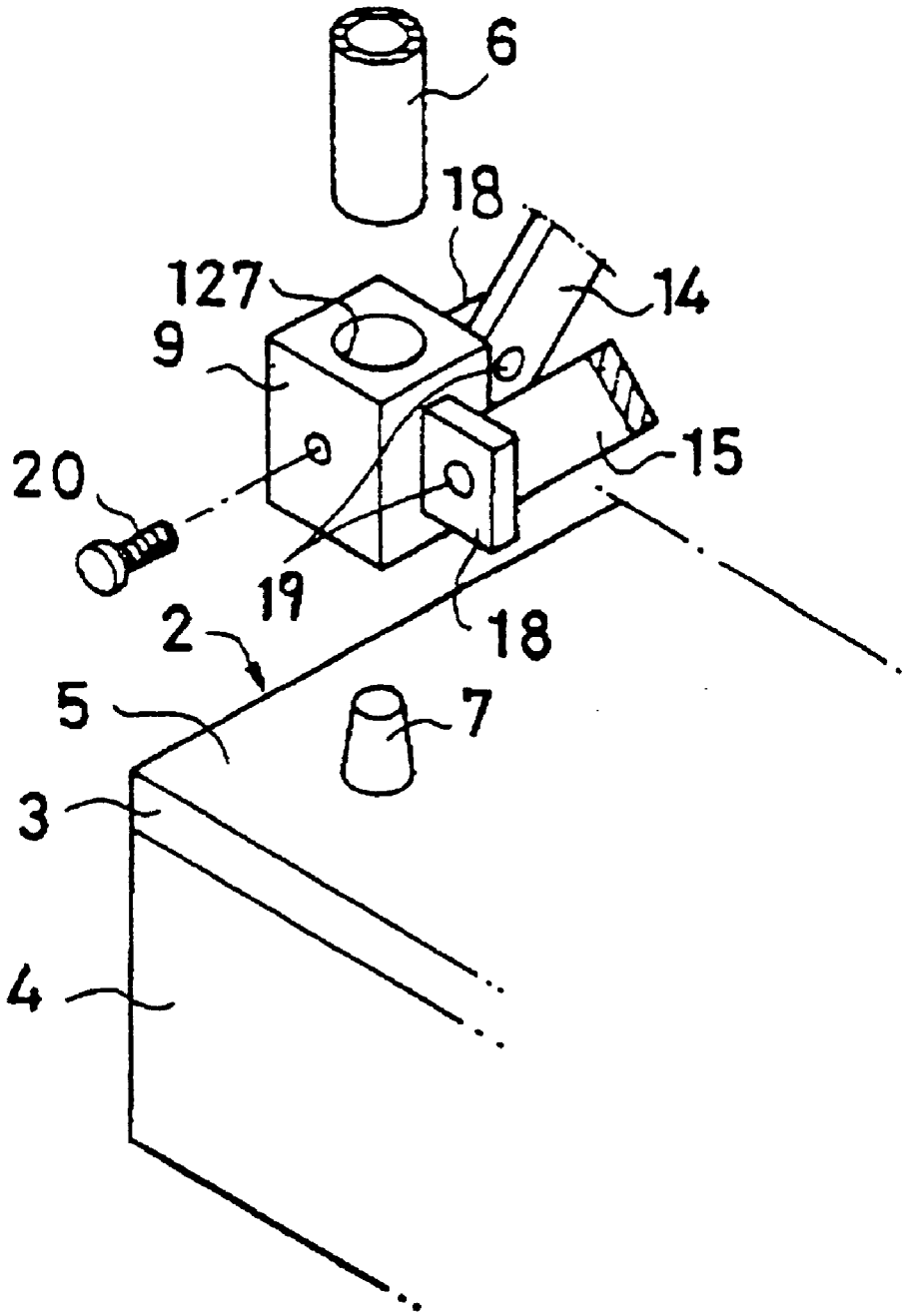
FIG. 4 is a perspective view showing a situation where the second joint and the support shown in FIG. 1 are separated from each other.

The article transporting/storing apparatus shown in FIG. 1 has four supports 6 which are detachably attached to the article-loading surface 5 at four corners of the pallet 2 each in the substantially vertical state with respect to the article-loading surface 5. Supposing a square on the pallet 2, the supports 6 are detachably attached in an erected posture at the corners of the square. The support 6 is made from a material such as metal, resin, or wood, but in the example shown in the figure, the support 6 is made with a hollow metal pipe as shown in FIG. 3 and FIG. 4. Projections 7 are provided at four corners of the article-loading surface 5 of the deck board 3, and a lower section of each support 6 is engaged with each of the projection 7. As described above, each of the supports 6 in this example can be manually and easily detachably attached to the pallet 2.

Further the article transporting/storing apparatus in this example has first and second joints 8, 9 each attached to the respective support 6 in the longitudinal direction thereof respectively, and first and second coupling members 14, 15 each for coupling two adjoining supports 6 located side by side to each other. Eac of the first and second coupling members 14, 15 couples two adjoining supports 6 in each of the first to fourth edges 10, 11, 12, and 13 of the pallet crossing each other at right angles. As understood from FIG. 2, when the our supports 6 are attached to the pallet 2, the second joint 9 is positioned under the first joint 8, and also in the state where the four supports are attached to the pallet 2, the first and second coupling members 14, 15 cross each other.

The first and second joints 8, 9 comprises, as shown in FIG. 3 and FIG. 4, a tubular body made from such a material as metal, synthetic resin, or rubber, and the supports 6 are engaged in central holes 27, 127 respectively. Two tongue pieces 16, 18 project from each of the joints 8, 9, and edge section of the first and second coupling members 14, 15 are rotatably connected via pins 17, 19 to the tongue pieces 16, 18 respectively. The first and second coupling members 14, 15 are made from a material with high rigidity such as wood, hard resin, or metal into a thin plate form.

When it is necessary to identify each of the four supports 6 described above, as shown in FIG. 1, the four supports are identified as a first support 6A, a second support 6B, a third support 6C, and a fourth support 6D. Similarly, first and second joints 8, 9 attached to the supports 6A to 6D are identified as 8A, 9A; 8B, 9B; 8C, 9C; 8D, 9D respectively. Further, the first and second coupling members which couple the first and second supports 6A and 6B, second and third supports 6B and 6C, third and fourth supports 6C and 6D, fourth and first supports 6D and 6A to each other are identified as 14A and 15A, 14B and 15B; 14C and 15C; and 14D and 15D. These reference numerals are used in the other embodiments also.

The first and second coupling members 14, 15 are rotatably connected to the joints as described below.

Figure 2:
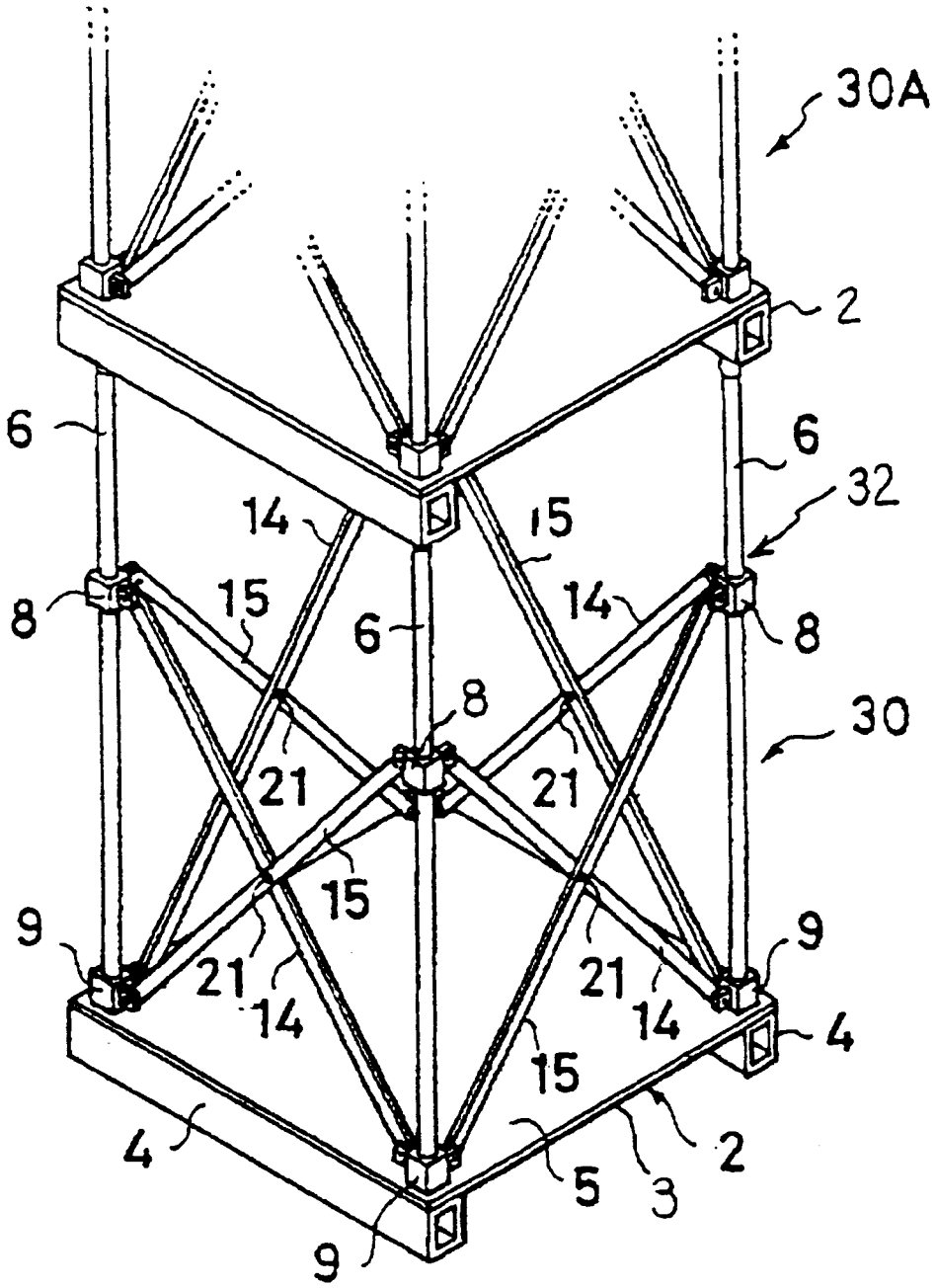
FIG. 2 is a perspective view showing a situation in which the article transporting/storing apparatus shown in FIG. 1 is assembled and a plurality of them are piled up on each other.

As understood from FIG. 1 and FIG. 2, the first coupling member 14A provided between the first and second supports 6A and 6B attached to the pallet 2 in a first edge 10 thereof and located side by side has one edge thereof in the longitudinal direction rotatably connected via a pin to the first joint 8A attached to the first support 6A and at the same time has the other edge thereof in the longitudinal direction rotatably connected via a pin to the second joint 9B attached to the second support 6B. Further, the second coupling member 15A provided between the first and second supports 6A and 6B has one edge thereof in the longitudinal direction rotatably connected via a pin to the first joint 8B attached to the second support 6B and at the same time has the other edge thereof in the longitudinal direction rotatably connected via a pin to the second joint 9A attached to the first support 6A.

The first coupling member 14B provided between the second support 6B and third support 6C attached to the pallet 2 on a second edge 11 thereof next to the first edge 10 and located side by side has one edge thereof in the longitudinal direction rotatably connected via a pin to the first joint 8B attached to the second support 6B and at the same time has the other edge thereof in the longitudinal direction rotatably connected via a pin to the second joint 9C attached to the third support 6C. The second coupling member 15B provided between the second and third supports 6B and 6C has one edge thereof in the longitudinal direction rotatably connected via a pin to the first joint 8C attached to the third support 6C and at the same time has the other edge thereof in the longitudinal direction rotatably connected via a pin to the second joint 9B attached to the second support 6B.

Further, the first coupling member 14C provided between the third and fourth supports 6C, 6D attached to the pallet 2 on a third edge 12 thereof next to the second edge 11 and located side by side has one edge thereof in the longitudinal direction rotatably connected via a pin to the first joint 8C attached to the third support 6C and at the same time has the other edge thereof in the longitudinal direction rotatably connected via a pin to the second joint 9D attached to the fourth support 6D. The second coupling member 15C provided between the third and fourth supports has one edge thereof in the longitudinal direction rotatably connected via a pin to the first joint 8D attached to the support 6D and at the same time has the other edge thereof in the longitudinal direction rotatably connected via a pin to the second joint 9C attached to the third support 6C.

Similarly, the first coupling member 14D provided between the fourth and first supports 6D and 6A attached to the pallet 2 on a fourth edge 14 thereof next to the third edge 12 and located side by side has one edge thereof in the longitudinal direction rotatably connected via a pin to the first joint 8D attached to the fourth support 6D and at the same time has the other edge thereof in the longitudinal direction rotatably connected via a pin to the second joint 9A attached to the first support 6A. The second coupling member 15D provided between the fourth and first supports 6D and 6A has one edge thereof rotatably connected via a pin to the first joint 8A attached to the first joint 6A and at the same time has the other edge thereof in the longitudinal direction rotatably connected via a pin to the second joint 9D attached to the fourth support 6D.

As described above, in the article transporting/storing apparatus shown in FIG. 1 to FIG. 4, each of the first coupling members 14 has one edge thereof in the longitudinal direction rotatably connected to each of the first joint 8 attached to the support 6 of two adjoining supports located side by side on each of the edges 10, 11, 12, and 13 of the pallet 2 and at the same time has the other edge thereof in the longitudinal direction rotatably connected to the second joint 9 attached to the other support 6 of the two adjoining supports located side by side on each edge of the pallet. On the other hand, each of the second coupling members 15 has one edge thereof in the longitudinal direction rotatably connected to the first joint 8 attached to the other (latter) support 6 and at the same time has the other edge thereof in the longitudinal direction rotatably connected to the second joint 9 attached to the one (former) support 6. Thus, each of the support 6 function to support the first and second coupling members 14, 15.

Further, at least one of the first and second joints 8, 9 coupled to the first and second coupling members 14, 15 respectively are movably assembled with the respective support 6 so that the joints can move in the longitudinal direction thereof. In an example shown in the figures, each of the second joints 9 is located in a lower section of each support 6, and is fixed, as shown in FIG. 4, with a screw or by means of welding to each support 6. On the other hand, each of the first joints 8 is slidably engaged with each support 6 in the longitudinal direction. The first joint 8 may be fixed to the support 6 with the second joint slidably engaged with the support 6, or both the first and second joints 8, 9 may be engaged slidably with the support 6.

Pallet 2 shown in FIG. 1 of various sizes each corresponding to a size of the article to be transported are prepared. When the article 1 is to be transported, a pallet 2 having a size suitable to the size of the article 1 is selected. Then, the article 1 is placed on the article-loading surface 5 of the pallet 2, the article 1 is fixed to the pallet 2 with a bolt or the like, and if necessary the article 1 is covered with the cover 31. The distances D1 and D2 between the projections 7 vary according to a size of the selected pallet 2, and a distance between the supports 6 before attaching to the pallet 2 can freely be adjusted as described below so that the distance corresponds to the spaces D1 and D2.

Namely, when, of the supports 6 before attaching to the pallet 2, the two adjoining supports 6A and 6B, and other two adjoining supports 6C and 6D are pulled in the direction of the arrow A in FIG. 1 so that the supports go farther from each other. The first joints slides downward along each of the support 6 and a space between the first and second supports 6A, 6B and a space between the first and fourth 6A, 6D widens. The first and fourth supports 6A, 6D and second and third supports 6B, 6C move in the directions indicated by arrow B so that the supports get farther from each other, and also spaces between the supports are widened.

On the contrary, when the supports 6 are pressed in the directions opposite to those indicated by the arrows A and B, each of the first joints 8 moves upward along the respective support 8, so that a space between any two adjoining supports 6 is narrowed. In the example shown in FIG. 1, spaces between every two adjoining supports provided on four edges 10, 11, 12, 13 of the pallet 2 change at the same rate, so that the distances between them are correlatively adjusted.

As described above, spaces between every two adjoining supports are adjusted according to spaces D1, D2 between the projections 7 of the selected pallet 2, and then lower sections of the supports are engaged with the projections 7 of the pallet 2 with the article 1 placed thereon. The four supports 6 may detachably be attached to four corners of the pallet 2 by engaging a central hole of each of the second joints 9 fixed to a lower section of each support 6 with each projection 7, and further the supports 6 may detachably be attached to the pallet 2 as described with reference to FIG. 7.

As described above, by preparing two pallets 2 having different distances D1, D2 between the projections 7, the supports 6 can be attached to any of the pallets 2 by adjusting a distance between two adjoining supports.

The first and second coupling members 14, 15 may be kept free without coupling them to each other, but in the example shown in the figure, the first and second coupling members 14, 15 forming a pair are coupled to each other with a pivotal pin 21 so that each of the coupling members can freely rotate. Therefore, when adjusting a distance between the supports 6, the work for adjusting a distance between the two adjoining supports can smoothly be executed by smoothly operating the first and second coupling members 14, 15. This is true also in other embodiments described hereinafter.

The work for adjusting a distance between the two adjoining supports can be executed also by slidably engaging the first and second joints 8 and 9 with the respective support 6 in the longitudinal direction thereof. However, when either one of the first and second joints 8, 9 for instance the second joint 9 is fixed to the support 6 and the other joint 8 is slidably assembled with the support 6 like in the example shown in FIG. 1, the first and second coupling members 14, 15 can smoothly be moved and the work for adjusting a space between supports can be carried out easily.

By assembling the supports 6 with the pallet 2, an article transporting/storing apparatus 30 assembled as shown in FIG. 2 can be constructed. Article 1 (not shown in FIG. 2) is accommodated on the article-loading surface 5 within an accommodating space surrounded by four supports 6 as well as by the coupling members 14, 15. In this state, by inserting, for instance, a fork of a forklift under the pallet 2 and raising the fork, it is possible to raise the article transporting/storing apparatus 30 and transport the article 1. In addition, it is possible to move the article transporting/storing apparatus 30 with the article 1 loaded thereon into a truck, a sea vessel, or a train to be transported therewith. Further, the article 1 accommodated in the article transporting/storing apparatus can be stored in a warehouse or in similar facilities. As described above, when the article 1 is transported or stored, the article 1 is surrounded with the first and second coupling members 14, 15, so that the article 1 is protected.

On the other hand, the pallet 2 has a coupling section with an upper section of another article transporting/storing apparatus detachably coupled thereto in the rear side from the article-loading surface 5 thereof, and in the example shown in FIG. 1, the coupling section comprising four engagement holes 22 provided at four leg sections 4 of the pallet 2.

With the configuration as described above, it is possible to pile up a plurality of article transporting/storing apparatuses each with an article placed thereof (not shown) on each other as shown in FIG. 2. Namely, by detachably setting caps 23 each having a sharp tip in upper sections of the supports 6 of the article transporting/storing apparatus as shown in FIG.

1, the article transporting/storing apparatus 30 is placed in, for instance, a warehouse. Then, another article transporting/storing apparatus 30A having the same configuration as the article transporting/storing apparatus 30 can be placed on the article transporting/storing apparatus 30 by raising the article transporting/storing apparatus 30A with, for instance, a forklift. The caps 23 (See FIG. 1) set in upper sections of the four supports 6 of the lower article transporting/storing apparatus 30 are engaged in engagement holes 22 (See FIG. 1) formed on the upper article transporting/storing apparatus 30A. Thus, a plurality of article transporting/storing apparatuses 30, 30A can be positioned and piled up on each other, so that the articles 1 can be stored by effectively using a space inside a warehouse. Further, a plurality of article transporting/storing apparatuses may be piled up on each other and transported together.

The cap 23 set in an upper section of each support 6 is used for making it easier to engage each support 6 in the engagement hole 22. However, tip of each of the support 6 may be engaged in the engagement hole 22 without using the cap 23 as described above. By tapering the tip of each support 6, the support 6 can easily be engaged in the engagement hole 22.

Figure 5:
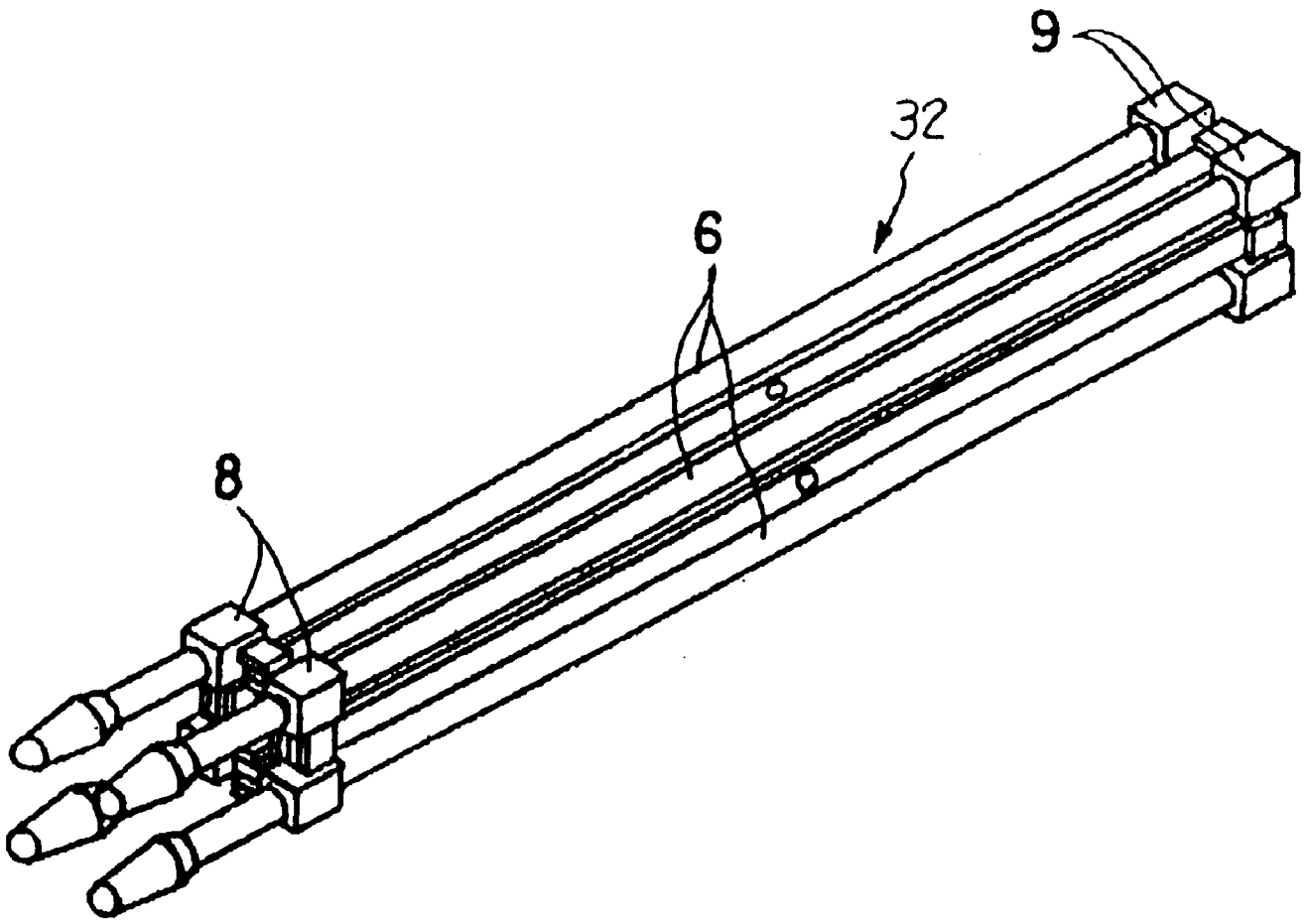
FIG. 5 is a perspective view showing a situation where the support shown in FIG. 1 has been folded.

When the article transporting/storing apparatus is not in use, the first and second coupling members 14, 15 are folded and the entire unit can be folded into a compact form as shown in FIG. 5. This can be achieved by pulling off the four supports 6 from the pallet 2 and moving the supports 6 closer to each other. Thus, the article transporting/storing apparatus can be accommodated in an extremely small space. As described above, the supports 6 and coupling members 14, 15 form a support unit 32, which can freely be folded or unfolded.

Figure 6:
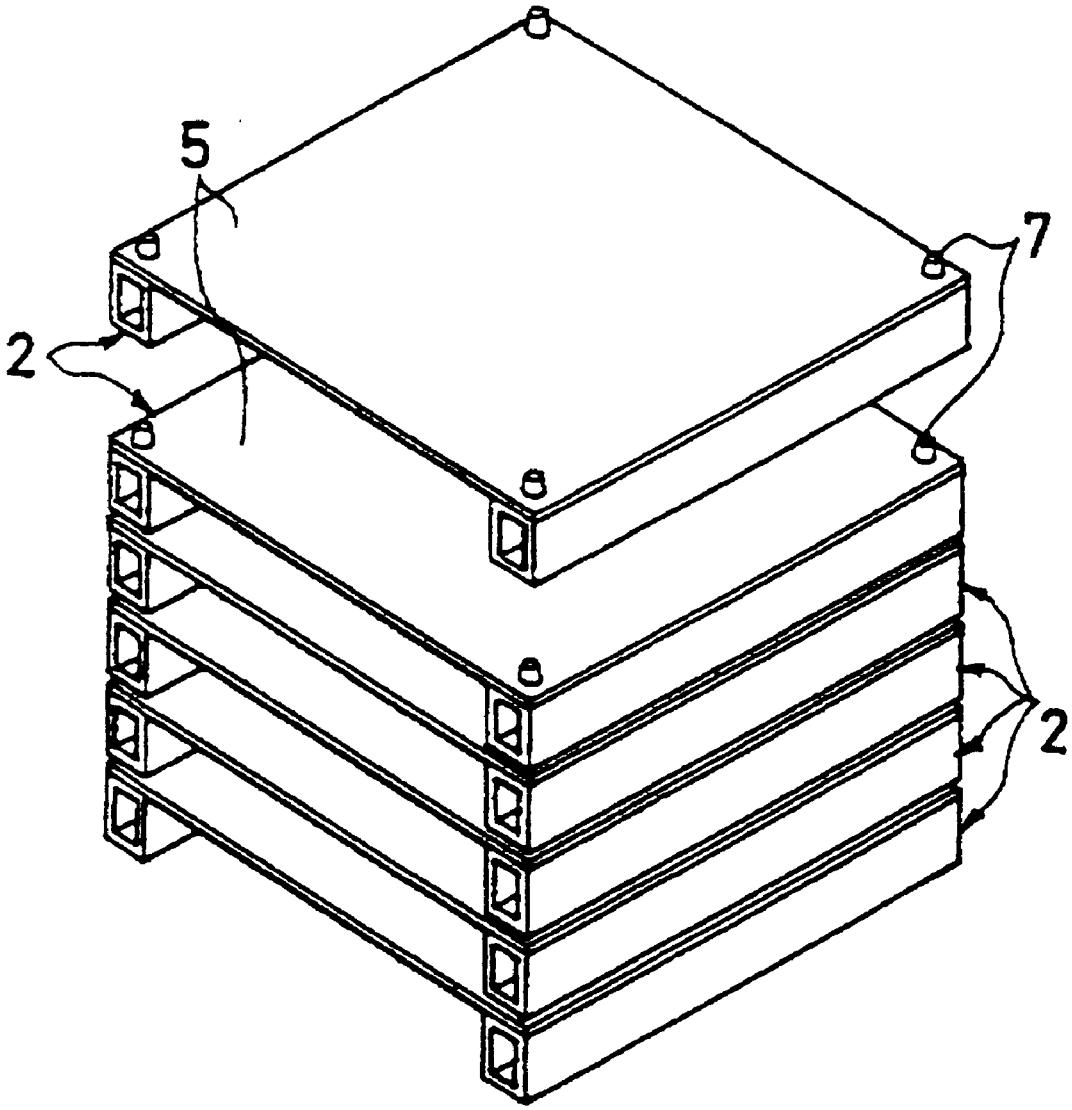
FIG. 6 is a perspective view showing a situation in which a plurality of pallets shown in FIG. 1 are piled up on each other.

On the other hand, a plurality of pallets 2 each with the supports 6 removed therefrom can be piled up on each other as shown in FIG. 6. By engaging the projections 7 formed on the article-loaded surface 5 of the pallet 2 in the engagement holes 22 (See FIG. 1) of the upper pallet 2, the pallets can correctly be positioned and piled up on each other. As described above, the supports 32 and pallets 2 can be used repeatedly, and the necessity of aborting an article transporting/storing apparatus made from, for instance, corrugated board based on the conventional technology can be reduced.

As described above, with the article transporting/storing apparatus shown in FIG. 1 to FIG. 6, substantially regardless of a size of the article 1 to be transported or stored, a pallet 2 having a size suited to the size of the article 1 can be selected, and by adjusting a distance between supports 6 in correspondence to the spaces D1 and D2 between the projections 7, the article 1 can easily be transported or stored.

The article transporting/storing apparatus according to the embodiment shown in FIG. 7 to FIG. 10 also has the pallet 2, on which the article 1 such as a copying machine (Refer to FIG. 9 and FIG. 10), and first to fourth supports 6A, 6B, 6C, and 6D (See FIG. 7) attached to the four corners of the pallet 2 each in the substantially vertical state against the article-loading surface 5 of the pallet 2. Namely, supposing a square on the pallet 2, the support 6 are provided at four corners of the pallet 2 each in the erected posture. Also in this case, a lower section of each support 6 may detachably be attached to the pallet 2 as described above with reference to FIG. 1, but in the example shown in FIG. 7, mounting holes 24 are provided at four corners of the article-loading surface 5 of the pallet 2, and by directly inserting the lower sections of the supports 6 or caps 25 engaged with the lower sections thereof into the amounting holes 24, the supports can easily be attached to or detached from the pallet 2 manually. Further, in the pallet 2 shown in FIG. 7, three leg sections 4, 4, 4A are fixed on the lower surface of the deck board 3. The other configuration of the pallet 2 is not substantially different from that of the pallet 2 shown in FIG. 1.

Figure 7:
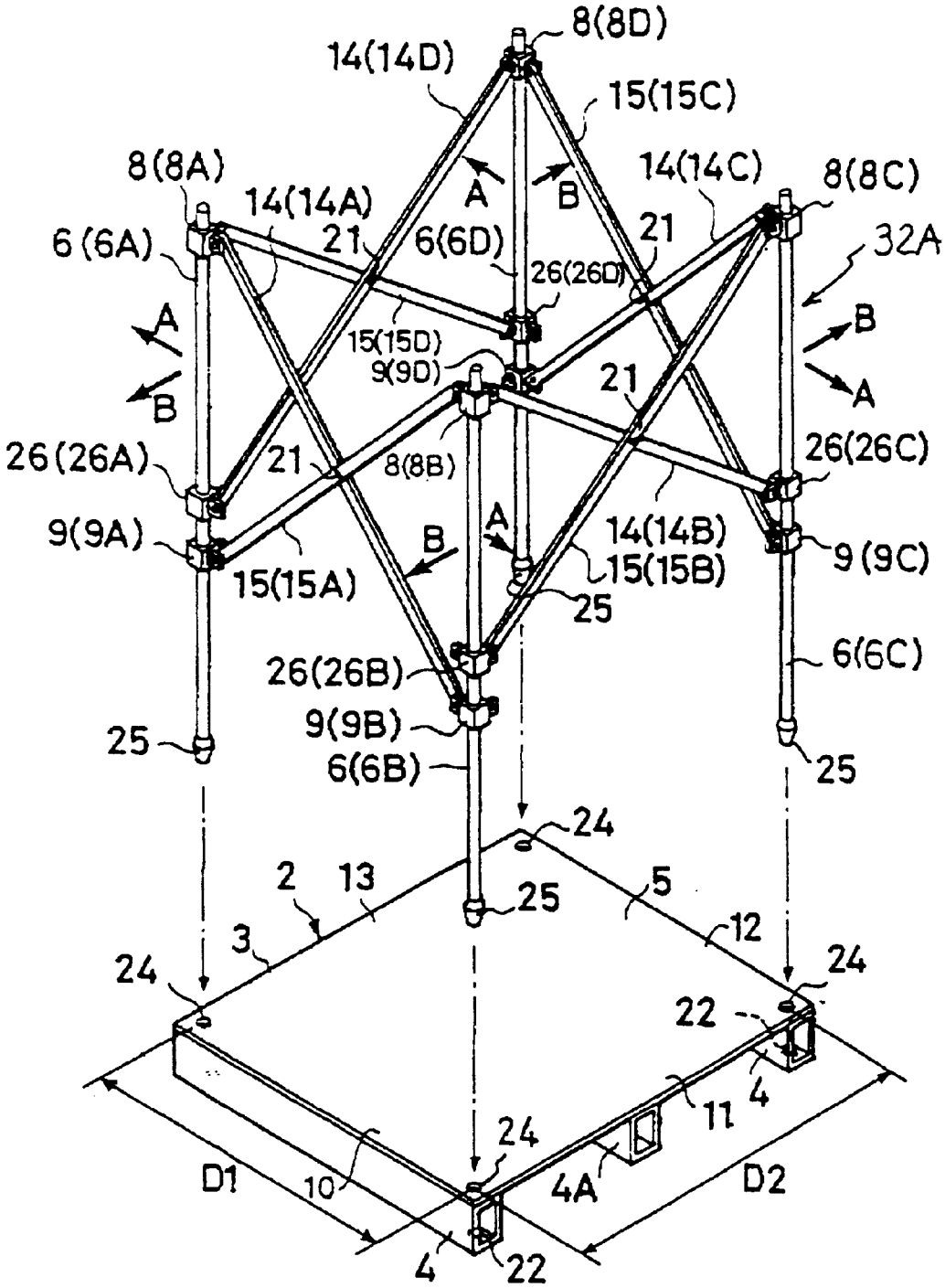
FIG. 7 is a perspective view showing another embodiment of article transporting/storing apparatus different from that shown in FIG. 1.

In the example shown in FIG. 7, in addition to the first and second joints 8, 9, also a third joint 26 is attached to each of the supports 6. Further, the reference numerals 26A, 26B, 26C, and 26D are assigned to the third joints 26 to identify them.

As described above, the article transporting/storing apparatus shown in FIG. 7 has the first to third joints 8, 9, 26 attached to each of the first to fourth supports 6A to 6D along the longitudinal direction thereof. In addition, the article transporting/storing apparatus has, like that shown in FIG. 1, the first and second coupling members 14, 15 for coupling the two adjoining supports first and second supports 6A and 6B, second and third supports 6B and 6C, third and forth supports 6C and 6D, and fourth and first supports 6D and 6A located side by side on four edges 10 to 13 of the pallet 2 respectively.

When the four supports 6 are attached to the pallet 2, the second and third joints 9, 26 are located under the first joint 8, and at the same time the second joint 9 is located under the third joint 26, further, the first and second coupling members 14, 15 cross each other.

Each of the first and second coupling members 14, 15 has one edge thereof in the longitudinal direction rotatably coupled via a pin to each joint in the same way as shown in FIG. 3 and FIG. 4.

When the first to fourth supports 6A to 6D are attached to the pallet 2, the first and second coupling members 14A, 15A provided between the first and second supports 6A and 6B located side by side on the first edge 10 of the pallet 2 have one edge thereof in the longitudinal direction rotatably coupled with the first joints 8A, 8B attached to the first and second supports 6A, 6B and at the same time the other edges thereof in the longitudinal direction rotatably coupled with the second joints 9B, 9A attached to the second and first supports 6B, 6A respectively.

Similarly, the first and second coupling members 14B, 15B provided between the second and third supports 6B, 6C located side by side on the second edge 11 next to the first edge 10 of the pallet 2 have one edge thereof in the longitudinal direction rotatably coupled with the first joints 8B, 8C attached to the second and third supports 6B, 6C and at the same time the other edges thereof in the longitudinal direction rotatably coupled with the third joints 26C, 26B attached to the third and second supports 6C, 6B.

The first and second coupling members 14C, 15C provided between the third and fourth supports 6C and 6D located side by side on the third edge 12 next to the second edge 11 of the pallet 2 have one edge thereof in the longitudinal direction rotatably coupled with the first joints 8C, 8D attached to the third and fourth supports 6C, 6D respectively and at the same time have the other edges thereof in the longitudinal direction rotatably coupled with the second joints 9D, 9C attached to the fourth and third supports 6D and 6C respectively.

The first and second coupling members 14D, 15D provided between the fourth and first supports 6D, 6A located side by side on the fourth edge 13 next to the third edge 12 of the pallet 2 have one edge thereof in the longitudinal direction rotatably coupled with the first joints 8D, 8A attached to the fourth and first supports 6D, 6A respectively and at the same time have the other edges thereof in the longitudinal direction rotatably coupled with the third joints 26A, 26D attached to the first and fourth supports 6A, 6D respectively.

As described above, one joint is coupled with each edge section of the first and second coupling members 14, 15, but at least the second and third joints 9, 26 of the first to third joints 8, 9, 26 coupled with the first and second coupling members 14, 15 are assembled with the respective support 6 so that the joints can move in the longitudinal direction thereof. In the example shown in the figure, the first joints 8 located in the upper section of each support 6 are fixed to the support 6 with a screw or by press-fitting or welding, and the second and third joints 9, 26 are slidably engaged with the support 6 so that the joints can move in the longitudinal direction thereof. Also the first joints 8 may slidably be attached to each support 6 so that the joint can move in the longitudinal direction thereof.

Figure 9:
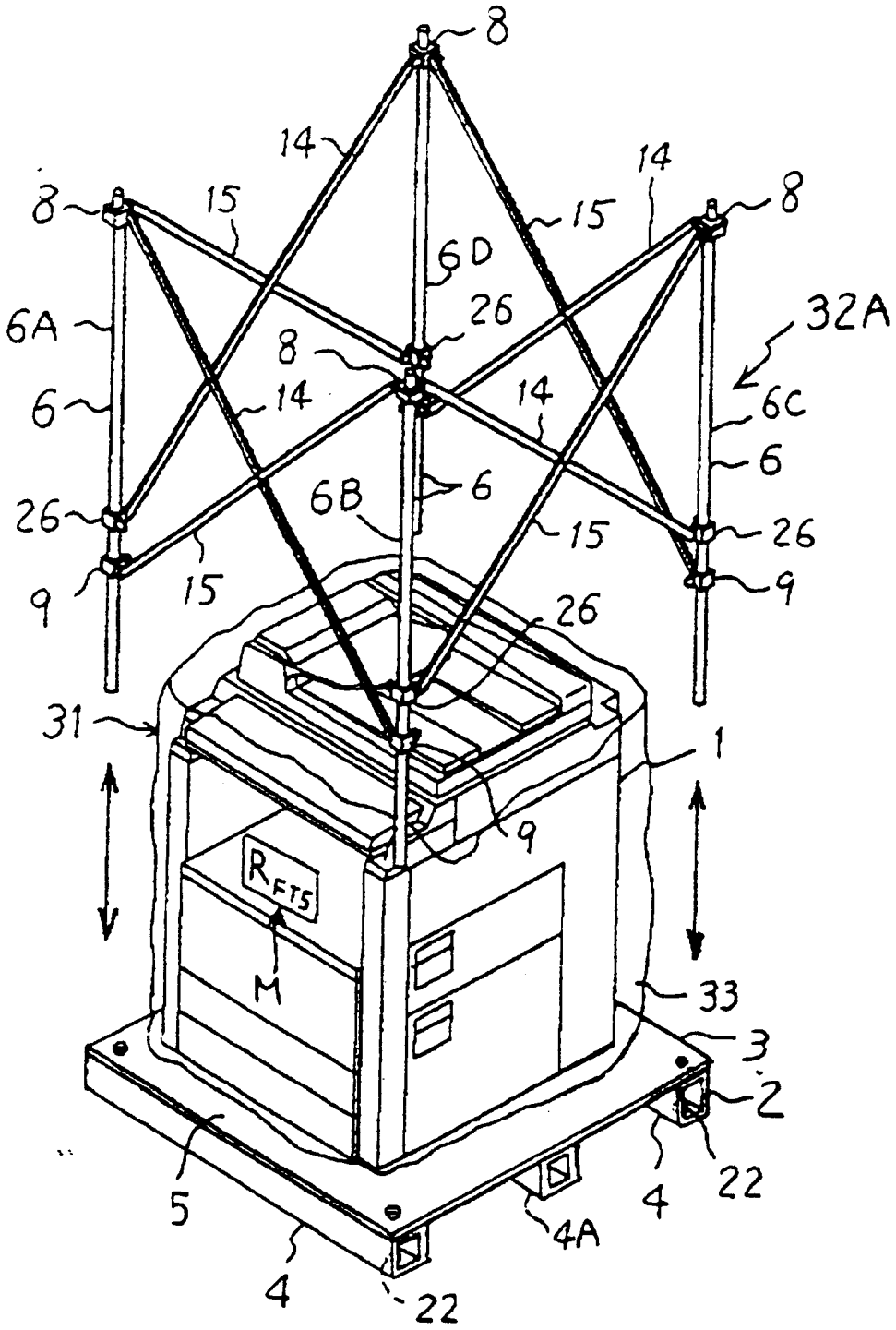
FIG. 9 is a perspective view showing a situation in which a support unit is attached to or detached from a pallet.

When transporting an article with the article transporting/storing apparatus shown in FIG. 7, a pallet 2 having a size suited to the size of the article is selected. Then, the article 1 is placed on the pallet 2 as shown in FIG. 9 or in FIG. 10, the article 1 is detachably fixed to the pallet 2, and also the article is covered with a cover 31 according to the necessity. On the other hand, a distance between the supports 6 before attaching to the pallet 2 is adjusted to correspond to the distances D1, D2 between the mounting holes of the selected pallet 2.

To adjust the distance, the first and second supports 6A, 6B provided on the first edge 10 and the third and fourth supports 6C, 6D provided on the third edges 12 opposite to the first edge 10 are pulled in the direction indicated by the arrow A in FIG. 7 or in the direction contrary to the direction above. The second joints 9 attached to these supports slide up and down along each support 6. Therefore, distance between the first and second supports 6A, 6B and a space between the third and fourth supports 6C, 6D change at the same rate. In this example, a distance between the second support 6B and third support 6C and a distance between the fourth support 6D and first support 6A does not change when only the spaces between the supports 6A and 6B and between the supports 6C and 6D are adjusted.

When the distances are to be adjusted, the second and third supports 6B, 6C and the fourth and first supports 6D, 6A are pressed in the direction indicated by the arrow B in FIG. 7, or in the direction contrary to that indicated by the arrow. With this operation, the third joints 26 engaged with the supports move upward or downward along each of the supports, and the distances between the second and third supports 6B, 6C and between the fourth and first supports 6D, 6A change at the same rate. As described above, in the article transporting/storing apparatus in this example, a distance between the two adjoining supports located side by side on one edge of the pallet 2 and a distance between the two adjoining supports located side by side on an edge opposite to the former edge are correlatively adjusted so that the distances change at the same rate, and also distances between two pairs of two adjoining supports located side by side respectively at positions opposite to the former pairs of two adjoining supports are adjusted so that the distances change at the same rate. Thus, a distance between two adjoining supports can be adjusted more freely as compared to the case shown in FIG. 1.

As described above, by preparing the pallets 2 having the distances D1, D2 between the mounting holes 24 to which the supports 6 adjustably spaced from each other are to be set, supports 6 with the distances therebetween adjusted can be attached to any of the pallet 2.

As described above, completely like in the embodiment described above, an article placed on the article-loading surface 5 of the pallet 2 can be transported easily. Further, the pallet 2 has a coupling section comprising four engagement hole 22 formed on a rear surface in the side contrary to the article-loading surface 5, to which upper sections of four supports of another article transporting/storing apparatus can be inserted. Thus, like in the case shown in FIG. 2, a plurality of assembled article transporting/storing apparatuses can be piled up on each other and the articles can be stored in a small space (Refer to FIG. 12).

Figure 8:
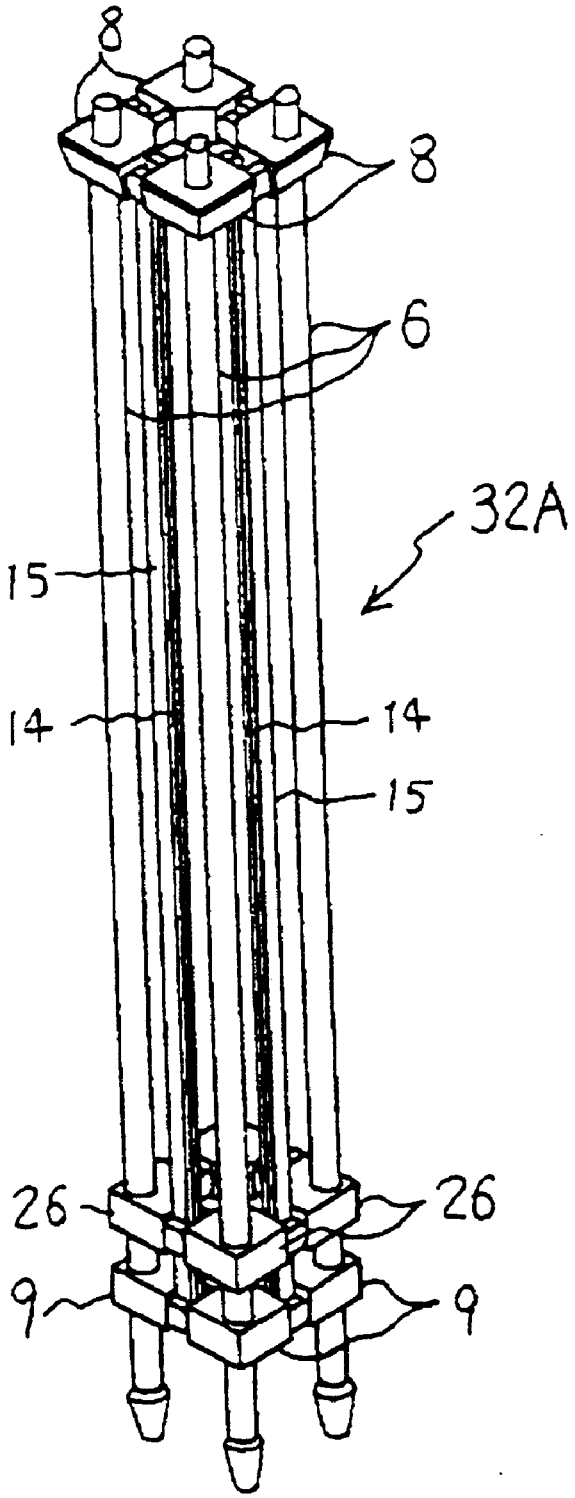
FIG. 8 is a perspective view showing a situation in which the support shown in FIG. 7 has been folded.

In addition, by pulling out the supports 6 shown in FIG. 7 from the pallet 2, the supports 6 and the first and second coupling members 14, 15 can be folded into a compact form as shown in FIG. 8, and at the same time the pallets can be piled up on each other. As described above, the four supports 6 and coupling members 14, 15 coupled via the joints 8, 9, 26 to the supports form a support unit 32A which can easily be folded when the supports are removed from the pallet 2.

FIG. 9 shows a situation in which the article 1 is placed on the pallet 2, the article 1 is detachably attached to the pallet 2 and is covered with the cover 31, then the support unit 32A shown in FIG. 7 is lowered from above the pallet 2 to attach the supports 6 to the pallet 2, or the support unit 32A are raised upward to remove the supports from the pallet 2, and also the article transporting/storing apparatus shown in FIG. 1 to FIG. 6 can be used in this way.

Figure 10:
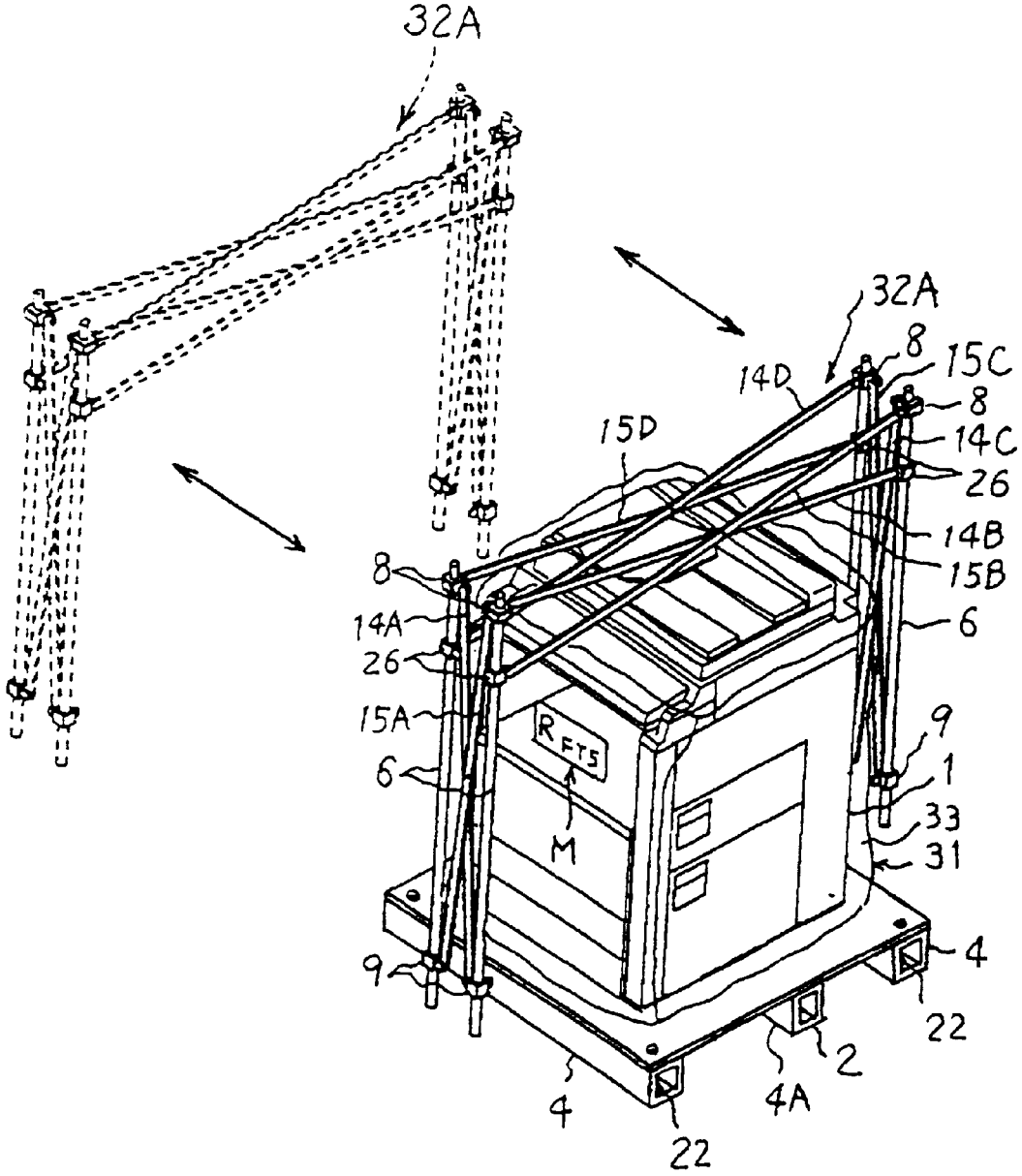
FIG. 10 is a perspective view showing another situation in which the support unit is attached to or detached from the pallet.

When the method as described above is employed, it is required to lower or raise the support units 32, 32A and the operation is little complicated. On the other hand, FIG. 10 shows a situation in which the third joint 26 of the support unit 32A shown in FIG. 7 is slid upward, the first and second coupling members 14B, 14B and the first and second coupling members 14D, 15D located at opposite positions respectively are raised upward, other first and second coupling members 14A and 15A, 14C and 15C are folded respectively with the support unit 32A moved in the horizontal direction, the support unit 32A is attached to or detached from the pallet 2. With this method, it is not required to lower or raise the support unit 32A and the work can be carried out very easily, and in addition, the supports 6 are separated by a large distance from the article 1 when the support unit 32A is moved in the horizontal direction, so that the support unit 32A can be attached to or detached from the pallet 2 without touching the first and second coupling members 14, 15 or the supports 6 to the article 1 and hence without giving any damage to the article 1.

Figure 11:
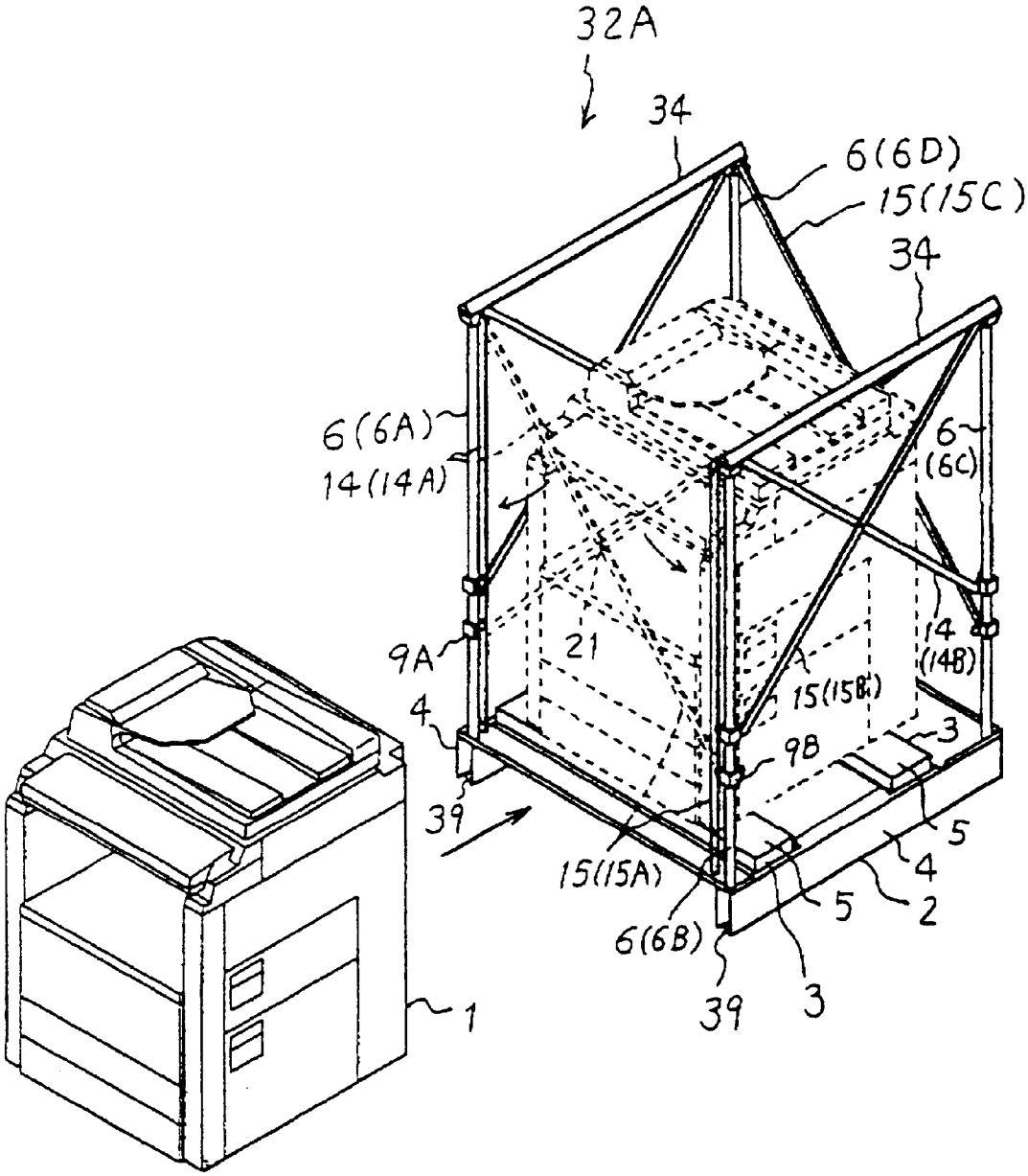
FIG. 11 is a perspective view showing an example of a situation in which an article is loaded on the pallet.

FIG. 11 shows a using method in which at first the supports 6 are attached to the pallet 2, the support unit 32A is set on the pallet 2, and then the article 1 is placed on the pallet 2. The first and second coupling members 14A, 15A shown herein has lower edges thereof in the longitudinal direction rotatably coupled with the second joints 9B, 9A, and also the pins 21 can freely be attached thereto or detached therefrom.

When the support unit 32A shown in FIG. 11 is set on the pallet 2, all of the first and second coupling members 14, 15 are coupled via a pin to the joints respectively, while the article 1 has not been loaded on the pallet 2. Then, the pins 21 that couple the coupling members 14A, 15A opposing to the article 1 outside the pallet 2 are moved with the other edges thereof in the longitudinal direction, namely the lower edges removed from the second joints 9B, 9A. The pins that couple the lower edges of the coupling members to the joints are separated to remove the coupling members from the joints. With this operation, the first and second coupling members 14A, 15A in the state as indicated by a dash line in FIG. 11 rotated about one edges thereon in the longitudinal direction, namely about the upper edges thereof respectively, and the coupling members 14A, 15A hang down as indicated by a solid line in the figure. Thus, the first support 6A and second support 6B are separated from each other, so that the article 1 is carried onto the pallet 2 through a space between the two supports 6A, 6B and then is loaded on the pallet 2 as indicated by a dash line in FIG. 11. Then the first and second coupling members 14A, 15A are rotated as shown by a dash line in FIG. 11 and coupled with each other with the pin 21, and the other edge thereof in the longitudinal direction are coupled with the second joints 9B and 9A with a pin respectively.

With the method described above, the article 1 can be loaded on unloaded from the pallet 2 without raising the support unit 32A.

In the example shown in FIG. 11, the other edges of the first and second coupling members 14A, 15A are detachably coupled to the second joints 9B, 9A respectively, but one edges thereof in the longitudinal direction may be detachably coupled with the first joints 8A, 8B respectively. Further, the other edges of the first and second coupling members 14A, 15A and the other edges thereof in the longitudinal direction may be detachably coupled to the joints 8A, 8B, 9B, and 9A all together. Further, when a pair of the first and second coupling members are constructed as described above, the article 1 can be loaded unloaded from the pallet 2 from above. Namely, to describe two coupling members provided between two adjoining supports located side by side as a pair of coupling members, the support unit 32A has four pairs of coupling members, and of the coupling member pairs, the first coupling members 14A, 15A; 14B, 15B; 14C, 15C, and 14D, 15D constituting at least one coupling member pair have one edges thereof in the longitudinal direction detachably coupled with the respective joints, and at the same time have the other edges thereof in the longitudinal direction detachably coupled with the respective joints. This configuration can be applied as it is to the article transporting/storing apparatus having the support unit 32 shown in FIG. 1.

Bridging members 34 are attached to the upper sections of the first support 6A and fourth support 6D as well as to the upper sections of the second support 6B and third support 6C of the support unit 32A shown in FIG. 11. These bridging members 34 prevent the supports from fluctuating even when the upper sections of two supports are coupled with each other and a force is applied to the supports 6 in the horizontal direction, and the bridging members are used according to the necessity. When a distance between the two adjoining supports is adjusted or the support unit 32A is folded as described above the bridging members 34 are removed from the supports 6.

Figure 12:
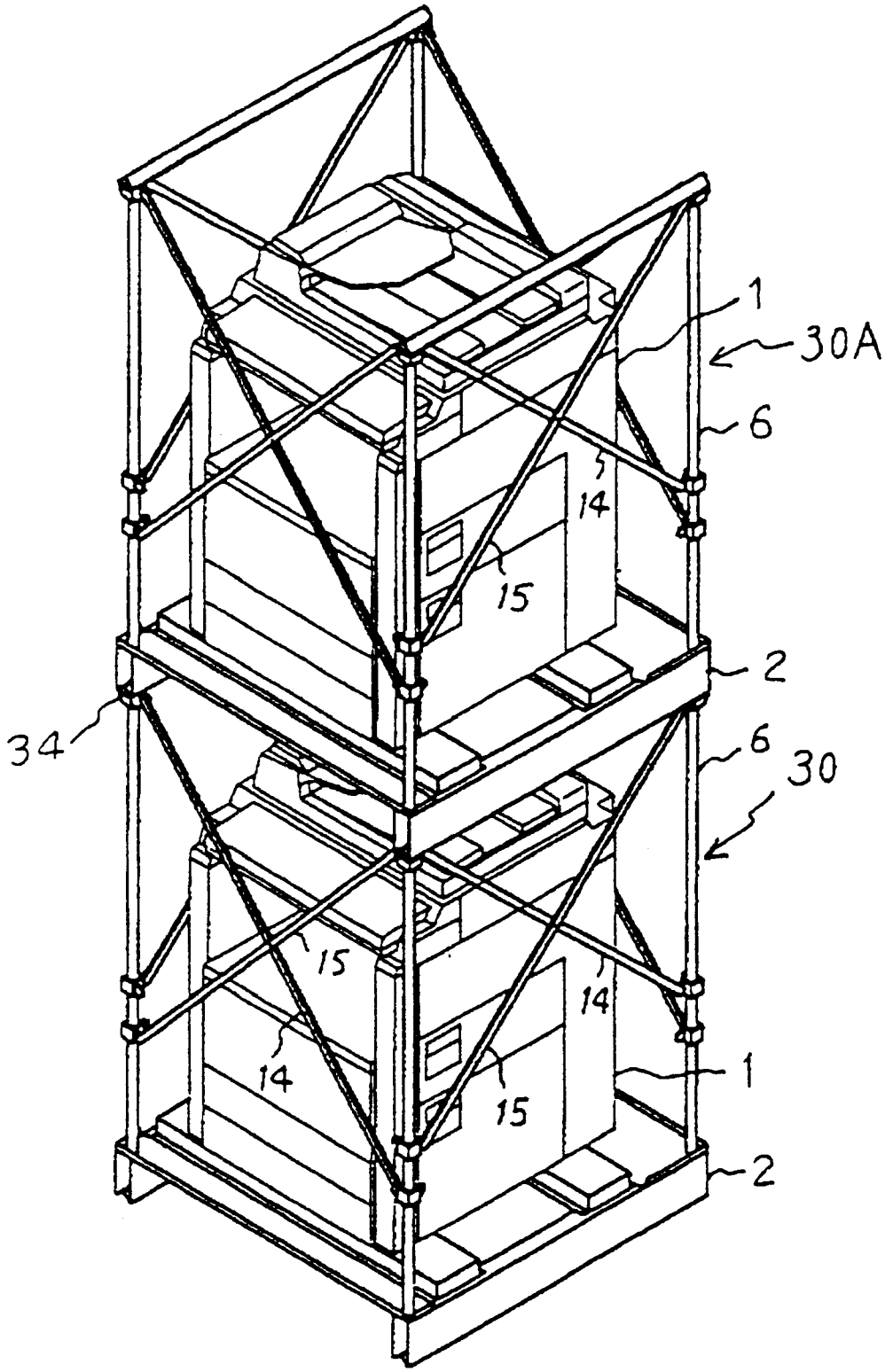
FIG. 12 is a perspective view showing a situation in which the article transporting/storing apparatuses have been piled up on each other.

Construction of the pallet 2 shown in FIG. 11 is slightly different from that of the pallet shown in FIG. 7, but the difference is not substantial. The pallet shown in FIG. 11 also has two leg sections 4 with the deck board 3 fixed thereon, and an article is placed on the article-loading surface 5 thereof. Further, an engagement section 39 comprising a reversed V-shaped groove is formed in a lower side face of each leg section 4 shown in FIG. 11, and this engagement section 39 engages with the bridging member 34 of the article transporting/storing apparatus located in the lower side. FIG. 12 shows the situation. As described above, in the example shown in FIG. 11 and FIG. 12, the engagement section 39 has a coupling section to which an upper section of an article transporting/storing apparatus located in the lower side can detachably be coupled.

Although the second and third joints 9, 26 of the article transporting/storing apparatus shown in FIG. 7 can freely slide against the supports 6 to which the joints are attached respectively, the joints 9, 26 may be fixed to the supports with a screw or the like after the support unit 32A is set on the pallet 2. This is true also for the first joint 8 shown in FIG. 1. With this feature, rigidity of the support units 32, 32A assembled to the pallet 2 can be improved and the article 1 can be supported firmly.

However, in a case where the article transporting/storing apparatuses have been piled up on each other and the article transporting/storing apparatuses are transported by a truck or other vehicle, vibrations are applied from outside to the article transporting/storing apparatuses, but it has been clarified as a result of experiments that, if the second and third joints 9, 26, which are slidable against each support 6, are not fixed to the support and further the second and third joints 9, 26 are fixed and coupled with each other, vibrations to the article transporting/storing apparatus can efficiently be absorbed and vibrations to the article transporting/storing apparatus in the lower side is prevented from being delivered to the article transporting/storing apparatus in the upper side and stability of the article transporting/storing apparatuses piled up on each other can be improved as a whole.

Figure 13:
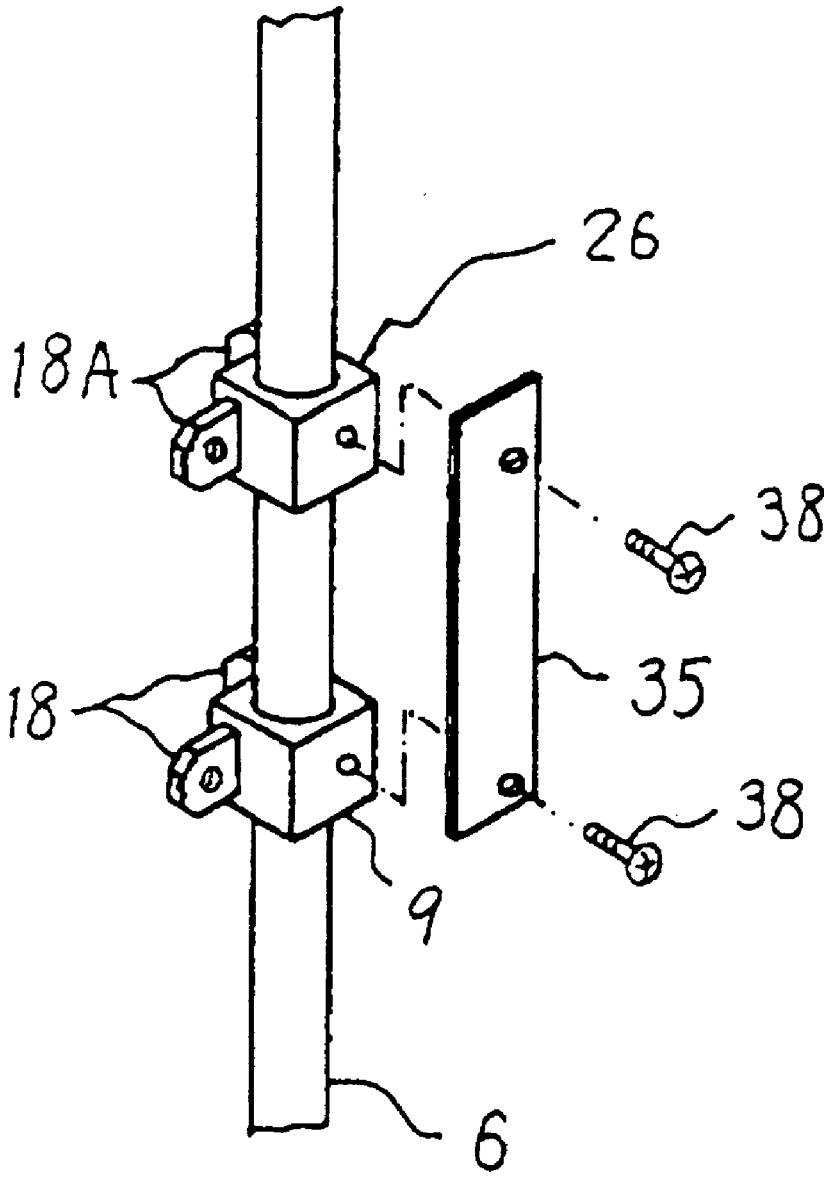
FIG. 13 is a perspective view showing a situation in which the upper and lower joints are coupled with a joint fixing member.
Figure 14:
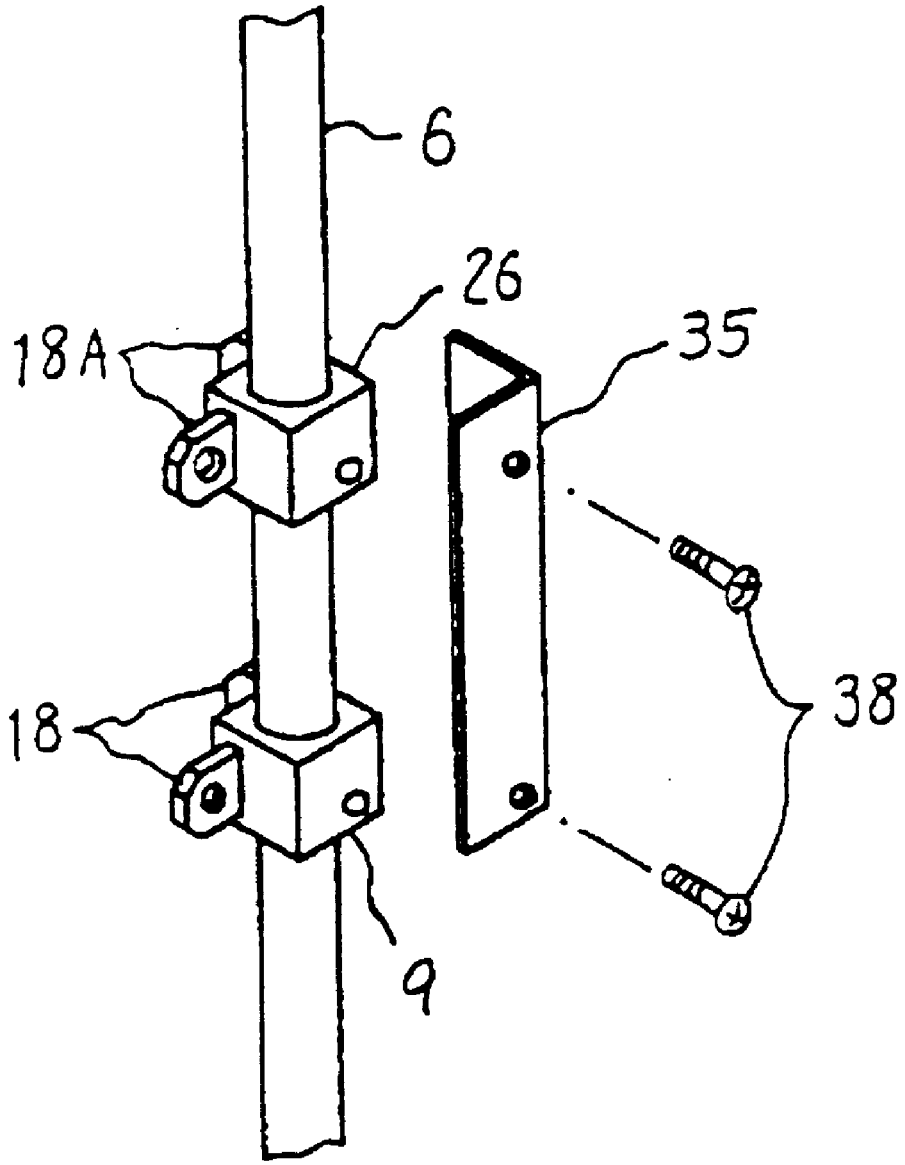
FIG. 14 is a perspective view showing another example of the joint fixing member.
Figure 15:
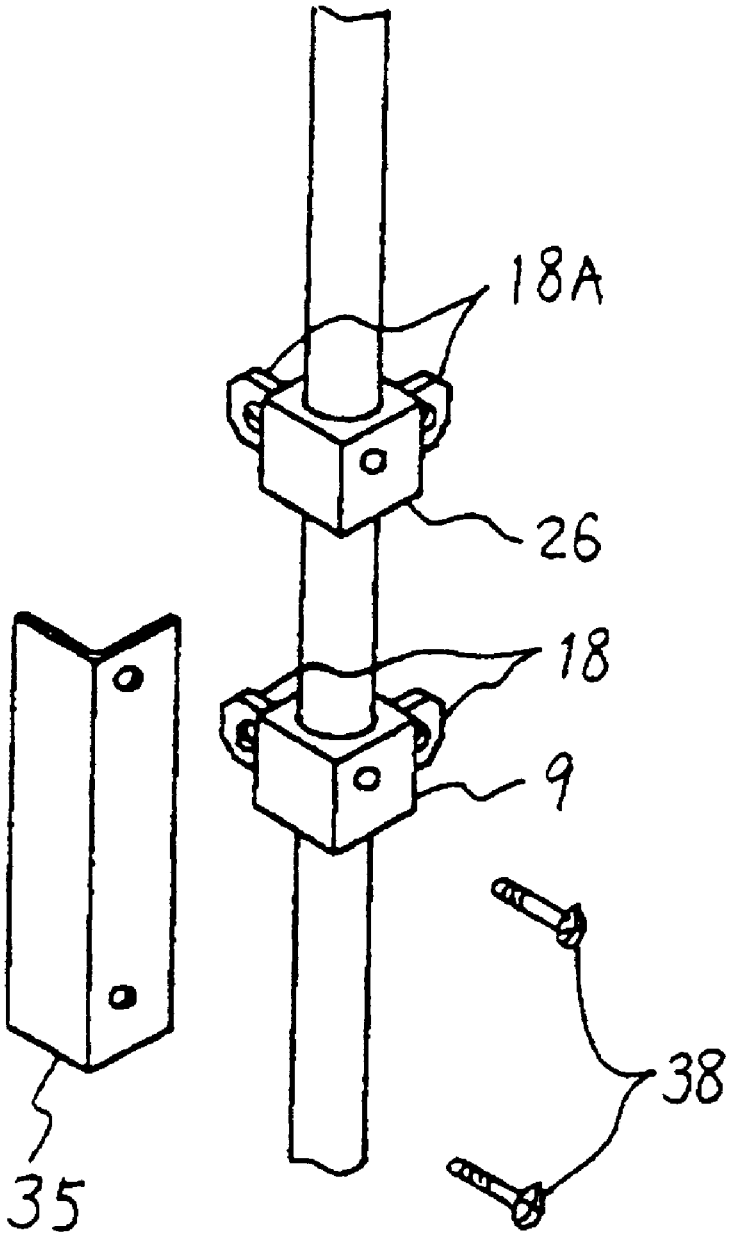
FIG. 15 is a perspective view showing a situation in which other joints are coupled to each other with the joint fixing member shown in FIG. 14.

From this point of view, in the embodiment shown in FIG. 13 to FIG. 15, distances between supports of the support unit 32A shown in FIG. 7 are adjusted, and then after the support unit 32A is set on the pallet 2, joint fixing members 35 are detachably fixed to the second and third joints 9 and 26 attached to each support, for instance, with a screw. The joint fixing member 35 is made from a material having high rigidity such as metal or hard resin.

As described above, when a distance between the second and third joint 9, 26 is kept constant and the joints are not fixed to the supports 6, even if vibrations during transport or an earthquake are delivered to the article transporting/storing apparatuses, the vibrations are absorbed. Especially when the article transporting/storing apparatuses are piled up on each other, vibration of the article transporting/storing apparatus in the upper side can efficiently be suppressed with the stability improved. In addition, weight of an article loaded on the article transporting/storing apparatus located in the upper side may be larger as compared to that of an article loaded on the article transporting/storing apparatus located in the lower side. Thus, a worker can pile up the article transporting/storing apparatuses efficiently on each other with out paying special attention to the weight of the article.

When the first joint 8 shown in FIG. 7 is slidably attached to the support 6 so that the joint can move in the longitudinal direction thereof, even if the first joint 8 and second or third joint 9, 26 or all of the first to third joints 8, 9, 26 are fixed and coupled with the joint fixing member 35, the above-described effect can be achieved. In the article transporting/storing apparatus shown in FIG. 1, when the second joint 9 is slidably assembled to the support 6 so that the joint can freely move in the longitudinal direction, even if the first joint 8 and second joint 9 are fixed and coupled with each other with the joint fixing member 35, the same effect as described above can be achieved. When the support units 32, 32A are folded, it is required only to remove the joint fixing member 35 from the joints.

As described above, the joint fixing member 35 can be used to detachably fix and couple at least two joints, which can move in the longitudinal direction thereof, to one support 6 in the state where the support 6 is attached to the pallet 2.

The joint fixing member 35 shown in FIG. 13 is made from a flat plate, while that shown in FIG. 14 and FIG. 15 are made from a material having an L-shaped cross section. Either joint fixing member can play its original function, as rigidity of the joint fixing member 35 shown in FIG. 15 is higher against twisting as compared with that of other joint fixing members, so that the effect of absorbing vibration of the article transporting/storing apparatus can further be improved. By making it possible to use the joint fixing member 35 having the same form for coupling joints attached to four supports 6 regardless of which type of joint fixing member is used, cost reduction can be achieved. As the joint fixing member 35 shown in FIG. 13 comprises a flat plate, joints to the supports 6 can be coupled to each other with the joint fixing member according to the same embodiment, but as tongue pieces 18, 18A for coupling the coupling members 14, 15 are provided in the projecting form in each joint, so that, when the L-shaped joint fixing member 35 shown in FIG. 14 or FIG. 15 is used, to make common the parts, it is necessary to adjust positions of screw holes or a number thereof in the joint fixing member 35 as well as a relation between these factors and positions of the tongue pieces 18, 18A. As described above, by constructing the joint fixing member 35 so that all of a plurality of joint fixing members 35 each for detachably fixing a plurality of joints attached to each of the four supports 6 to each other, it becomes possible to reduce the cost.

Figure 16:
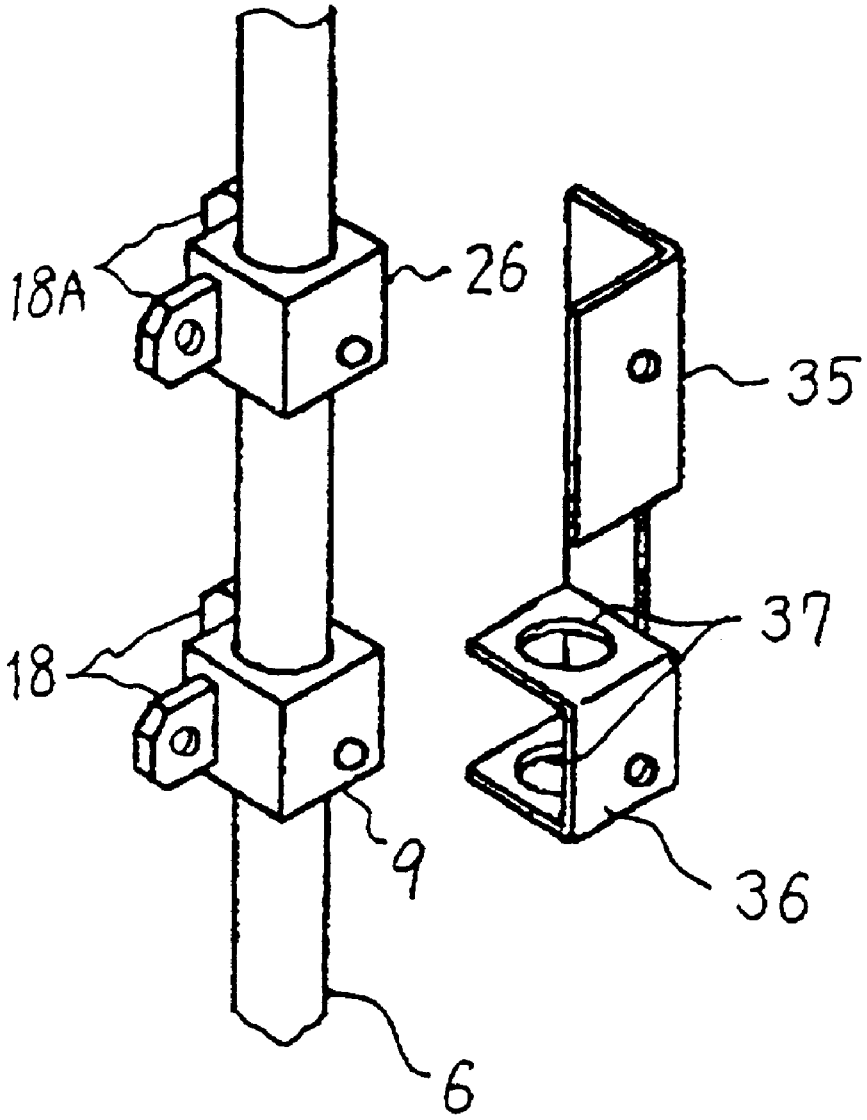
FIG. 16 is a perspective view showing another example of the joint fixing member.
Figure 17:
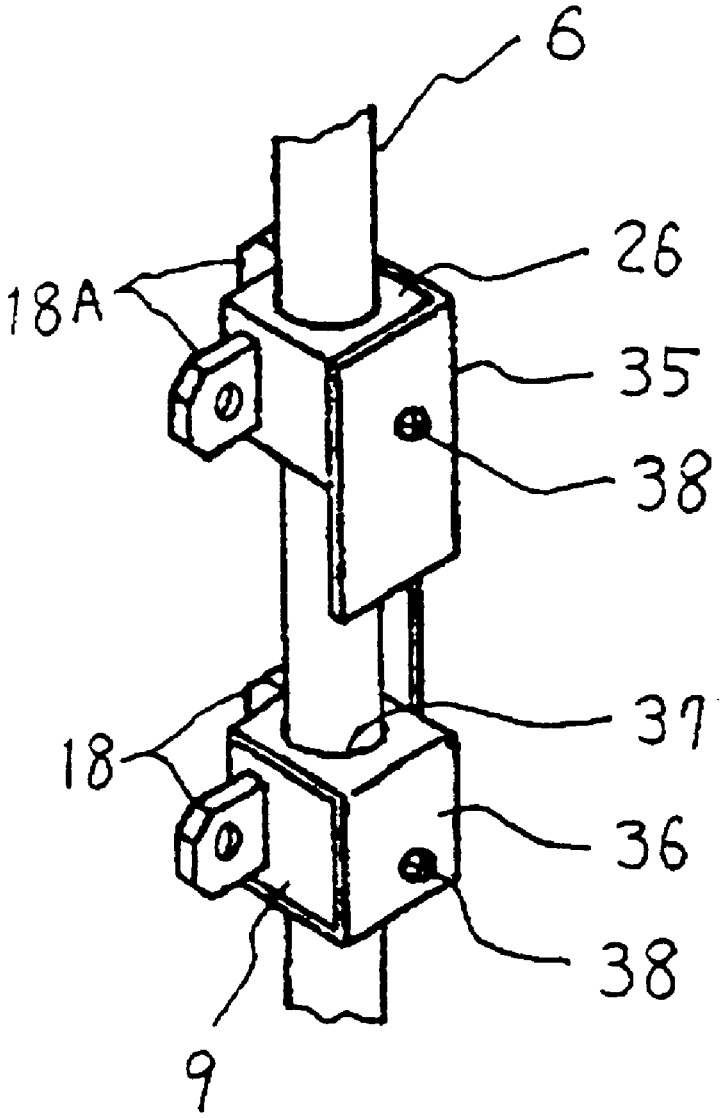
FIG. 17 is a perspective view showing a situation in which joints are coupled to each other with the joint fixing member shown in FIG. 16.

Also as shown in FIG. 16 and FIG. 17, by forming a holding section having a ]-shaped cross section in the joint fixing member 35 with a hole 37 formed therein and also by engaging the holding section 36 with one of the joints 9 and penetrating the support 6 through the hole 37, the joint fixing member 35 is held on the support 6 even if a screw 38 is removed, which makes it possible to prevent the joint fixing member from being lost.

Figure 18:
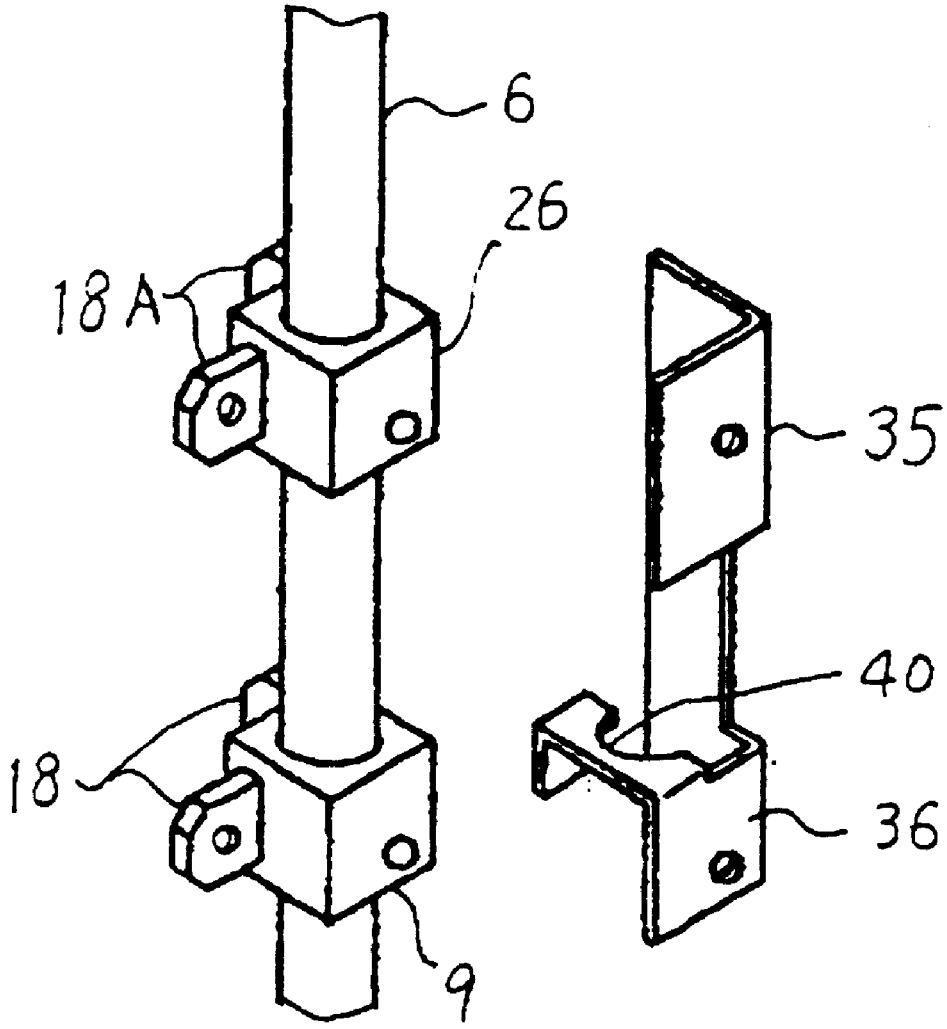
FIG. 18 is a perspective view showing still another example of the joint fixing member.
Figure 19:
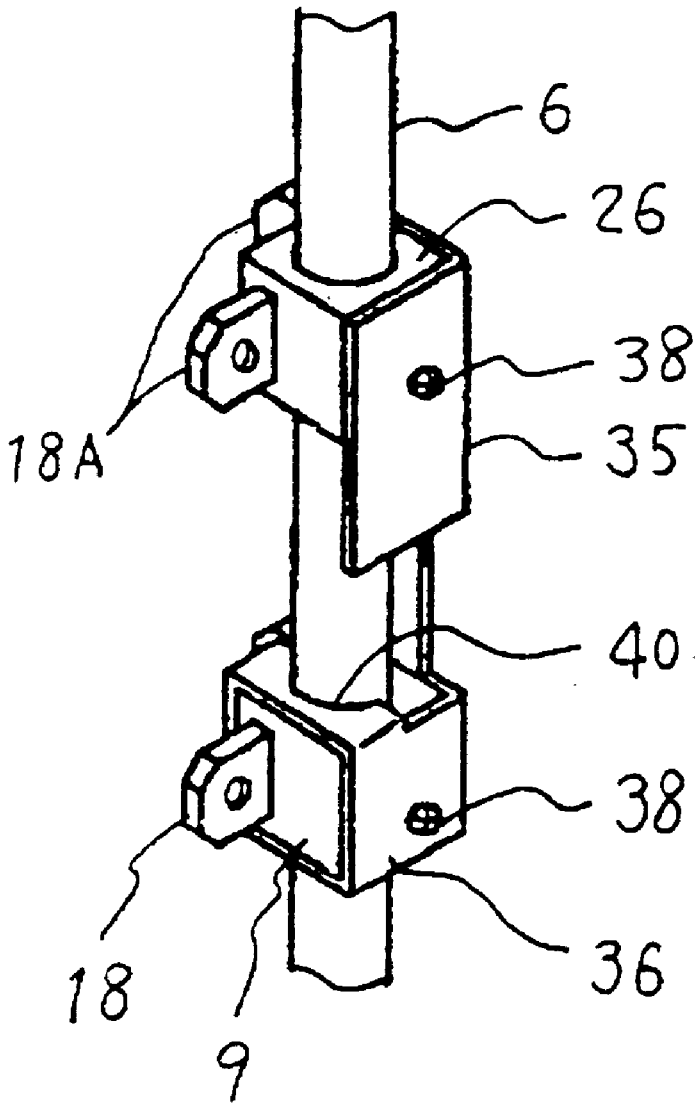
FIG. 19 is a perspective view showing a situation in which joints are coupled to each other with the joint fixing member shown in FIG. 18.

In the example shown in FIG. 18 and FIG. 19, by engaging a notch 40 formed in the holding section 36 of the joint fixing member 35, the joint fixing member 35 can be held on the support 6 even when the screw 38 is removed.

As described above, by assembling the joint fixing member 35 with the support 6 so that the joint fixing member 35 is not separated from the support 6, loss of the joint fixing member 35 is prevented, and also the trouble that the joint fixing member 35 disturbs an operation of other components can be prevented.

By the way, as described above, the article transporting/storing apparatuses can be piled up on each other and transported or stored in the state, but the single article transporting/storing apparatus with an article loaded thereon may be transported or stored. In this case, a space above the article transporting/storing apparatus is wasteful.

In the embodiment shown in FIG. 20 to FIG. 25, the article transporting/storing apparatus has a ceiling plate 41 removably placed on the supports 6 thereof. Such a ceiling plate may be applied to any of the embodiments described above.

Any of the ceiling plates 41 shown in FIG. 20 to FIG. 25 has an engagement member 42 that engages with the bridging member 34 attached to an upper section of the support 6 on its side face, and the ceiling plate 41 is placed over the four supports 6 via the bridging members 34. Alternatively, the ceiling plate 41 may directly be placed on the supports 6. Further, it is preferable to use a hooking unit which is not illustrated for positioning the ceiling plate 41 to the support 6 and locking the ceiling plate 41 to the support 6.

Figure 20:
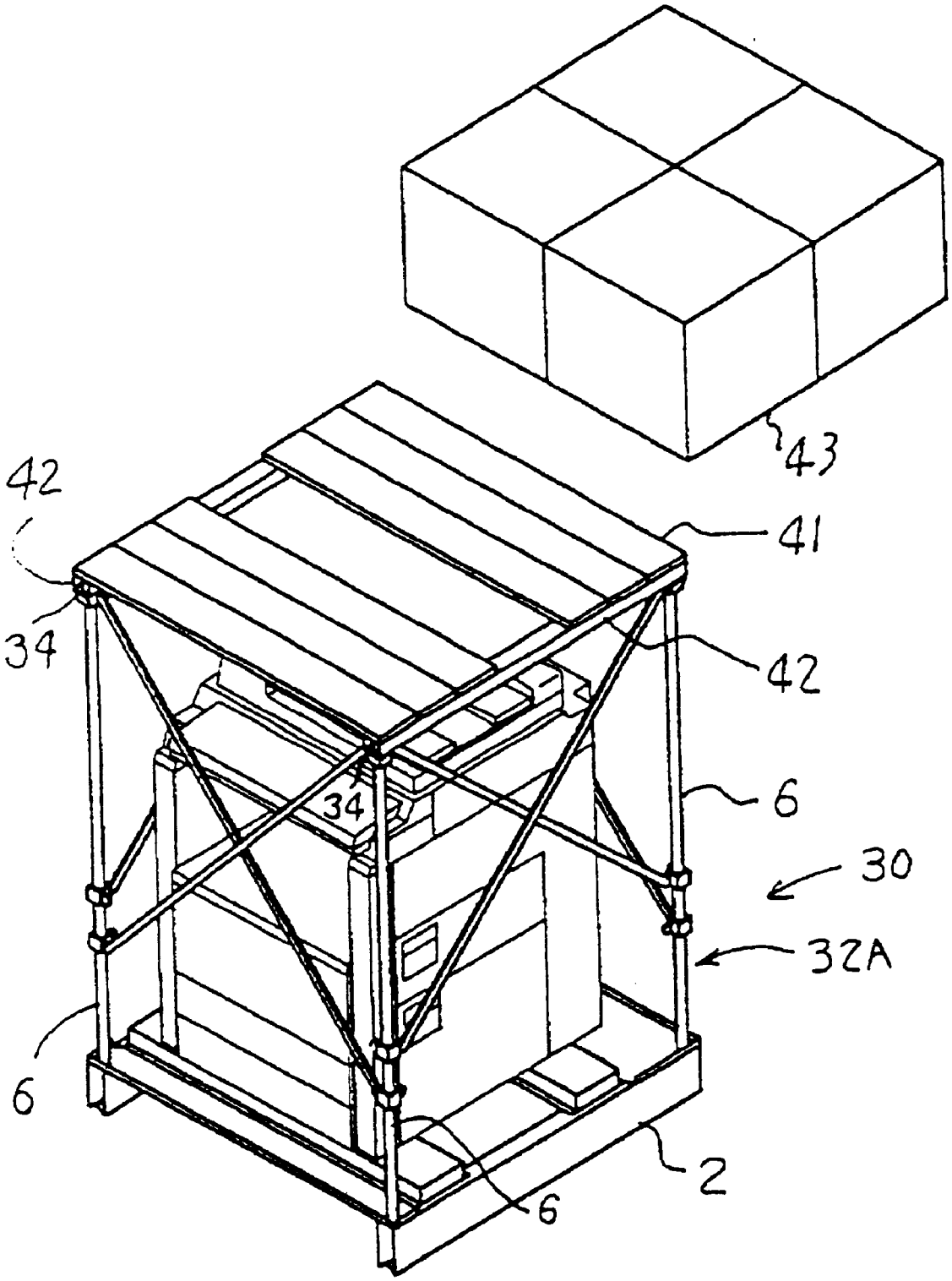
FIG. 20 is a perspective view showing an example in which a ceiling plate is set on the joint fixing member.
Figure 21:
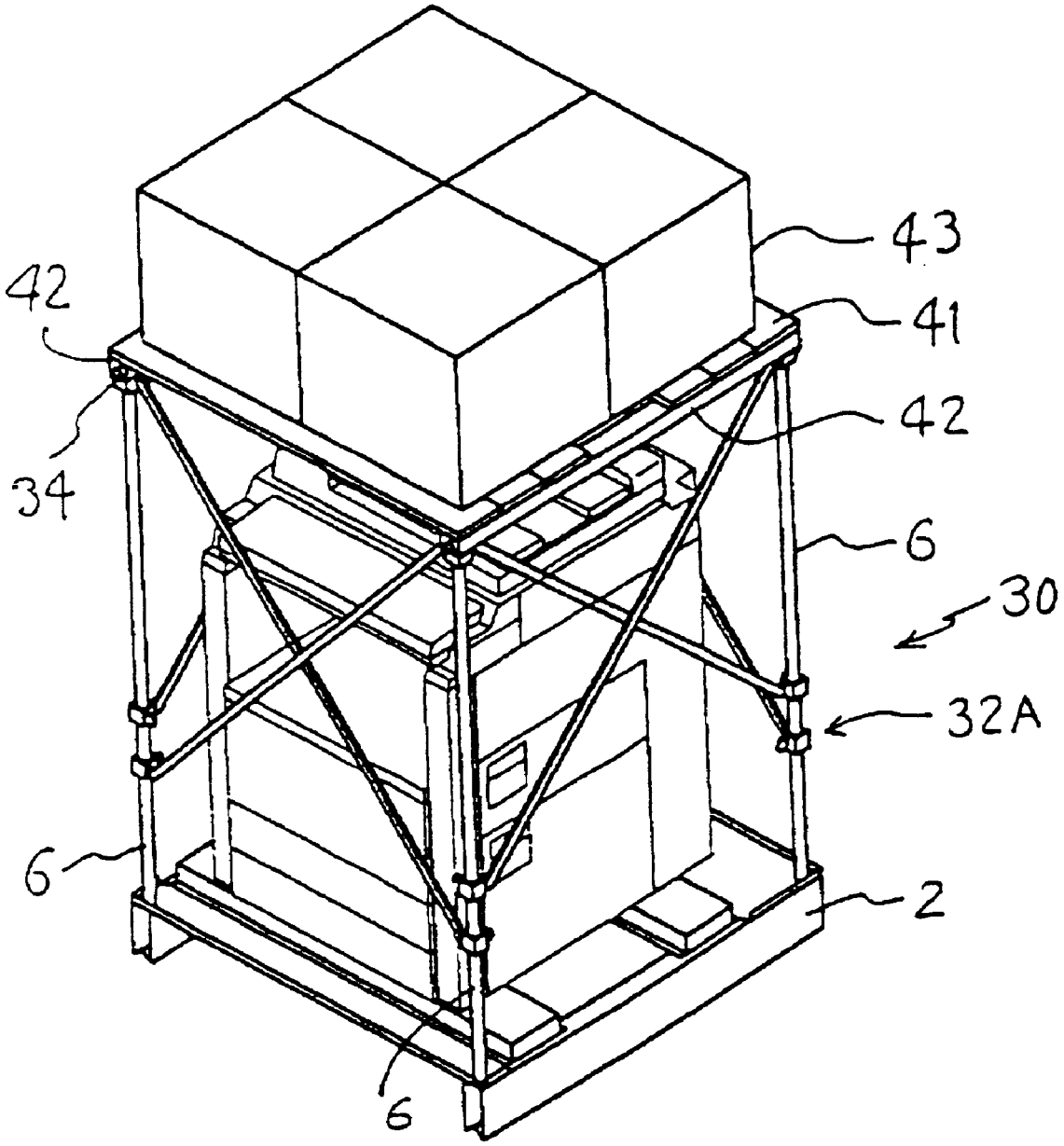
FIG. 21 is a perspective view showing a situation in which an article has been loaded on the ceiling plate.

FIG. 20 shows a situation in which the ceiling plate 41 is set on the support unit 32A. While FIG. 21 shows a situation in which an article 43 such as a cargo is placed on the ceiling plate 41. An upper surface of this ceiling plate 41 is a flat surface, and the article 43 can stably be placed on this surface, so that a space above the article transporting/storing apparatus can effectively be utilized.

Figure 22:
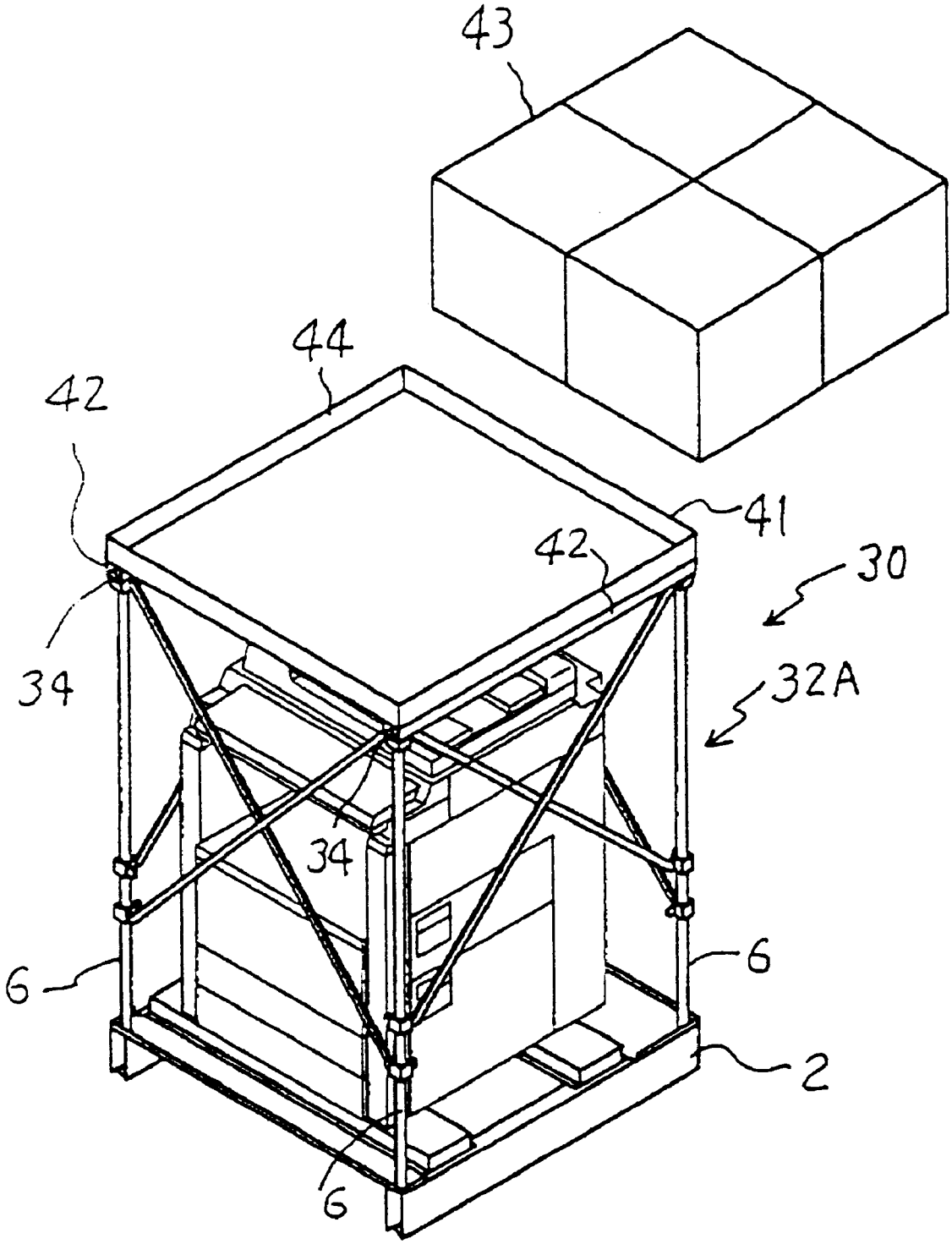
FIG. 22 is a perspective view showing another example of the ceiling plate.
Figure 23:
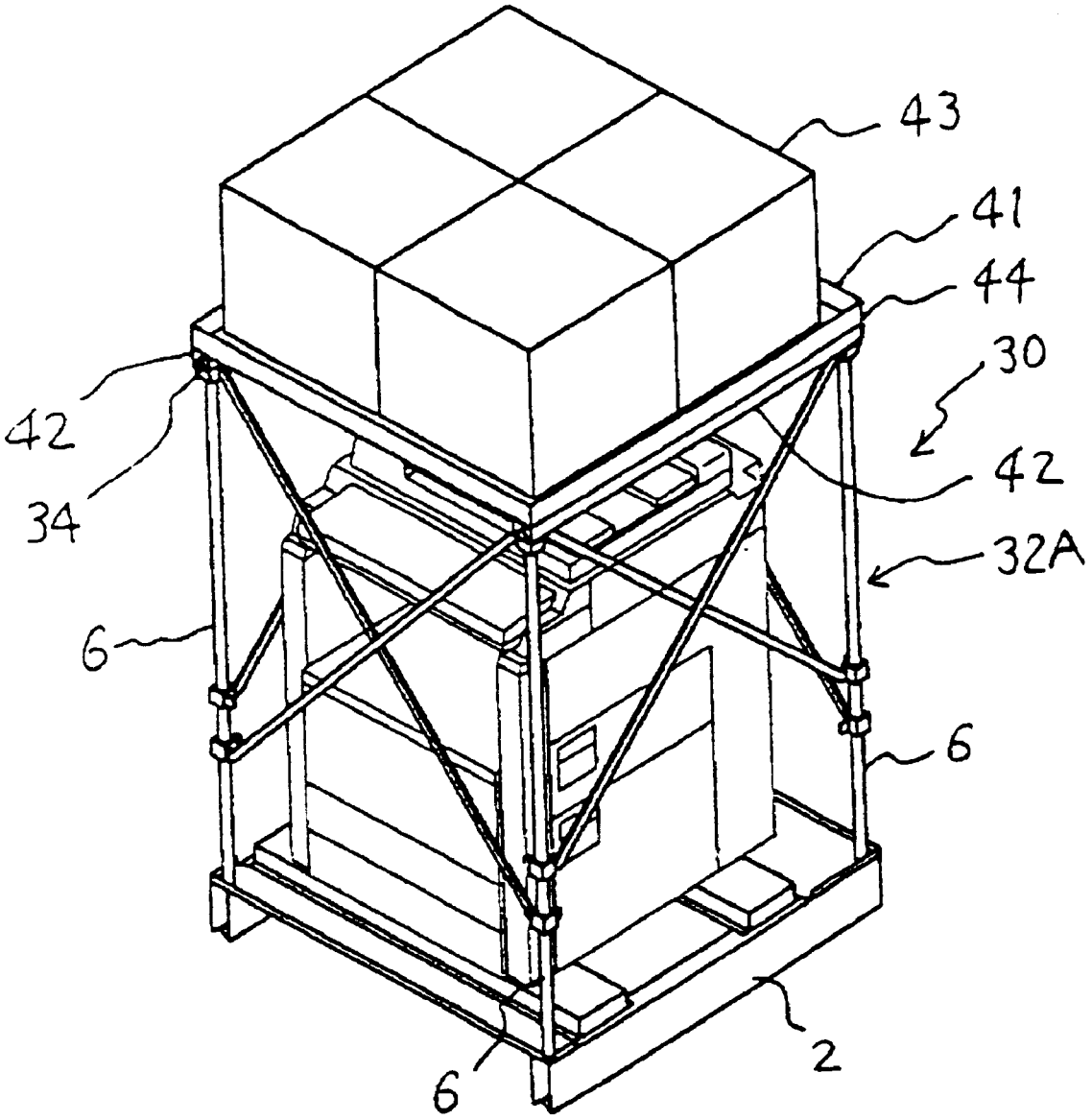
FIG. 23 is a perspective view showing a situation in which an article has been loaded on the ceiling plate shown in FIG. 22.
Figure 24:
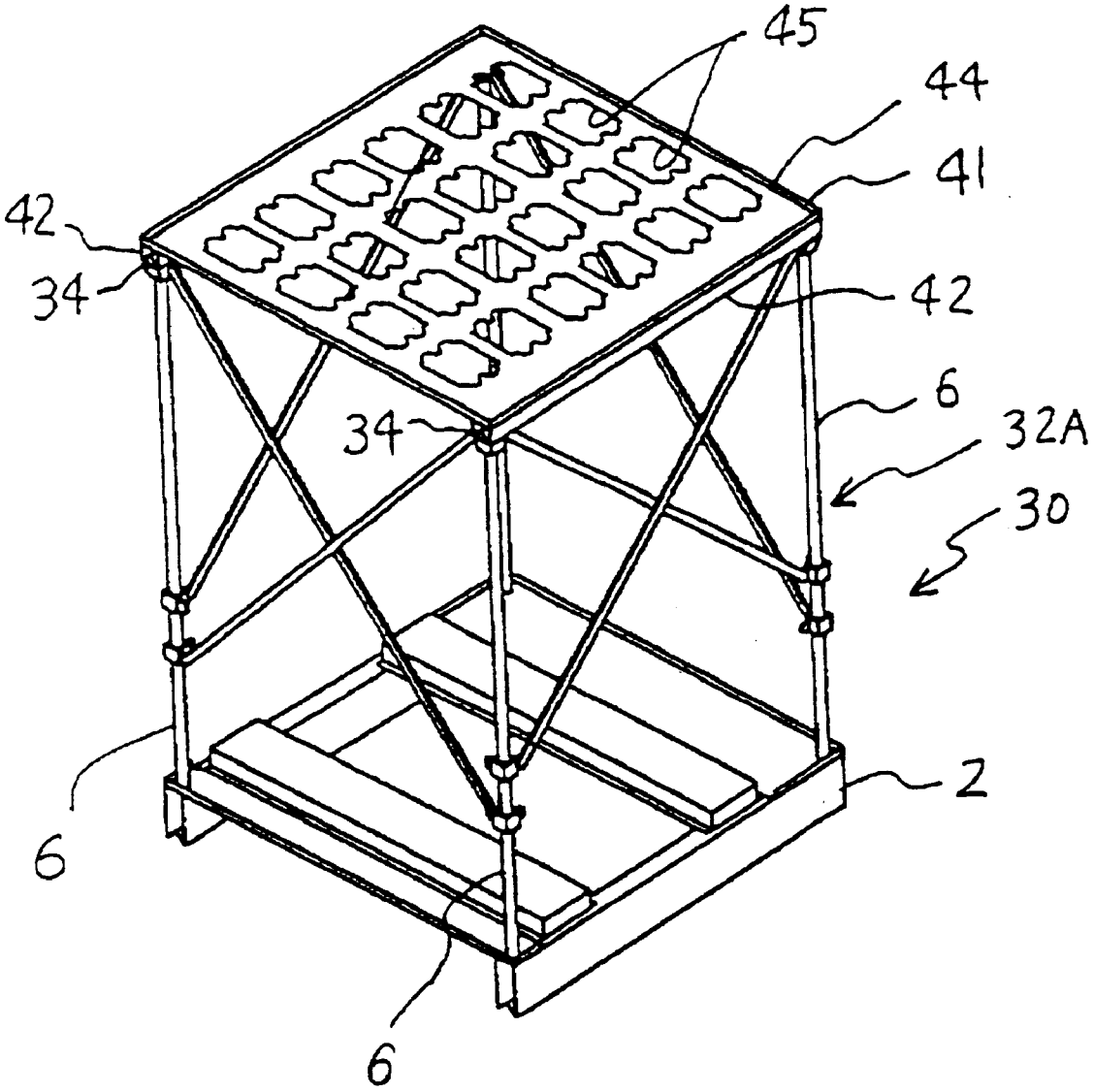
FIG. 24 is a perspective view showing still another example of the ceiling plate.

The ceiling plate 41 shown in FIG. 22 has an article drop preventing unit comprising a bank 44 at its ridge, and when the article 43 such as a cargo is placed on this ceiling plate 41 as shown in FIG. 23, the article 43 is prevented by the bank 44 from falling from the top surface thereof. Also falling of an article can be prevented by forming an article-drop preventing unit comprising a recess at a center of the ceiling plate 41 and accommodating the article in this recess. As described above, when the ceiling plate 41 has an article-drop preventing unit for preventing an article placed thereof from falling, even when the article transporting/storing apparatus vibrates, it is possible to prevent the article 43 placed on the ceiling plate 41 from falling from a top surface of the ceiling plate or from going out of the top surface, which makes it possible to hold the article 43 on the ceiling plate 41 in the stable conditions.

Figure 25:
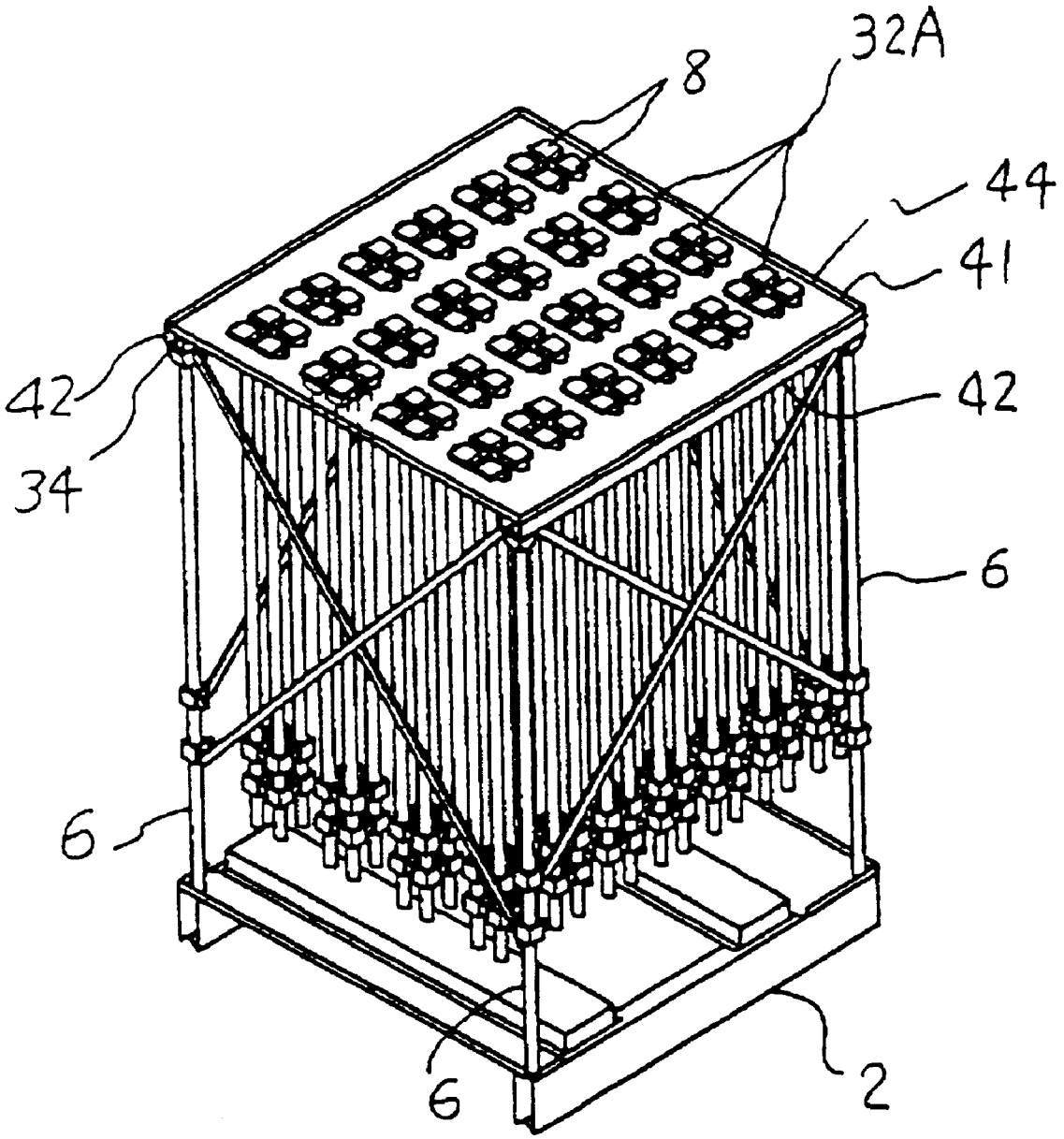
FIG. 25 is a perspective view showing a situation in which the support units have been accommodated on the ceiling plate shown in FIG. 24.

As described above, the first and second coupling members 14, 15 constitute an example of a coupling member for coupling the supports 6 to each other as described above, and the ceiling plate 41 shown in FIG. 24 and FIG. 25 has a number of accommodation holes 45 each for accommodating the supports 6 detached from the pallet 2 and the coupling unit or coupling members 14, 15 constituting the coupling unit. The support unit 32A can be accommodated in the accommodation hole 45 as shown in FIG. 25. For instance, when a number of article transporting/storing apparatuses each with the article 1 loaded thereof are removed from a place to another place, the article 1 is unloaded from each of the article transporting/storing apparatuses, and then the article transporting/storing apparatuses are returned to the original place, it is possible to remove the support unit 32A from the pallet 2, pile up the pallets on each other, and return the pallets to the original place. In this step, as shown in FIG. 25, one article transporting/storing apparatus is kept assembled with folded support units 32A inserted into the accommodation holes 45 formed on the ceiling plate 41, and the first joint 8 thereof is hooked on a ridge of the accommodation hole to hang down the support unit 32A therefrom. With this configuration, a number of support units 32A can efficiently be transported.

By the way, as understood from FIG. 12, when the article 1 is loaded on the article transporting/storing apparatus, there exist the first and second coupling members 14, 15 between two adjoining supports 6, but there are large openings between the support 6 and the coupling members 14, 15. So when, for instance, the article transporting/storing apparatus with the article 1 loaded thereon and other cargo are placed on a load base of a truck and transported together, the other cargo may go into the article 1 placed on the article transporting/storing apparatus through the openings.

To prevent this trouble, the article transporting/storing apparatus shown in FIG. 26 to FIG. 31 has a protecting unit for shielding at least a portion of the opening between the two supports located side by side. This protecting unit can be applied to any of the embodiments described above.

Figure 26:
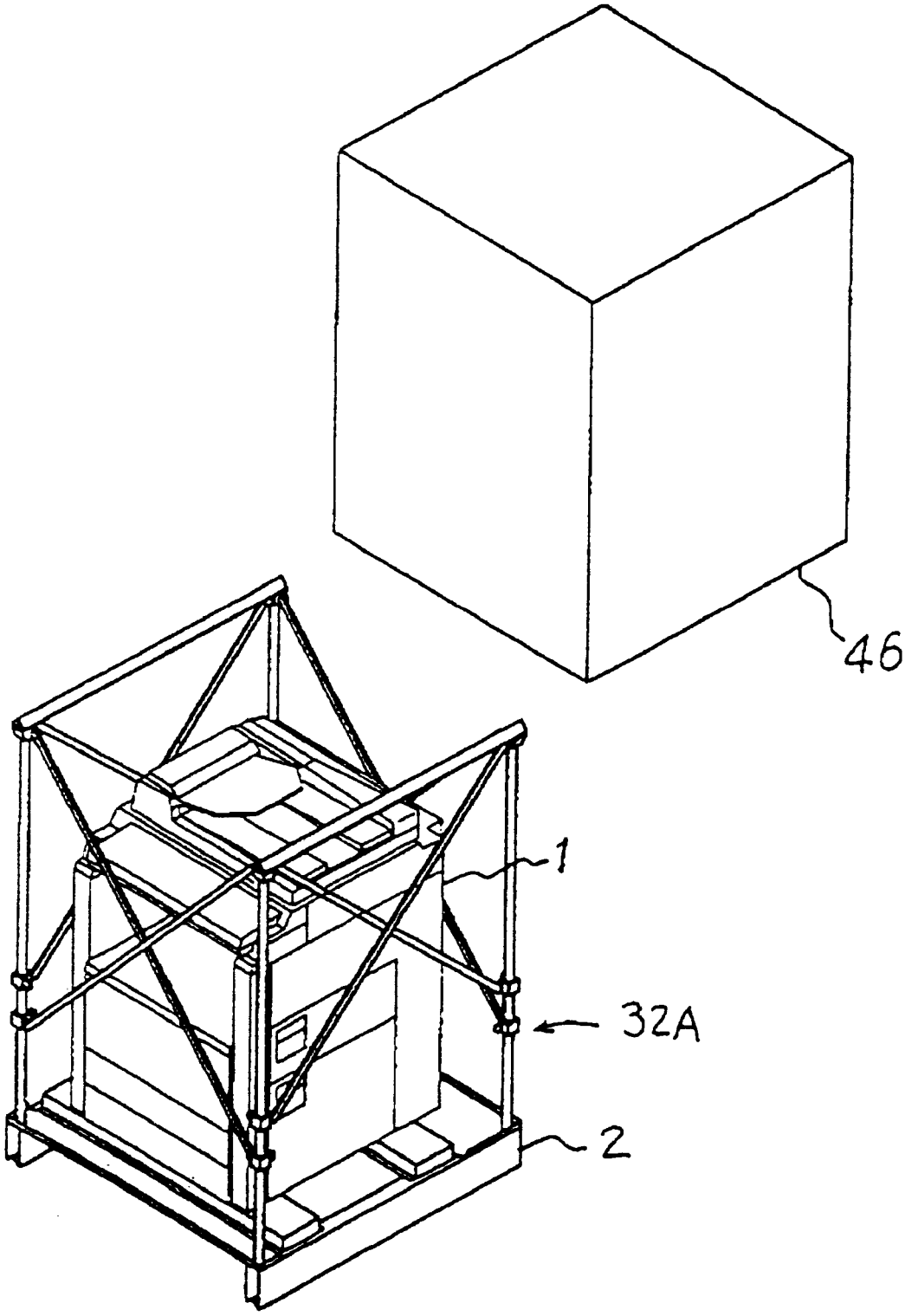
FIG. 26 is a perspective view showing a situation in which a support unit is covered with a box.

In the example shown in FIG. 26, the protecting unit comprises, for instance, a bag or a box 46 with an opening in the lower section thereof made from such a material as resin such as polyethylene, paper, or corrugated board, and this box 46 covers the article transporting/storing apparatus with the article 1 placed thereof from the upper side. Because of this configuration, all opening between the supports are shielded from the outside, which prevents the problem that the article 1 placed on the article transporting/storing apparatus is contacted by a cargo outside the article transporting/storing apparatus.

Figure 27:
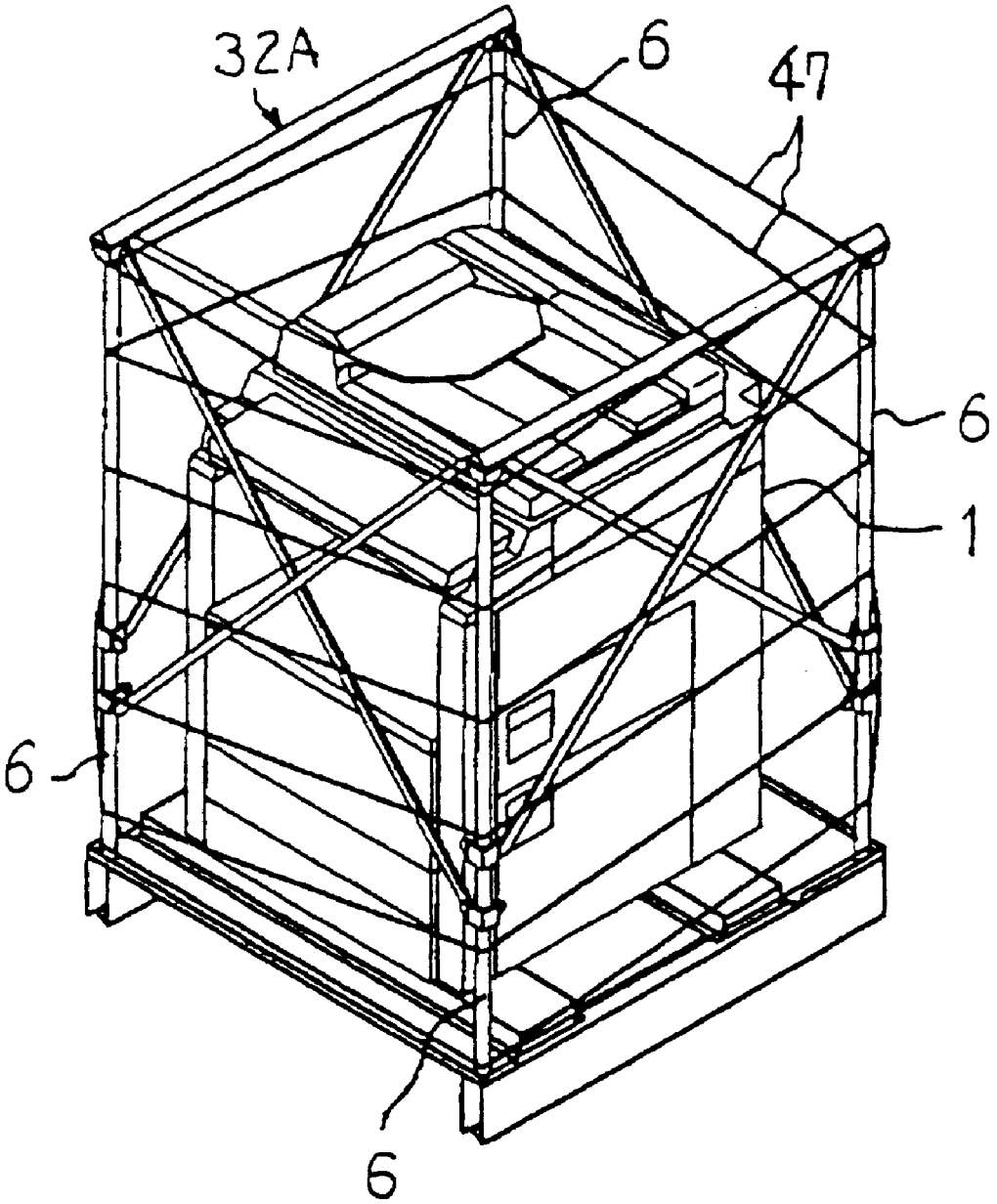
FIG. 27 is a perspective view showing a situation in which the support unit is covered with stretch film.

In the example shown in FIG. 27, the protecting unit is made from stretch film 47 comprising self-adhesive film. This stretch film 47 is wound around the support 6 attached to the article transporting/storing apparatus from the outside, and it adheres to the support 6 because it is a self-adhesive film. As described above, a portion or the entire opening between the supports can be blocked with the stretch film 47.

Figure 28:
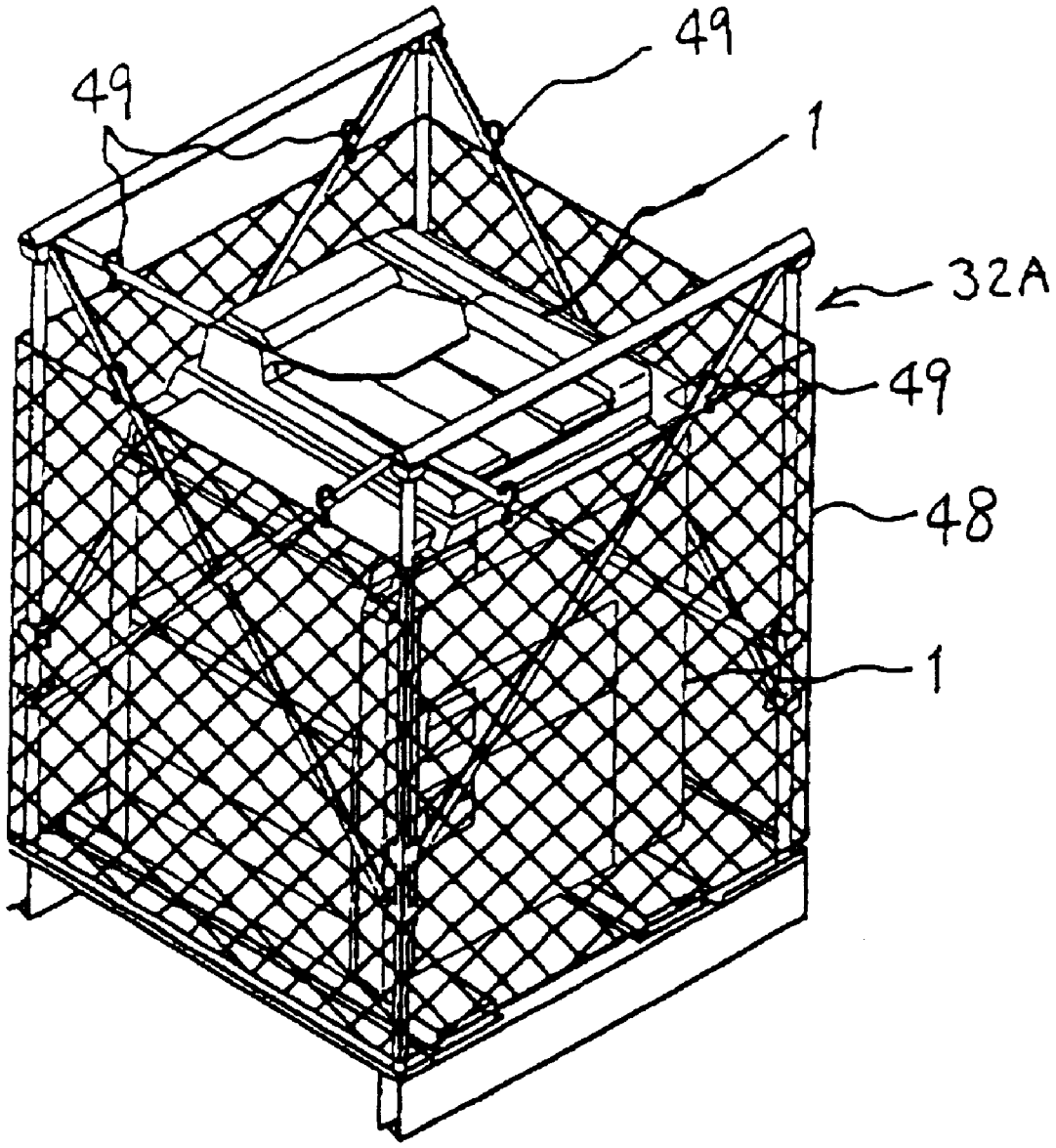
FIG. 28 is a perspective view showing a situation in which the support unit is covered with a protection net.
Figure 29:
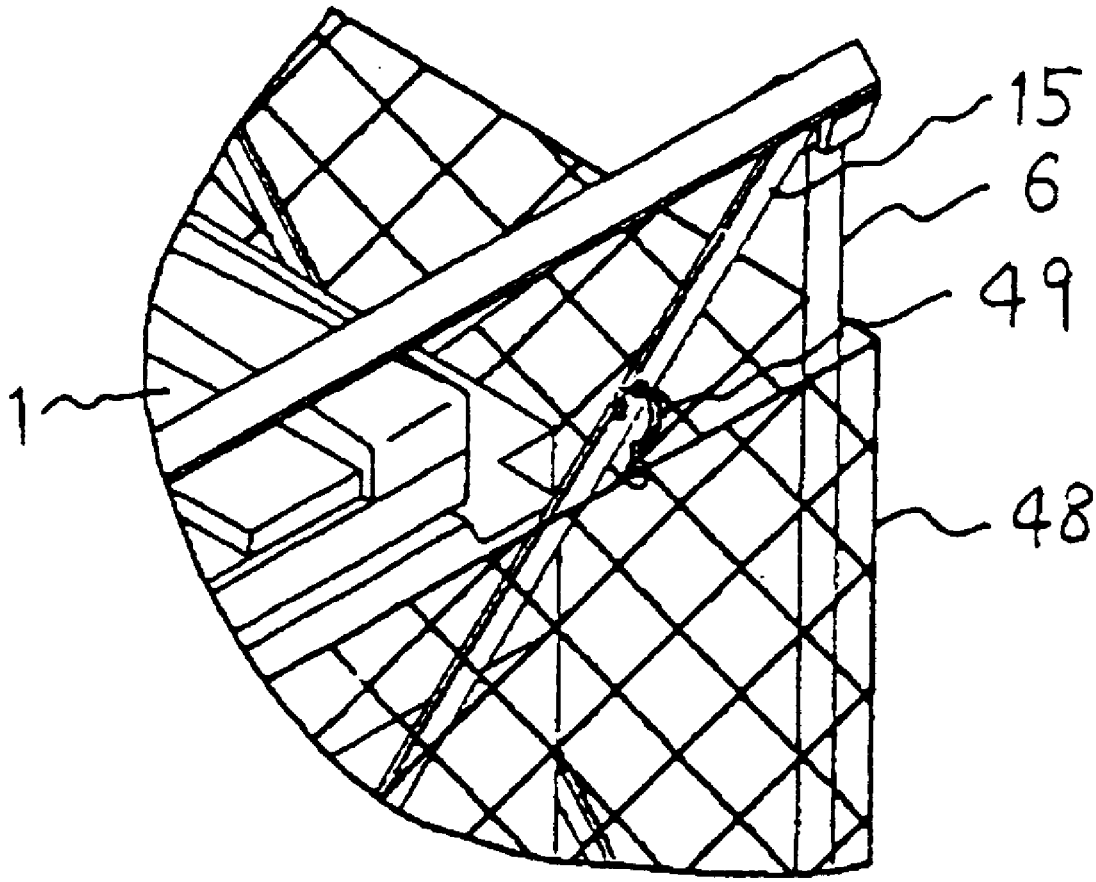
FIG. 29 is a partially enlarged view of FIG. 28.

In the example shown in FIG. 28 and FIG. 29, the protecting unit comprises a protection net 48, the protection net 48 is set on the supports 6 attached to the article transporting/storing apparatus from the outside, a plurality of hooks 49 provided on the protection net 47 are hooked, for instance, in locking holes formed on the coupling member 15, thus the protection net 48 being attached to the article transporting/storing apparatus. Also because of this feature, a portion of the opening between the supports is blocked to prevent other cargo from coming into a space inside the supports.

Figure 30:
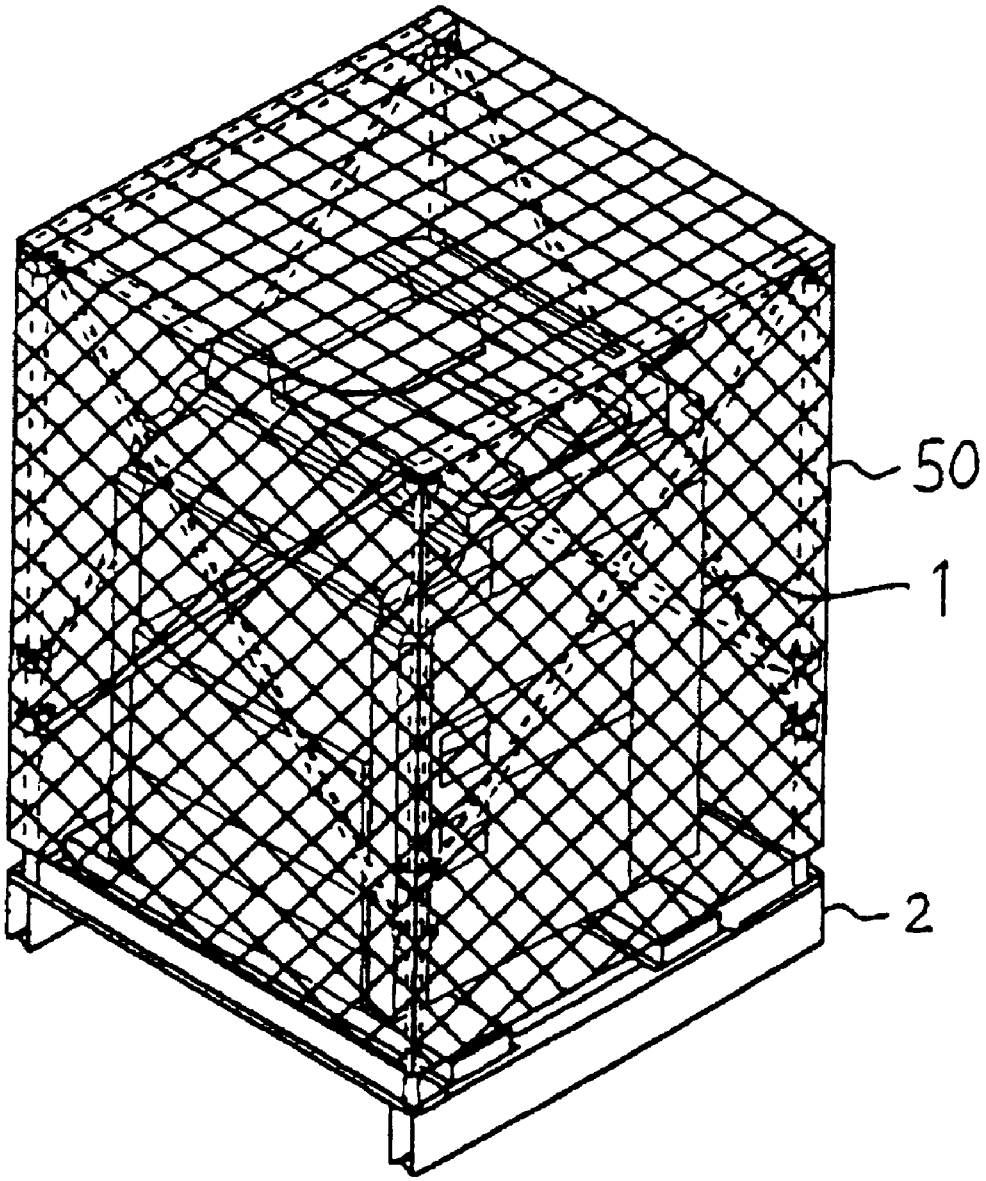
FIG. 30 is a perspective view showing another example of the protection net.

In the example shown in FIG. 30, the protecting unit comprises a protection net 50 having a net also on the top section, and this protection net covers supports of the support units set on the pallet 2 from the outside to protect the article 1 placed thereon.

Figure 31:
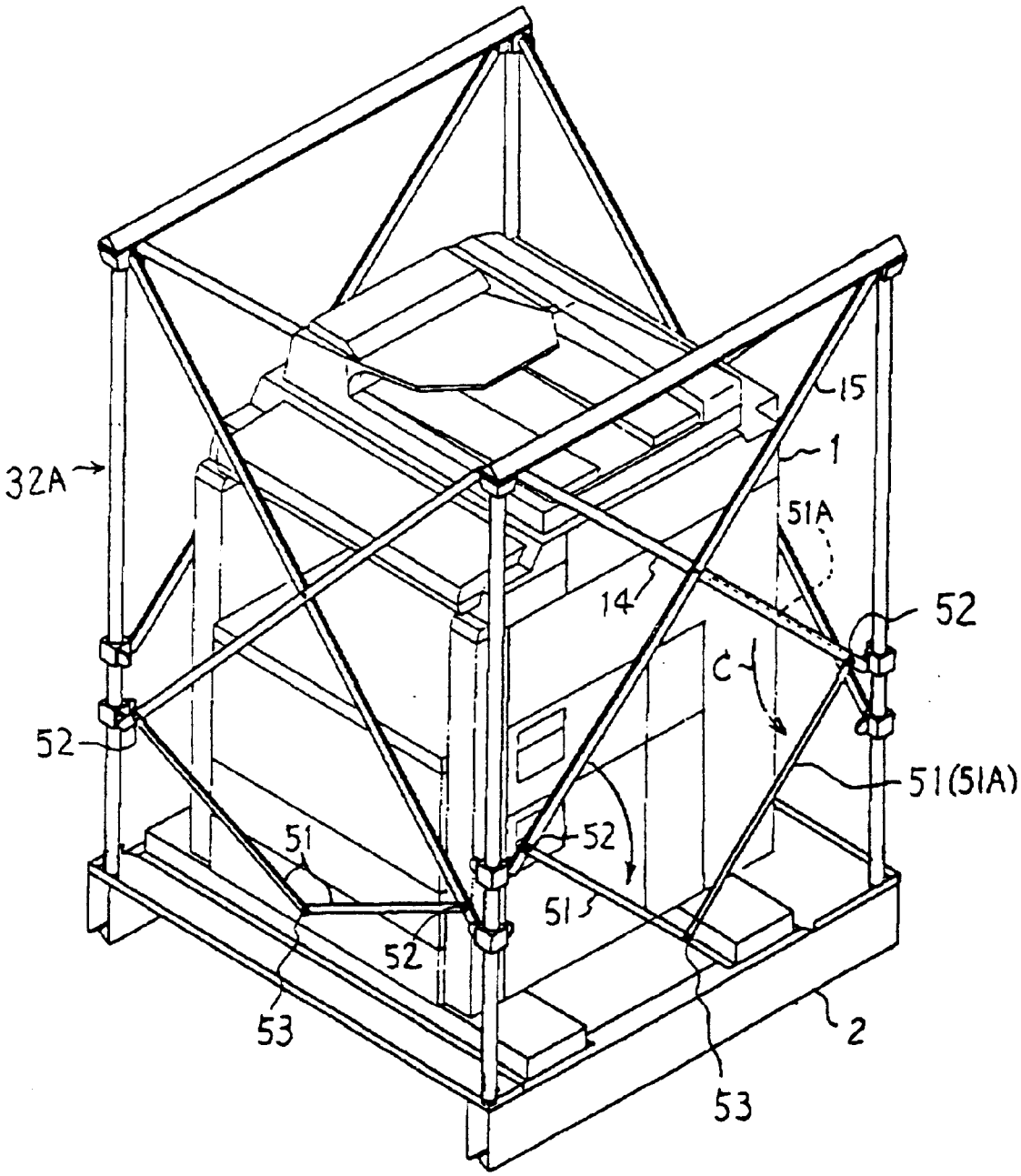
FIG. 31 is a perspective view showing an article transporting/storing apparatus with a protection arm provided therein.

Further, in the example shown in FIG. 31, the protecting unit comprises a plurality of protecting arms 51. The protecting arm 51 is rotatably coupled with a pivotal pin 52 to the coupling members 14, 15. To describe operations of the protecting arm indicated by the reference numeral 51A of the protecting arms 51, this protecting arm 51A is, when not being used, piled on the coupling member 14 for storage as indicated by a dash line in FIG. 31. When this support unit 32A is set on the pallet 2, the protecting arm 51A stored therein is moved to a position for use indicated by a solid line by rotating the protecting arm 51A about the pivotal pin 52 as indicated by the arrow C. Then a tip of this protecting arm 51A is coupled with a tip of the next protecting arm 51 having been moved to the position for use with a coupling pin 53 or a locking unit such as a bolt or a nut. Other protecting arms 51 are moved in a similar way to the respective positions for use. Thus, the protecting arms 51 are positioned between the supports 6, and prevent other cargo from coming into the article transporting/storing apparatus with the article 1 accommodated therein.

Figure 32:
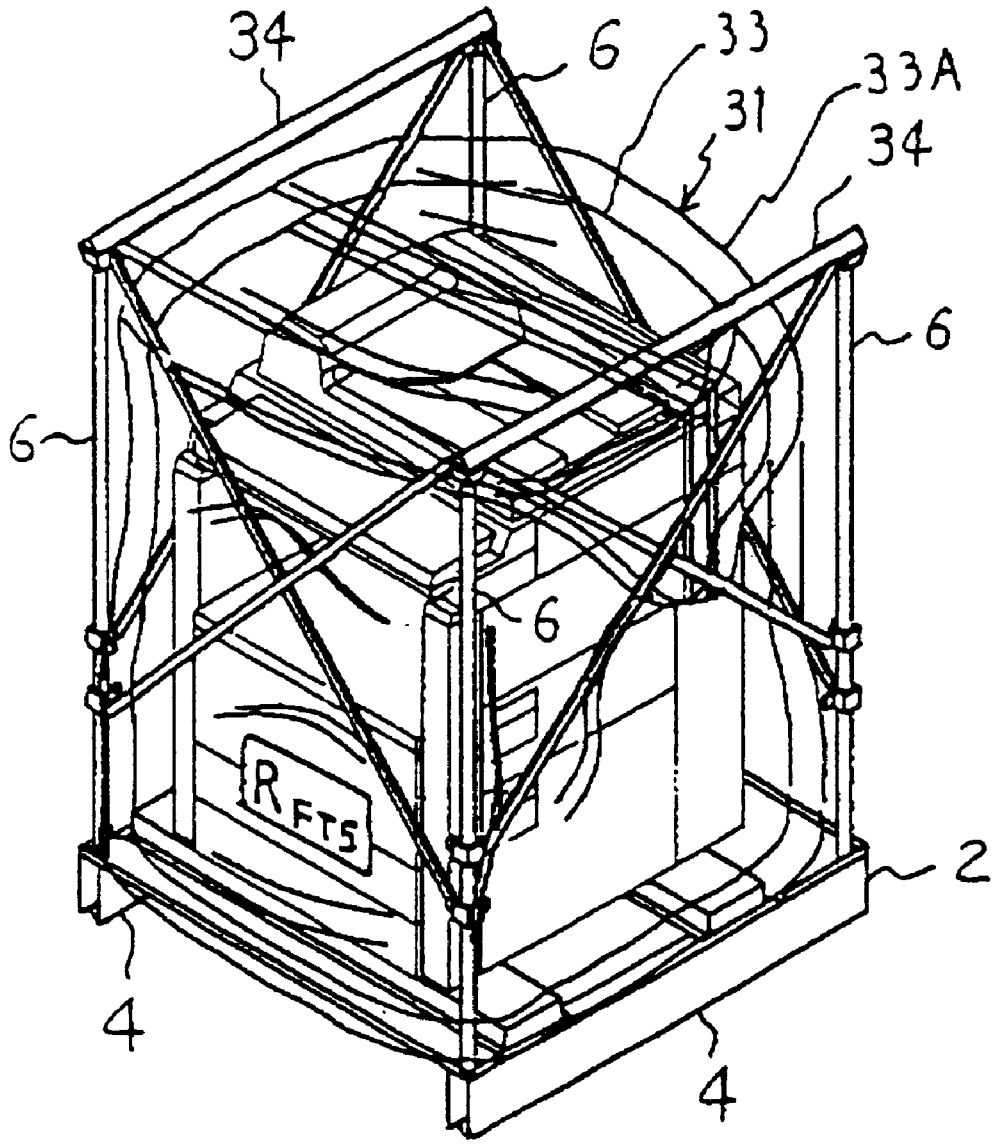
FIG. 32 is a perspective view showing an example in which the cover is formed with dual bags.

As shown in FIG. 1 or FIG. 7, also by covering the article 1 itself loaded on the article transporting/storing apparatus, the article 1 can be protected during transportation. FIG. 1 shows a flexible bag 33 that envelops the article 1 as the cover 31 for covering at least a portion of the article 1, but the cover 31 may be formed from at least two bags each enveloping the article 1. FIG. 32 shows an example in which the cover 31 is made with two bags 33, 33A. When the article 1 is enveloped with two bags, even if a quantity of foreign materials or dust is deposited to the outer bag 33A due to static electricity during transportation or storage of the article 1 together with the article transporting/storing apparatus, the foreign materials or dust can be taken away by removing the outer bad 33A when the article 1 is delivered to the user, so that a product with good appearance can be delivered to the user.

Figure 33:
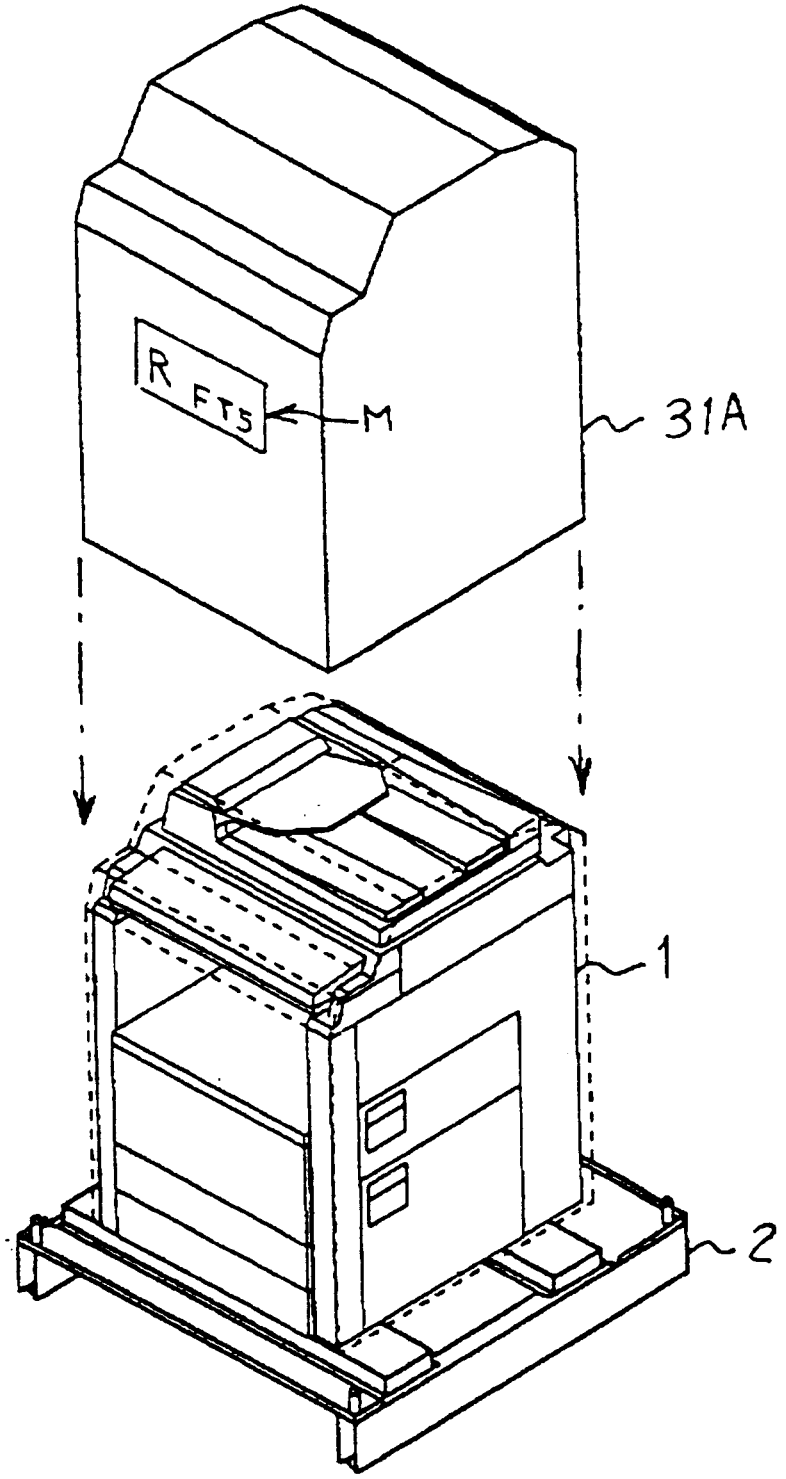
FIG. 33 is a perspective view showing an example in which the cover is made with a box.

Also as a cover for covering at least a portion of the article placed on the pallet 2 and providing information M display concerning the article 1, if necessary, for instance, the cover 31A having a form suited to a form of a product as shown in FIG. 33 may be used in place of a flexible bag. The cover 31A is made from such a material as resin or corrugated board, and also information M concerning the article 1 is displayed on this cover. The cover 31A can be used repeatedly, which makes it possible to suppress generation of wastage. If the cover 31A can be folded, the user can efficiently carry back the folded cover 31A after the product is delivered to the customer.

Figure 34:
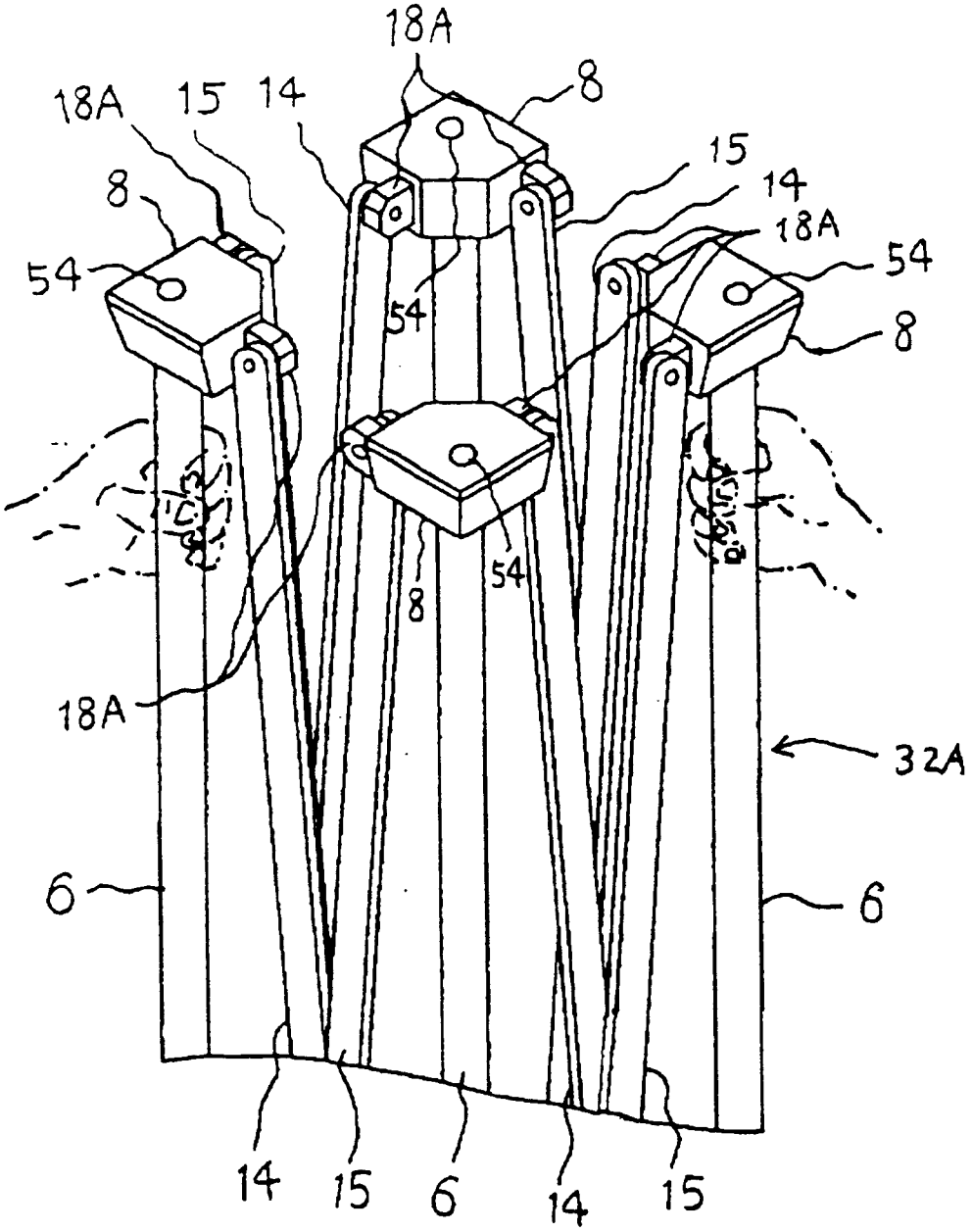
FIG. 34 is a perspective view showing a situation in which the support unit is being folded.
Figure 35:
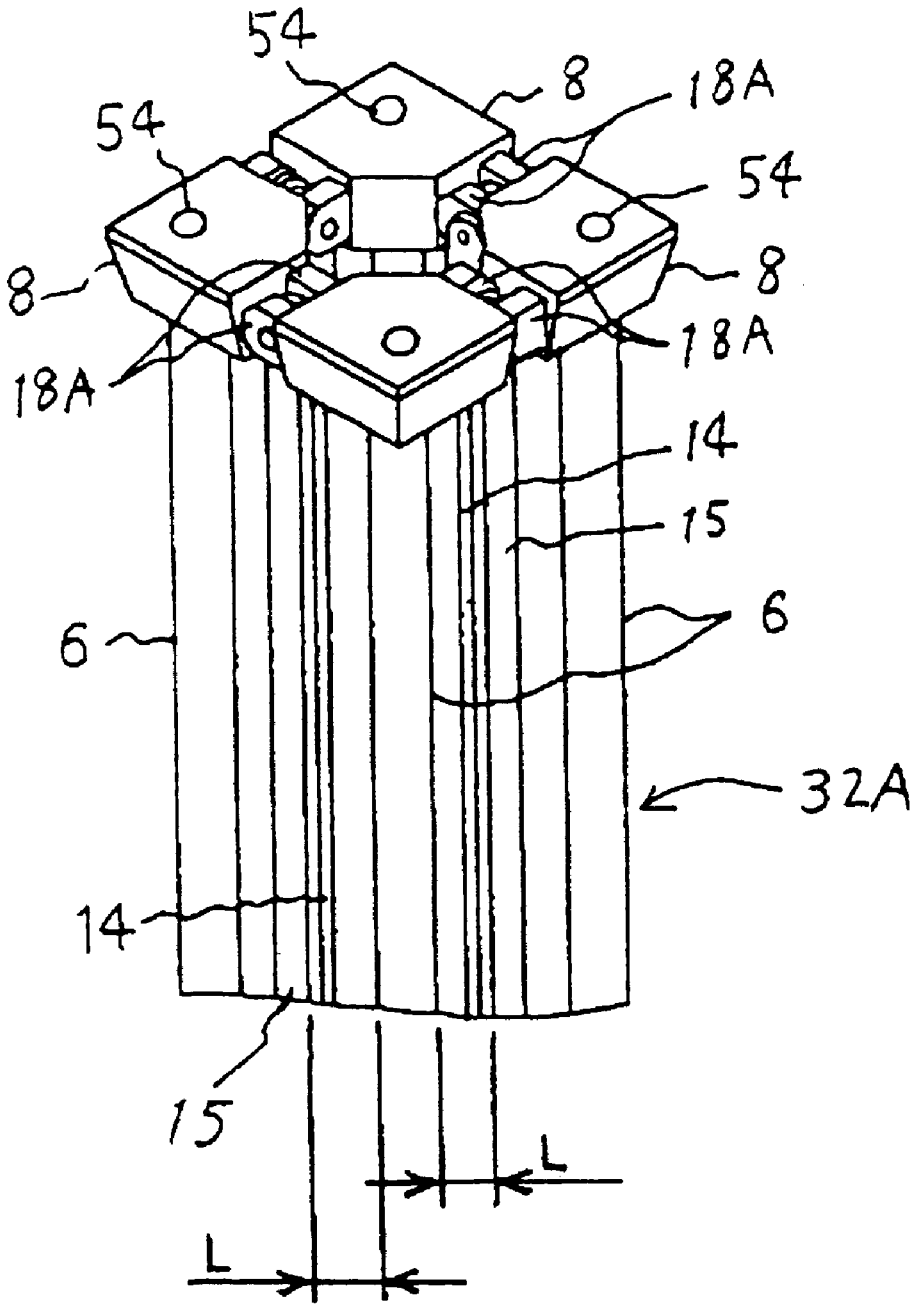
FIG. 35 is a perspective view showing the folded support unit.
Figure 36:
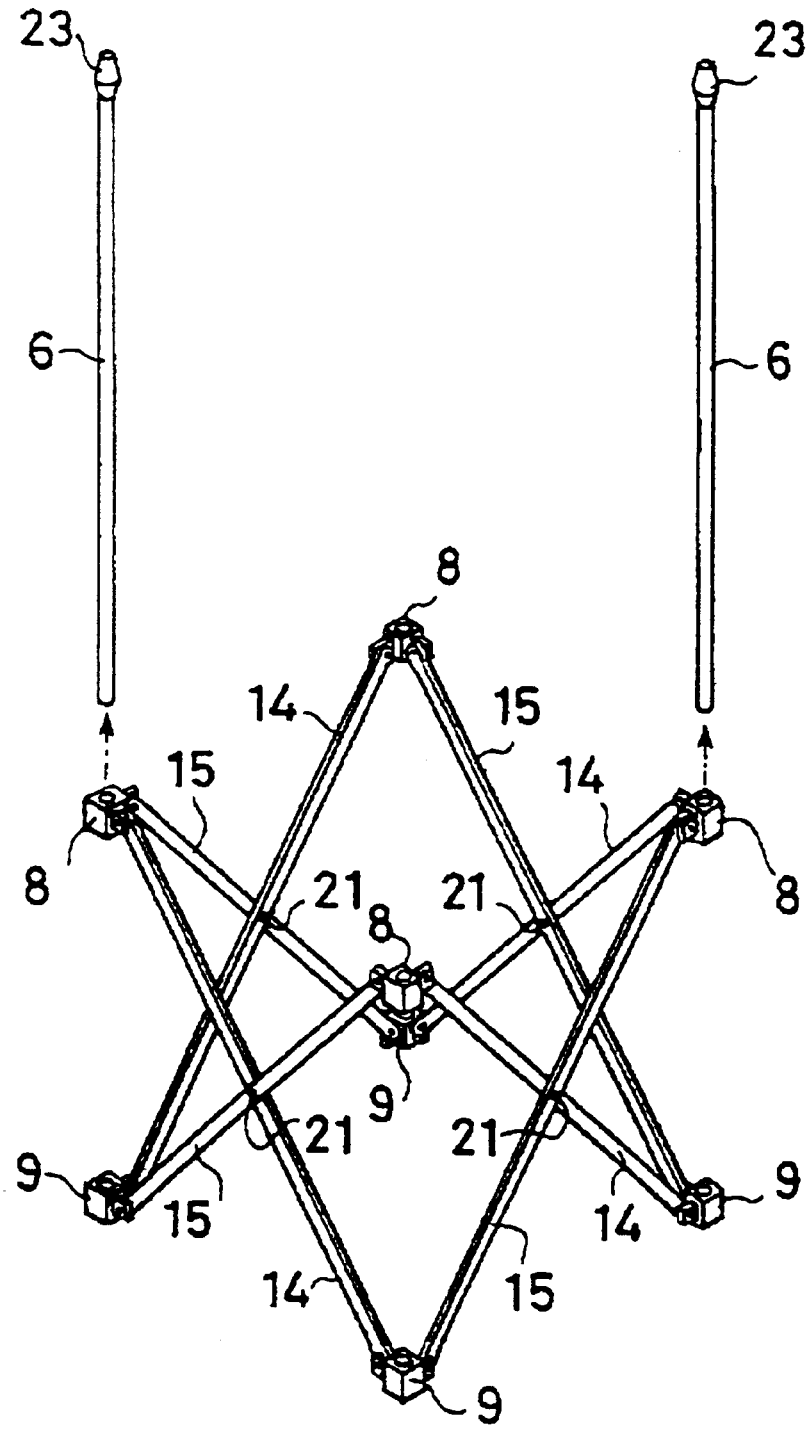
FIG. 36 is a perspective view showing a situation in which the support shown in FIG. 1 are separated from the first and second joints.

As described above, in the article transporting/storing apparatus described above, the support 6 detachably attached to the pallet 2 and the coupling members 14, 15 each for coupling two adjoining supports located side by side to each other form the support units 32, 32A each foldable when the supports are removed from the pallet 2, and with this configuration, the support unit removed from the pallet 2 can be stored in a small space or can be transported easily. When folding this support unit, the user holds the supports 6 with hands as shown in FIG. 34, gets the supports 6 closer to each other, and folds the support unit as shown in FIG. 35. However, if a clearance L between the support 6 and the coupling members 14, 15 is too small, the fingers of the hands that hold the supports 6 may get caught in this clearance.

In order to prevent this, in the article transporting/storing apparatus shown in FIG. 34 and FIG. 35, supports, joints, and coupling members are assembled with each other so that, when the support unit 32A is folded, a clearance L of 15 mm or more, and preferably 20 mm or more is generated between the support 6 and the coupling members 14, 15 rotatably coupled via the joint 8 to the support 6. More specifically, by making the tongue piece 18A provided on each joint 8 project more, the clearance L can be set to the value as described above. By making the clearance L larger, it is possible to prevent the trouble that operator's fingers are held in the clearance.

The configuration described above can be applied as it is to the article transporting/storing apparatus shown in FIG. 1 to FIG. 6. In the support unit 32A shown in FIG. 34 and FIG. 35, a recessed section 54 is formed on a top surface of the first joint 8 fixed to each support 6, and an engagement pin (not shown) provided in a projecting formed on a rear surface of the bridging member 34 shown in FIG. 11 is detachably engaged in this recessed section. As described above, the support unit 32A shown in FIG. 34 and FIG. 35 is slightly different from the support unit 32A shown in FIG. 7, but the basic configuration is same.

As understood from the description above, each of the article transporting/storing apparatuses described above comprises the pallet 2 with the article 1 placed thereon, a plurality of supports 6 detachably attached to the pallet 2 so that the supports surround the article 1 placed on the pallet 2, and a coupling unit for coupling two adjoining supports to each other so that a space between the two adjoining supports can freely be adjusted.

To describe more specifically, the article transporting/storing apparatus comprises the pallet 2 with the article 1 placed thereon, four supports 6 detachably attached to the article-loading surface 5 of the pallet 2 each in the substantially erected state against the article-loading surface, and a coupling unit for coupling two adjoining supports to each other so that a space between the two adjoining supports can be adjusted. In the example shown in FIG. 1 to FIG. 6, the first and second coupling members 14, 15 and first and second joints 8, 9 form the coupling unit, and in the example shown in FIG. 7 and on, the first and second coupling members 14, 15 and the first to third joints 8, 9, 26 form the coupling unit.

In the coupling unit in the example shown in FIG. 1 to FIG. 6 a distance between two adjoining supports located side by side is correlatively adjusted so that the distance between two adjoining supports on all edges of the pallet are changed at the same rate. With this configuration, an article having a different size can be transported or stored by the article transporting/storing apparatus having a size suited to that of the article.

In the coupling unit shown in FIG. 7 and on a distance between two adjoining supports is correlatively adjusted so that a distance between two adjoining supports located side by side on one edge and a distance between two adjoining supports located side by side on an edge opposite to the former edge are changed at the same rate. In the coupling unit a distance between two adjoining supports is adjusted so that a distance between two adjoining supports located side by side on an edge opposite to the former edge is changed at the same rate. Therefore, a degree in the freedom of adjusting a distance between the two adjoining supports increases.

Further in any of the article transporting/storing apparatuses described above, the pallet 2 has a coupling section with an upper section of another article transporting/storing apparatus detachably attached thereto in the opposite side of the article-loading surface 5, so that a plurality of article transporting/storing apparatuses can easily be piled up on each other.

Further in each of the article transporting/storing apparatuses described above, it is advantageous that each support 6 and the joints 8,9 or 8, 9, 26 assembled with the support 6 are separably assembled with each other. For instance, in a case of the article transporting/storing apparatus shown in FIG. 1, as described above, by fixing the second joint 9 to the support 6 with a removable screw 20 (See FIG. 4) and by removing the screw 20, each support 6 can be separated from the first and second joints 8, 9.

With the configuration as described above, when any of components of the article transporting/storing apparatus, for instance, one of the supports 6 is damaged and the support 6 is to be replaced by a new one, the support can easily be removed from the joints and replaced by a new one. Also when the article transporting/storing apparatus is to be abolished, each support and each joint are separated from each other and can be abolished discretely. Thus, it is especially desirable that the first and second coupling members 14, 15 can be separated from each joint and in addition, the coupling members 14, 15 themselves can be separated from each other.

Various types of configuration according to the present invention can further be modified by changing or improving each component, and can be used to transport or store, in addition to a copying machine as described above, various types of industrial products such as electric homeware products, cars, components thereof such as an engine, an automatic vending machine, a printer, a facsimile machine, furniture, construction materials, and substantially any type of industrial products.

Figure 37:
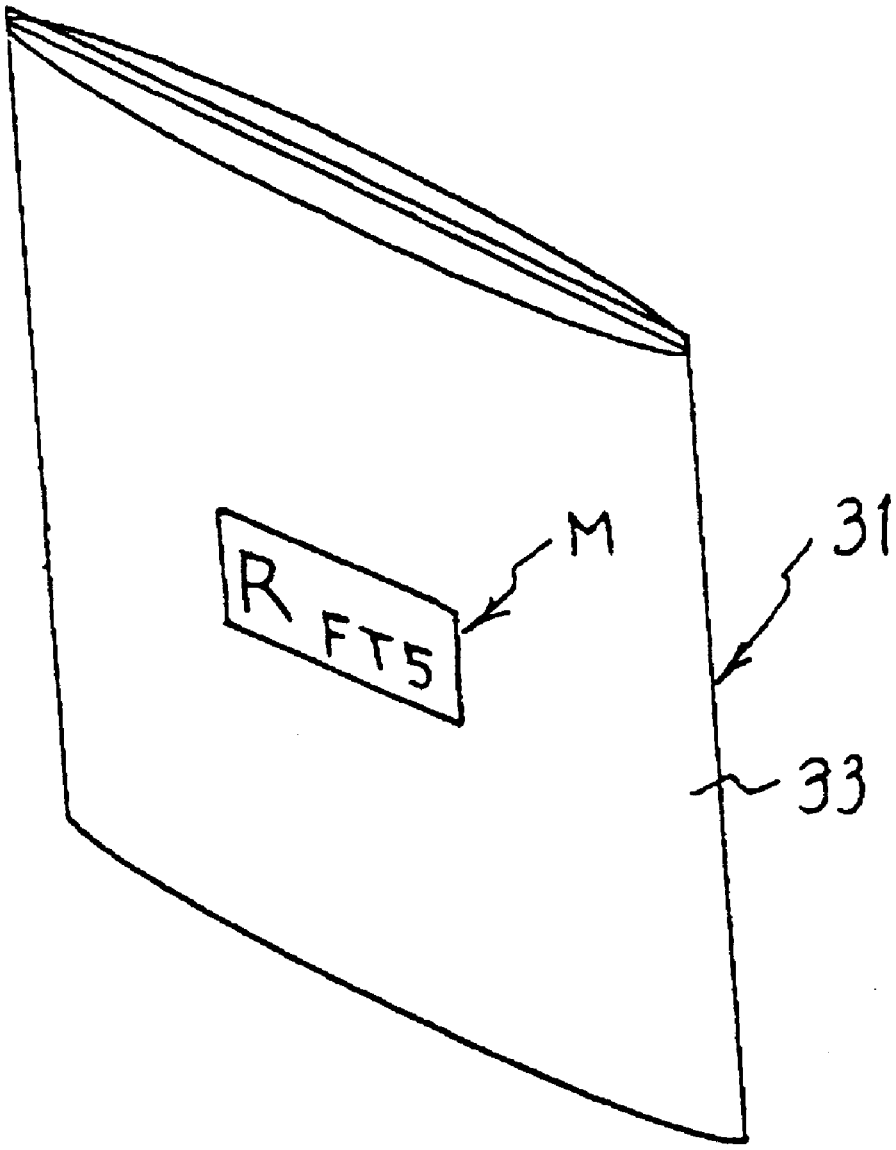
FIG. 37 is a perspective view showing a bag in the folded state.

Next detailed description is made for the cover 31 covering the article 1 placed on the pallet 2 of the article transporting/storing apparatus shown in FIG. 1. This cove 31 functions as a protection cover for covering at least a portion of the article to protect the article 1, for instance, when something strikes the article 1 as well as to prevent foreign materials or dust from getting deposited on the article. The cover 31 shown in FIG. 1 comprises, for instance, a flexible bag 33 made from a resin sheet or a resin film made of such a material as polyethylene and envelops the article 1 on the pallet 2. FIG. 37 show a cover 31 not in use, when using this cover 31 it is opened as shown in FIG. 38 and the article 1 is inserted from the opening below to cover the article 1 as shown in FIG. 1.

Figure 38:
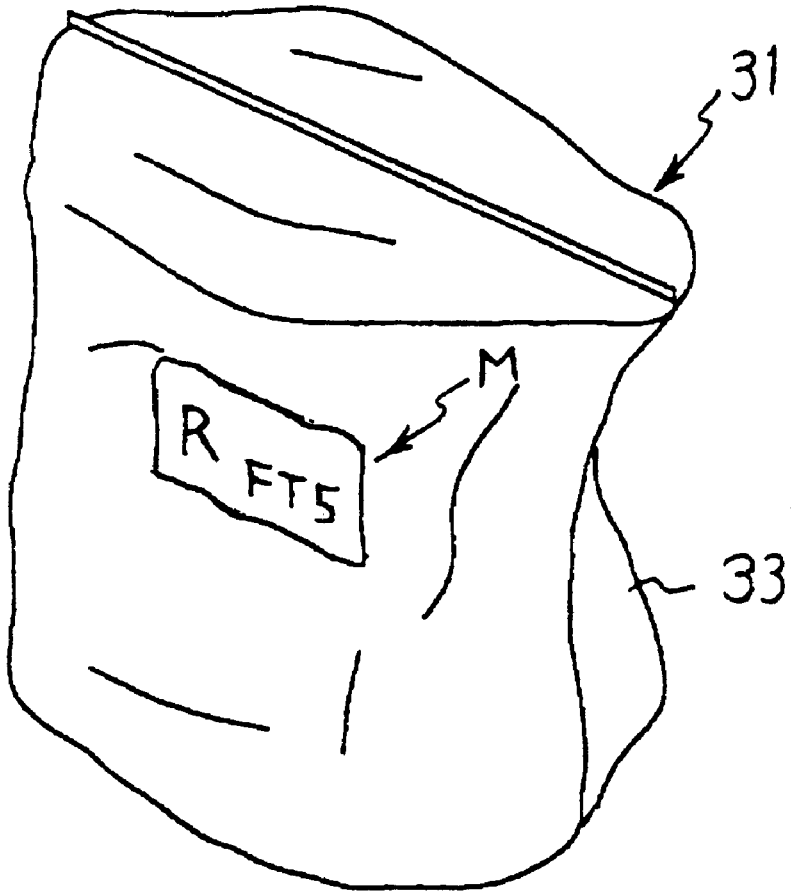
FIG. 38 is a perspective view showing a situation in which the bag is used for covering an article.

As shown in FIG. 1, FIG. 37, and FIG. 38, the cover 31 has a display concerning the article 1 thereon. For instance, as shown in the example shown in the figures, in addition to "R" indicating a name of a manufacturer of the article 1 and "FT5" indicating a product name of the article 1, a remark such as a display indicating the necessity to prevent the article 1 from being wet with rain, namely a care mark or the like is displayed. The display may directly be written or printed on the cover 31, but a sheet with the display written or printed thereon may be adhered to the cover 31.

As described above, the article 1 can be protected with the cover 31 without fail, and additional information concerning the article is displayed on the cover 31, so that any specific member for displaying the information is not required, which makes it possible to reduce the cost of the article transporting/storing apparatus.

Figure 39:
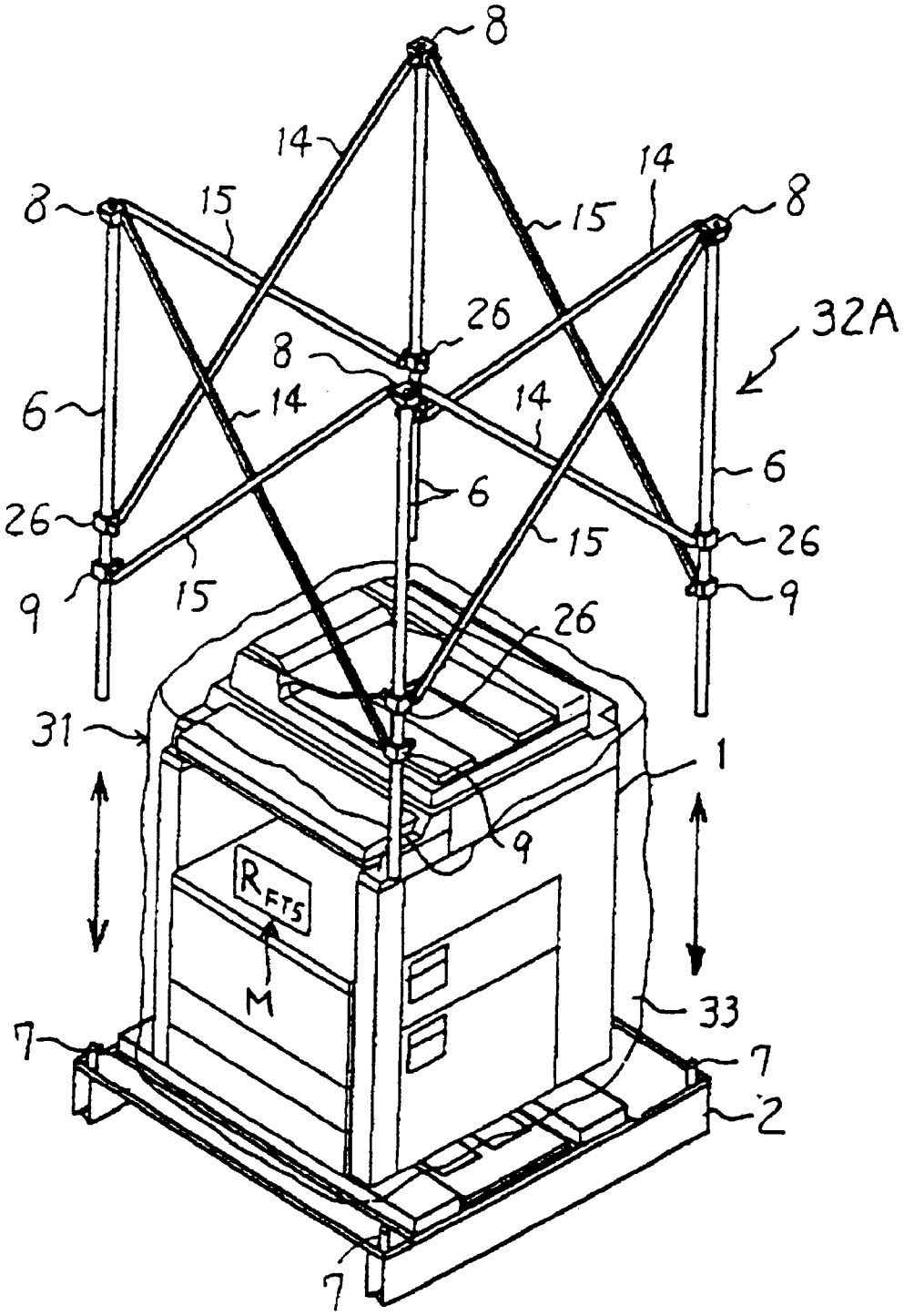
FIG. 39 is a perspective view showing a situation in which the support unit is attached to or detached from the pallet.
Figure 40:
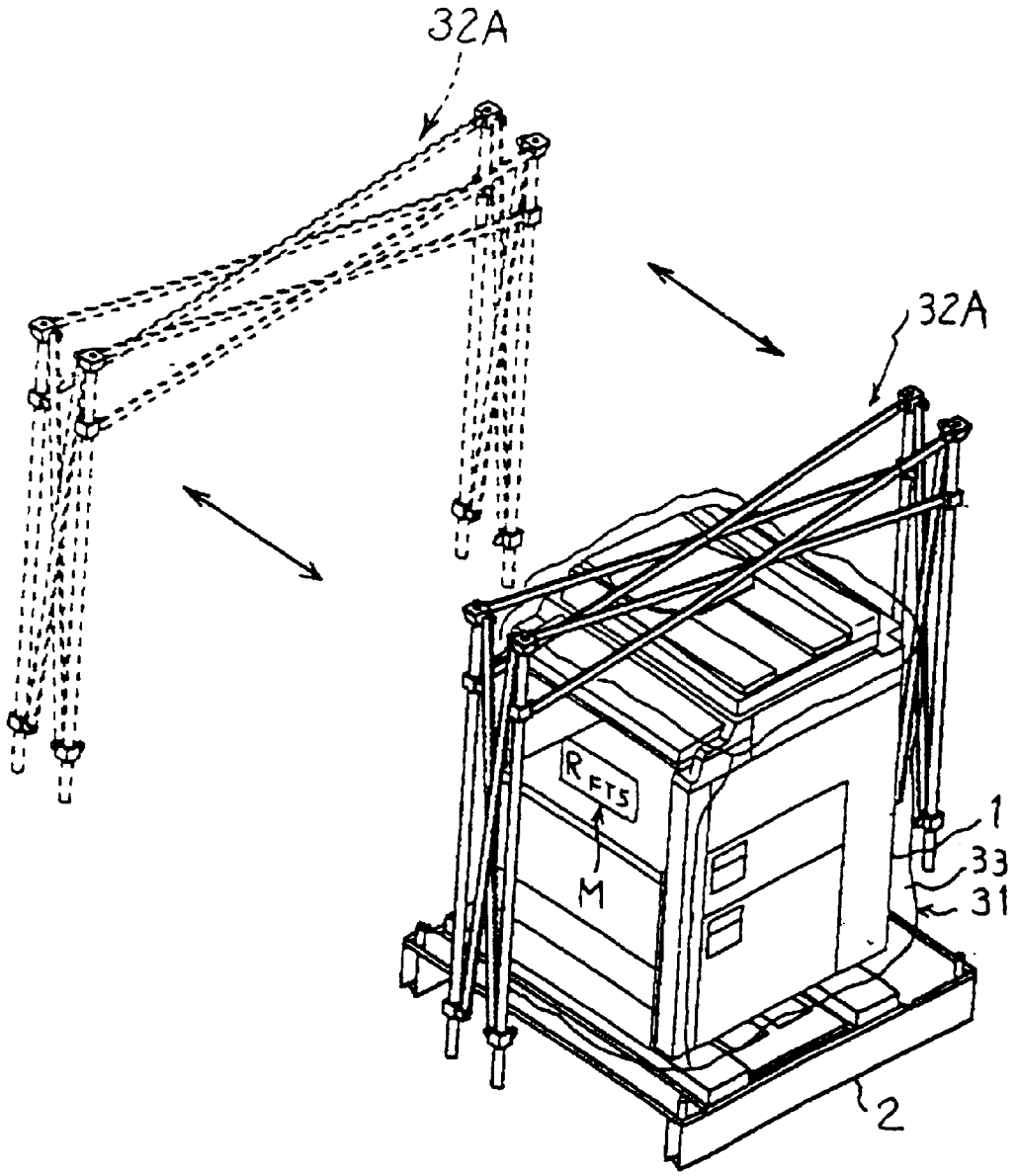
FIG. 40 is a perspective view showing a situation in which the support unit is attached to or detached from the pallet.

FIG. 39 shows a situation in which, after the article 1 placed on the pallet 2 is covered with the cover 31, the support unit 32A is lowered from above and attached to the pallet 2, or the support unit 32 is raised upward and removed from the pallet 2. FIG. 40 shows a situation in which the support unit 32A is folded and is moved in the horizontal direction, and then the support unit 32A is attached to or removed from the pallet 2. In the example shown in FIG. 39 and FIG. 40, like in the case shown in FIG. 1, four projections 7 are provided in the pallet 2 with lower sections of the supports 6 engaged therewith and then are attached to the pallet 2. An operation for detaching the support unit 32A from or attach the support unit 32A to the pallet 2 is as described above, so that description concerning the operation is omitted herein.

Figure 41:
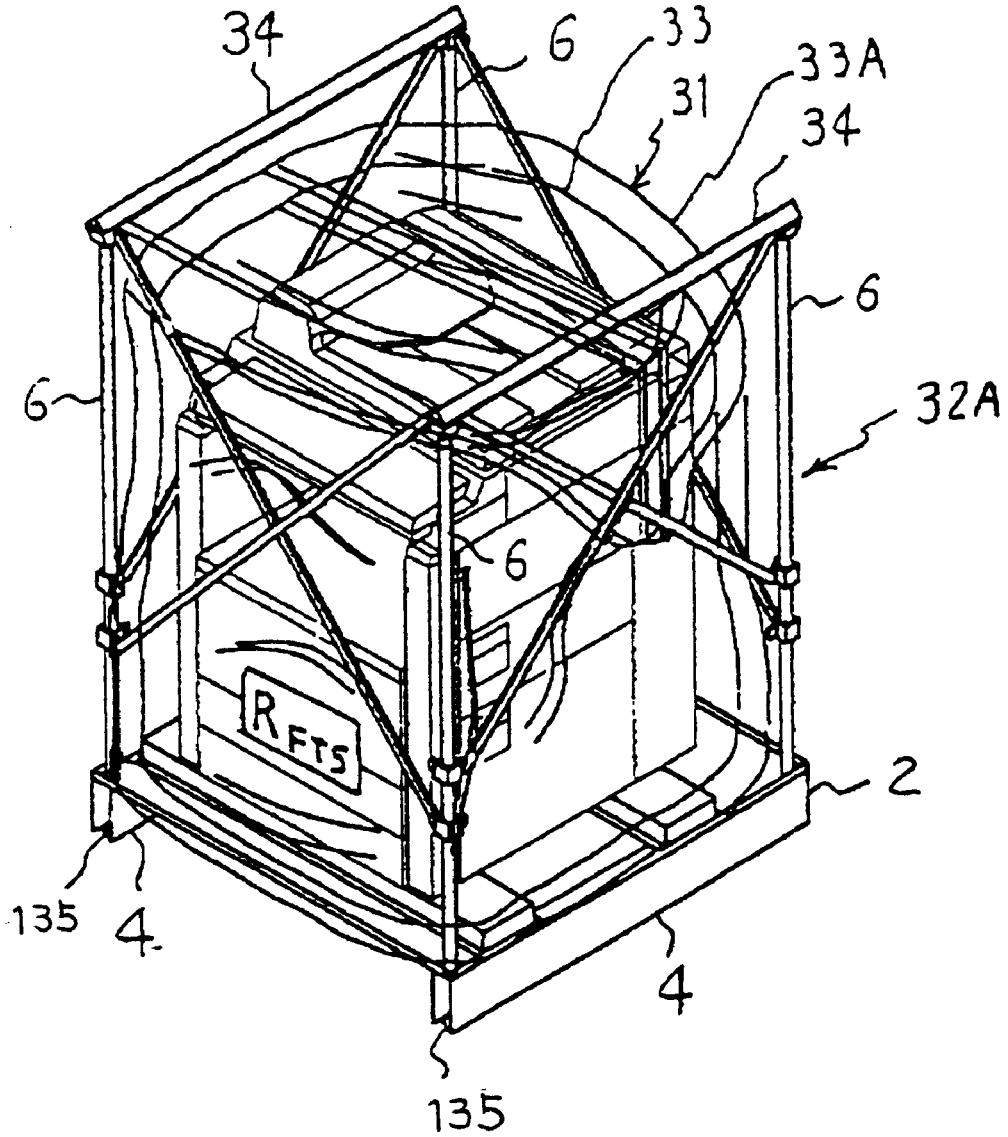
FIG. 41 is a perspective view showing an example in which an article is covered with dual bags.

In the examples described above, the cover 31 for covering the article 31 comprises a flexible bag for enveloping the article 1 therewith, and a number of sheets of bag is one, but the cover 31 may comprise two or more bags each for enveloping the article 1, and FIG. 41 shows an example in which the cover 31 comprises two bags 33, 33A. When the article 1 is covered with two bags as shown in the figure, even if foreign materials or dust are deposited due to static electricity on an outer surface of the outer bag 33A, the foreign materials or dust can easily be removed by removing the outer bag 33A, so that a product with good appearance and without any dust or foreign material deposited thereon can be delivered to a user.

A coupling plate (bridging member) 34 having a reversed V-shaped cross section is detachably attached to the support 6 shown in FIG. 41 with a bottom surface 135 of the leg section 4 of the pallet 2 having a reverse V-shaped form complementary to the above-described reverse V-shaped form (Also the pallet shown in FIG. 39 and FIG. 40 has the same configuration), and when the article transporting/storing apparatuses are piled up on each other, the reverse V-shaped bottom surface of the leg section 4 of the article transporting/storing apparatus located in the upper side engages the coupling plate 34 of the article transporting/storing apparatus located in the lower side.

With the configuration shown in FIG. 1, as the support 6 is a slender member, when the support 6 is attached to the pallet 2, if an external force is loaded to an upper section of the support 6, the upper section of the support 6 fluctuates, which may make the support unit attached to the pallet 2 unstable. Further, it is difficult to always keep constant a space between upper section of two adjoining supports, and the space may widen or shrunken as compared to the prespecified one. When engagement holes (FIG. 1) of the pallet 2 of the article transporting/storing apparatus located in the upper side are engaged with caps 23 attached to upper edge sections of the supports 6 of the article transporting/storing apparatus located in the lower side to load the article transporting/storing apparatus 30A on the article transporting/storing apparatus 30 in the lower side, it is required to engage the engagement holes 22 with the caps 23 compulsively adjusting a space between upper sections of the supports 6, and the work is very complicated. This is true also in a case where the cap 23 is not provided and upper sections of the supports 6 are directly engaged with the engagement holes 22.

Figure 42:
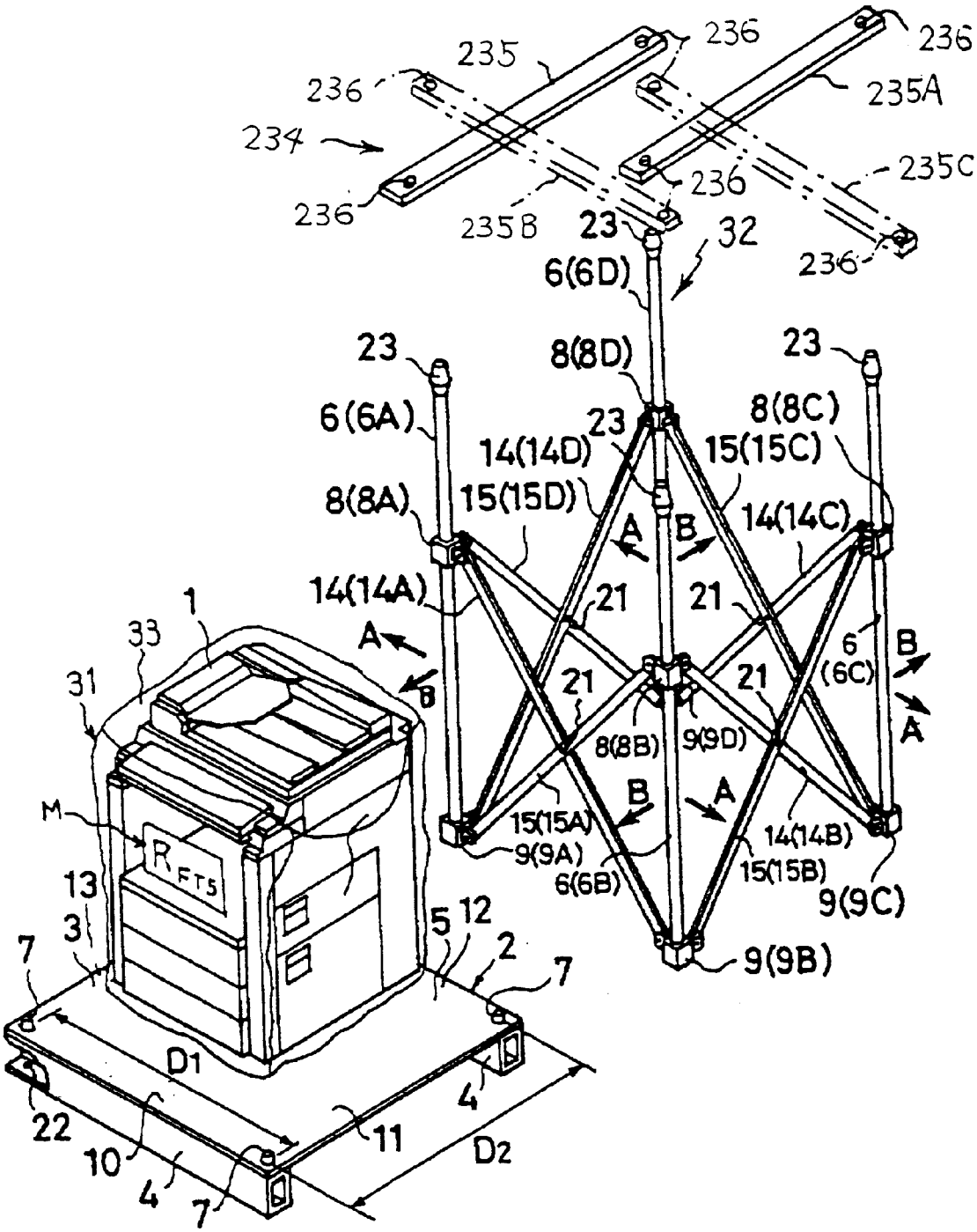
FIG. 42 is a perspective view showing an example of the article transporting/storing apparatus.

To solve the problem described above, in the article transporting/storing apparatus shown in FIG. 1, as shown in FIG. 42, a restricting unit 234 for keeping a regular space between supports by coupling upper sections of the supports 6 is provided. The restricting unit 234 has two bridging members 235, 235A each made from metal, hard resin, wood or the like. Each of the bridging members 235, 235A has a form of a slender rod or a slender plate, and mounting holes 236 are formed at both edges thereof in the longitudinal direction respectively. A distance between the two mounting holes of the bridging members 235, 235A is equal to the distance D2 between the projections 7, 7 of the pallet 2.

As described above with reference to FIG. 1, after the support unit 32 is attached to the pallet 2 by engaging lower sections of the four supports 6 with the projections 7 of the pallet 2, the mounting holes 236 of one of the bridging members 235 are engaged with the caps 23 in the upper section of the first and fourth support 6A and 6D respectively. When the cap 23 is not provided, the mounting holes 236 are directly engaged with upper sections of the supports 6A, 6D. Similarly, the mounting holes 236 of the other bridging member 235A are engaged with the caps 23 in the upper sections of the second and third supports 6B and 6C. Thus, the upper sections of the supports 6A, 6D and 6B, 6C located side by side respectively are integrally coupled to each other. Hence, a distance between the upper sections of the supports is restricted to a substantially equal distance D2 between the projections 7, so that upper sections of the supports 6 are stabilized.

Figure 43:
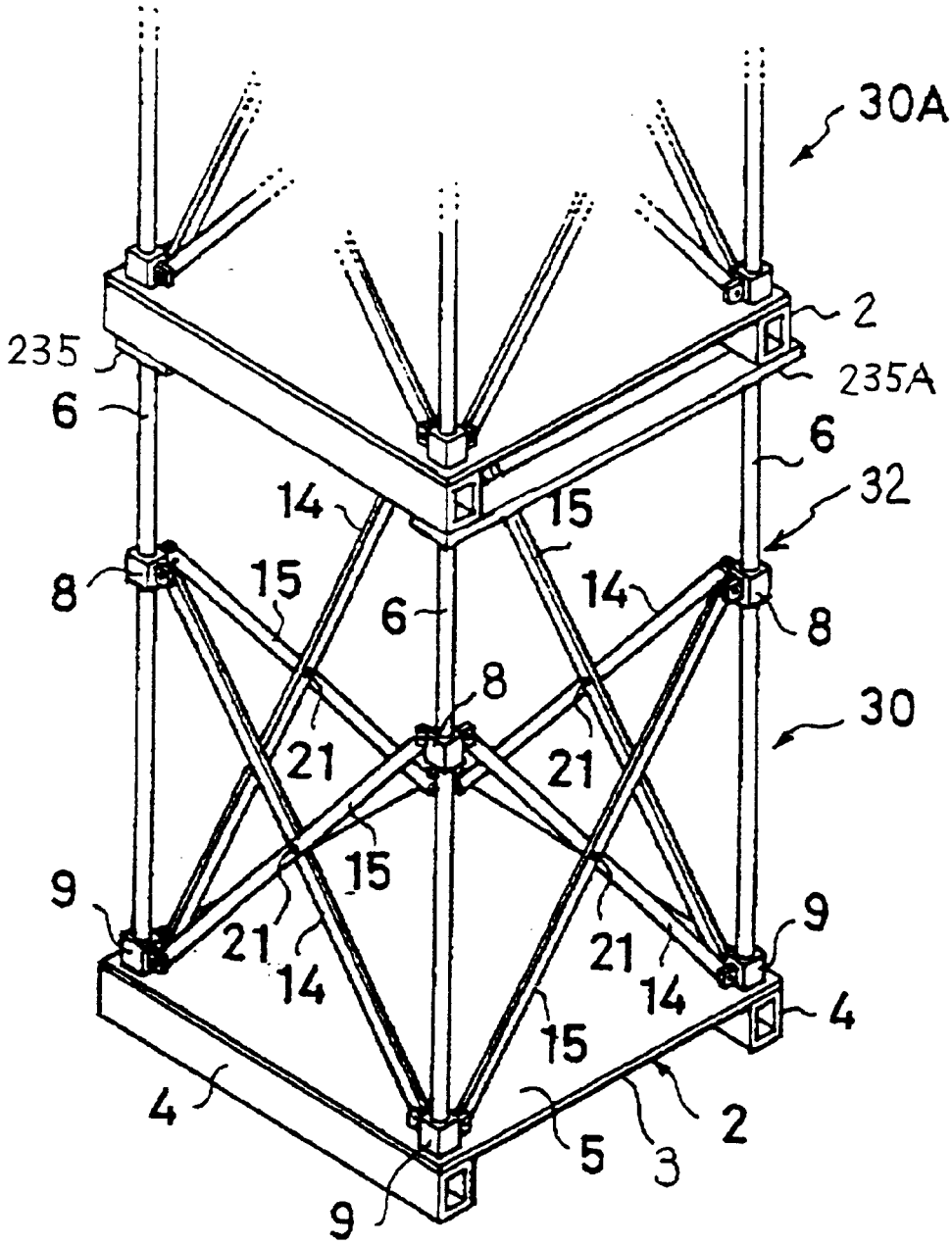
FIG. 43 is a perspective view showing a situation in which the article transporting/storing apparatus shown in FIG. 42 is assembled and a plurality of them are piled up on each other.

When the article transporting/storing apparatus 30A is loaded on the article transporting/storing apparatus 30 as shown in FIG. 43, engagement holes 22 of the upper article transporting/storing apparatus 30A can easily be engaged with the caps 23 provided on the supports 6 of the lower article transporting/storing apparatus 30 or the supports 6 themselves. Additionally, upper sections of the bridging members 235, 235A are stabilized, so that also stability of the article transporting/storing apparatus 30A placed on the article transporting/storing apparatus 30 is improved.

Distance between the supports 6A, 6B and between the supports 6C and 6D may be adjusted to the distance D1 between the projections 7 of the pallet 2 by engaging the mounting holes 236 of the two bridging members 235B, 235C with the caps 23 set on upper sections of the supports 6A, 6B, 6C, and 6D or directly with the supports 6A, 6B, 6C, and 6D. Also by using at least one of the four bridging members 235, 235A, 235B, 235C shown in FIG. 42, a space between upper sections of the two supports can be maintained at a correct length, which achieves the object of the restricting unit 234. Further, a square frame-shaped restricting unit can be made by two or more, for instance, all of the four bridging members into an integrated form.

By removing the bridging members from the supports 6, the support unit 32 can be folded easily as shown in FIG. 5. Thus, the restricting unit 234 can freely be attached to or detached from the supports 6.

As described above, in the state where a plurality of supports, more specifically two supports 6 like in the case shown in FIG. 42 and FIG. 43, are attached to the pallet 2, the restricting unit 234 restricts a distance between the two supports by coupling upper sections of at least two supports to each other.

Figure 44:
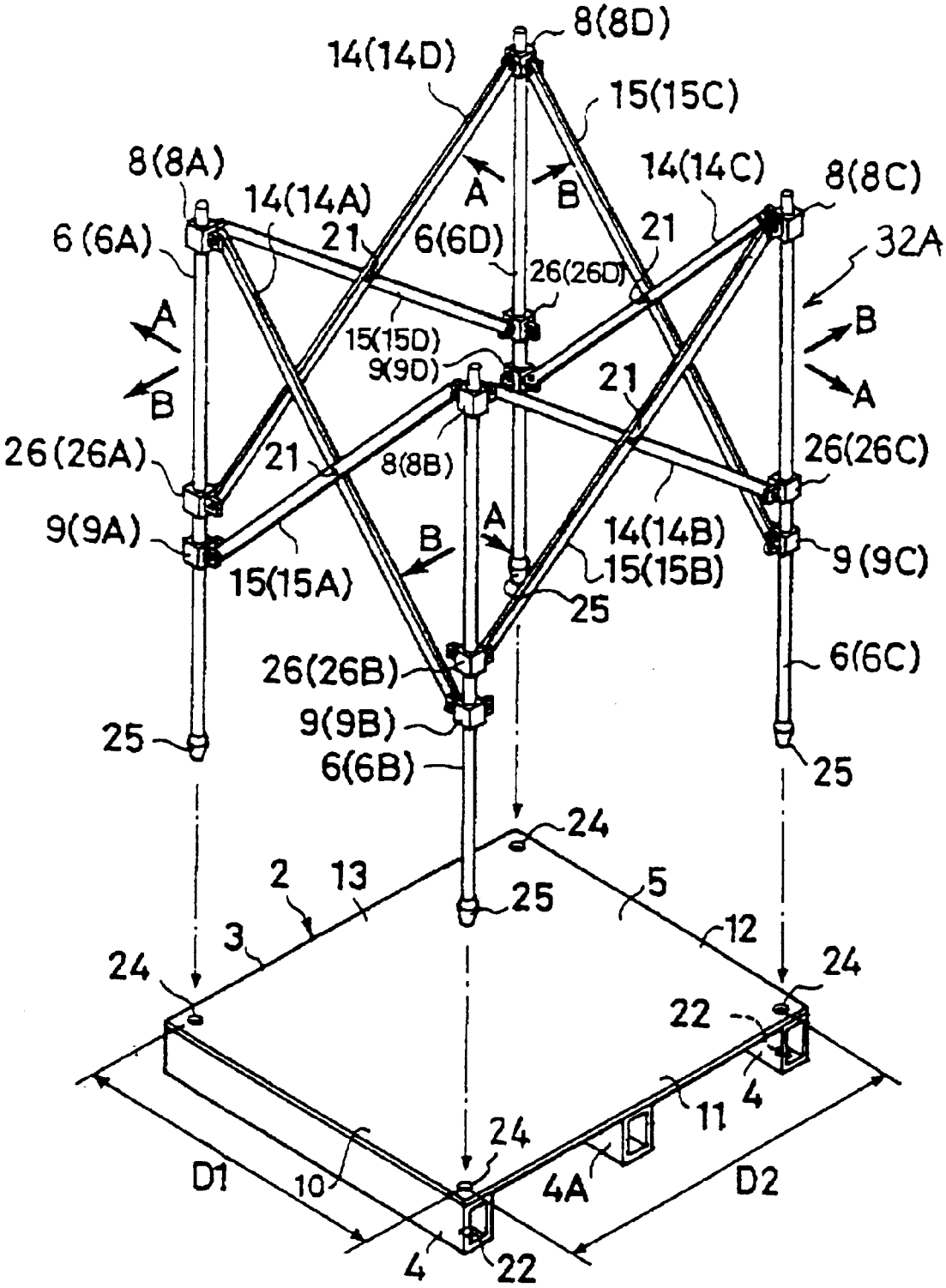
FIG. 44 is a perspective view showing an embodiment of an article transporting/storing apparatus different from that shown in FIG. 42.
Figure 45:
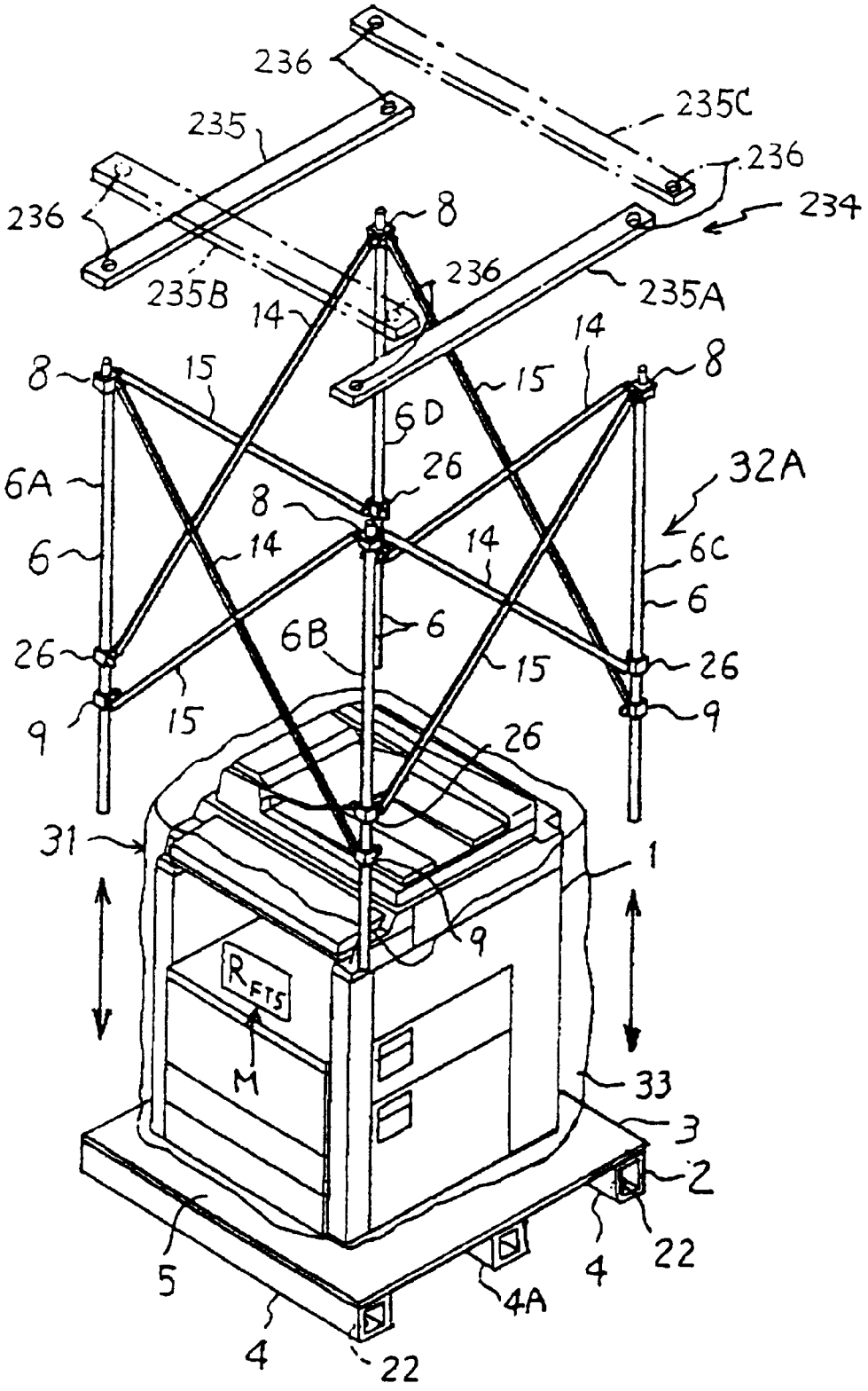
FIG. 45 is a perspective view showing a situation in which the support unit is attached to or detached from the pallet.

Also the article transporting/storing apparatus according to the embodiment shown in FIG. 44 and FIG. 45 comprises the pallet 2 with the article 1 placed thereon, and first to fourth supports 6A, 6B, 6C, and 6D detachably attached to the article-loading surface 5 of the pallet 2 each in the substantially erected state against the article-loading surface 5. Namely, considering a square above the pallet 2, the supports 6 are provided each in the erected posture at four corners of the square. Also in this form, lower sections of the supports 6 can detachably be attached to the pallet 2 in the way described in relation to FIG. 1 above, but in the example shown in FIG. 44, mounting holes 24 are provided at four corners of the article-loading surface 5 of the pallet 2, and the supports 6 are attached to the pallet 2 by inserting the lower sections of the support 6 into the mounting holes 24 or by inserting the caps 25 provided in the lower sections of the supports respectively into the mounting holes 24. In the pallet 2 shown in FIG. 44, three leg sections 4, 4, 4A are fixed to a bottom surface of the deck board 3. The other configuration of the pallet 2 is the same as that of the pallet 2 shown in FIG. 1.

In the example shown in FIG. 44, in addition to the first and second joints 8, 9, a third joint 26 is attached to each of the supports 6. The third joints 26 are identified discretely by assigning the reference numerals of 26A, 26B, 26C, and 26D to them.

As described above, the article transporting/storing apparatus shown in FIG. 44 has the first to third joints 8, 9, and 26 attached to each of the first to fourth supports 6 respectively along the longitudinal direction thereof, and in addition, like in the article transporting/storing apparatus shown in FIG. 1, has the first and second coupling members 14, 15 each for coupling the first and second supports 6A and 6B, second and third supports 6B and 6C, third and fourth supports 6C and 6D, and fourth and first supports 6D and 6A provided side by side on the edges 10 to 13 of the pallet 2 respectively when the supports 6 are attached to the pallet 2.

When the four supports 6 are attached to the pallet 2, the second and third joints 9, 26 are located under the first joint 8, and at the same time the second joint 9 is located under the third joint 26, and also in the state where the first to fourth supports 6A to 6D are attached to the pallet 2, the first and second coupling members 14, 15 cross each other.

When an article is transported with the article transporting/storing apparatus shown in FIG. 44, the pallet 2 having a size suited to that of the article is selected with the article 1 placed on the pallet 2 as shown in FIG. 45, and the article is detachably fixed to the pallet 2, or is covered with the cover 31 according to the necessity. On the other hand, distances between two adjoining supports on the four edges are adjusted so that the distances correspond to the spaces D1 and D2 between the mounting holes 24.

As described above, an article placed on the article-loading surface of the pallet 2 can be transported in the same way as in the embodiments described above. Also the pallet 2 shown in FIG. 44 has a coupling section with four engagement holes 22 to which upper sections of four supports of another article transporting/storing apparatus are detachably connected, and with this coupling section, assembled article transporting/storing apparatuses can be piled up on each other to store articles in a small space.

FIG. 45 shows a situation in which the support unit 32A shown in FIG. 44 is lowered from above and attached to the pallet 2, or the support unit 32A is raised upward to remove it from the pallet 2. An operation required for attached the support unit 32A to or detaching the support unit 32A from the pallet 2 is as described before.

Also the article transporting/storing apparatus shown in FIG. 44 and FIG. 45 has a restricting unit 234 (See FIG. 45) for restricting, by coupling upper sections of at least two supports, a distance between the two supports. The restricting unit 234 shown in this figure is not different from that shown in FIG. 42. Namely, also the restricting unit shown in FIG. 45 has two bridging members 235, 235A with mounting holes 236 formed at two edges thereof in the longitudinal direction, and after the four supports 6 are attached to the pallet 2, the bridging members 235, 235A are engaged with the upper sections of the supports 6A, 6D and those 6B, 6C. In the example shown in FIG. 44 and FIG. 45, the mounting holes 236 of the bridging members 235, 235A are directly engaged with upper sections of the supports 6, but as shown in FIG. 42, the configuration is allowable in which caps are set in upper sections of the supports 6 and the mounting holes are engaged with the caps. Also the restricting unit 234 shown in FIG. 45 can be modified as shown by the mounting members 235B, 235C with dashed lines as described in FIG. 42.

As described above, also the article transporting/storing apparatus shown in FIG. 44 and FIG. 45 is stabilized due to the upper sections of the supports 6 attached to the pallet 2 with the restricting unit 234 and can be kept in a regular form between two adjoining supports. Therefore, when one article transporting/storing apparatus is placed on another article transporting/storing apparatus, the supports of the lower article transporting/storing apparatus can correctly be engaged with the mounting holes 22 of the upper article transporting/storing apparatus.

Figure 46:
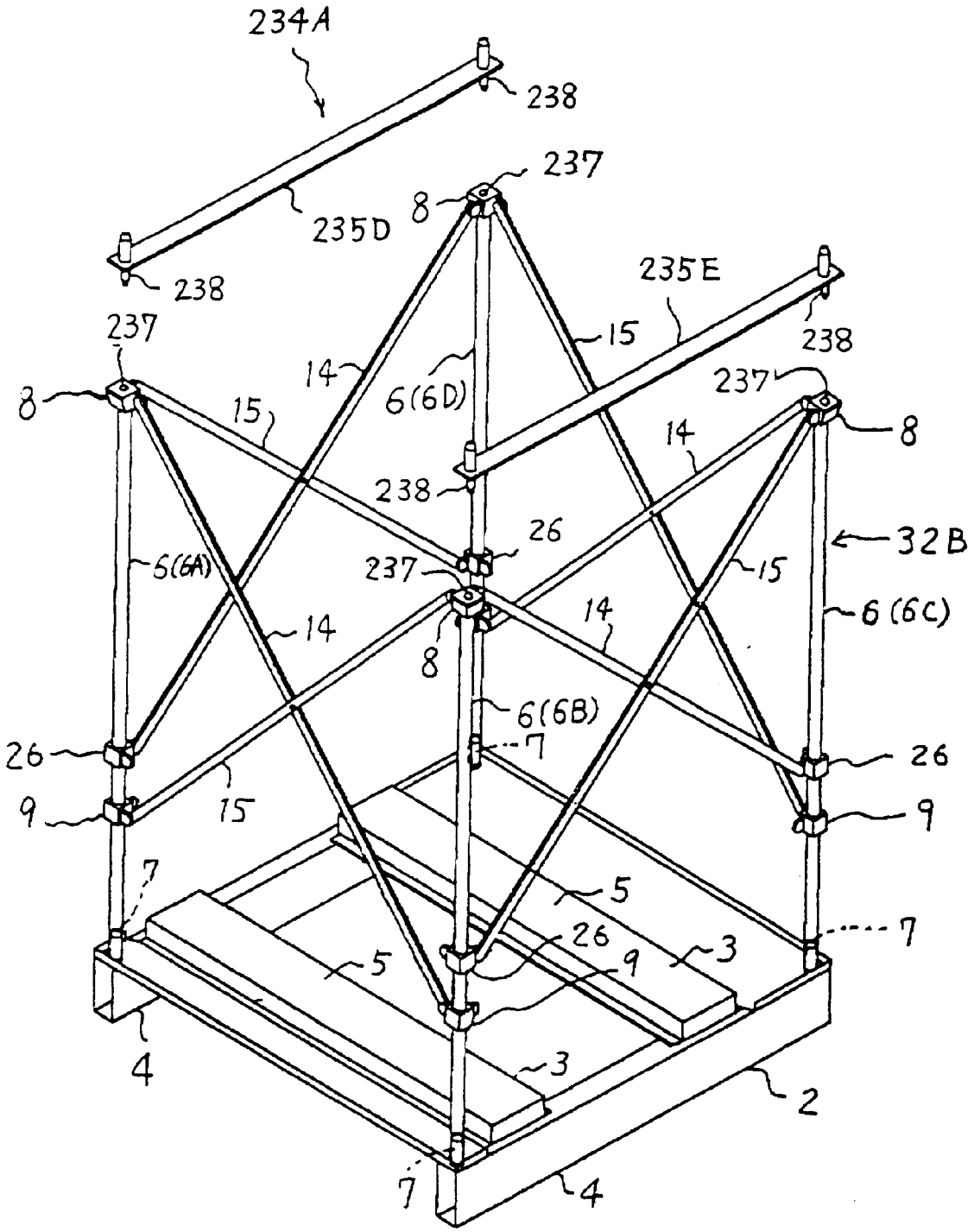
FIG. 46 is a perspective view showing an example of a bridging member.

Basic configuration of a support unit 32B having the supports 6 and coupling members 14, 15 in the article transporting/storing apparatus shown in FIG. 46 is not different from that of the support unit 32A shown in FIG. 44. The support unit 32B shown in FIG. 46 is different from that shown in FIG. 44 only in the points that the first joint 8 is fixed to each of the supports with a mounting hole 37 provided in an upper section of the joint 8 and lower sections of the supports are engaged with the projections 7 provided at four corners of the pallet 2. Also in the pallet 2 shown in FIG. 46, two deck boards 3 are fixed to the leg sections 4 with an article not shown herein placed on the article-loading surface 5 thereof, and the article is detachably fixed to the pallet 2 according to the necessity.

The restricting unit 234A shown in FIG. 46 restricts a distance between two adjoining supports by coupling upper sections of the two supports, and this restricting unit 234A has two bridging members 235D, 235E with engagement pins 238 fixed at the two ends in the longitudinal direction respectively. When the bridging members 235D, 235E are attached to the supports, the engagement pins 238 are engaged with the mounting holes 237 in upper sections of the two supports. Thus, the same effect as that by the restricting unit 234 in each of the embodiments described above can be achieved.

Figure 47:
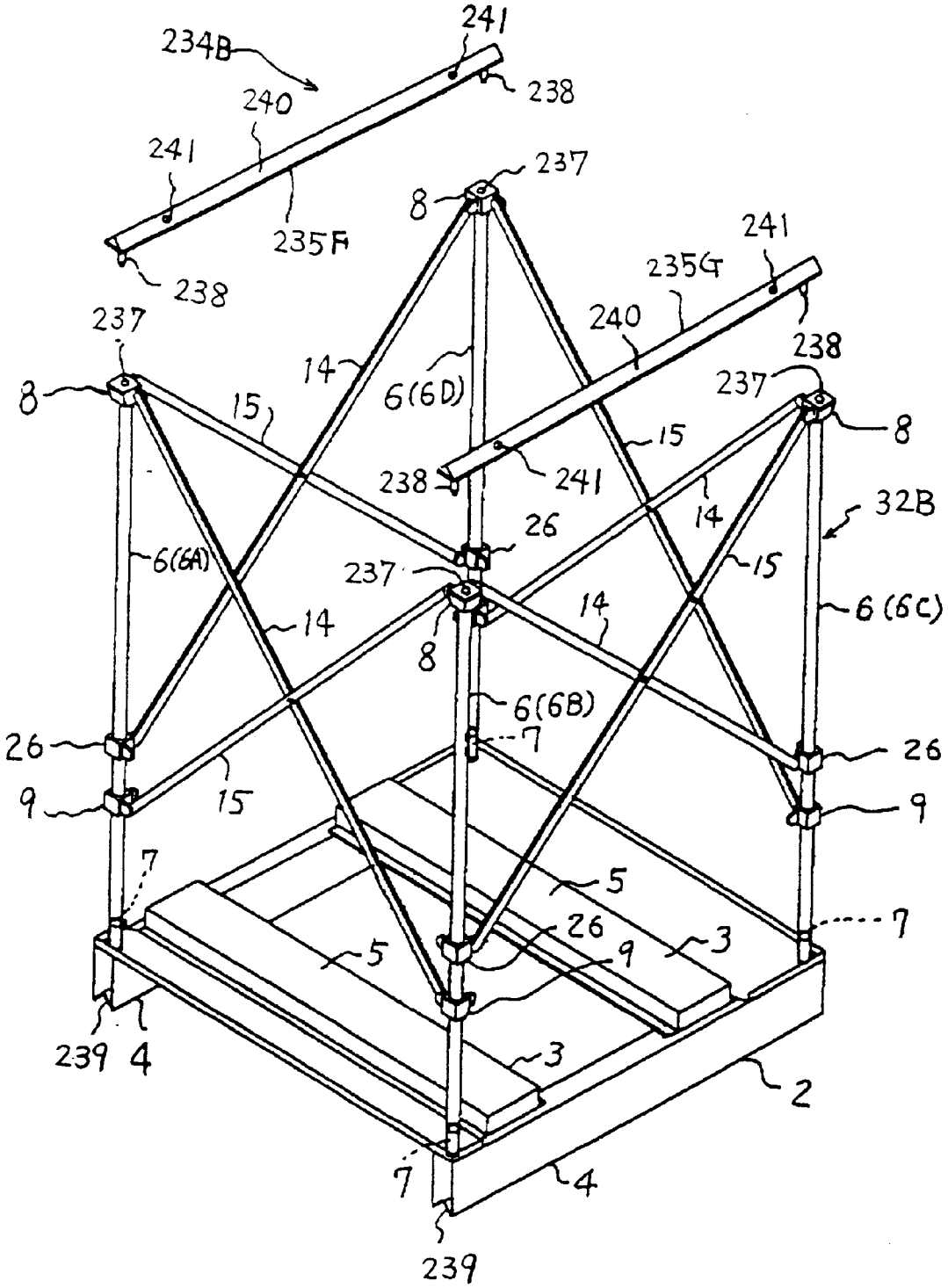
FIG. 47 is a perspective view showing another example of the bridging member.

The support unit 32B of the article transporting/storing apparatus shown in FIG. 47 is not different from that shown in FIG. 46, and also the pallet 2 is not different from that shown in FIG. 26 excluding the points that an engagement section 239 formed with a reverse V-shaped form extending along the full length of the leg section in the longitudinal direction is formed.

Also the restricting unit 234B shown in FIG. 47 restricts a distance between two adjoining supports by coupling the upper sections of the two supports in the state where the four supports 6 are attached to the pallet 2, and also the restricting unit 234B shown in the figure has two bridging members 235F, 235G. The restricting unit 234B explained till here is not different from the restricting units 234, 234A described above.

Difference of the restricting unit 234B shown in FIG. 47 from other ones is that the cross of each of the bridging members 235F, 235G is triangular with one of the vertexes pointing upward. Engagement pins 238 are provided in the projecting form at two ends thereof in the longitudinal direction, and the bridging members 235F, 235G are detachably attached to the supports 6, as shown in FIG. 48, by engaging the engagement pins 238 in the mounting holes 237 formed in the first joint 8 in an upper section of the support 6 attached to the pallet 2.

Figure 48:
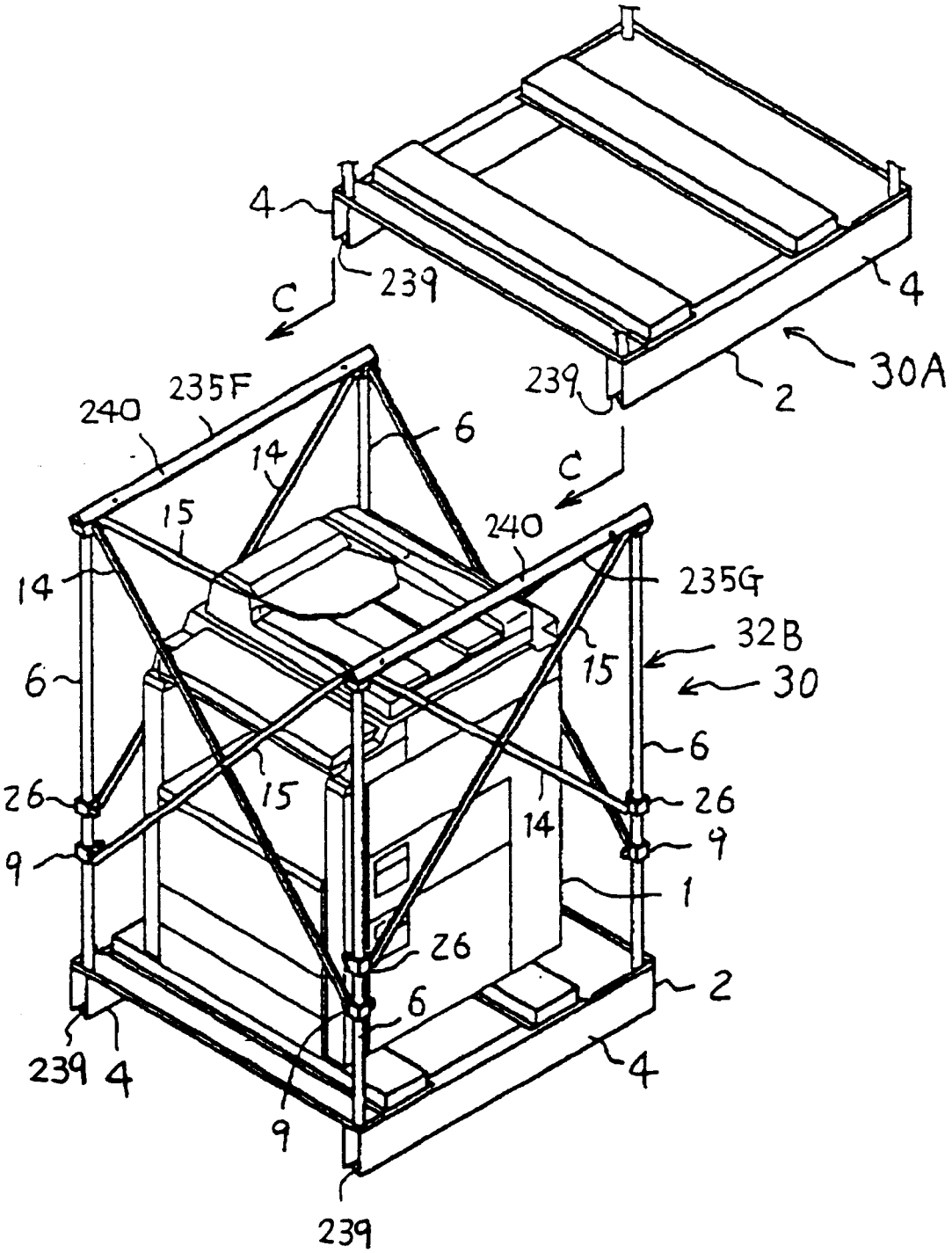
FIG. 48 is a perspective view showing a situation in which the bridging member shown in FIG. 47 is attached to an upper section of the support.
Figure 49:
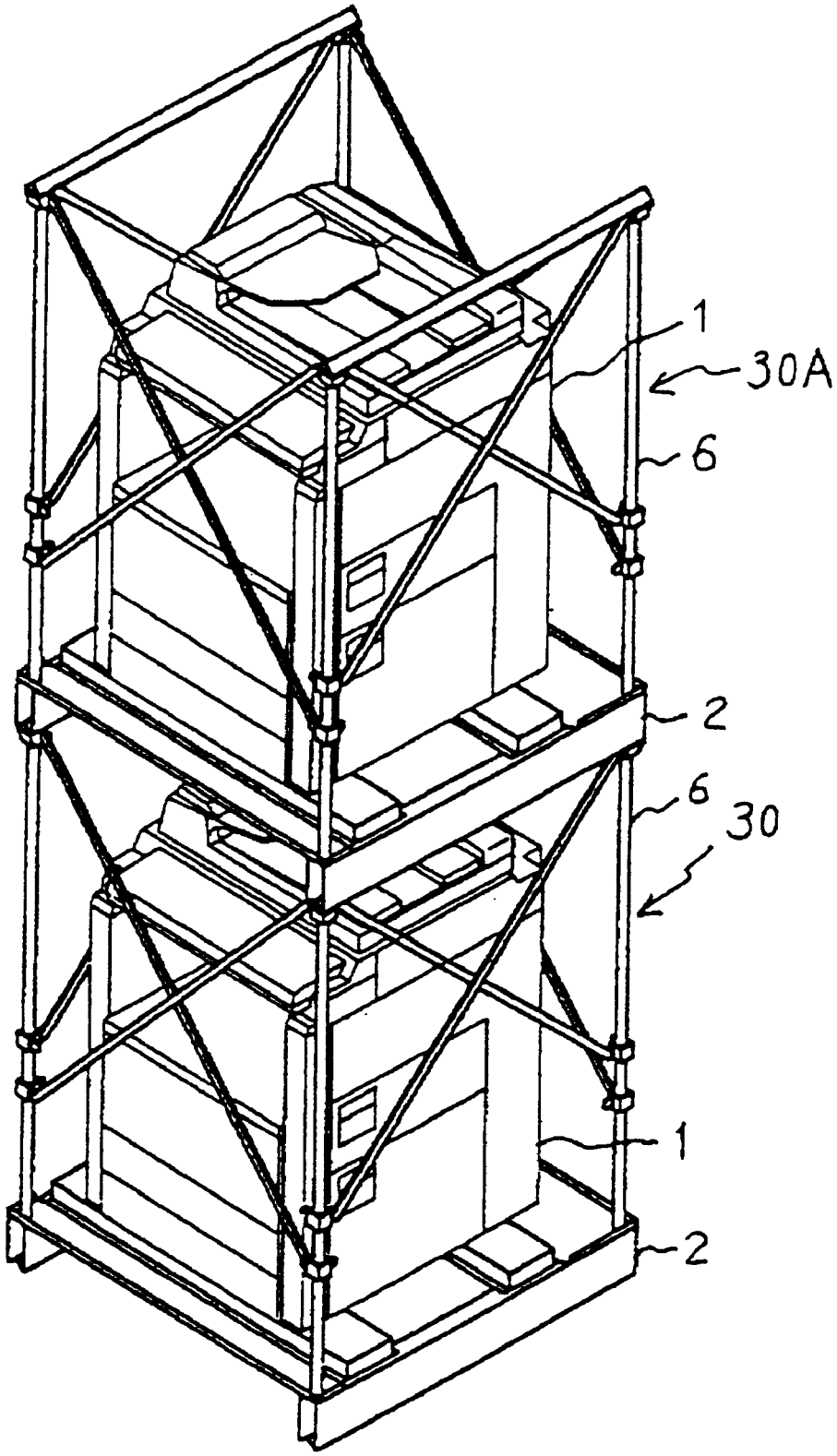
FIG. 49 is a perspective view showing a situation in which an article transporting/storing apparatus has been piled on another article transporting/storing apparatus.

Herein, when another article transporting/storing apparatus 30A is placed on the article transporting/storing apparatus 30 shown in FIG. 48, the reverse V-shaped engagement sections 239 formed in a bottom surface of the pallet 2 of the upper article transporting/storing apparatus 30A are engaged in a guide section 240 formed with reverse V-shaped surfaces of the bridging members 235F, 235G of the lower article transporting/storing apparatus 30, and when the upper article transporting/storing apparatus 30 is pressed in the direction indicated by the arrow C in the figure in this state, the upper article transporting/storing apparatus 30A can automatically be positioned against the lower article transporting/storing apparatus and placed at a specified position of the lower article transporting/storing apparatus 30. The situation is shown in FIG. 49. Also situations before and after the engagement section 239 is engaged with the guide section 240 are shown in FIG. 50 and FIG. 51.

Figure 50:
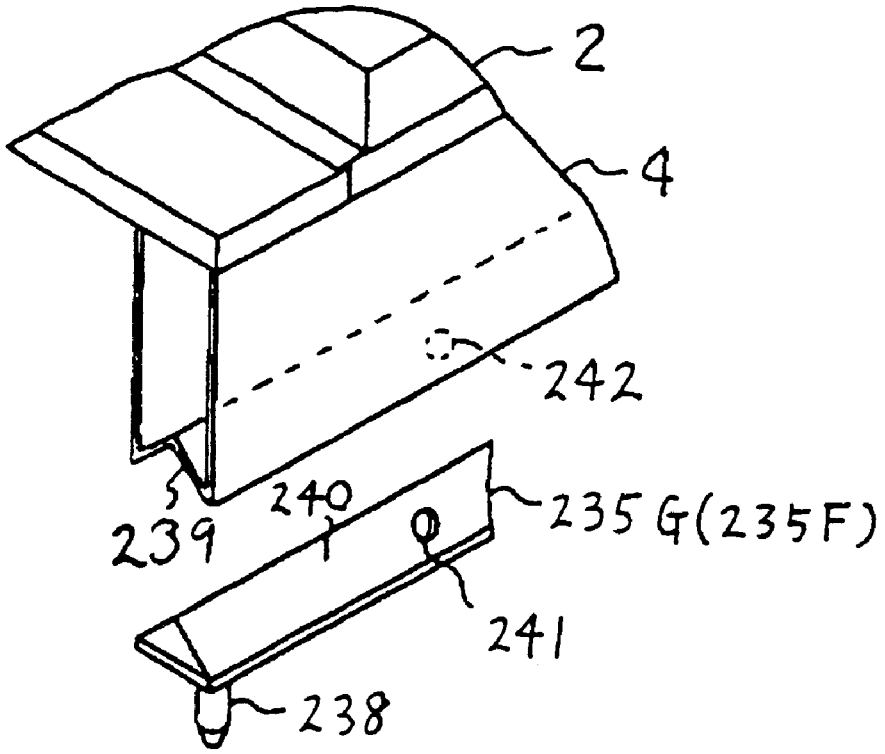
FIG. 50 is a perspective view showing a state where a engaging section of a leg section is engaged with the bridging member.
Figure 51:
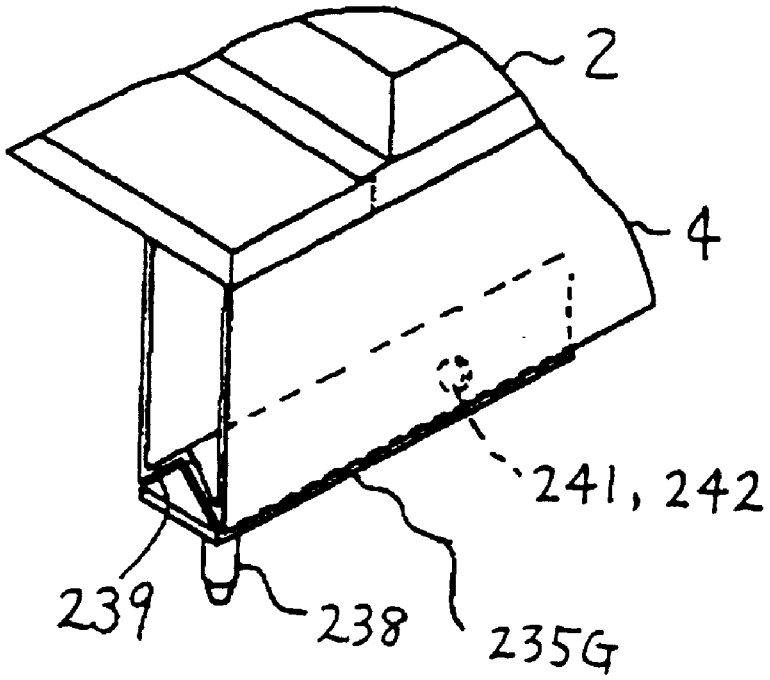
FIG. 51 is a perspective view showing a situation in which the engaging section has been engaged with the bridging member.

As understood from FIG. 50 and FIG. 51, when the engagement member 239 of the pallet 2 is engaged with the guide section formed by the bridging members 235F, 235G, even if positions of the upper and lower positions are displaced from each other, when the engagement section 239 is even slightly engaged with the guide section 240, the engagement section 239 is automatically engaged with the guide section 240 because of the weight of the upper article transporting/storing apparatus, so that the upper and lower article transporting/storing apparatuses can automatically and correctly be positioned to each other.

As described above, the work for loading the article transporting/storing apparatus onto another article transporting/storing apparatus can easily be carried out by using the bridging members 235F, 235G as a guide rail by sliding the engagement section 239 of the pallet 2 of the upper article transporting/storing apparatus 30A on the guide section 240 thereof, and loading the upper article transporting/storing apparatus 30A on the lower article transporting/storing apparatus 30. In addition, after loading, the upper article transporting/storing apparatus 30A can correctly be positioned above the lower article transporting/storing apparatus 30, more specifically along a lateral direction of the bridging members 235F, 235G, which improves safety thereof.

By the way, as the engagement section 239 can slide in the longitudinal direction of the bridging members 235F, 235G. when the article transporting/storing apparatuses are transported or stored, there is a possibility that the upper article transporting/storing apparatus 30A is displaced in the longitudinal direction of the bridging members 235F, 235G of the lower article transporting/storing apparatus 30.

Figure 52:
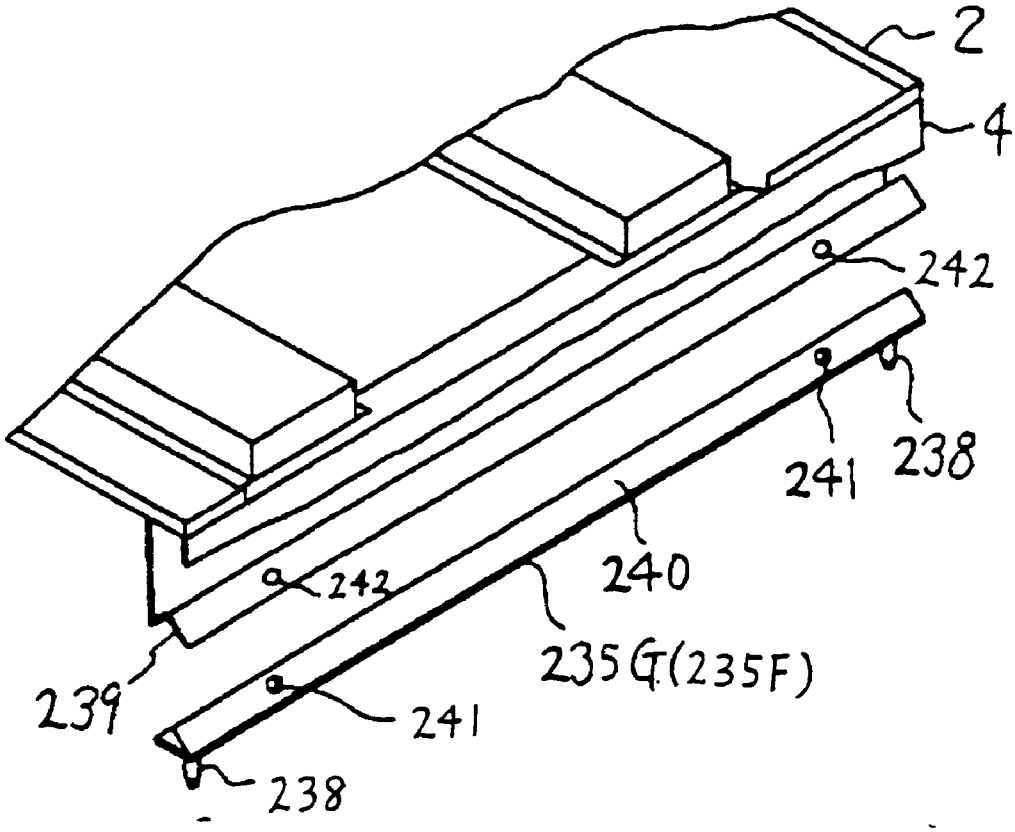
FIG. 52 is a perspective view showing the leg section and the bridging member.
Figure 53A:
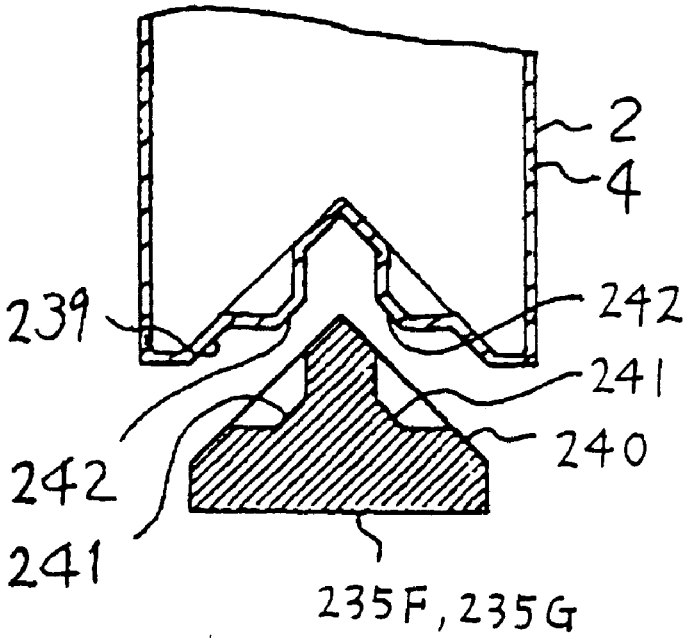
FIGS. 53A and 53B are cross-sections of a stopper unit.
Figure 53B:
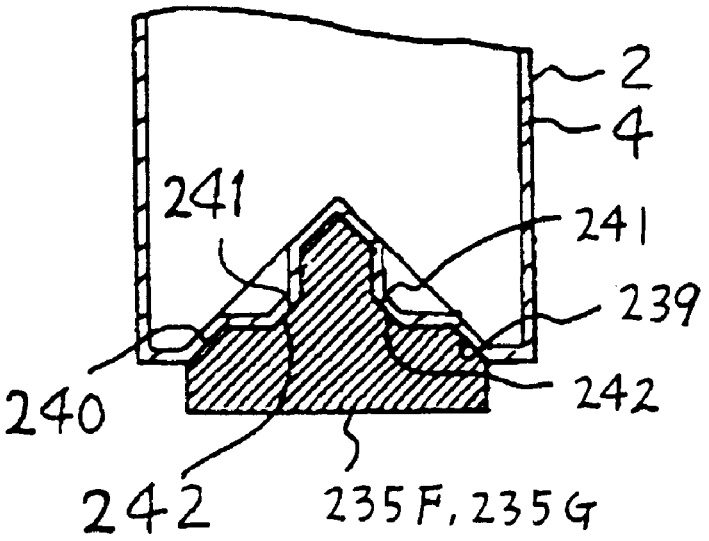

To overcome this problem, as shown in FIG. 50, FIG. 51, and in FIG. 52 in which a portion of the leg section 4 is shown in the broken state, an appropriate number of recessed sections 241 are formed in the bridging members 235F, 235G, while engagement projections 242 for engaging the recessed sections 241 are formed on the engagement section 239 of the leg section 4. FIG. 53A shows a state just before the engagement section 239 is engaged with the guide section 240. As shown in FIG. 53B, when the engagement section 239 is engaged with the guide section 240 and the upper article transporting/storing apparatus 30A is correctly positioned over the lower article transporting/storing apparatus 30, the engagement projections 242 provided in the engagement section 239 of the leg section 4 are engaged with the recessed sections 241 formed in the bridging members 235F, 235G. With this configuration, the pallet 2 of the upper article transporting/storing apparatus 30A does not slide in the longitudinal direction of the bridging members 235F, 235G of the lower article transporting/storing apparatus 30, so that the upper article transporting/storing apparatus 30A is prevented from displacing against the lower article transporting/storing apparatus 30.

Figure 54A:
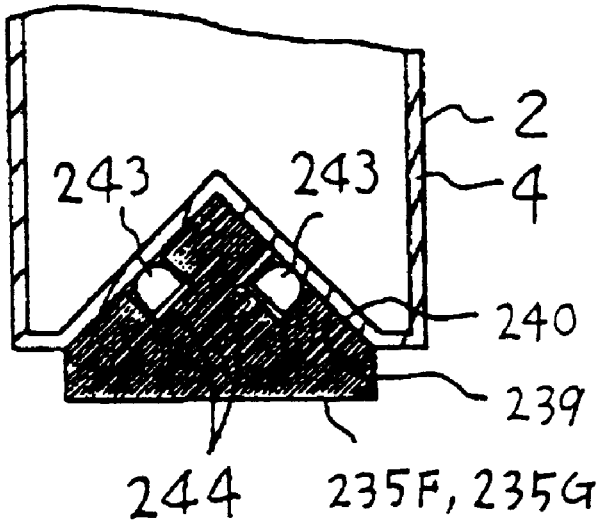
FIGS. 54A and 54B are cross-sections of another stopper unit.
Figure 54B:
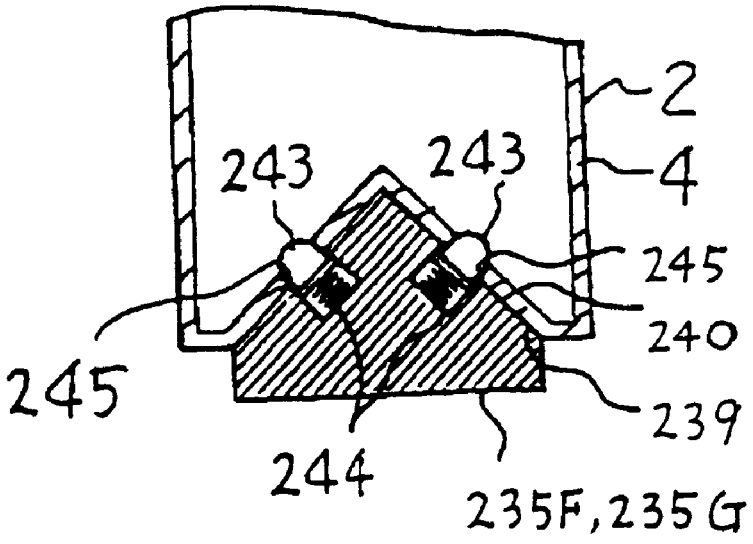

As described above, the recessed sections 241 and engagement projections 242 for engagement form a stopper unit for engaging the engagement section 239 of the pallet 2 with the bridging members 235F, 235G, but as the stopper unit, various types of stopper unit other than the one described above can be used. For example, the configuration is allowable in which engagement projections are provided in the bridging members 235F, 235G and recessed sections for engagement with the engagement projections are provided in the engagement section 239 of the leg section 4. Also the configuration as shown in FIG. 54A and FIG. 54B is allowable in which engagement holes 245 are formed in the engagement section 239 of the leg section 4, engagement pins 243 are buried in the grooves formed in the bridging members 235F, 235G, and the engagement pins 243 are energized upward by a compression spring 244. The engagement section 239 formed in the leg section 4 of the upper article transporting/storing apparatus engages with the guide section formed by the bridging members 235F, 235G of the lower article transporting/storing apparatus, but if the upper article transporting/storing apparatus is not correctly positioned over the lower article transporting/storing apparatus, as shown in FIG. 54A, the compression spring 244 is pressurized and compressed by the engagement section, and the engagement pins 243 go into the grooves. When the upper article transporting/storing apparatus is correctly positioned over the lower article transporting/storing apparatus, as shown in FIG. 54B, the engagement pins 243 get engaged into the engagement holes 245, and the engagement pints 243 go into the engagement holes 244 because of action of the compression spring 243 to achieve engagement between the engagement pins 243 and engagement holes 245. Thus, it is possible to prevent the upper article transporting/storing apparatus from displacing against the lower article transporting/storing apparatus.

As described above, the restricting unit 234 of the article transporting/storing apparatus shown in FIG. 47 to FIG. 54 has the bridging members 235F, 235G spanned over a plurality (two in the example in the figures) of supports 6 for coupling upper sections of the supports 6, and the bridging members 235F, 235G have a guide section with which the engagement section 23 of the pallet 2 of another article transporting/storing apparatus 30A placed thereon engages along the longitudinal direction of the bridging members 235F, 235G.

In the example shown in FIG. 47 to FIG. 54, the engagement section 239 and guide section 240 each have a reverse V-shaped cross section, but the present invention is not limited to the configuration described above, and so long as the engagement section 239 of the pallet 2 and one of guide sections 240 of the bridging members 235F, 235G have a convex form and the other guide section has a form allowing to slidably engage with the convex form above, the object of tight engagement can be achieved.

The article transporting/storing apparatus shown in FIG. 47 to FIG. 54 has a stopper unit for locking, when another article transporting/storing apparatus placed in the upper side occupies a specified position against the article transporting/storing apparatus located in the lower side, the engagement section 239 of the pallet 2 of the upper article transporting/storing apparatus 30A to the bridging members 235F, 235G each having the guide section 240 respectively, and with this configuration, the upper article transporting/storing apparatus 30A can correctly and non-moveably be positioned.

The configuration described above can be applied not only to the article transporting/storing apparatus having a support unit 34B according to the embodiment shown in FIG. 46 and FIG. 47, but also to the article transporting/storing apparatus having the support units 34, 34A shown in FIG. 42 to FIG. 45.

The bridging members 235, 235A, 235B, 235C, 235D, 235E, 235F, 235G of the restricting units 234, 234A, 234B described above are detachably attached to the supports 6, and when the bridging members are removed from the supports 6, the support unit can be folded as described above, but when the bridging members are removed from the supports 6 and the removed bridging members, pallet 2 with the support unit having been removed therefrom, and the folded support unit are transported, the bridging members may disturb smooth execution of the work.

Figure 55:
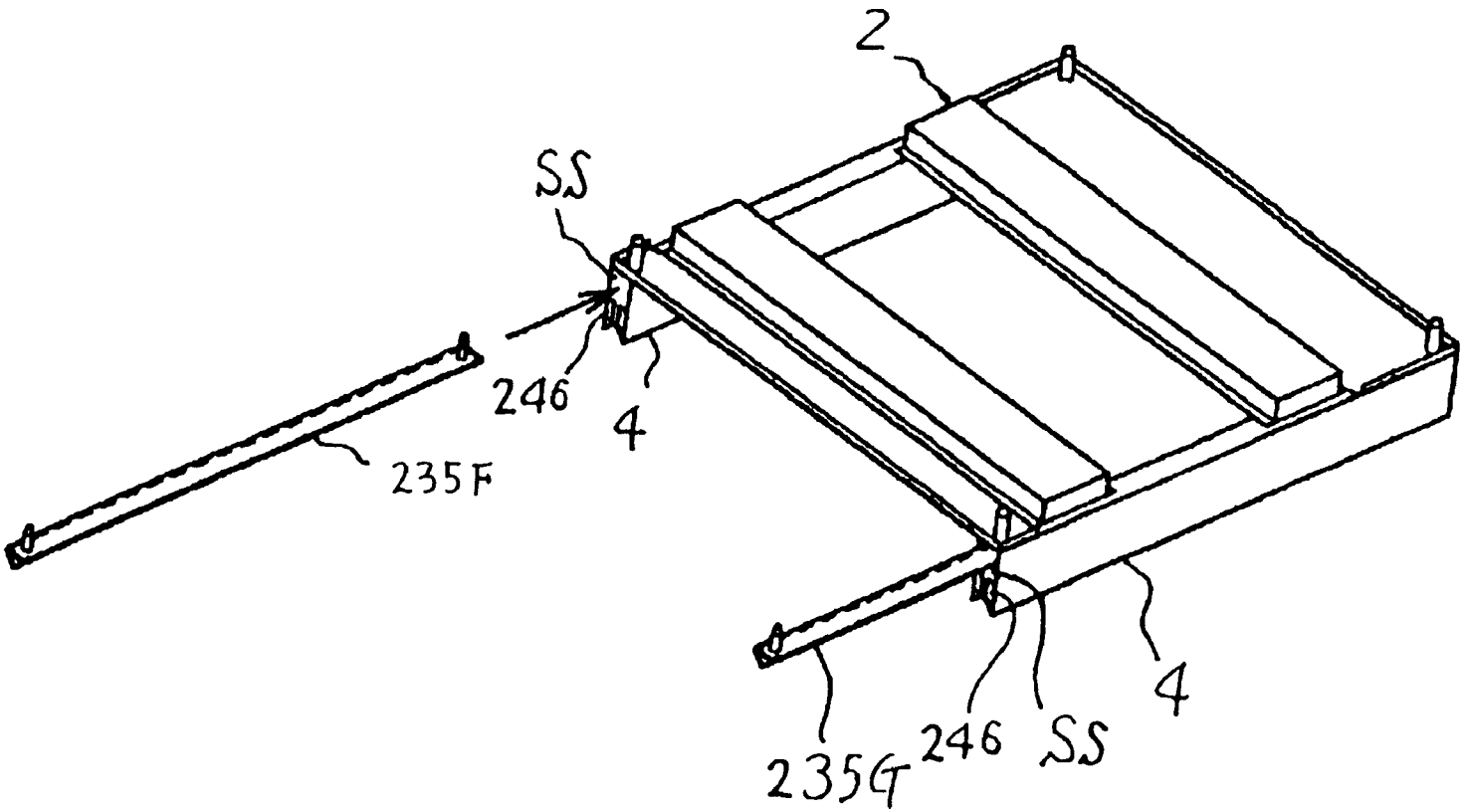
FIG. 55 is a perspective view showing a situation in which the bridging member is about to be accommodated on the pallet.
Figure 56:
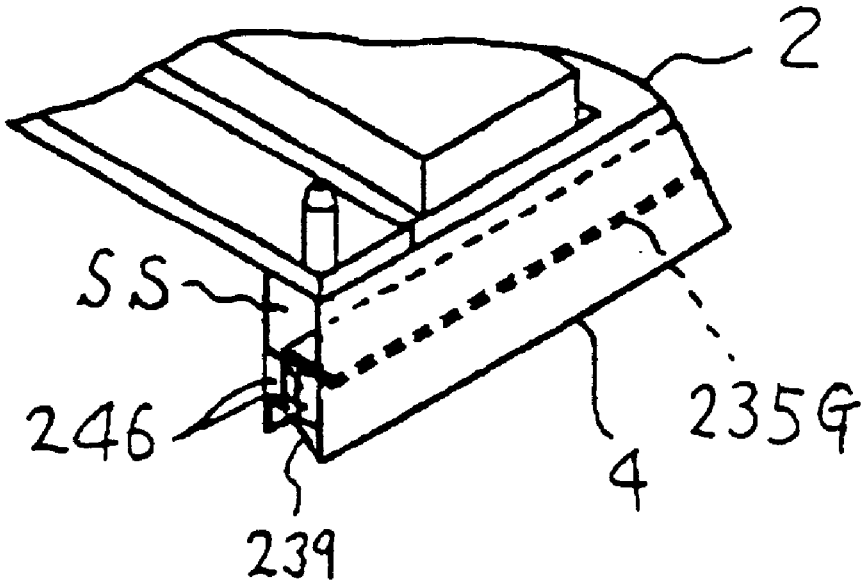
FIG. 56 is a perspective view showing a situation in which the bridging member has been accommodated on the pallet.

To overcome this problem, as shown in the example shown in FIG. 55 and FIG. 56, it is desirable to form a hollow section SS in the leg section 4 of the pallet 4 for accommodating the bridging members 235F, 235G removed from the supports 6 in the hollow section SS. When the bridging members are accommodated in the leg section 4 as shown in FIG. 56, the bridging members accommodated in the hollow section 33 are transported together with the pallet 2, it is advantageous to prevent the bridging members from going out of the hollow section SS by providing a stopper 246 for the bridging members formed by bending the leg section 4 at an opening of the hollow section of the leg section.

Also the other bridging members 235 and 235A to 235E can also be accommodated in the pallet 2 in the same way as in the example shown in FIG. 55 and FIG. 56.

When the pallet 2 has an accommodating section for accommodating restricting units removed from the supports 6 as described above, it is possible to prevent the restricting unit from disturbing smooth transportation thereof, and in addition, a specified number (two in the example shown in the figures) of restricting units can be accommodated in one pallet 2, and because of this feature there is also provided the advantage that a number of restricting units can be put under strict management.

As understood from the above description, each of the article transporting/storing apparatuses shown in FIG. 42 to FIG. 56 comprises the pallet 2 with the article 1 placed thereon, a plurality of supports 6 detachably attached to the pallet 2 so that the supports surround the article 1 placed on the pallet 2, a coupling unit for coupling two adjoining supports 6 to each other so that a space between the two adjoining supports can be adjusted, and a restricting unit for restricting, in the state where the plurality of supports are attached to the pallet, a distance between two adjoining supports by coupling upper sections of the supports 6 to each other.

More specifically, the article transporting/storing apparatus comprises the pallet 2 with the article 1 placed thereon, four supports detachably attached to the pallet 2 each in the substantially erected section against the article-loading surface 5 of the pallet 2, a coupling unit for coupling two adjoining supports to each other so that a space between the two adjoining supports located side by side can be adjusted, and a restricting unit for restricting a space, in the state where the four supports are attached to the pallet 2, between the two adjoining supports by coupling upper sections of the supports 6. In the example shown in FIG. 42 and FIG. 43, the first and second coupling members 14, 15 and first and second joints 8, 9 form the coupling unit, and in the example shown in FIG. 44 to FIG. 56, the first and second coupling members 14, 15 and first to third joints 8, 9, 26 form the coupling unit.

The coupling unit shown in FIG. 42 and FIG. 43 correlatively adjusts a space between two adjoining supports so that all spaces between two adjoining supports in each couple are changed at the same rate. With this configuration, it is possible to transport or store the articles having various sizes by selecting the article transporting/storing apparatus having a size suited to that of the article to be transported or stored.

The coupling unit shown in FIG. 44 to FIG. 56 correlatively adjusts a space between two adjoining supports so that a space between two adjoining supports located side by side on one edge of the pallet 2 and a space between two adjoining supports located side by side on another edge opposite to the former edge of the pallet 2 are changed at the same rate, and at the same time so that a space between two adjoining supports on one edge of the pallet and a space between two adjoining supports on another edge next to the former edge of the pallet are changed at the same rate. The coupling unit correlatively adjusts a space between two adjoining supports so that all of a space beaten two adjoining supports located side by side on one edge of the pallet 2, that between another couple of two adjoining supports located side by side on another edge opposite to the former edge of the pallet 2 and also that between still another couple of two adjoining supports located side by side on still another edge next to the first edge of the pallet 2 are changed at the same rate.

In any of the embodiments described above, the supports 6 detachably attached to the pallet 2 and a coupling unit for coupling two adjoining supports located side by side to each other form the support units 32, 32A each foldable when the supports are removed from the pallet 2, and because of this feature, the support unit removed from the pallet 2 can be stored in a small space or can easily be transported.

Also in any of the article transporting/storing apparatuses described above, the pallet 2 has a coupling member (engagement section 239 of the leg section 4 in the example shown in FIG. 47 to FIG. 56) provided in the side contrary to the article-loading surface 5 thereof, to which an upper section of another article transporting/storing apparatus is detachably attached, so that a plurality of article transporting/storing apparatuses can be piled up on each other.

Further in each of the article transporting/storing apparatuses described above, it is advantageous to detachably assemble the joints 8, 9 or joints 8, 9, 26 with each support 6. For instance, in a case of the article transporting/storing apparatus shown in FIG. 42, the second joint 9 is fixed with a removable screw to the support 6, and the first and second joints 8, 9 can be separated from each support 6 as shown in FIG. 32 by removing the screw.

With the configuration as described above, even if any component of the article transporting/storing apparatus, for instance, one of the supports 6 is damages an the support 6 is to be exchanged for a new one, the support 6 can easily be exchanged for a new one by removing the support 6 from the pallet 2. Also when the article transporting/storing apparatus is to be abolished, the supports and joints can easily be disassembled from each other and disposed discretely. Therefore, it is especially desirable that the first and second coupling members 14, 15 can be separated from the joints and further the coupling members 14, 15 can be separated from each other.

Figure 57:
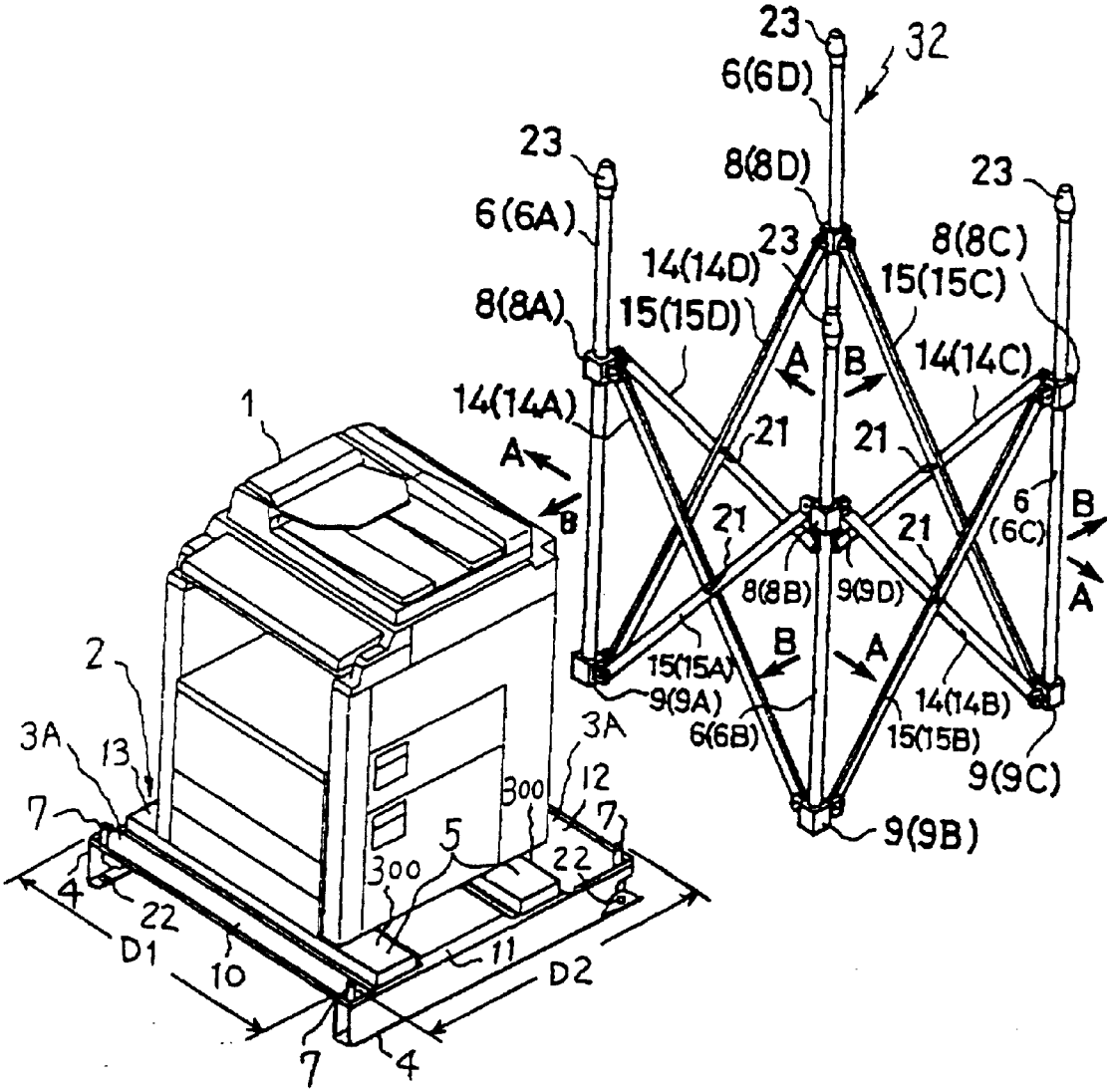
FIG. 57 is a perspective view showing an example of the article transporting/storing apparatus.

FIG. 57 shows a perspective view showing another example of the article transporting/storing apparatus according to the present invention. The article transporting/storing apparatus shown in this figure has basically the same configuration as that of the article transporting/storing apparatus shown in FIG. 1, but the article transporting/storing apparatus has a plurality of (two in the figure) base members 300 each fixed to each leg section 4 in the state where the base member is spanned over the two leg sections 4 of the pallet 2 and two reinforcing members 3A fixed to the two leg sections 4 respectively, and a top surface of the base member 300 functions as the article-loading surface 5. Herein, the cover 31 is not shown.

The pallet 2 is made form a metal plate such as a steel plate, but such materials with high rigidity as wood or hard resin may be used for constructing the pallet. The base member 300 and reinforcing member 3A may be fixed to the leg sections 4 by means of welding or with adhesive, but may be fixed thereto with a screw or other appropriate material not shown herein so that the components can easily be disassembled from each other. Further, as described later, one or more base members can be position-adjustably fixed to a main body of the pallet 2 including the leg sections 4. Also a pallet comprising a rectangular and flat plate with an appropriate number of leg sections fixed thereto or a pallet having other form may be used. Also a pallet having various forms other than a square one may be used.

Figure 58:
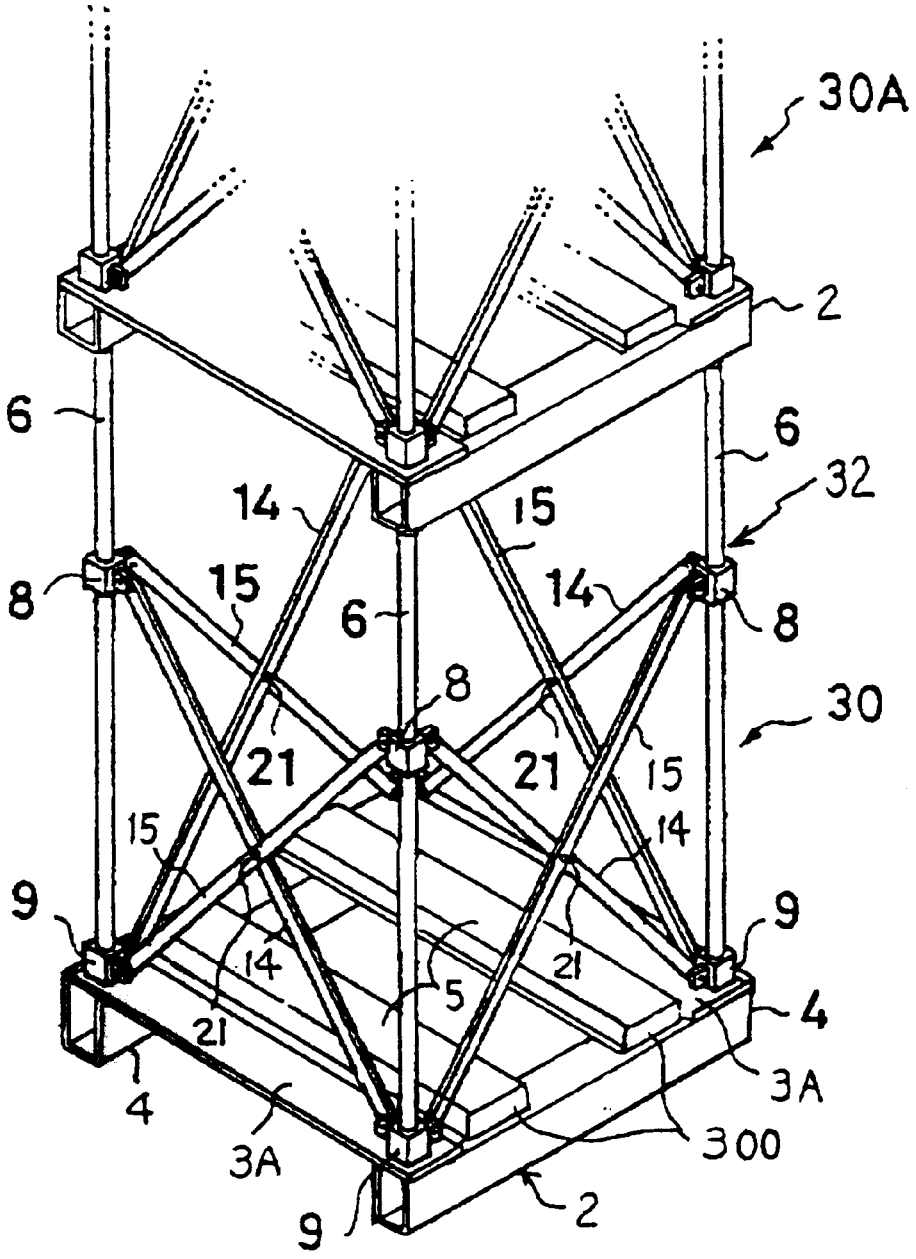
FIG. 58 is a perspective view showing a situation in which the article transporting/storing apparatus shown in FIG. 57 is assembled and a plurality of them are piled up on each other.

Further the article transporting/storing apparatus has a plurality of supports, more specifically four supports in the case shown in FIG. 57, and as shown in FIG. 58, in the state where the supports are detachably attached to the pallet 2 at four corners thereof each in the substantially erected sate against the article-loading surface of the pallet 2. Considering a square above the pallet 2, the four supports 6 are attached to four corners of the pallet 2 in the erected posture respectively.

Figure 59:
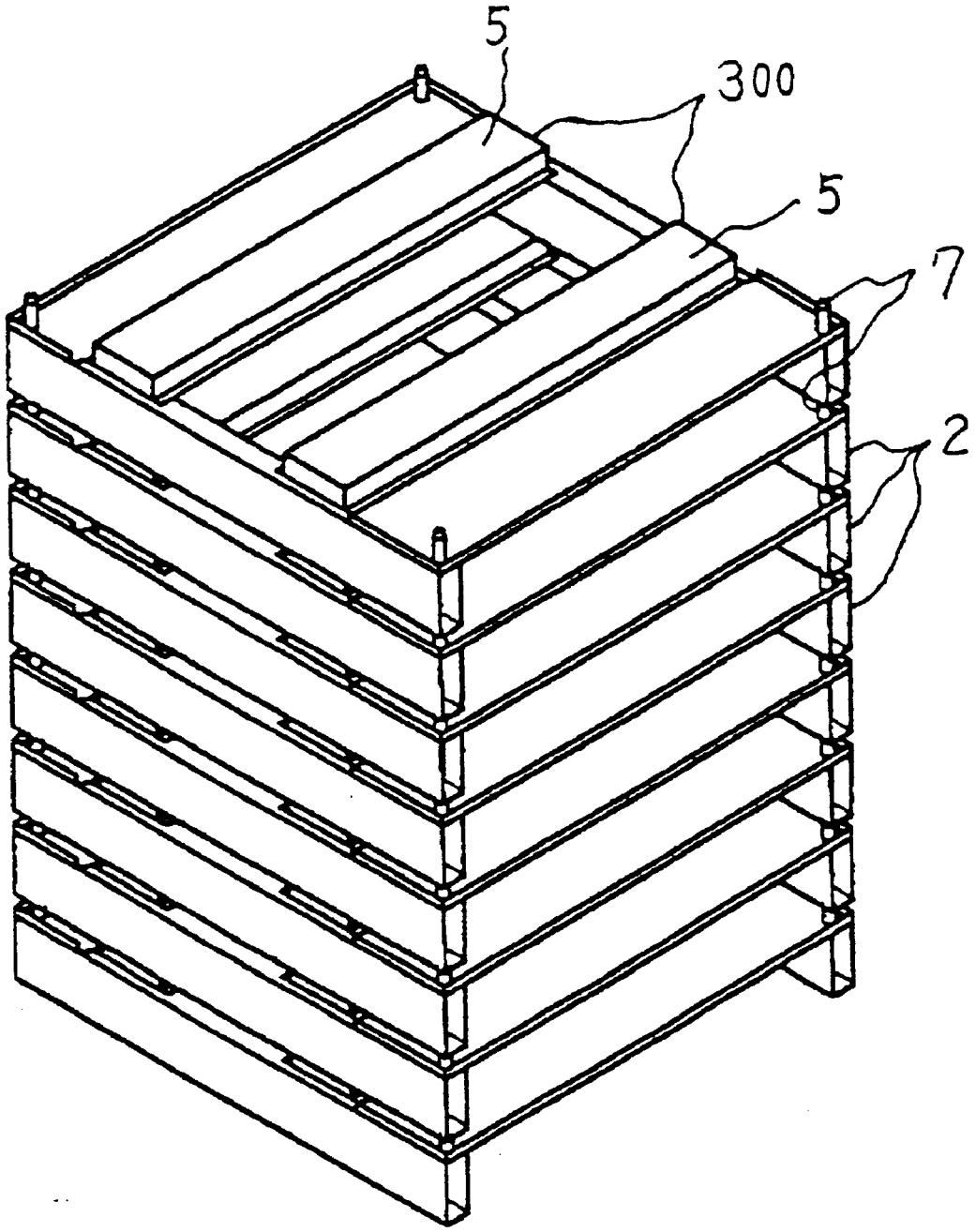
FIG. 59 is a perspective view showing a situation in which the pallets shown in FIG. 57 have been piled up on each other.

Also in the article transporting/storing apparatus shown in FIG. 57, the pallets 2 can be piled up on each other and stored in the state as shown in FIG. 59. In this step, by engaging the projections formed on the pallet 2 with the engagement holes 22 (See FIG. 57) of the pallet located in the upper side respectively, it is possible to correctly position the pallets against each other. As described above, the support unit 32 and the pallet 2 can be used repeatedly, and components to be abolished at the destination of transportation like in a case of article transporting/storing apparatus made from corrugated board or the like can be eliminated or reduced.

Figure 60A:
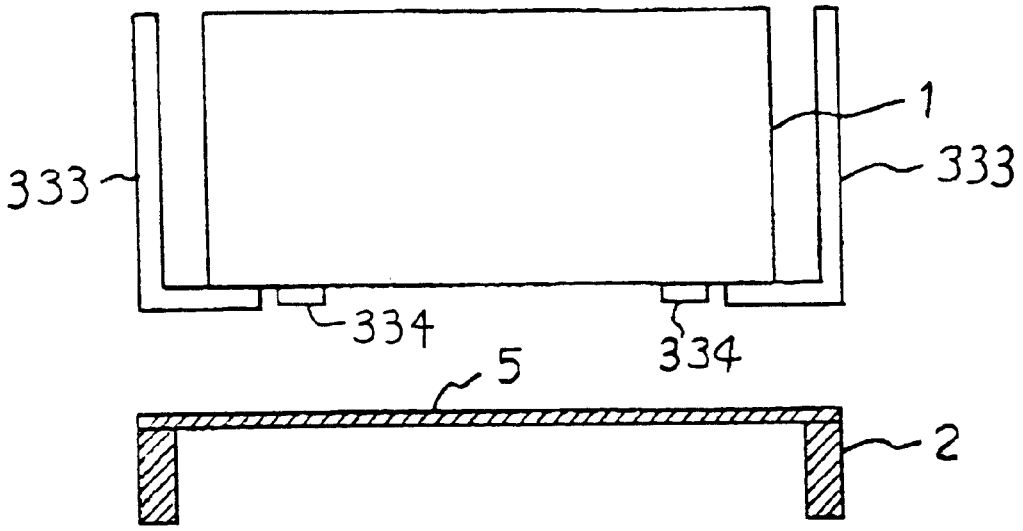
FIGS. 60A and 60B are explanatory views explaining occurrence of a trouble when a step is not provided on the pallet.
Figure 60B:
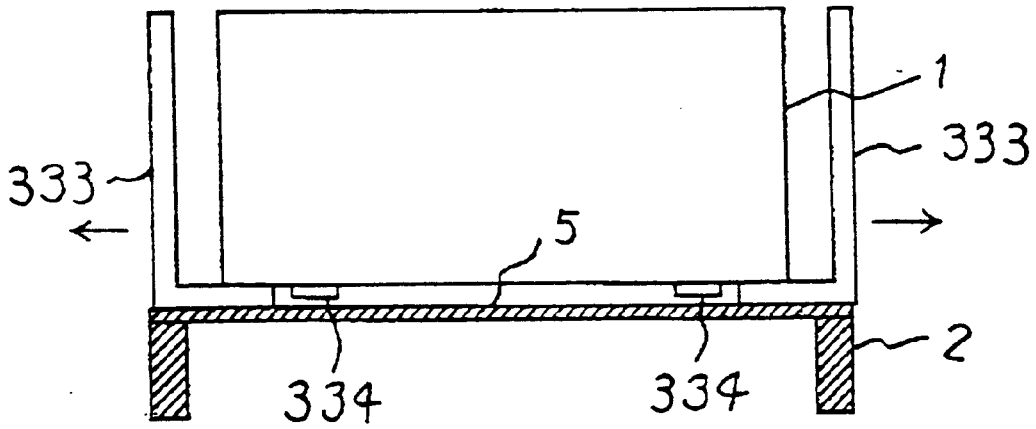

By the way, the article 1 such as a copying machine transported with an article transporting/storing apparatus is usually loaded onto or unloaded from the article-loading surface 5 of the pallet 2 with a fork lift or a robot chuck apparatus or the like prepared in a plant. FIG. 60A and FIG. 60B each show a situation in which the article 1 comprising a copying machine is held by a check 33 of a robot chuck apparatus as an article supporting member, the check is lowered, and the article 1 is loaded onto the article-loading surface 5 of the pallet 2. In the case shown in the figures, when the chuck 33 strikes a top surface of the pallet 2, a bottom section of the article 1, legs of the copying machine in this case are still above the top surface of the pallet 2. Therefore, if the chuck is forcibly pulled away in the direction indicated by the arrow in the figure, the article 1 drops to the top surface of the pallet 2, and a large impact may be given to the article 1.

Figure 61:
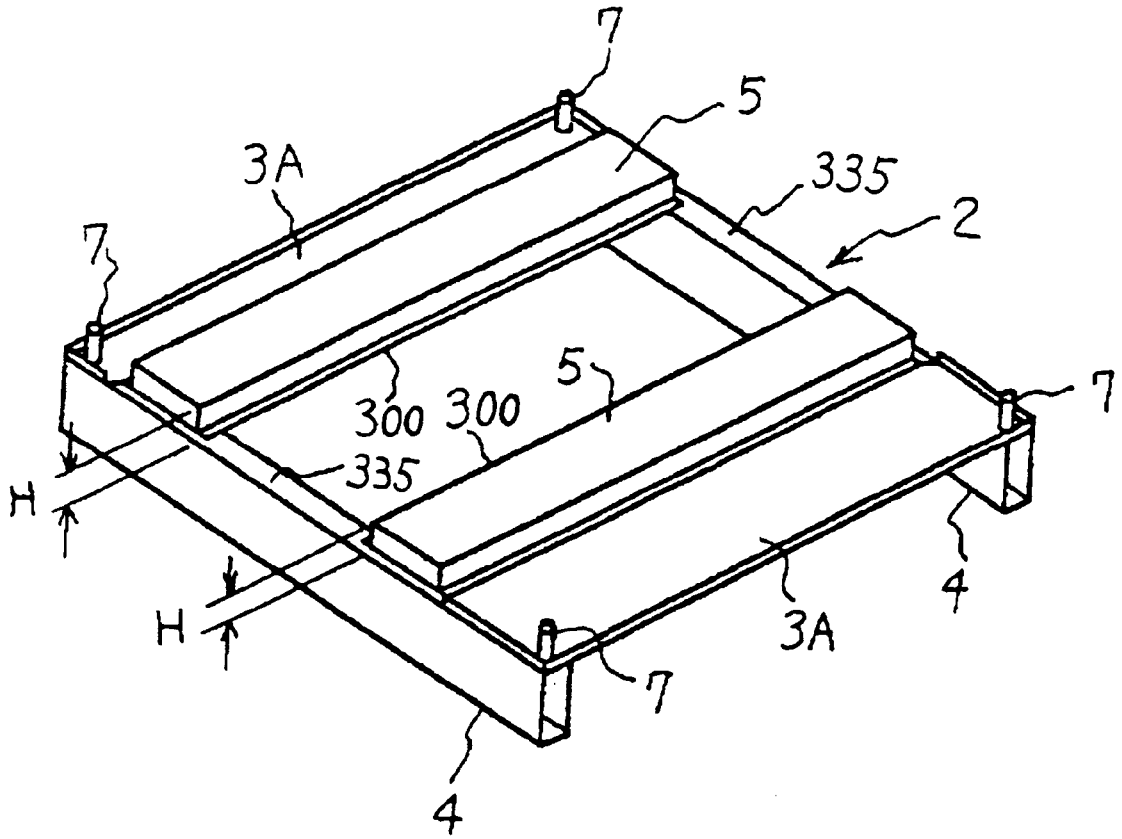
FIG. 61 is a perspective view showing the single pallet.

FIG. 61 is a perspective view showing the single pallet 2 shown in FIG. 57, and with this pallet 2, the trouble described above does not occur. The pallet 2 has two leg sections 4 and base member 300 fixed thereto, and a top surface of the base member 300 functions as the article-loading surface 5. With this configuration, a step H is formed between the article-loading surface 5 of the pallet 2 and at least a portion of the pallet other than the article-loading surface thereof, top surfaces 335 of the two leg sections 4 between the two base members 300 in the example shown in the figure is formed. Height of the step H is larger than thickness of the chuck 33 of the robot chuck apparatus (See FIG. 62) or a fork of a forklift. With this configuration, when the pallet 2 is placed in the horizontal posture and the article 1 is placed on the article-loading surface of the pallet 2, a clearance G into which an article holding member of an article loading/unloading apparatus such as a robot chuck apparatus or a fork lift, namely the chuck 333 or a fork thereof can be inserted is formed top surfaces 335 of the leg sections 4 as a portion of the pallet 2 and the article 1 thereabove. The height of the step H is set so that the clearance G as described can be formed there.

Figure 62A:
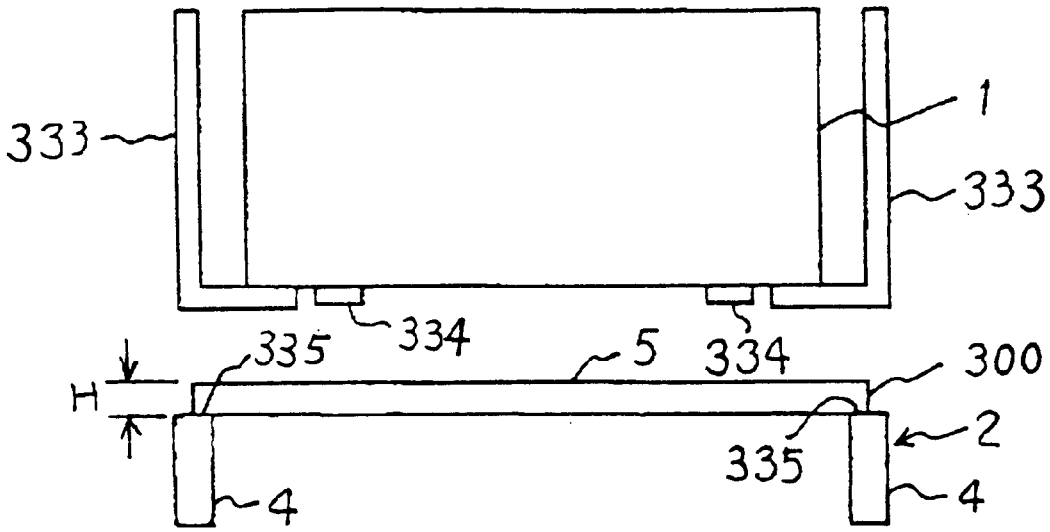
FIGS. 62A and 62B are explanatory view showing a situation in which an article is being loaded on the pallet with a robot chuck device.
Figure 62B:
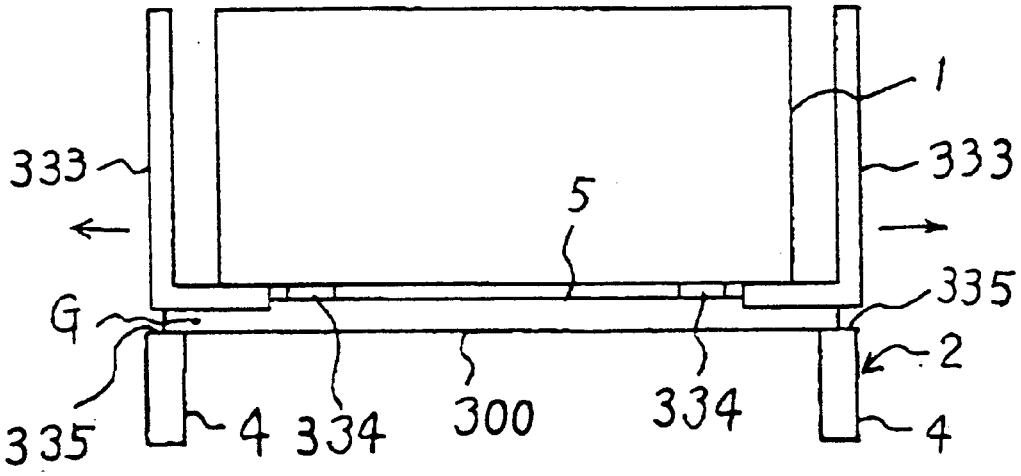
Figure 63:
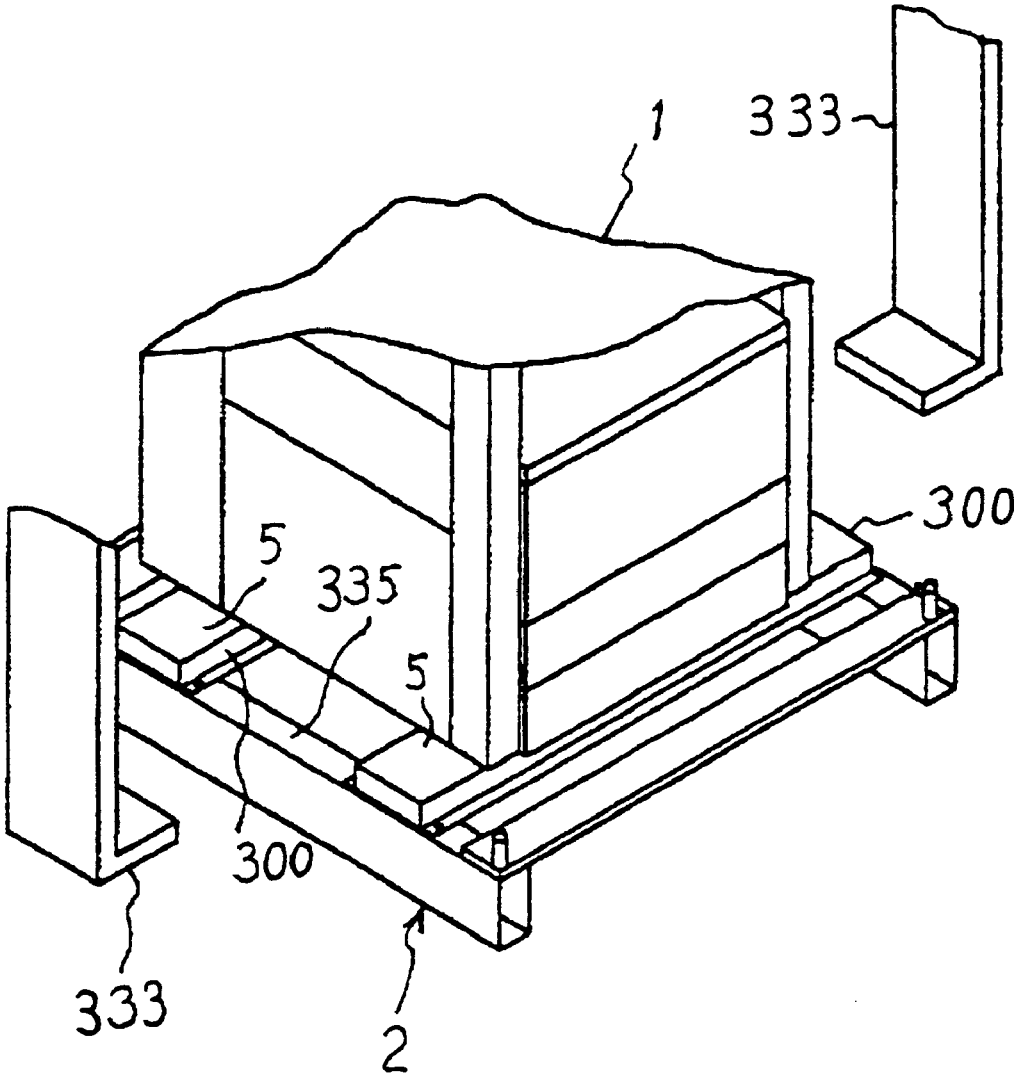
FIG. 63 is a perspective view showing a situation in which an article is loaded on the pallet with a robot chuck device.
Figure 64:
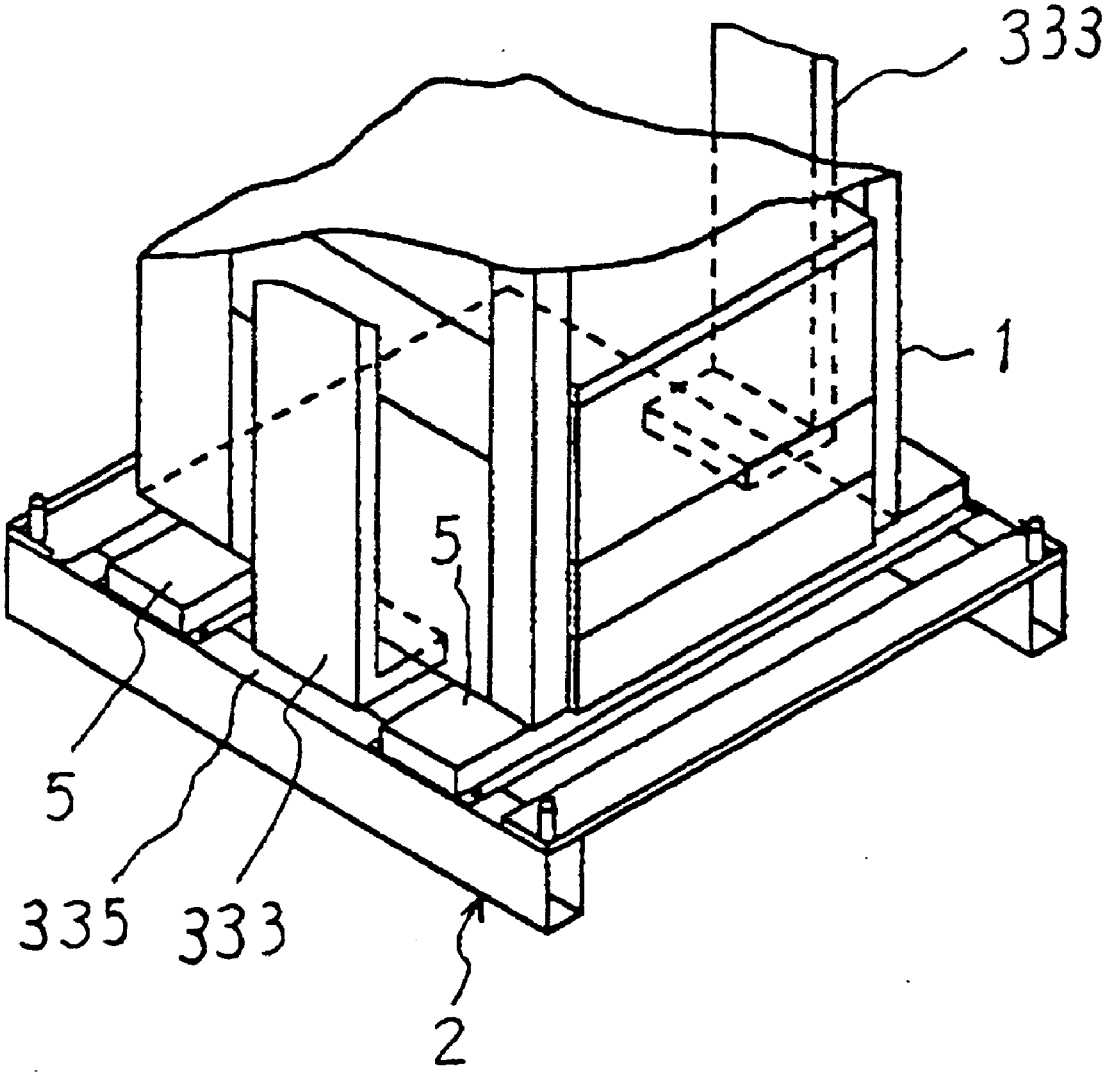
FIG. 64 is a perspective view showing a situation in which an article is loaded on the pallet with a robot chuck device.

As shown in FIG. 62A, when a lower side face of the article 1 is held by a pair of checks 333 of a robot chuck apparatus installed in a plant and the article 1 is placed on the article-loading surface 5 of the pallet 2 by lowering the article 1, the chuck 333 is positioned in the clearance G between the article 1 and upper faces 335 of the leg sections 4 in the state where the legs 334 of the article 1 are placed on the article-loading surface 5. Thus, when the chuck 333 is moved in the direction indicated by the arrow in the figure, the chuck 33 can be pulled out from the clearance G without giving large impact to the article 1. By operating the chuck 333 in the reverse sequence, the chuck 333 can be inserted into the clearance G to move the article 1 upward from the article-loading surface 5 of the pallet 2 without giving any large impact to the article 1. FIG. 63 and FIG. 64 are perspective views each showing a situation in which the article 1 is loaded onto or unloaded from the pallet 2 as described above. The article 1 can also be loaded onto or unloaded from the pallet 2 smoothly with a forklift.

FIG. 65 to FIG. 69 show examples of the pallet 2 each having configuration different from that of the pallet 2 shown in FIG. 57 to FIG. 61, but the basic configuration thereof is not different from that of the pallet 2 shown in FIG. 57. Namely in a case of the pallet 2 shown in FIG. 65 to FIG. 69, lower sections of the supports 6 of the support units 32, 32A are engaged with the projections 7 provided thereon to form an article transporting/storing apparatus, and the article transporting/storing apparatus is used in the same way as described above. Also in a case of the pallet 2 shown in FIG. 65 to FIG. 69, after the-support units 32, 32A are removed from the pallet 2, the pallets 2 are piled up on each other with the projections 7 provided in the lower pallet 2 engaged with the engagement holes 22 provided in the upper pallet 2, thus the pallets 2 can be positioned over each other.

Figure 65:
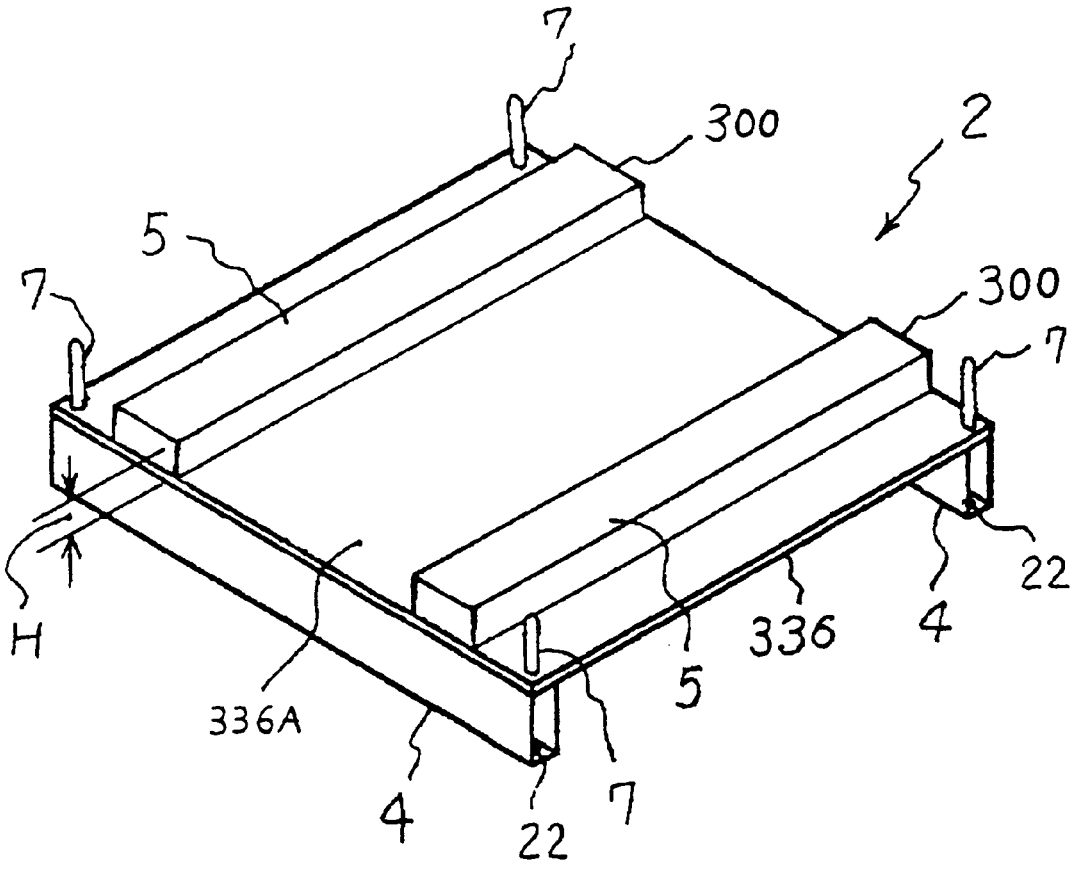
FIG. 65 is a perspective view showing another example of the pallet.

In the example shown in FIG. 65, the pallet 2 comprises a pair of leg sections 4, a flat board 336 fixed to the leg sections 4, and a pair of base members 300 fixed to a top surface of the flat board 336, and a top surface of the base member 300 plays a role of the article-loading surface 5. Also in the example shown in FIG. 66, top surfaces of a pair of base members 300 fixed to a pair of leg sections 4 constitute the article-loading surface 5 for an article to be placed thereon, and a base member 337 between the two article-loading surfaces of the base members 300 is lower than the article-loading surfaces 5. Also in the examples described above, a step H is formed between the article-loading surface 5 and at least a portion of the pallet other than the article-loading surface (a top surface of the board 336A between the two base members 300 in FIG. 65 and the base member 337 in FIG. 66) is formed. Height of the step H is set so that, when the pallet 2 is placed in the horizontal posture and an article is placed on the article-loading surface 5 thereof, a clearance into which an article holding member of the article loading/unloading apparatus can be inserted is formed. Thus, the completely same effects and actions as those of the pallet 2 shown in FIG. 61 to FIG. 64 can be achieved.

Also in a case where an entire top surface of the pallet 2 is covered by the board 336 as shown in FIG. 65, by providing the base member 300, it is possible to form a clearance into which a chuck or a fork can be inserted between the article placed on the article-loading surface 5 and a top surface of the board 336A, thus the trouble explained with respect to FIG. 6A does not arise.

Figure 66:
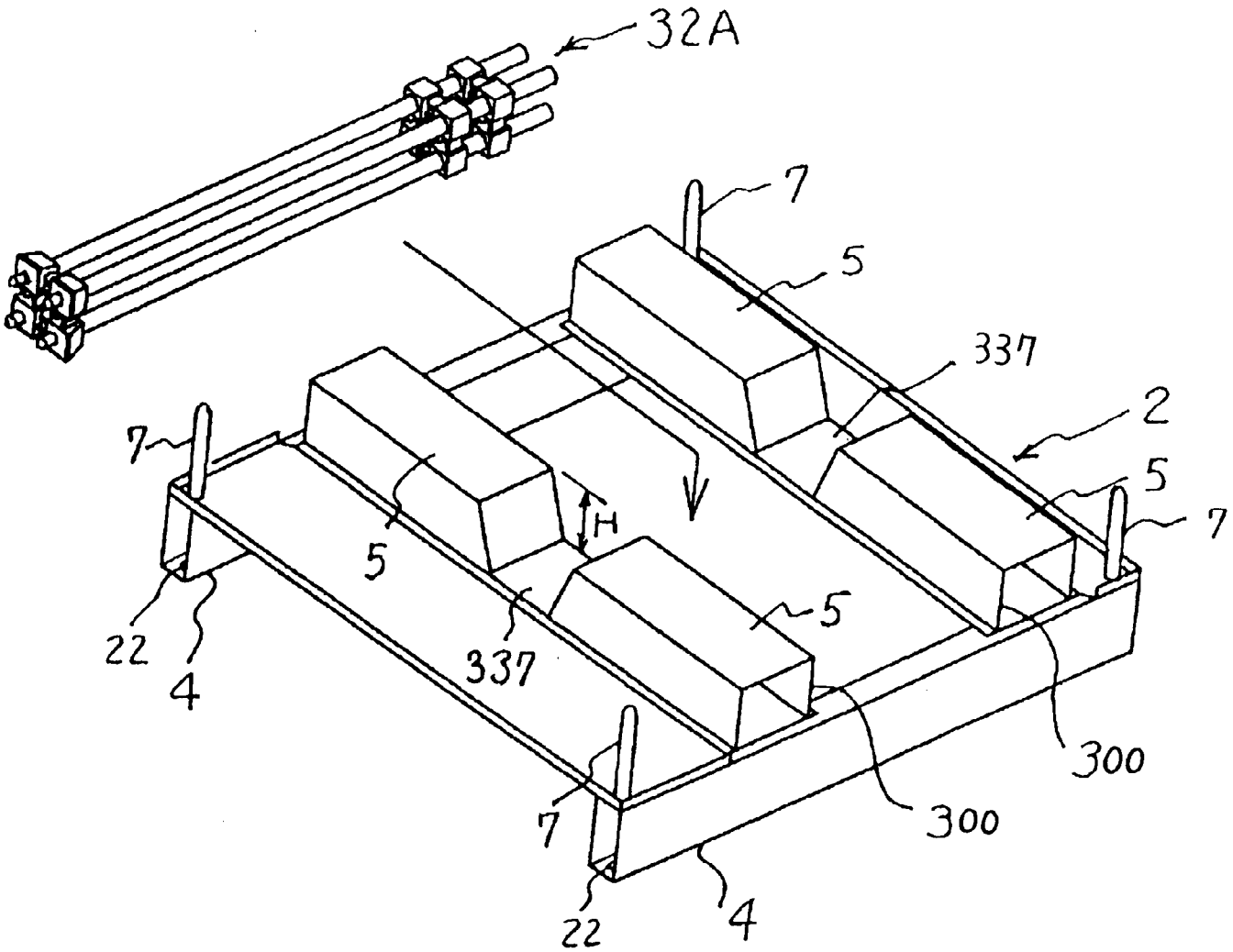
FIG. 66 is a perspective view showing still another example of the pallet.
Figure 67:
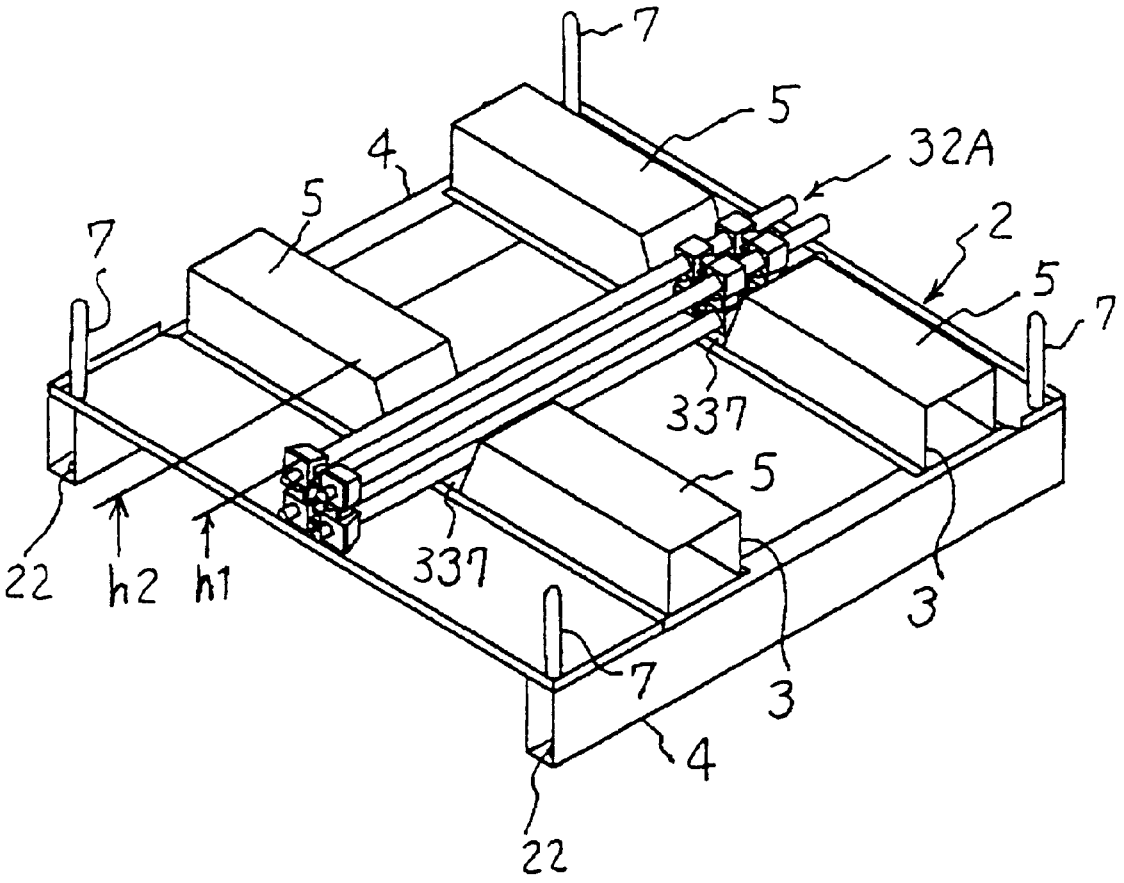
FIG. 67 is a perspective view showing a situation in which the support unit has been accommodated on the pallet shown in FIG. 66.

In the pallet 2 shown in FIG. 66, the folded support units 32, 32A can be accommodated in the portion of the pallet 2 described above, namely in the base member section 337. Height of the step H is set so that, in the state where the pallet 2 shown in FIG. 66 is placed in the horizontal posture, when the folded support unit 32A is accommodated in the horizontal posture in the base member section 337 between the two article-loading surfaces of the base members 300 as shown in FIG. 67, height h1 of the support unit 32A from the horizontal surface is lower than height h2 of the article-loading surface 5 from the same horizontal surface. With this configuration, for instance, when the article transporting/storing apparatus is stored in a warehouse or is returned back after the article 1 is delivered to the customer, the support unit 32A and pallet 2 are separated from each other, the article transporting/storing apparatus can conveniently be stored or returned by accommodating the folded support unit 32A on the base member section 337. In addition, even when a number of pallets 2 are piled up on each other as shown in FIG. 59, the piled-up pallets are not disturbed by the support unit 32A accommodated therein. As described above, by accommodating the support unit 32A in the pallet 2, management of the pallet 2 and support unit 32A becomes easier, and also loss of the support unit 32A is prevented.

FIG. 66 and FIG. 67 each show the support unit 32A also shown in FIG. 8, but also the support unit 32 shown in FIG. 5 can be accommodated in the base member section 337 completely as described above. In FIG. 66 and FIG. 67, a coupling member of the support unit 32A is not shown.

Figure 68:
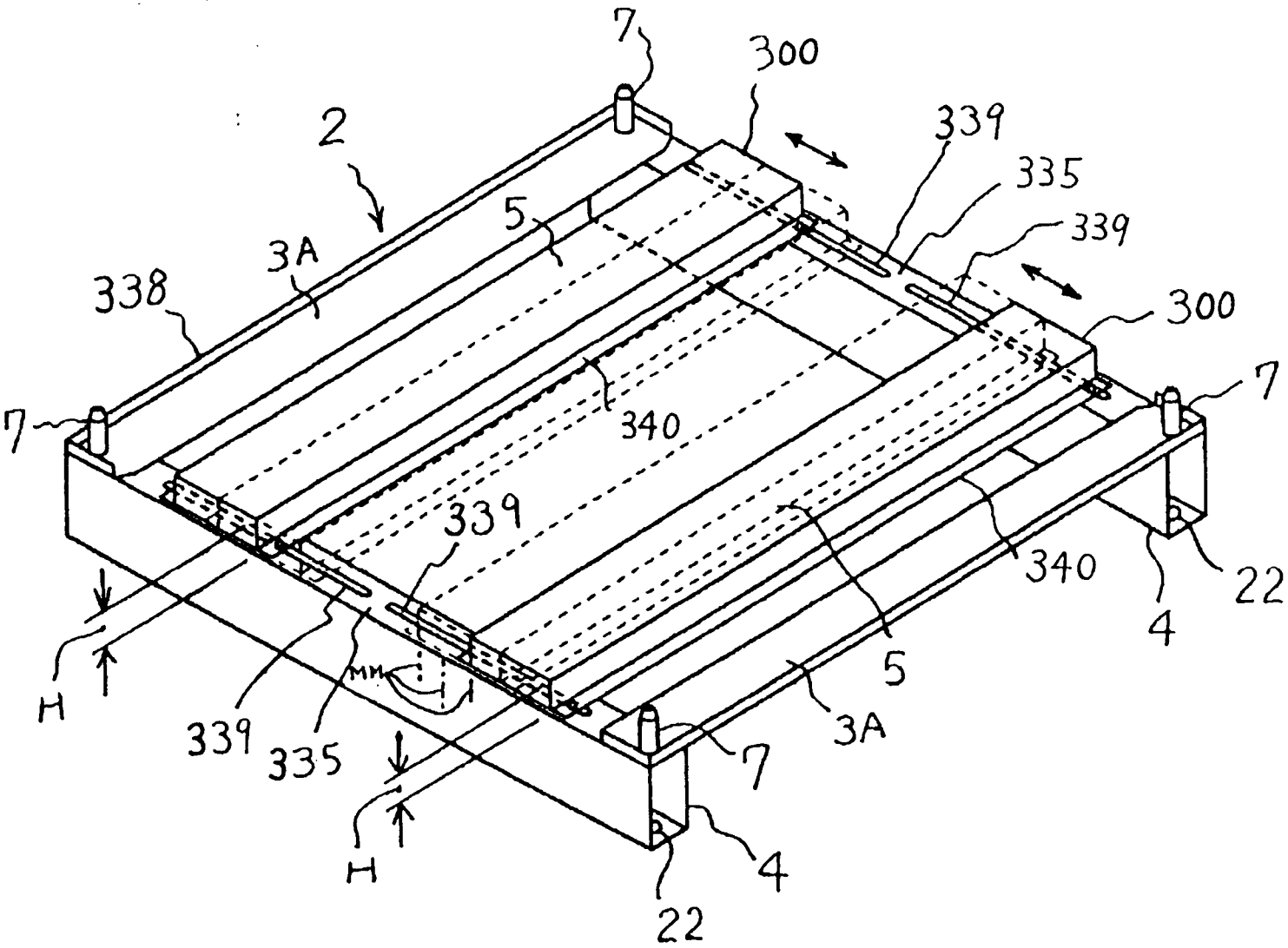
FIG. 68 is a perspective view showing still another example of the pallet.
Figure 69:
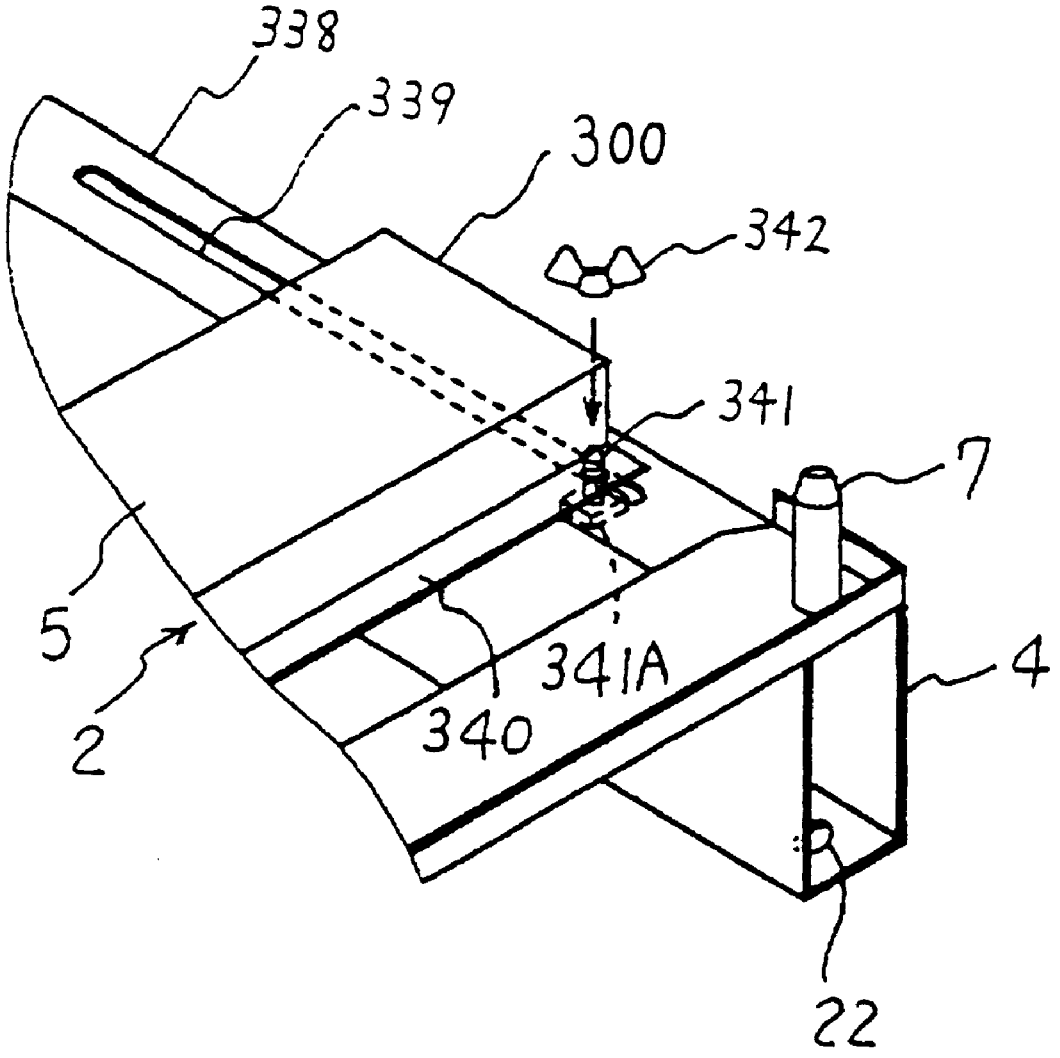
FIG. 69 is a partially enlarged view of the pallet shown in FIG. 68.

Also the pallet 2 shown in FIG. 68 and FIG. 69 has two leg sections 4, a pair of base members 330 spanned over the two leg sections, and reinforcing members 3A fixed to the two leg sections, and a step H is formed between the article-loading surface 5 comprising a top surface of the base member 300 and at least a portion of the pallet 2 other than the article-loading section 5, namely a top surface 335 of the leg section, and height of the step H is set like that of the step H shown in FIG. 61 to FIG. 65 or in FIG. 66 and FIG. 67.

The pallet 2 shown in FIG. 68 and FIG. 69 is different in the following points from the pallet 2 described above. Assuming that a section of the pallet 2 other than the base member 300 is called the main body 338 of the pallet 2, the article-loading surface is formed in the base member 300 fixed to the basic body 338 of the pallet so that the article-loading surface 5 can be positioned against the main body 338 of the pallet 2. In this example, long holes 339 extending in the longitudinal direction are formed on upper walls of the leg sections 4, and as clearly shown in FIG. 69, bolts 341 are inserted into through-holes formed at four sections of a flange section 340 of each base member 300 so that the bolts can move in the longitudinal direction of the hole holes 339 with nuts 342 set on the bolts 341. A head section 341A of each bolt 341 is located in the inner side from the leg section 4, and a width of the head section 341A is larger than that of the long hole 339.

When each of the nuts 342 is loosened, the base member 300 can be moved against the main body 338 of the pallet in the direction indicated by the arrows in FIG. 68. After the base member 300 is set at a desired position, for instance at the position indicated by a dashed line in FIG. 68, the base member 300 can be fixed to the main body 338 of the pallet at that position. With this configuration, a position of the base member 300 against the main body 338 of the pallet can be adjusted according to a size of an article placed on the article-loading surface 5, and articles having various sizes can efficiently be loaded on the article-loading surface 5.

Also in order to easily and accurately decide a position of the base member 300, a marker MM indicating the position may be formed on the leg section 4, or a seal displaying the marker MM may be adhered on the leg section 4.

Detailed description is made below with reference to FIG. 70 to FIG. 86 for another examples in which the folded support units 32, 32A can be assembled with and accommodated in the pallet 2.

Figure 70:
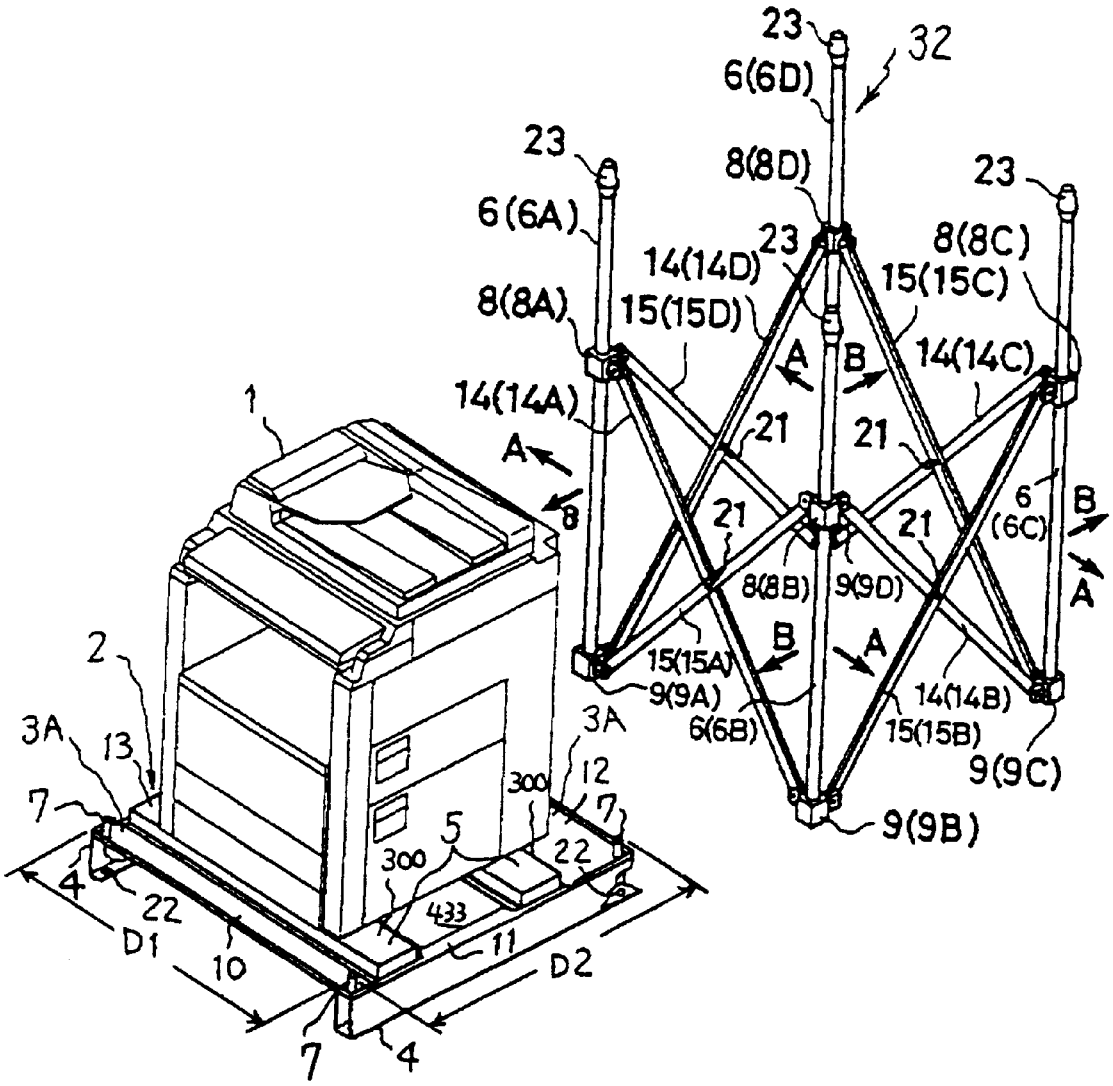
FIG. 70 is a perspective view showing an example of the article transporting/storing apparatus.
Figure 71:
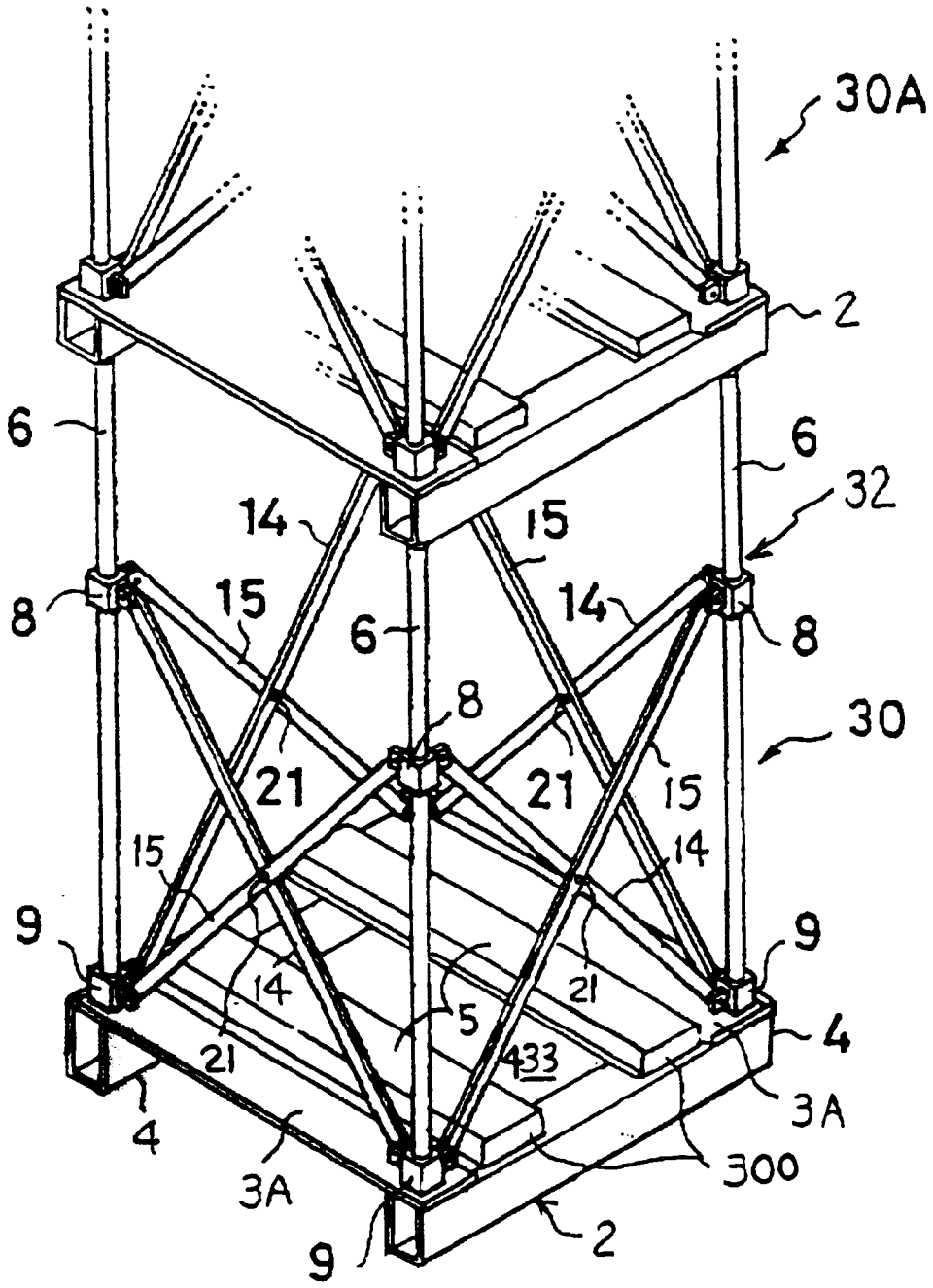
FIG. 71 is a perspective view showing a situation in which the article transporting/storing apparatus shown in FIG. 70 is assembled and a plurality of them are piled up on each other.
Figure 72:
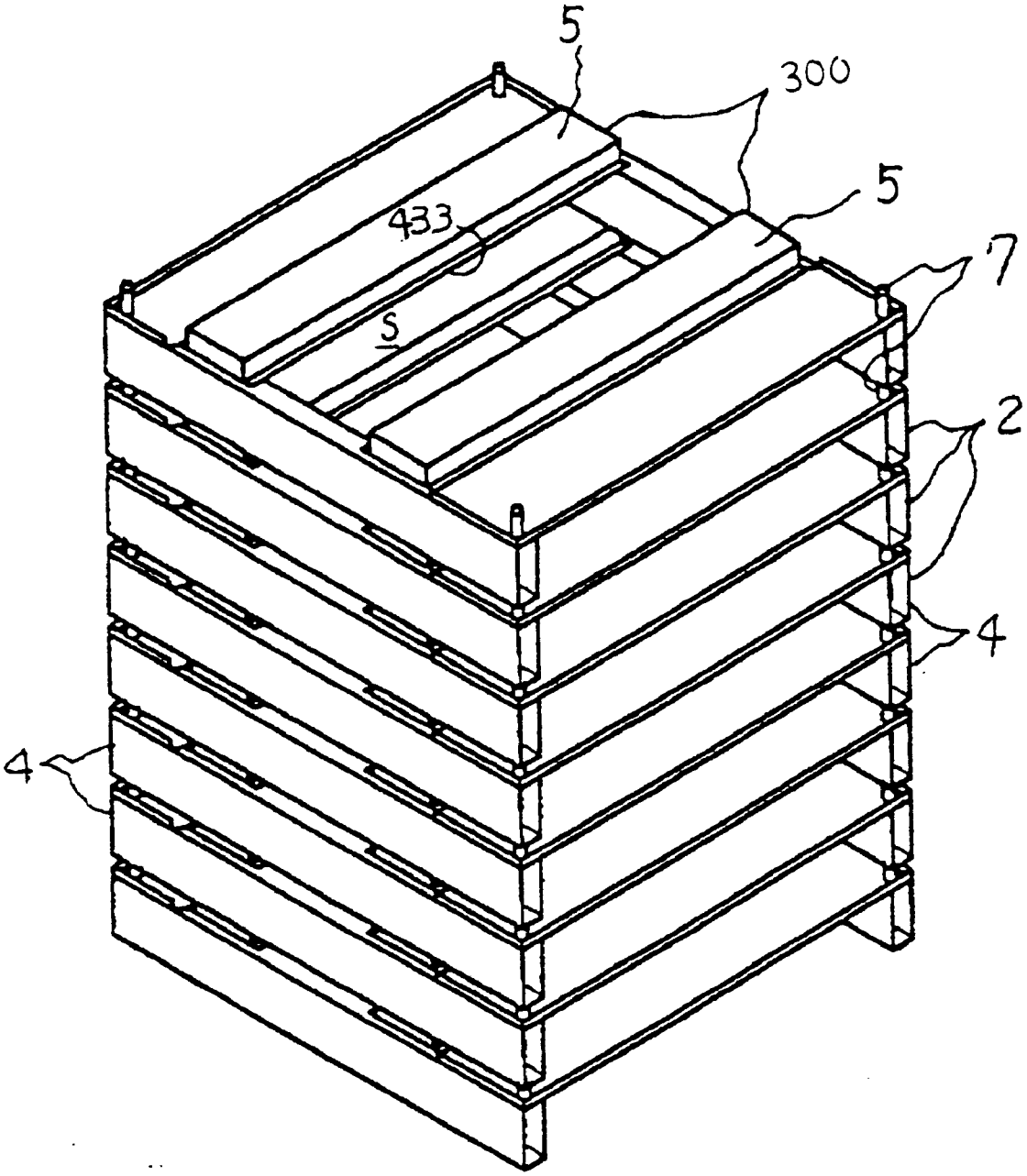
FIG. 72 is a perspective view showing a situation in which the pallets shown in FIG. 1 have been piled up on each other and accommodated.

FIG. 70 to FIG. 72 show views each of the same configuration as that in FIG. 57 to FIG. 59 respectively. However, the opening 433 is formed herein by the two leg sections 4 and two base members 300 at the central section of the pallet 2. When the pallets 2 described above are piled up on each other as shown in FIG. 72, a vertically penetrating space S is formed inside the pallets due to the opening 433.

Figure 73:
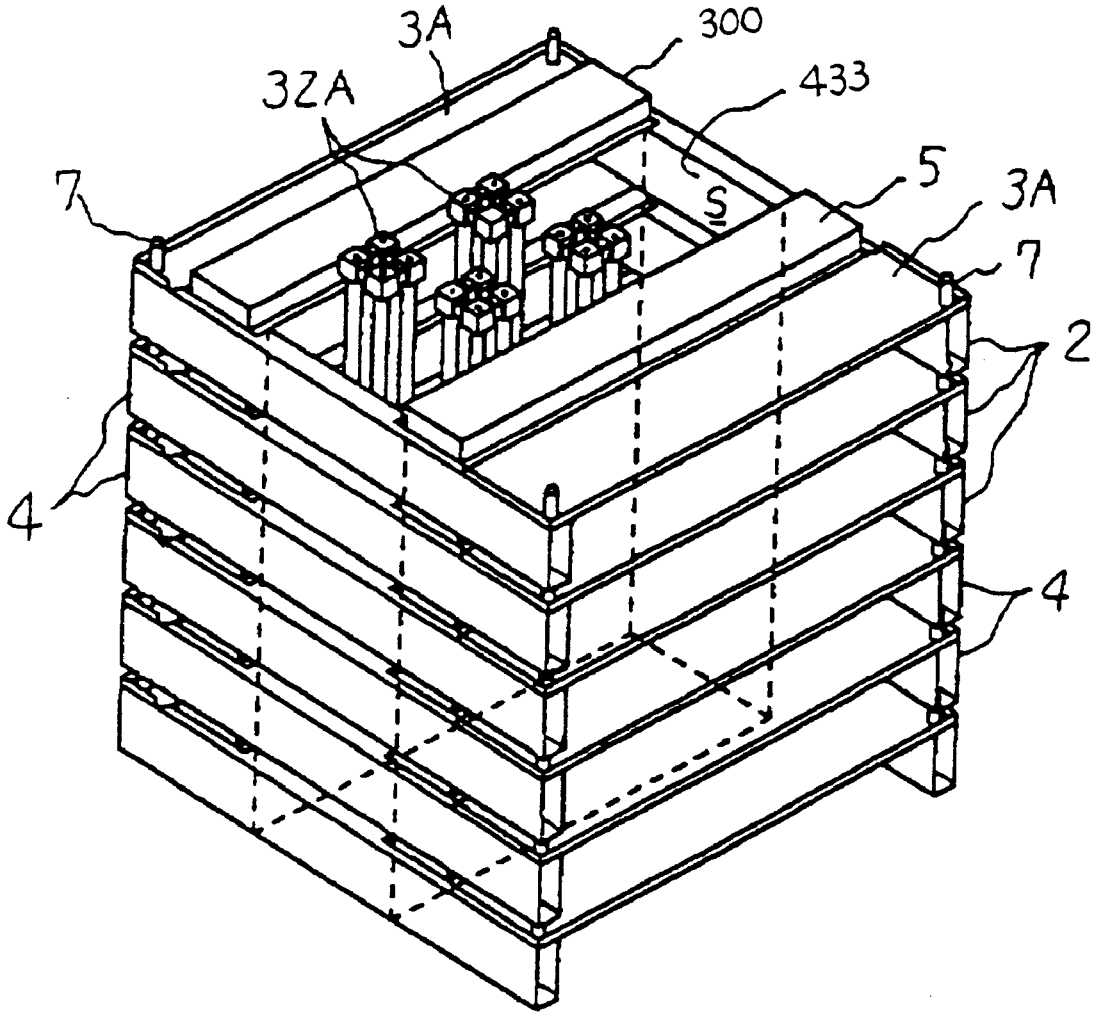
FIG. 73 is a perspective view showing a situation in which the support unit has been accommodated inside the piled-up pallets.

Although FIG. 73 also shows, similarly to FIG. 72, a situation when a plurality of pallets 2 without the support units 32, 32A are piled up on each other, the figure shows a case in which the support units 32A removed from the pallet 2 are accommodated in the space S formed inside the plurality of pallets 2. In FIG. 73, an outline of the space S formed by the opening 433 of the plurality of pallets 2 is indicated by a dashed line, and the support units 32A can be accommodated in the space S in their upright position.

As described above, if the support units 32A are accommodated in the space S, as compared to a case where a large number of support units 32A and a large number of pallets 2 are separately transported or stored, the space occupied with those components can effectively reduced. In FIG. 70 to FIG. 72 as described above, in addition to the configuration shown in FIG. 57 to FIG. 59, when the plurality of pallets 2 without the support units 32, 32A are piled up on each other, the opening 433 is formed on the pallets 2 so that the space S with the folded support units 32, 32A accommodated inside thereof is partitioned and formed. This configuration is designated as a first configuration.

When a large number of pallets 2 are piled up on each other as shown in FIG. 72 and FIG. 73, and if each of the pallets 2 is displaced and moved in the horizontal direction, the space S can not be insured, and the folded support units 32A can not be accommodated in the space S in their right posture.

Therefore, when the pallets 2 are piled up on each other as shown in FIG. 72 and FIG. 73, by engaging the projections 7 provided on the pallets 2 with the engagement holes 22 of the pallets 2 in the upper side therefrom, the pallets 2 are correctly positioned and piled up on each other in the vertical direction to prevent the pallets 2 from getting displaced and moved in the horizontal direction. The projections 7 and engagement holes 22 show one example of a positioning unit for positioning the piled-up pallets on each other.

Figure 74:
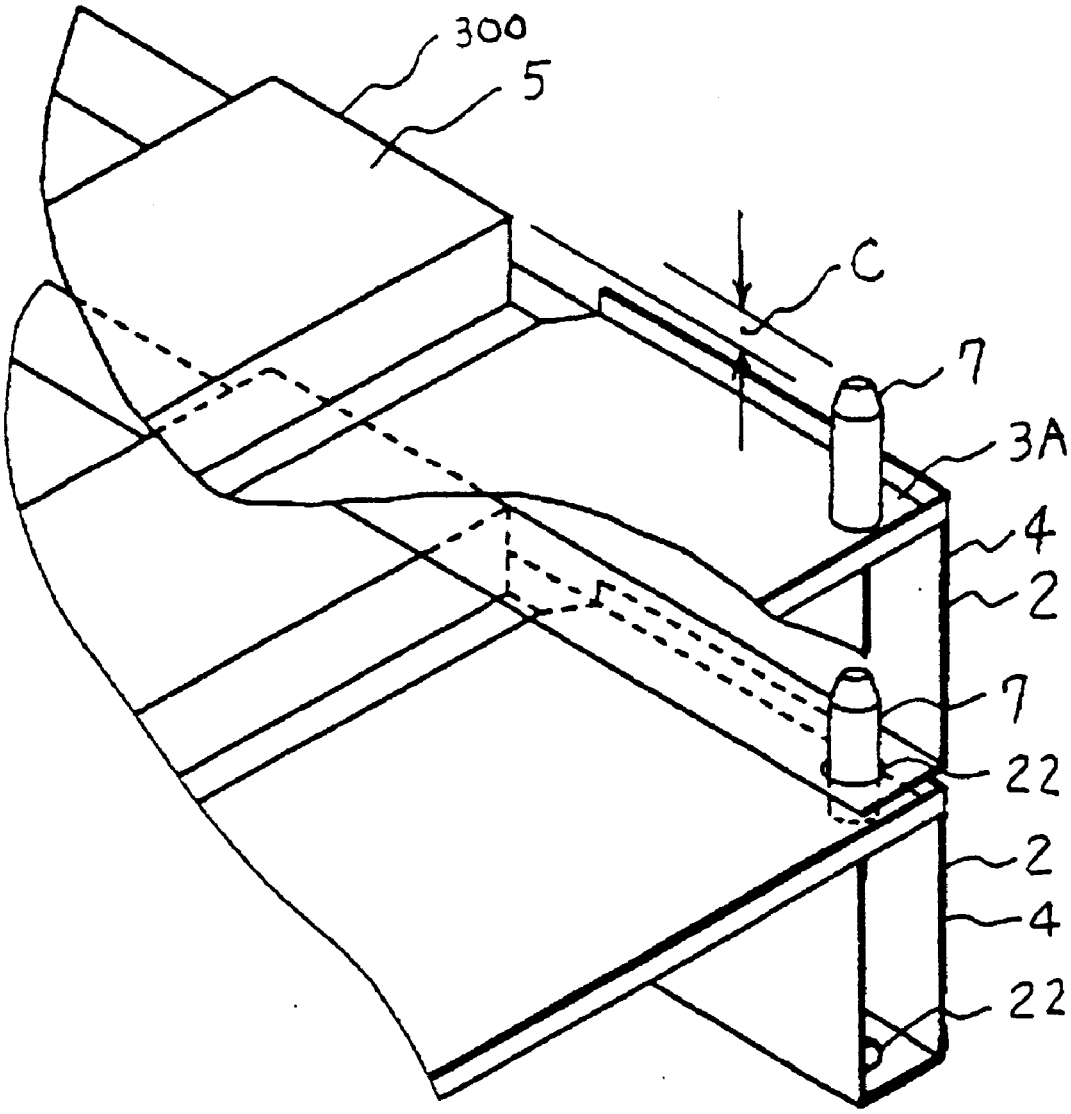
FIG. 74 is a partially enlarged view of the pallet shown in FIG. 73.

The height of each projection 7 provided on the pallet 2 is made higher as shown by the reference sign C in FIG. 74 than the height of the article-loading surface 5. Thus, when the pallets 2 are piled up on each other, the projections 7 can surely be engaged in the engagement holes 22 on the upper-side pallets 2 respectively, so that the pallets 2 can accurately be positioned.

As described above, the article transporting/storing apparatus in the embodiment has, in addition to the first configuration, the positioning unit for positioning pallets when a plurality of pallets 2 without the support units 32, 32A are piled up on each other. Therefore, the space S for accommodating therein the folded support units 32, 32A can surely be insured inside the pallets 2 piled up on each other. This configuration is designated as a second configuration.

Although the figures after FIG. 74 show a pallet 2 with configuration different from that of the pallet in the examples shown in FIG. 70 to FIG. 74, the basic configuration does not differ from that shown in FIG. 70 to FIG. 74. An article transporting/storing apparatus is configured such that the lower section of supports 6 of the support units 32, 32A are detachably engaged with the projections 7 provided on the pallets 2 shown in the figures after FIG. 75, and the article transporting/storing apparatus is used in completely the same manner as described before. As for the case of the pallets 2 shown in the figures after FIG. 75, after the support units 32, 32A are removed from the pallets 2, the pallets 2 are piled up on each other, and the projections 7 provided on the lower side of the pallets 2 are engaged in the engagement holes 22 formed in the upper-side pallets 2 to position those pallets 2.

Figure 75:
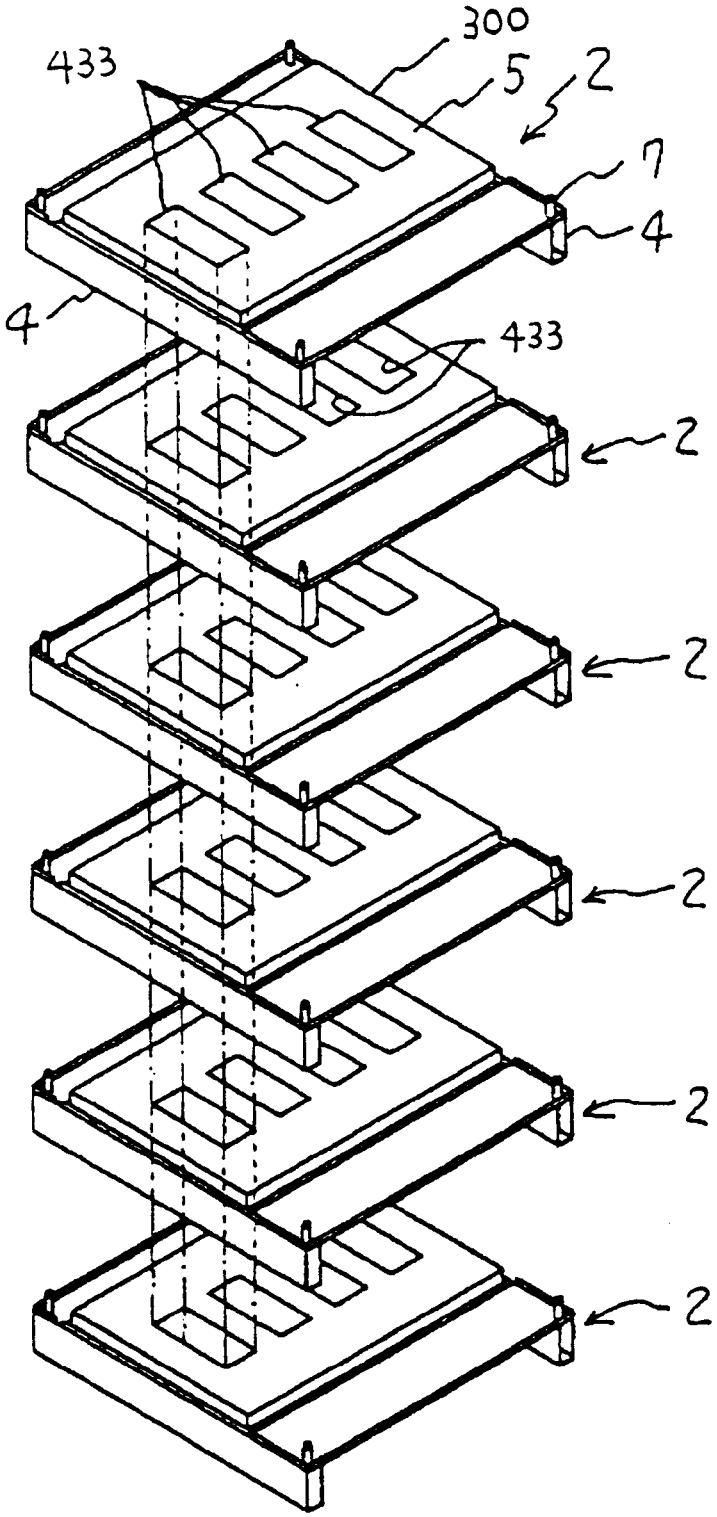
FIG. 75 is a perspective view showing an example of other pallet.
Figure 76:
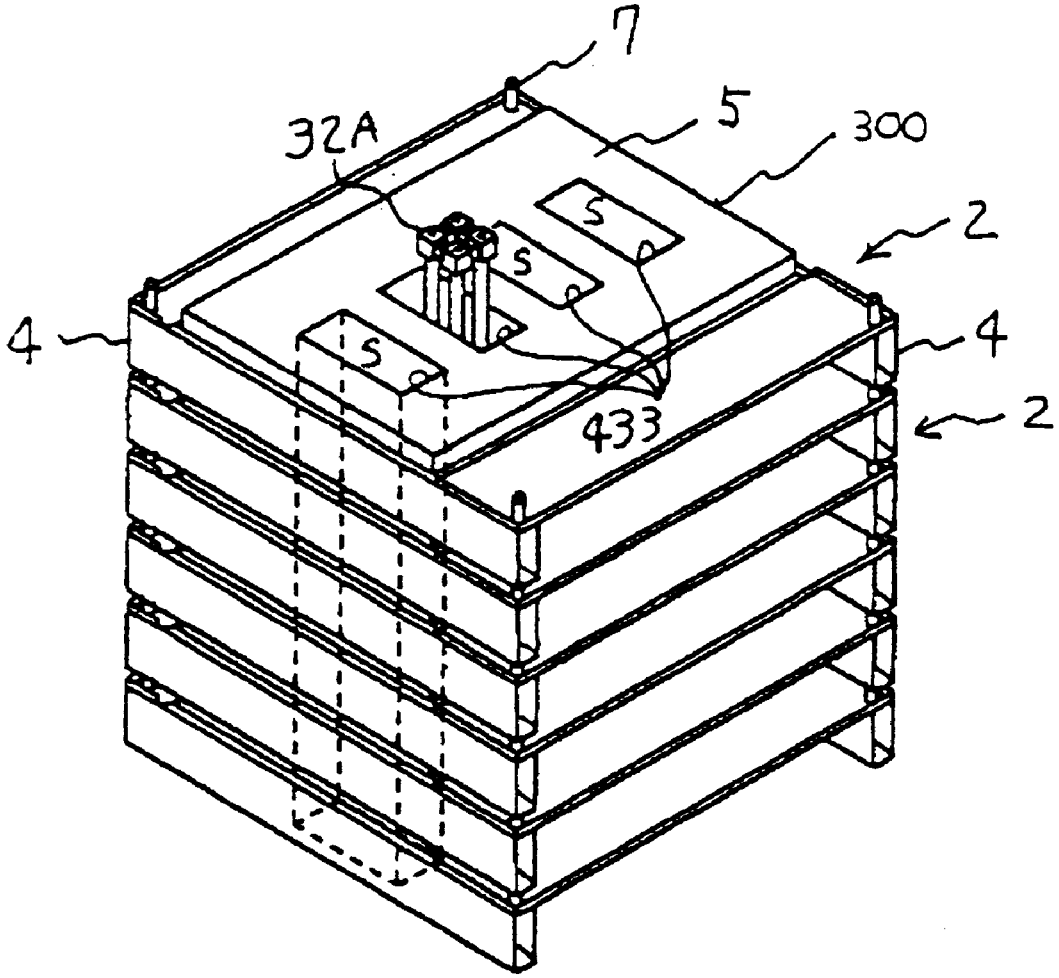
FIG. 76 is a perspective view showing a situation in which the pallets shown in FIG. 75 have been piled up on each other.

The pallets 2 shown in FIG. 75 and FIG. 76 are fixed by spanning a pair of leg sections 4 with one unit of base member 300, a plurality of openings 433 are formed on the base member 300, and the top surface of the base member 300 becomes an article-loading surface 5. The other configuration of the pallet does not differ from the pallet 2 shown in FIG. 73 and FIG. 74. When the plurality of pallets 2 without the support units are piled up on each other as shown in FIG. 76, a plurality of spaces S are formed due to the plurality of openings 433, and the support units 32A can be accommodated in each of the spaces into which the units are inserted.

As the large opening 433 is formed on the pallets 2 shown in FIG. 73, when support units 32A are accommodated therein, the support units 32A may fall down from the upright position, or the support units 32A may vigorously move about and rattle during transportation. In contrast, as the pallets 2 shown in FIG. 75 and FIG. 76 have openings 433 formed therein each of which is small in size, the support units 32A accommodated therein can be maintained in their upright position, and their rattle can be prevented. The support units 32A are held separated from their surrounding by the opening 433, so that the support units 32A can be maintained in the upright position or substantially upright position against the floor or ground where the pallets 2 are placed.

As described above, the article transporting/storing apparatus using the pallets 2 shown in FIG. 75 and FIG. 76 has, in addition to the first and second configurations, the openings 433 each formed in a size so that the support units 32, 32A inserted therein can be held in their upright position. This configuration is designated as a third configuration.

In the example shown in FIG. 75 and FIG. 76, the apparatus is configured so that, when the plurality of pallets 2 are piled up on each other, the openings 433 are matched to each other. Thus, this configuration, spaces S each in an appropriate form for accommodating the support units 32A therein can be partitioned and formed and the support units 32A can be held in their appropriate upright position.

Figure 77:
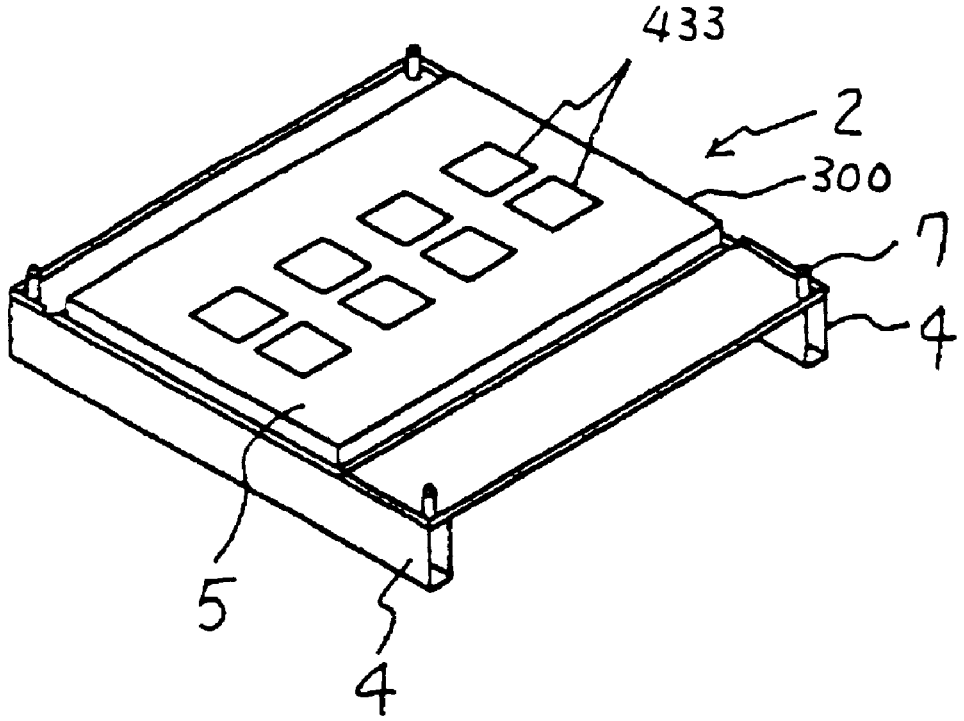
FIG. 77 is a perspective view showing still another example of the pallet.
Figure 78:
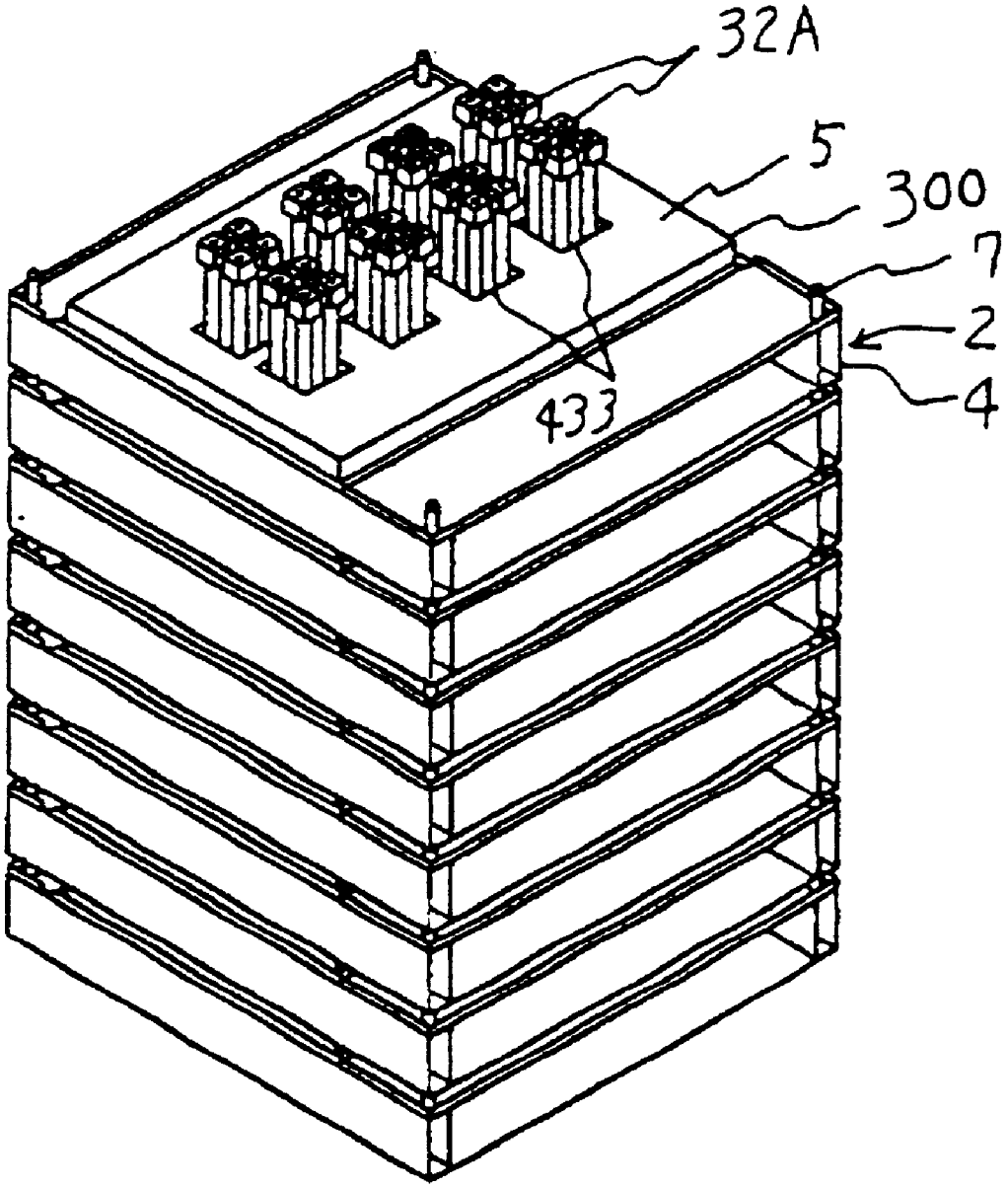
FIG. 78 is a perspective view showing a situation in which several pallets shown in FIG. 77 have been piled up on each other.

Although the pallet 2 shown in FIG. 77 and FIG. 78 does not differ from that shown in FIG. 75 and FIG. 76 except in a point that a number of openings 433 is larger than that shown in FIG. 75 and FIG. 76, the openings 433 shown in FIG. 77 and FIG. 78 can more surely hold the support units 32A.

As described above, the article transporting/storing apparatus using the pallets 2 shown in FIG. 75 to FIG. 78 has the configuration added to the first to the third configurations in which each position of the openings 433 on the pallets 2, area of the opening, and a form of the opening are set so that, when a plurality of pallets 2 without the support units 32, 32A are piled up on each other, the openings 433 of the pallets 2 are matched and provided opposite to each other. This configuration is designated as a fourth configuration.

The pallet 2 shown in FIG. 75 to FIG. 78 has the openings 433 for accommodating the support units 32A therein formed on the article-loading surface 5. Therefore, when an article 1 is placed on the article-loading surface 5 for using the pallet 2 as described above with reference to FIG. 70 to FIG. 72, a portion of the lower part of the article 1 may go inside the opening 433, so that the article 1 may be inclined. For instance, if the article 1 is a copying machine as shown in FIG. 70, and when the copying machine is loaded on the article-loading surface 5 shown in FIG. 75 to FIG. 78, the legs (rubber legs) on the bottom side of the copying machine may go inside the openings 433 or drop therein unless careful work is carried out.

Figure 79:
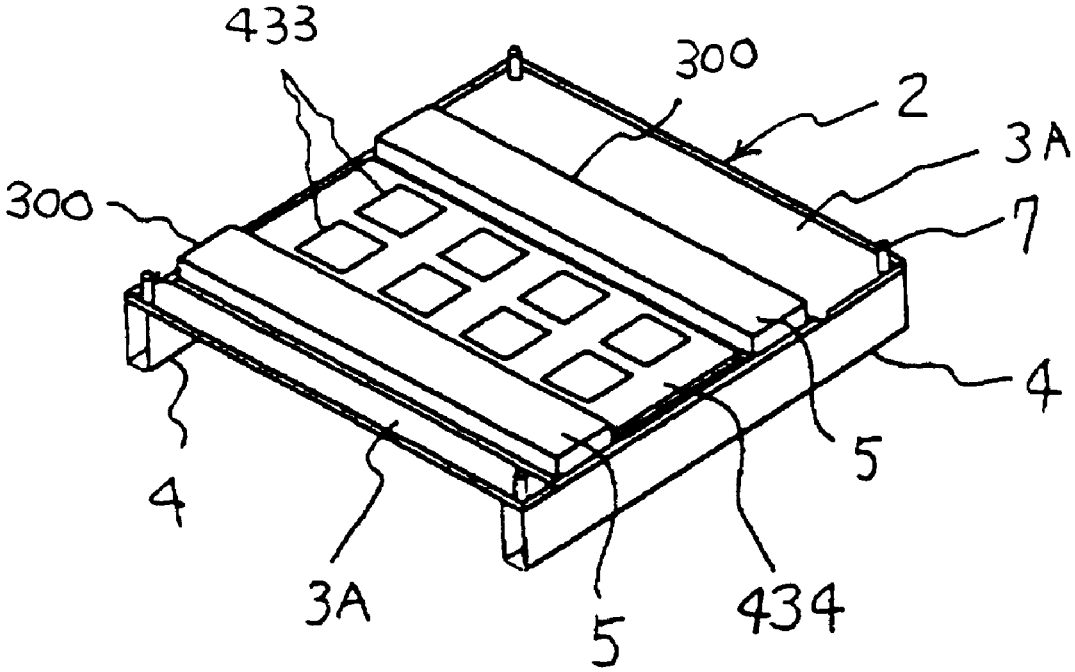
FIG. 79 is a perspective view showing still another example of the pallet.

Therefore, the pallet 2 shown in FIG. 79 has openings 433 for accommodating therein folded support units formed on a support-units holding plate 434 which is located between a pair of base members 300 spanned over a pair of leg sections 4 with a space therebetween and fixed thereto and of which edge sections are fixed to the leg sections 4 respectively. The support-units holding plate 434 is provided lower than the surface of the article-loading surface 5. The other configuration does not differ from that in the pallet described above. The pallet 2 shown in FIG. 79, the pallets 2 are also piled up on each other and support units can be accommodated in the spaces partitioned and formed by the openings 433 thereon.

When the article transporting/storing apparatus as shown in FIG. 70 to FIG. 72 is configured with the pallets 2 shown in FIG. 79 and an article 1 is loaded on each of the article-loading surfaces 5 of the pallets 2, the article 1 does not come in contact with the support-units holding plate 434. Therefore, a portion of the bottom section of the article 1 will never be caught in the opening 433 or inclined by dropping therein.

As described above, the article transporting/storing apparatus using the pallets 2 shown in FIG. 79 has the configuration added to the first to the fourth configurations in which the openings 433 are formed on the section other than the article-loading surface 5 of the pallet 2. This configuration is designated as a fifth configuration.

Figure 80:
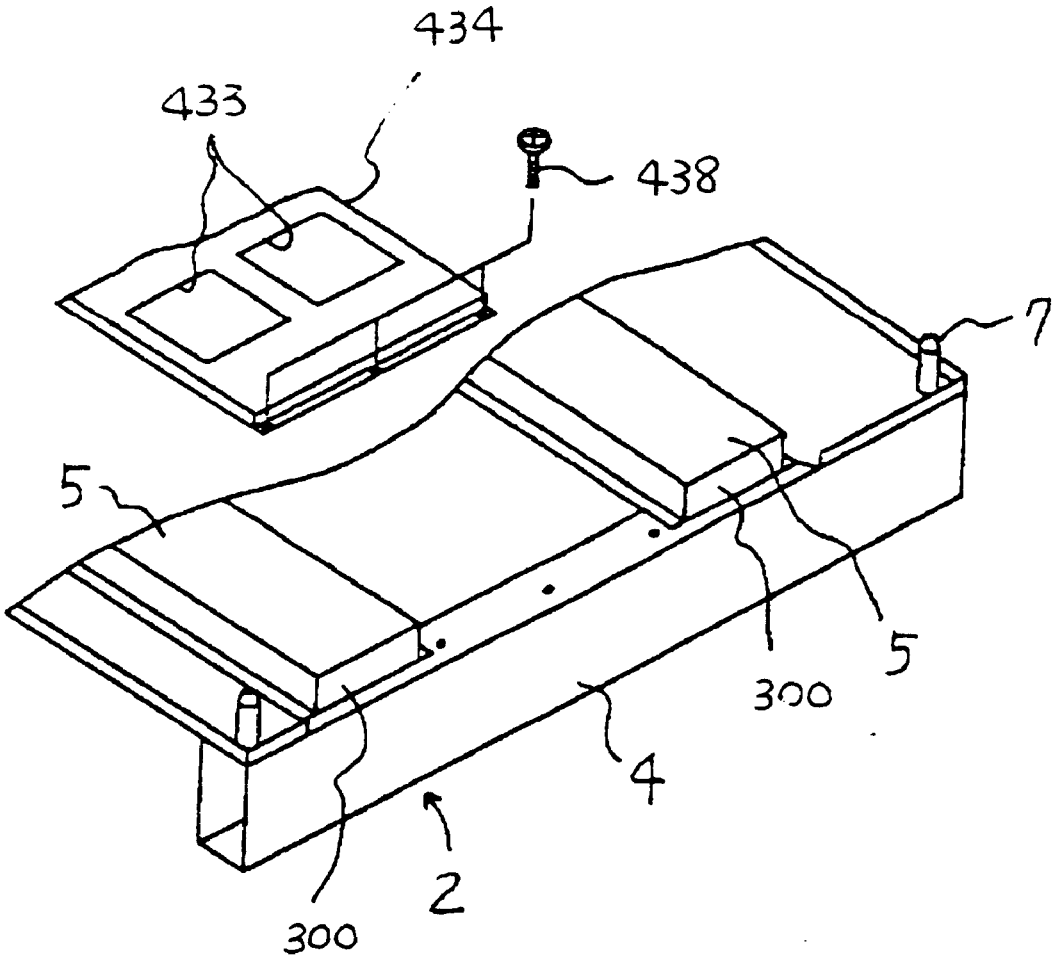
FIG. 80 is a perspective view showing an example of the pallet to which the support unit holding plate can detachably be attached to the main body of the support unit.
Figure 81:
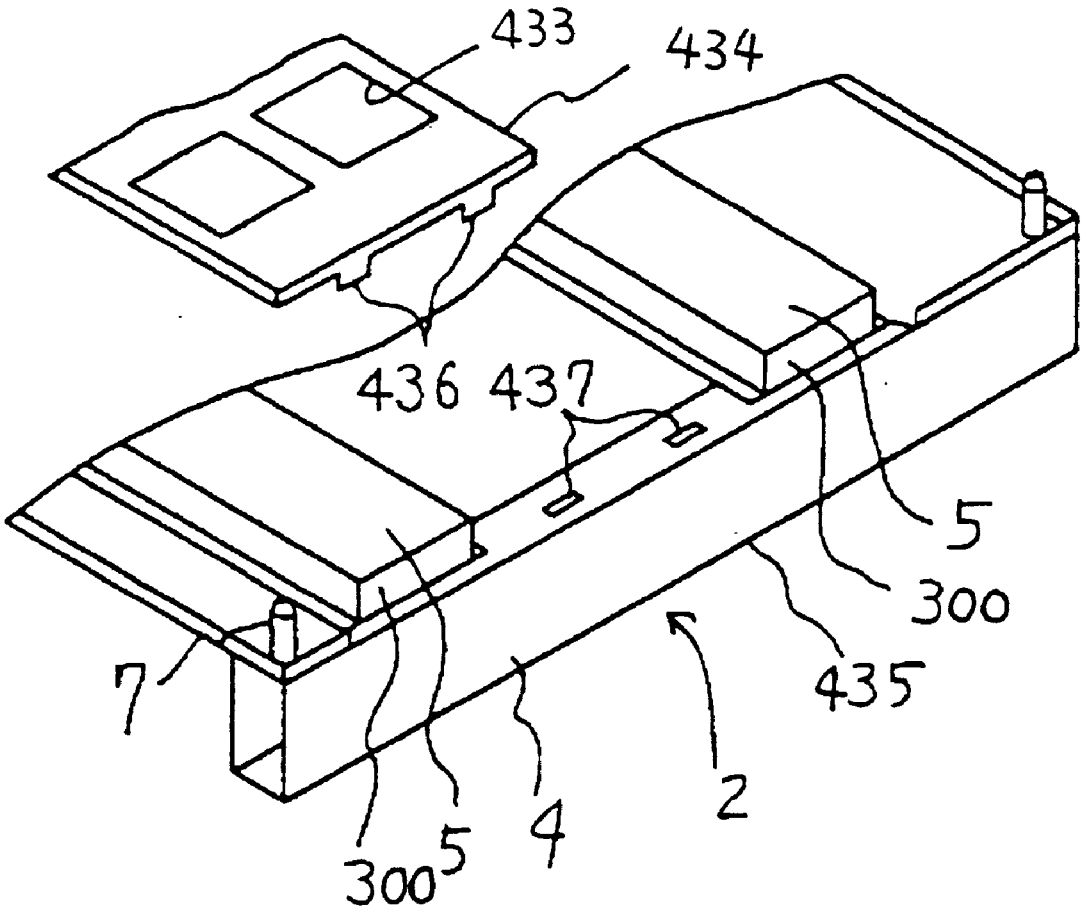
FIG. 81 is a perspective view showing another example of the pallet to which the support unit holding plate can detachably be attached to the main body of the support unit.

The support-units holding plate 434 can be fixed to the leg sections 4 by welding or the like so that the plate is not separated therefrom, but the support-units holding plate 434 may also detachably be attached to the leg sections 4. Assuming the pallet section other than the support-units holding plate 434 to be the main body 435 of the pallet, the support-units holding plate 434 is detachably attached to the main body 435 of the pallet as shown in FIG. 80 and FIG. 81. As shown in FIG. 80, the support-units holding plate 434 can detachably be fixed to the main body 435 of the pallet with an attaching unit such as screws 438 or bolts. The support-units holding plate 434 may also detachably be attached to the main body 435 of the pallet by forming locking claws 436 on the support-units holding plate 434, forming locking holes 437 on the upper walls of the leg sections 4 of the main body 435 as shown in FIG. 81, and locking the locking claws 436 in the locking holes 437.

As described above, the article transporting/storing apparatus having the pallets 2 shown in FIG. 80 and FIG. 81 has the configuration added to the first to the fifth configurations in which the openings 433 are formed on the support-units holding plate 434 detachably attached to the main body 435 of the pallet. This configuration is designated as a sixth configuration.

With the sixth configuration, as the support-units holding plate 434 can be attached to only a required pallet 2, cost can be reduced as compared to that in the case where the support-units holding plates 434 are provided on each of the pallet 2. For instance, in a case where articles are loaded on a plurality of article transporting/storing apparatuses, the articles are transported from one place to another place and delivered therein, then the support units are removed from the pallets of each of the article transporting/storing apparatuses, the pallets are piled up on each other, the folded support units are accommodated in the spaces in the inner side of the pallets, and the article transporting/storing apparatuses after all those steps are sent back to the original place, there is a method of attaching the support-units holding plates 434 only to the pallets of one of the article transporting/storing apparatuses, placing, when the pallets and support units are sent back, the pallets with the support-units holding plates 434 on top of the other pallets, and inserting and accommodating the support units in the openings 433 on the support-units holding plates 434. Thus, when a plurality of pallets and support units are sent back, all the pallets and support units can conveniently be packed and returned to the original place only by using one support-units holding plate 434.

By the way, as clearly understood from FIG. 73, FIG. 76 and FIG. 78, the support units 32A inserted in the openings 433 of those pallets 2 contact the floor surface at the bottom sections thereof. Accordingly, when a large number of pallets 2 piled up on each other are lifted upward in that state by a forklift or the like, the support units 32A are left on the floor surface. As described above, it is impossible or extremely difficult to lift the pallets 2 together with support units 32A.

Figure 82:
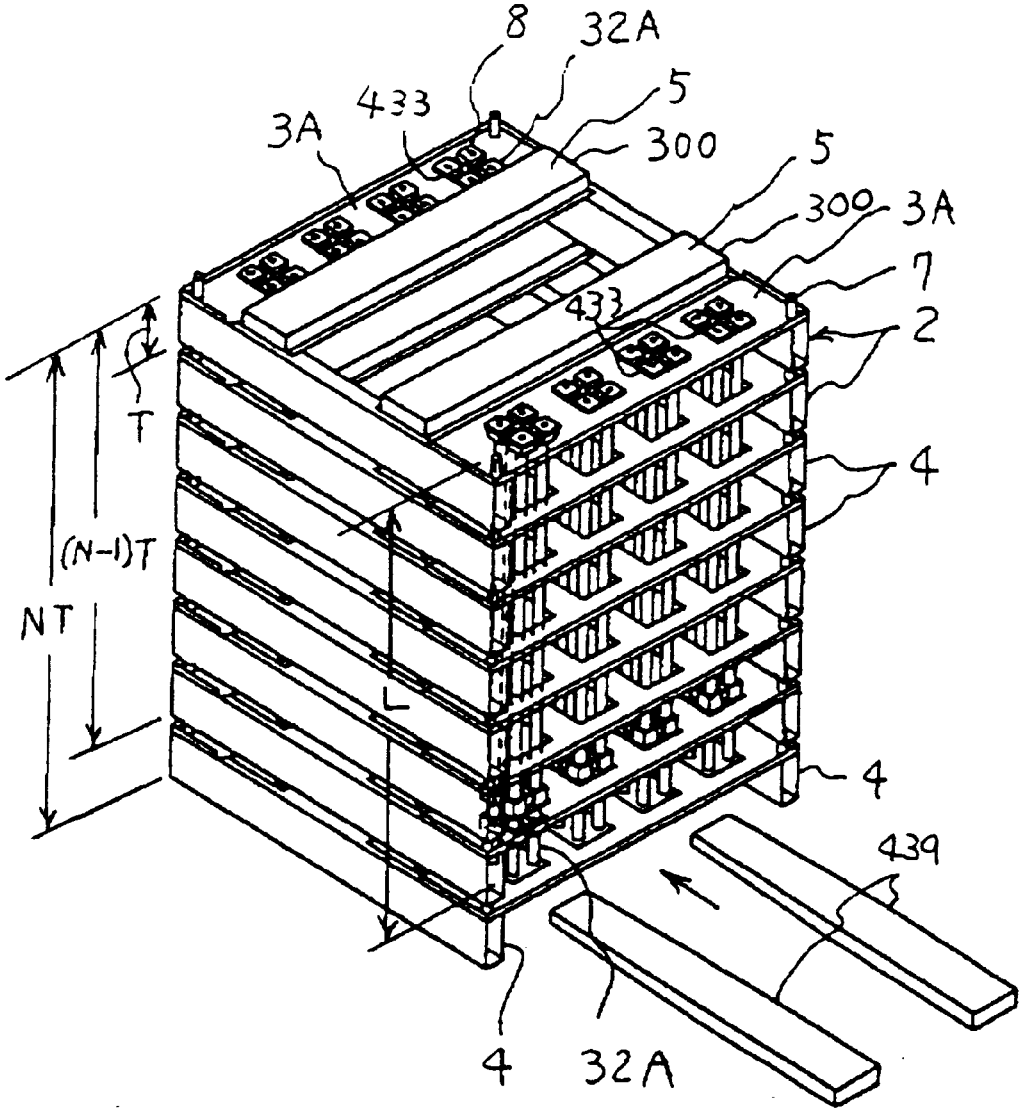
FIG. 82 is a perspective view showing a situation in which pallets according to other embodiment have been piled up on each other.

Therefore, the pallets 2 shown in FIG. 82 are configured so that the support units 32A inserted in the openings 433 are engaged on edges of the openings 433 and are hanged. The pallet 2 shown in FIG. 82 has, similarly to those shown in FIG. 70 and FIG. 72, a pair of leg sections 4, base members 300 fixed to the sections, and two pieces of reinforcing members 3A comprising plate members fixed to the leg sections 4 with the openings 433 formed on each of the reinforcing members 3A. A part of the support units 32A folded and inserted in the openings 433, in this example, a first joint 8 of four joints in one edge in the longitudinal direction of the support units 32A is formed larger than the area of the opening 433.

With the configuration described above, when each of the support units 32A is inserted in the opening 433, the four first joints 8 of the support unit 32A are hooked on the edge of the opening 433, so that the support units 32A are held in a state where they hang downward inside the plurality of pallets 2. Therefore, when the pallets 2 piled up on each other are lifted upward, the support units 32A can be lifted together with the pallets, so that the pallets 2 and support units 32A can efficiently be transported.

As described above, the article transporting/storing apparatus having the pallets 2 shown in FIG. 82 has the configuration added to the first to the sixth configurations in which a part of the folded support units 32, 32A is bigger than the openings 433 so that this bigger part of the support unit can rest on the edge of the opening 433. This configuration is designated as a seventh configuration.

By the way, as shown in FIG. 82, when a large number of pallets 2 are piled up on each other and the entire pallets are lifted and transported, a handling device such as forks 439 of a forklift are inserted under the lowest pallet as shown by the arrow, and the pallets 2 are lifted by lifting the forks 439. However, if the ends of the support units 32A inserted in the openings 433 of the pallets 2 are projecting into a space between the two leg sections 4 of the lowest pallet 2, the forks 439 hit these ends of the support units 32A so that it can not be inserted inside. Accordingly, it is desirable to accommodate the support units 32A inside the pallets 2 so that the ends of the support units 32A do not project below the lowest pallet 2.

However, if the length of the support units 32A is decided or a number of the pallets 2 to be pilled on each other is set so that the ends of the support units 32A do not project below the lowest pallet 2 or below the second or third pallet from the bottom, efficiency in accommodation of the support units 32A into the pallets 2 will be reduced.

For that case, the article transporting/storing apparatus having the pallets 2 shown in FIG. 82 has the configuration added to the first to the seventh configurations in which one end of the support units 32 or 32A i.e. a section of the four first joints 8 in FIG. 82 is bigger than the opening 433 so that the bigger part of the support unit can be engaged on the edge of the opening 433 formed on the pallet 2 in the top-stage of the plurality of pallets 2 piled up on each other, and assuming that N is an integer more than 2, T is a thickness of one piece of pallet, and L is a total length of one piece of support units 32, 32A, values of T and L are set so as to be $(N-1)\times T=L$. This configuration is designated as an eighth configuration.

As eight pallets 2 are piled up on each other in the example shown in FIG. 82, N is 8, and so $N-1=7$ is obtained, then a value $7\times T$ obtained by multiplying this value by the thickness T of the pallets 2 is coincident with the length L in the longitudinal direction of the support unit 32A. By setting the length of the supporting unit in this way, the ends of the accommodated support units 32A will not project below the lowest pallet 2, and the support unit 32A will end at the second pallet 2 from the bottom. Efficiency of accommodating the pallets 32A therein can be enhanced to the maximum, and the forks 439 can be inserted under the lower-stage pallet 2 without any trouble.

In the example shown in FIG. 82, although the same effect can be expected by inserting the support units 32A into the openings 433 at the step when the pallets 2 are piled up on each other by eight stages, it is cumbersome for the worker to each time determine how many stages should be piled up on each other.

For that case, in the article transporting/storing apparatus having the pallets 2 shown in FIG. 82, a number of openings 433 formed on each of the pallets 2 is set to the value N described above in addition to the eighth configuration. Eight openings 433 are formed on each of the pallets 2 in the example shown in FIG. 82. Thus, the worker piles the pallets 2 on each other by the number of the openings 433 formed on the pallets 2, and when the support units 32A are inserted from the openings 433 on the topmost pallet 2, the operations of piling the pallets 2 on each other as well as of accommodating the support units 32A therein can be completed in the state where the requirement of $(N-1)\times T=L$ is automatically satisfied. In this case, as the same number of support units 32A as that of the piled pallets 2 are accommodated in the pallets 2, the pallets 2 and the support units 32A can easily be managed, which is advantageous.

Figure 83:
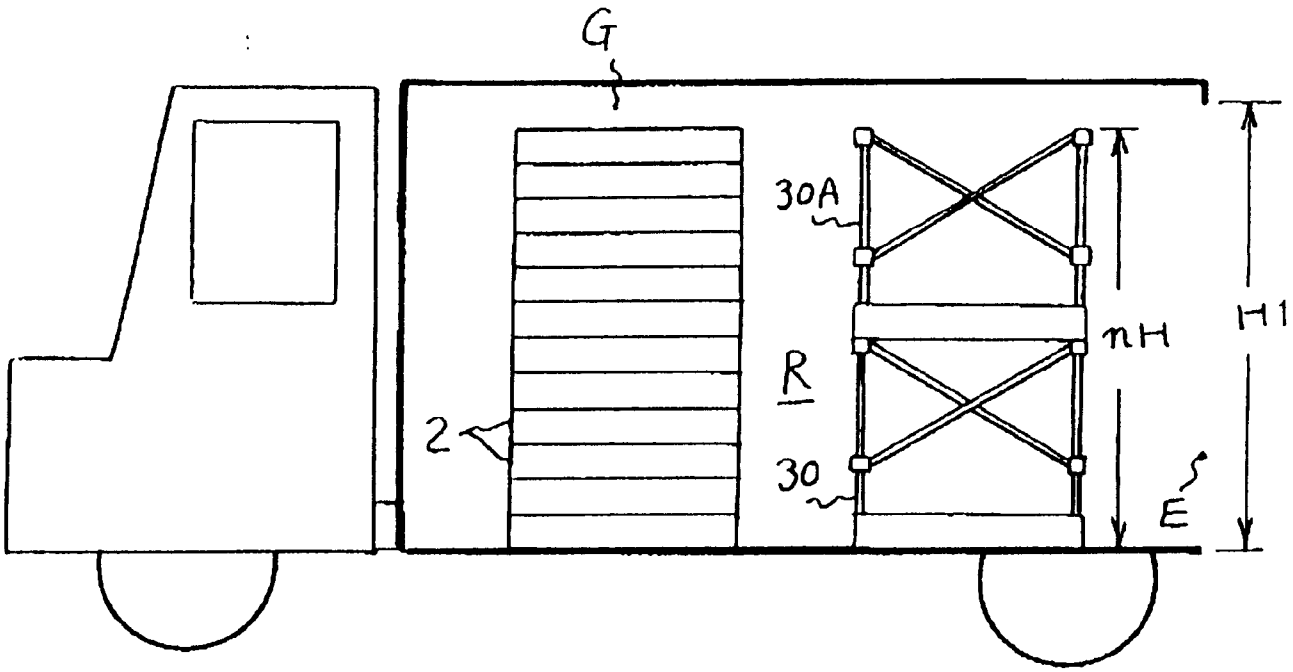
FIG. 83 is an explanatory view showing a situation in which the pallet and the article have been loaded in a truck.

A plurality of pallets 2 or article transporting/storing apparatuses piled up on each other as shown in FIG. 71 may be loaded into a transporting device such as a truck or a container for transportation. In this case, as shown in FIG. 83, piled-up pallets or assembled article transporting/storing apparatuses are accommodated into a container of a truck, namely an article-accommodating space R, if there is a large clearance in an upper section of the article-accommodating space R, the article transport efficiency becomes lower. On the contrary, a total height of the piled-up pallets or a total height of the assembled article transporting/storing apparatuses is equal to height of an article inlet/outlet port of the article-accommodating space R, the work efficiency for loading the pallets or article transporting/storing apparatuses into or unloading the pallets or the article transporting/storing apparatuses from the article-accommodating space R becomes lower. This is true also when the pallets or article transporting/storing apparatuses are loaded into or unloaded from container.

Therefore, in the article transporting/storing apparatus having the eighth or ninth configuration as described above, assuming that n is an integer of 1 or more, it is advantageous to set values of N and T so that a value of n×N×T is not more than a value obtained by subtracting 3 cm from height H1 of the article inlet/outlet port of the article-accommodating space R in the transporting device and not less than a value obtained by subtracting 10 cm from the height H1 of the article inlet/outlet port. This configuration is designated as tenth configuration. Height H1 of the article inlet/outlet port of a truck or a container, namely height H1 of the article inlet/outlet port from the floor of the article-accommodating space R is fixed according to the industrial standards, and assuming that height not more than a value obtained by subtracting 3 cm from height H1 of the article inlet/outlet port E and not less than a value obtained by subtracting 10 cm from the height H1 of the article inlet/outlet port is the maximum height, a value of n×N×T is set to the maximum height.

Figure 84:
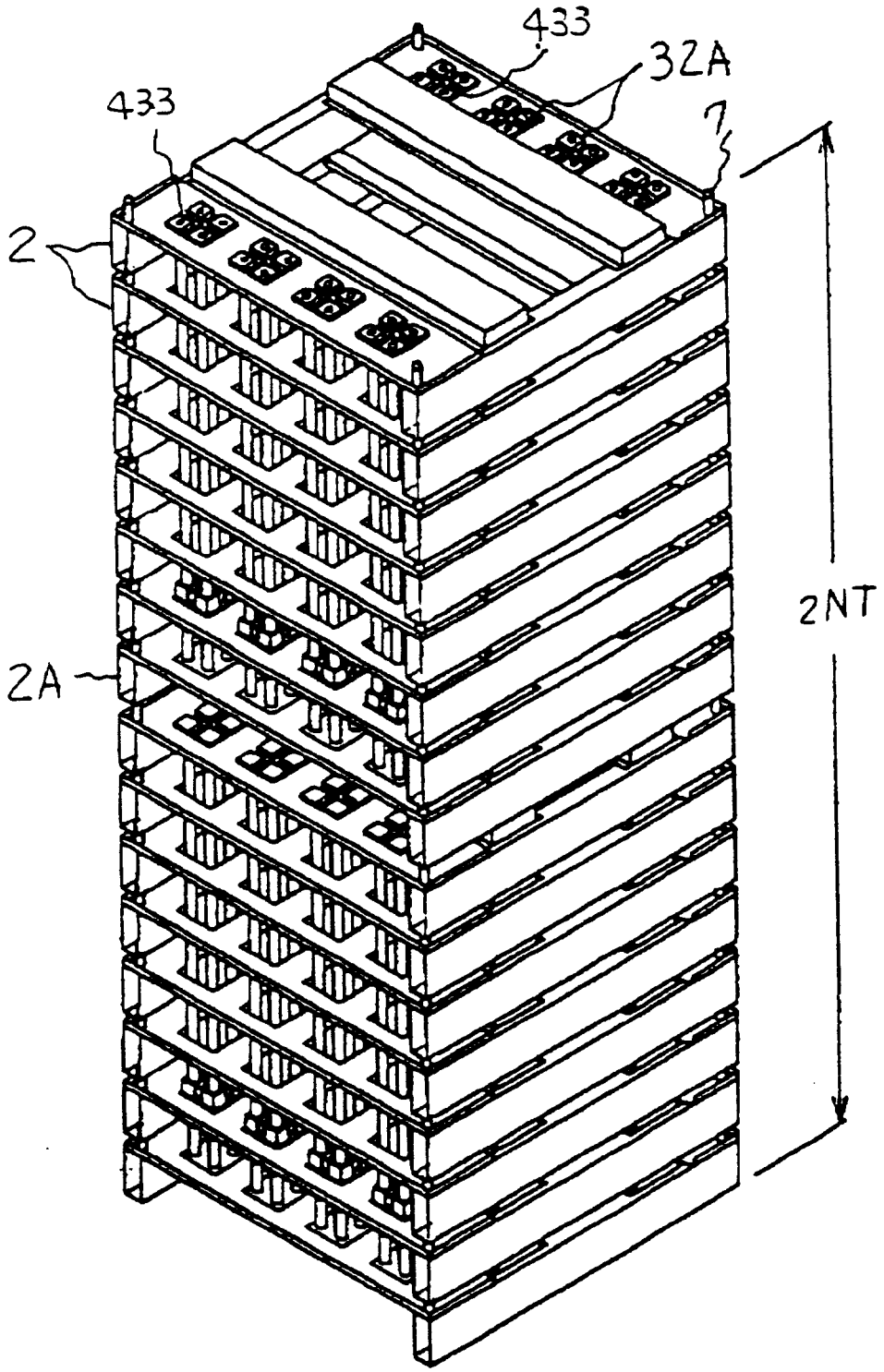
FIG. 84 is a perspective view showing a situation in which a plurality of pallets shown in FIG. 82 have been piled up into two blocks.

For instance, when the pallets 2 are piled up as shown in FIG. 82, the total height is substantial N×T, and when the piled-up pallets 2 are accommodated onto a cargo base of a truck, the value of N×T is set to the maximum height. In a case where a plurality of pallets 2 shown in FIG. 82 are piled up on each other as shown in FIG. 84 and the piled-up pallets (assuming that the pallets form one stage) are further piled up to form two stages as shown in FIG. 84 to accommodate all the pallets on a truck. The total height of the pallets 2 is 2×N×T (n=2), and the value corresponds to the maximum height described above.

Thus, when a plurality of pallets are piled up to be accommodated on a truck and are passed through the article inlet/outlet port E, a clearance larger than 3 cm and smaller than 10 cm is maintained between the topmost pallet 2 and an upper section of the article inlet/outlet port E, so that the pallets can easily be loaded into the article-accommodating space R. This is true also when the pallets are unloaded from the space R. In addition, only a small clearance G is generated above the pallets 2 accommodated in the article-accommodating space R, so that the efficiency in accommodating pallets can be improved. This is true also when the pallets 2 are accommodated into a container.

What was described above can also be applied to a case where one article transporting/storing apparatus 30, or a plurality of article transporting/storing apparatuses 30, 30A piled up on each other are accommodated onto a truck or into a container. Namely, in the article transporting/storing apparatus having any of the first to tenth configurations, when support units 32, 32A are assembled with one pallet 2 to assemble the article transporting/storing apparatus, assuming that the total height of the pallet 2 and support units 32, 32A is H and n is an integer of 1 or more, a value of H is set so that a value of H×n is smaller than a value obtained by subtracting 3 cm from height H1 of the article inlet/outlet port E of the article-accommodating space R of a transporting device and at the same time greater than a value obtained by subtracting 10 cm from height H1 of the article inlet/outlet port E. Assuming that this configuration is designated the eleventh configuration, with the eleventh configuration, one article transporting/storing apparatus (n=1) or article transporting/storing apparatus piled up into a plurality of stages (n≧1) are loaded onto or unloaded from a truck or a container, the work can easily be carried out, and furthermore the article-accommodating space can effectively be utilized with the efficiency in transporting articles improved.

Also when the pallets 2 are piled up, for instance, as shown in FIG. 82 or FIG. 84 and loaded onto or unloaded from a truck or a container, it is advantageous to construct the pallets giving the same result as that described above. Namely, in the article transporting/storing apparatus having any of the first to eleventh configurations, assuming that thickness of one pallet is T and m is an integer of 2 or more, a value of T is set so that it is less than a value obtained by subtracting 3 cm from height H1 of the article inlet/outlet port E of the article-accommodating space R in a transporting device and greater than a value obtained by subtracting 10 cm from the height H1 of the article inlet/outlet port E. Assuming that this configuration is designated as the twelfth configuration, also with the twelfth configuration, the pallets piled up on each other can efficiently be loaded into or unloaded from the article-accommodating space R, and further the article-accommodating space R can effectively be utilized.

By the way, when the pallets 2 are piled up as shown, for instance, in FIG. 84 and the pallets are divided to two groups with each groups transported one by one to another place, a fork is inserted under the eighth pallet from the top with where ends of the support unit 32A are not present (indicated by the reference 2A in FIG. 84) and eight pallets 2 are raised by the fork. However, if the pallet 2A without the ends of the support units 34A loaded thereon can not visually be checked from outside of the pallets 2 piled up on each other, the work efficiency becomes lower. Therefore, in the pallets 2 shown in FIG. 82 and FIG. 84, the openings 433 are formed in the side from where the fork is inserted, namely at a position closer to the edge section than to the central position when the pallet 2 is viewed from above. With this configuration, a worker can check the pallet 2A without the ends of the support units 32A present thereon by visually checking the pallets 2 piled up on each other, and can efficiently carry out the work by inserting the fork under the pallet 2A.

As described above, in any of the first to twelfth configuration, it is desirable to provide an opening at a position closer to an edge of the pallet 2 than to a central portion thereof. This configuration is designated as the thirteenth configuration.

Figure 85:
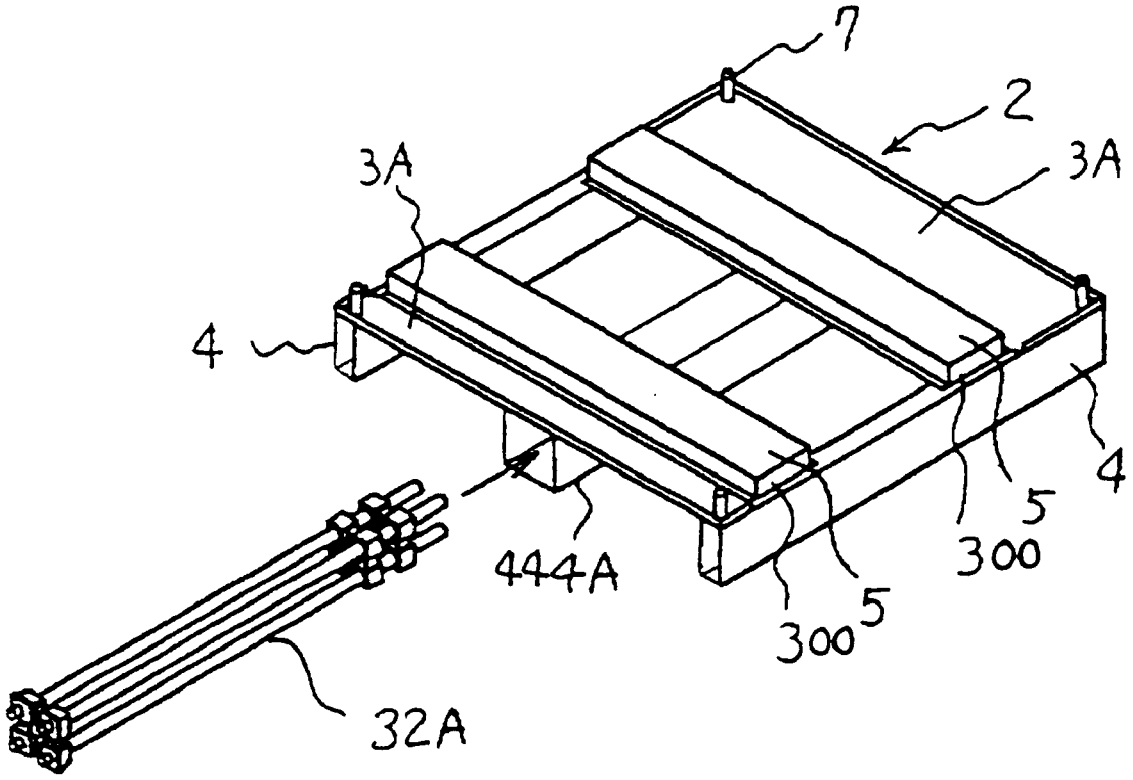
FIG. 85 is a perspective view showing an example in which the support unit is accommodated inside the pallet.
Figure 86:
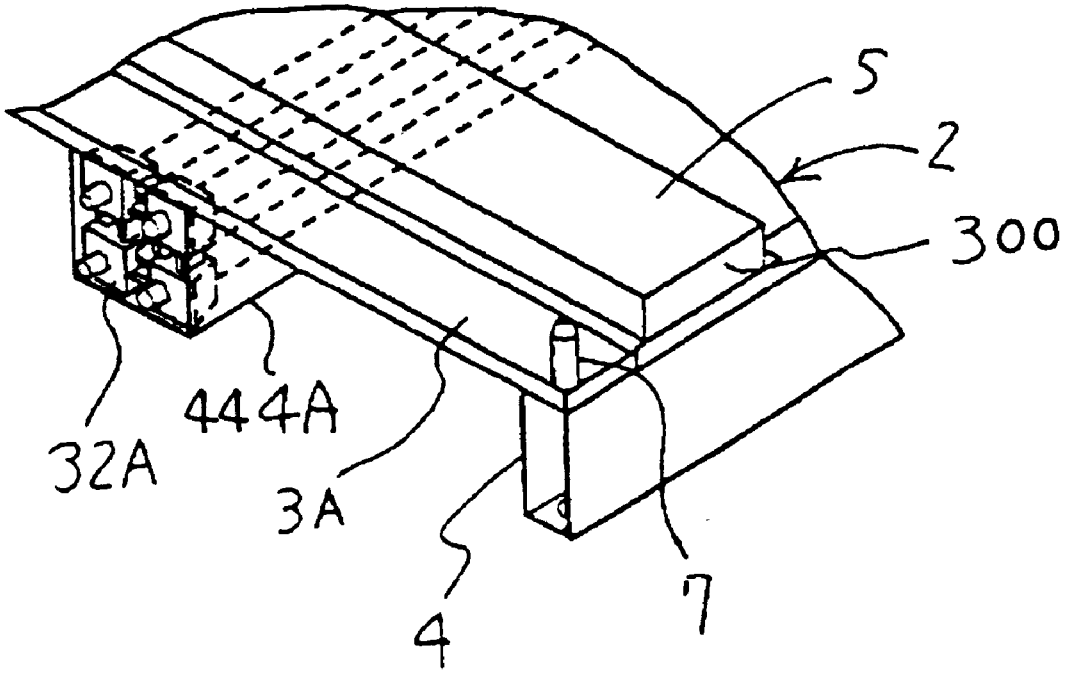
FIG. 86 is a perspective view showing a situation in which the support unit is accommodated in the leg section shown in FIG. 85.

In the examples shown in FIG. 73 to FIG. 84, the support unit is accommodated inside the palled piled up on each other, but the support unit can be accommodated in each discrete pallet 2. FIG. 85 and FIG. 86 show the example, and the pallet 2 shown in these figures has, in addition to the components of the pallet shown in FIG. 70 and FIG. 73, hollow third leg sections 444A each functioning as a support unit accommodating section, and the leg sections 444A are fixed to a bottom surface of the reinforcing member 3A. The support unit 32A removed from the pallet 2 is inserted as indicated by the arrow in FIG. 85 into the third leg section 444A, and can be accommodated therein as shown in FIG. 86. As described above, the third leg section 444A functions as a section for accommodating a support unit.

The article transporting/storing apparatus having the pallet shown in FIG. 85 and FIG. 86 has the configuration in which a section for accommodating the support units 32, 32A is provided in the pallet 2 of the article transporting/storing apparatus having any of the configurations shown in FIG. 70 to FIG. 77. Assuming that this configuration is designated as the fourteenth configuration, the article transporting/storing apparatus shown in FIG. 85 has the fourteenth configuration with a section for supporting a support unit therein added thereto. This configuration is designated as the fifteenth configuration.

With the fourteenth and fifteenth configurations, when a number of pallets is small or even one, the support units 32, 32A can easily be accommodated into the pallet 2. In addition, with the configuration in which one support unit can be accommodated in one pallet, the support unit and the pallet can easily be managed during transportation or storage thereof.

Various embodiments of the article transporting/storing apparatus according to the present invention are described above, when an article is placed on the pallet 2 of any of the article transporting/storing apparatuses described above and transported or stored together, if the article is largely displaced against the pallet 2, it is impossible to transport or store the article 1 in stable conditions.

Therefore, in the article transporting/storing apparatuses described in relation to FIG. 1 to FIG. 86 there is provided at least a positioning unit for positioning the article placed on the pallet 2 or a fixing unit for removable fixing the article to the pallet 2. Herein positioning the article against the pallet 2 with the positioning unit means that, when the pallet 2 is placed in the horizontally and the article 1 is placed on the pallet 2, the article 1 does not displace against the pallet 2 in the horizontal direction, but the article 1 is positioned and locked to the pallet 2 so that the article 1 can be removed from the pallet by raising it upward, and fixing the article 1 to the pallet 2 with the fixing unit means that the article placed on the pallet 2 is fixed to the pallet 2 so that the article does not move in the horizontal direction, nor in the vertical direction. Detailed description is made for the positioning unit and the fixing unit hereinafter.

Figure 87:
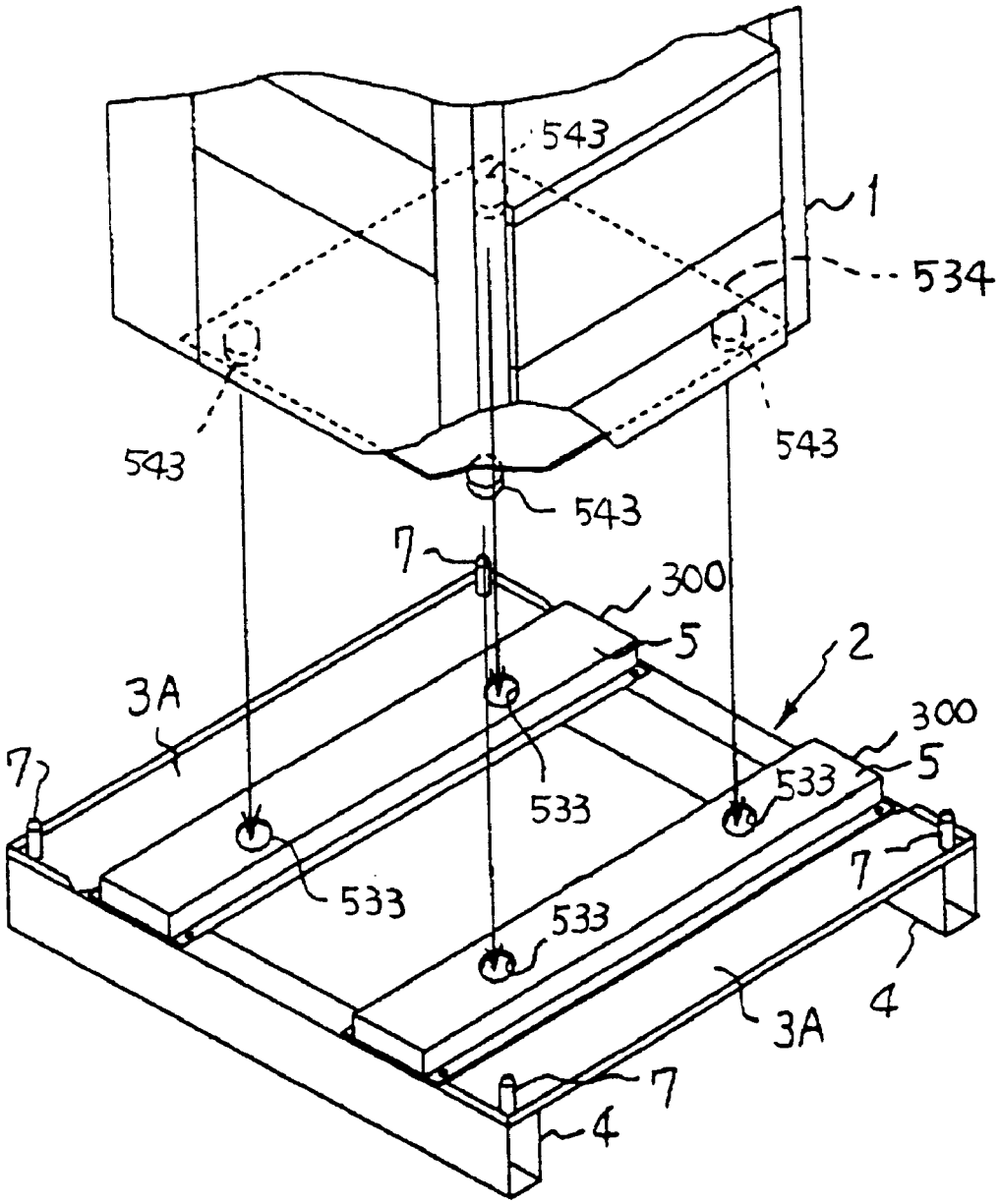
FIG. 87 is a perspective view showing a situation in which a leg section of a copying machine is engaged in through-holes of the pallet.

FIG. 87 shows an example of the positioning unit, and the positioning unit in this example has four engagement sections each comprising a throughhole 533 formed in the base member 300 of the pallet 2. On the other hand, in the side of an article such as, for instance, copying machine, there are provided four leg sections 543 each contacting a floor surface when the copying machine is placed on the floor surface. When the article 1 is placed on the article-loading surface 5 of the pallet 2, the leg sections 543 are engaged in the four throughholes 533 formed in the pallet 2 respectively. With this, the article 1 is correctly positioned against the pallet 2, and does not largely displace against the pallet 2 during transportation or storage thereof. Also the configuration is allowable in which engagement sections each comprising a groove is formed in place of the throughholes 533 and the article 1 is positioned against the pallet 2 by engaging the leg sections of the article 1 with the engagement sections, or in which projections of the article 1 other than the leg sections 543 are engaged in the engagement sections of the pallet 2.

The configuration in which the article 1 can be positioned against the pallet 2 by engaging the leg sections of the article 1 with the engagement sections of the pallet 2 is especially effective when, for instance, the article is transported by a user and an old article having been used by the user is returned to the vendor. For instance, when a copying machine is transported with an article transporting/storing apparatus to a user, the copying machine is unloaded from the article transporting/storing apparatus, and an old copying machine having been used by the user is loaded onto the pallet 2, the old copying machine can be positioned against the pallet 2 by engaging the leg sections of the old copying machine with the engagement sections of the pallet 2.

Figure 88:
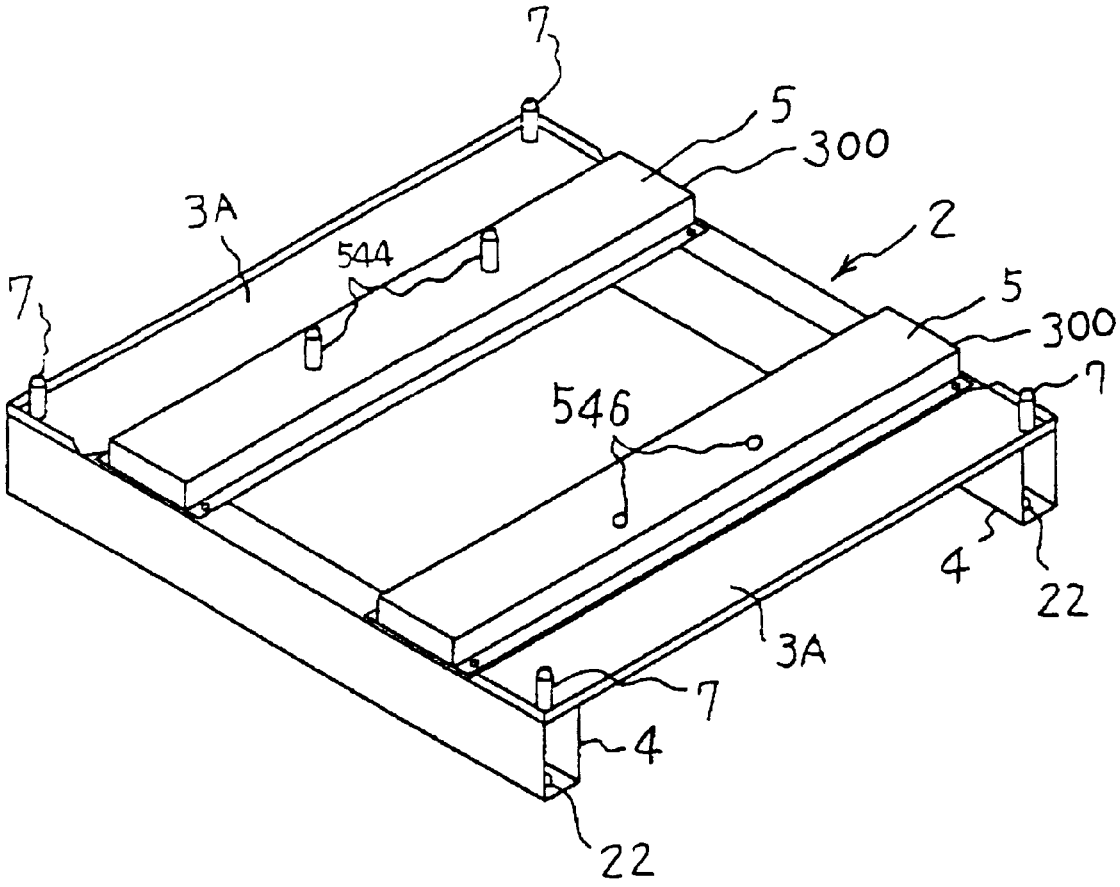
FIG. 88 is a perspective view showing a pallet having positioning pins and screw holes.
Figure 89:
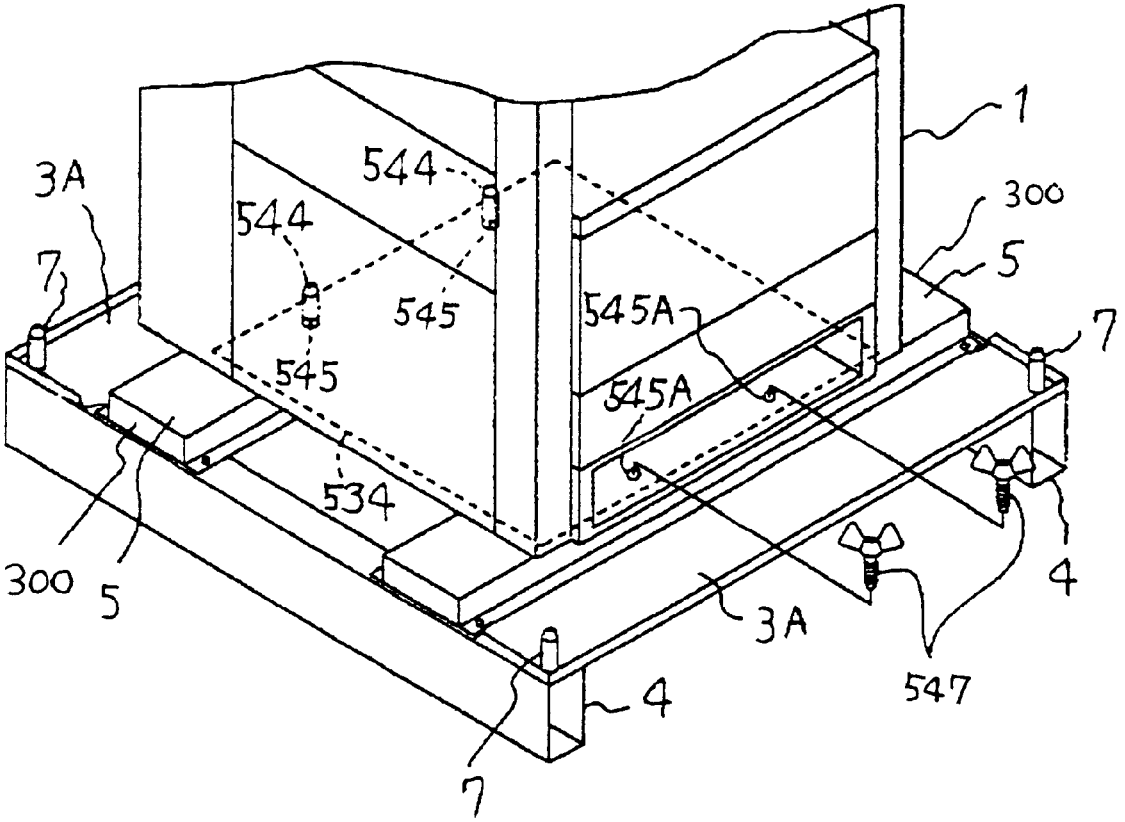
FIG. 89 is a perspective view showing a situation in which an article comprising a copying machine are mounted on the pallet shown in FIG. 88.

The positioning unit shown in FIG. 88 and FIG. 89 comprises a plurality of positioning pins 544 monolithically provided each in a projecting form on the base member 300 of the pallet 2, and a bottom section of the article 1 placed on the pallet 2, holes 545 formed in a bottom plate 534 of the copying machine shown in the figure are engaged with the positioning pins respectively, and with this construction, the article 1 is correctly positioned against the pallet 2.

A plurality of threaded screw holes 546 are formed in the base member 300 of the pallet 2 shown in FIG. 88 and FIG. 89, and a plurality of holes 545A are formed in a bottom section of the article 1 placed on the pallet 2, in this case in the bottom plate 534. When the article 1 is placed on the pallet 2, the holes 545A are aligned to the screw holes 546 respectively, so that the bolts 547 are inserted into the holes 545A and the bolts 547 are set in the screw holes 546. By tightening the bolts 547 as described above, the article 1 is fixed to the pallet 2. The article 1 can be separated from the pallet 2 by removing the bolts 547. As described above, the screw holes 546 and bolts 547 form a fixing unit for removably fixing the article 1 to the pallet 2, and by providing the fixing unit as described above, when the article 1 is loaded on an article transporting/storing apparatus and transported together with the article transporting/storing apparatus, even if the article transporting/storing apparatus vibrates or gets an impact, the article 1 can be kept fixed to the pallet 2.

For instance, when a copying machine as an example of the article 1 has a paper feed cassette, the paper feed cassette is pulled off from the front side to expose the holes 545A as shown in FIG. 89, and bolts 547 are inserted into the holes 545A.

In place of providing the positioning pins 544 shown in FIG. 88 and FIG. 89, the configuration is allowable in which four screw holes similar to the screw holes 545 are formed in the pallet, the article 1 is positioned against the pallet 2 by inserting bolts into the four screw holes to fix the article 1 to the pallet, however, when the article 1 is placed on the pallet 2, it is necessary to set a number of bolts in the screw holes, and the work is very complicated and troublesome. In contrast, like in the case shown in FIG. 88 and FIG. 89, when the article 1 is positioned with the positioning pins 544 and the article 1 is fixed to the pallet 2 by inserting bolts into the screw holes 546, a number of required bolts 547 can be reduced, and the work for setting the bolts or for removing the bolts can be simplified. As described above, when a positioning unit for positioning the article 1 placed on the pallet 2 to the pallet 2 and a fixing unit for removable fixing the article 1 placed on the pallet 2 to the pallet 2 are provided in the article transporting/storing apparatus, the work for attaching the article 1 to the pallet 2 can be simplified.

In the example shown in FIG. 88 and FIG. 89, two positioning pins 544 are provided and two bolts 547 are used for fixing. However, when the number of bolts 547 is less than the number of positioning pins 544 and for instance, three positioning pins 544 and one bolt 547 are used, the work for attaching the article 1 to or removing the article 1 from the pallet 2 can be further simplified. In this configuration, a number of places for positioning the article 1 to the pallet 2 with a positioning unit is smaller than a number of places for fixing the article 1 to the pallet 2 with a fixing unit.

A configuration is allowable in which many screw holes 546 are formed in the pallet 2 and some of the screw holes 546 are selected according to the weight of the article 1. For instance, when the article 1 is heavy, the article 1 is fixed tightly to the pallet 2 by inserting bolts into all of the screw holes 546, and when the article 1 is light, the article 1 is fixed to the pallet 2 by inserting the bolts 547 into only some of the screw holes 546. Further, a configuration is allowable in which screw holes 546 having various sizes are provided, and when a heavy article is to be transported, the article is fixed to the pallet 2 by inserting larger bolts only into screw holes 546 having a large bore. With this configuration, the article 1 can be fixed to the pallet 2 with an appropriate tightening force and also the work for removing the light-weight article 1 from the pallet 2 can be simplified.

Figure 99:
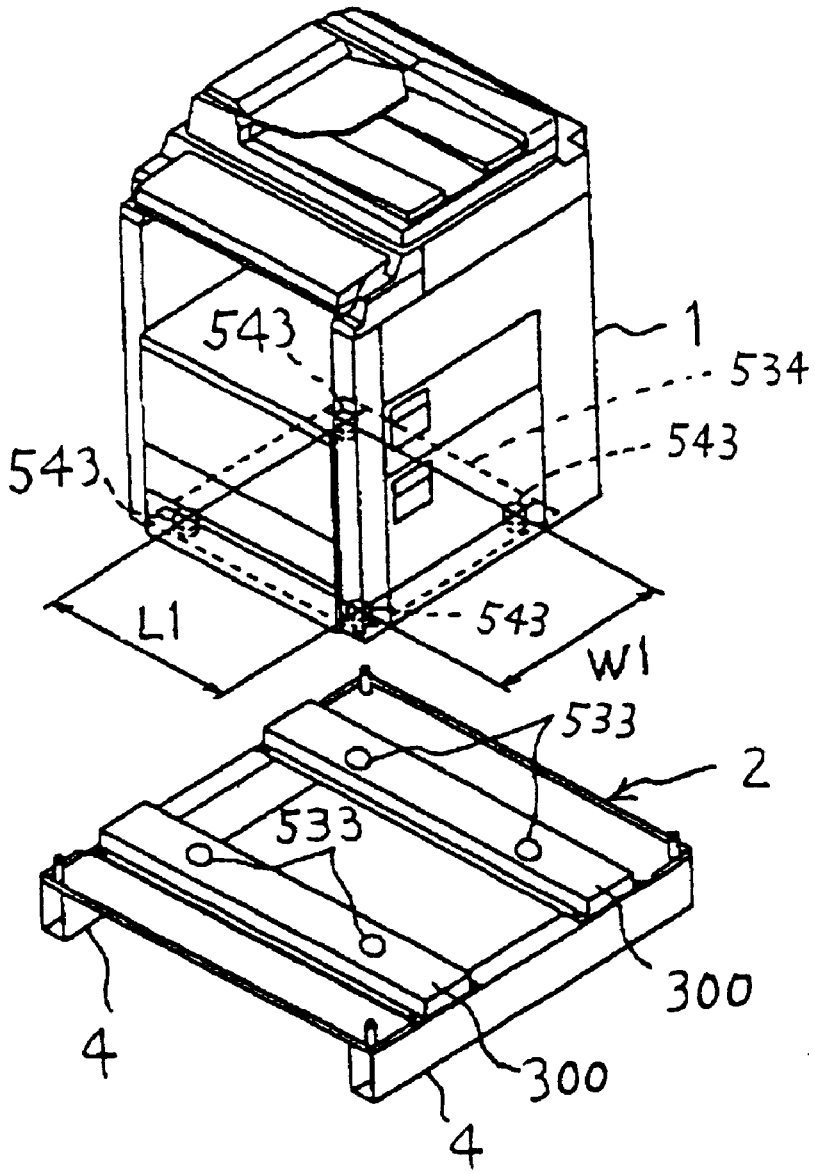
FIG. 99 is a perspective view showing a relation between a small-sized copying machine and the pallet.

In the example shown in FIG. 88 and FIG. 99, the positioning pins 544 are directly fixed to the base member 300 of the pallet 2. On the other hand, in the example shown in FIG. 90, a pair of the positioning pins 544 forming the positioning unit described above are fixed to the mounting members 549, and the mounting members 549 are fixed with screws 550 to the base member 300 of the pallet 2. The positioning pins 544A are engaged like the positioning units 544 shown in FIG. 89 in the holes 545 of the article 1 to position the article 1 against the pallet 2.

As described above, the positioning unit has positioning pins 544A for positioning the article 1 placed on the pallet 2, and the positioning pins 544A are fixed to the mounting members 549 attached to the pallet 2. With this configuration, the positioning pins 544A are set via the mounting members 549 to the pallet 2, and when a large external force is loaded to the article transporting/storing apparatus or the article 1, large stress is generated in the positioning pins 544A as well as in the mounting members 549, but stress is not generated in the pallet 2. Because of this feature, even if the mounting member 549 is damaged or permanently deformed, it is possible to prevent the pallet 2 itself from being damaged or permanently deformed. As energy is absorbed due to deformation of the mounting member 549, permanent deformation of the pallet 2 can be prevented. The pallet 2 itself is damaged or permanently deformed, and when the pallet 2 is abolished, economical loss is generated, but when the mounting member 549 is used, even if the mounting member 549 is damaged or permanently deformed and is exchanged for anew one, as the mounting member 549 is far smaller than the pallet 2 and can be produced with lower cost, the economical loss can be suppressed to the minimum level.

Figure 91:
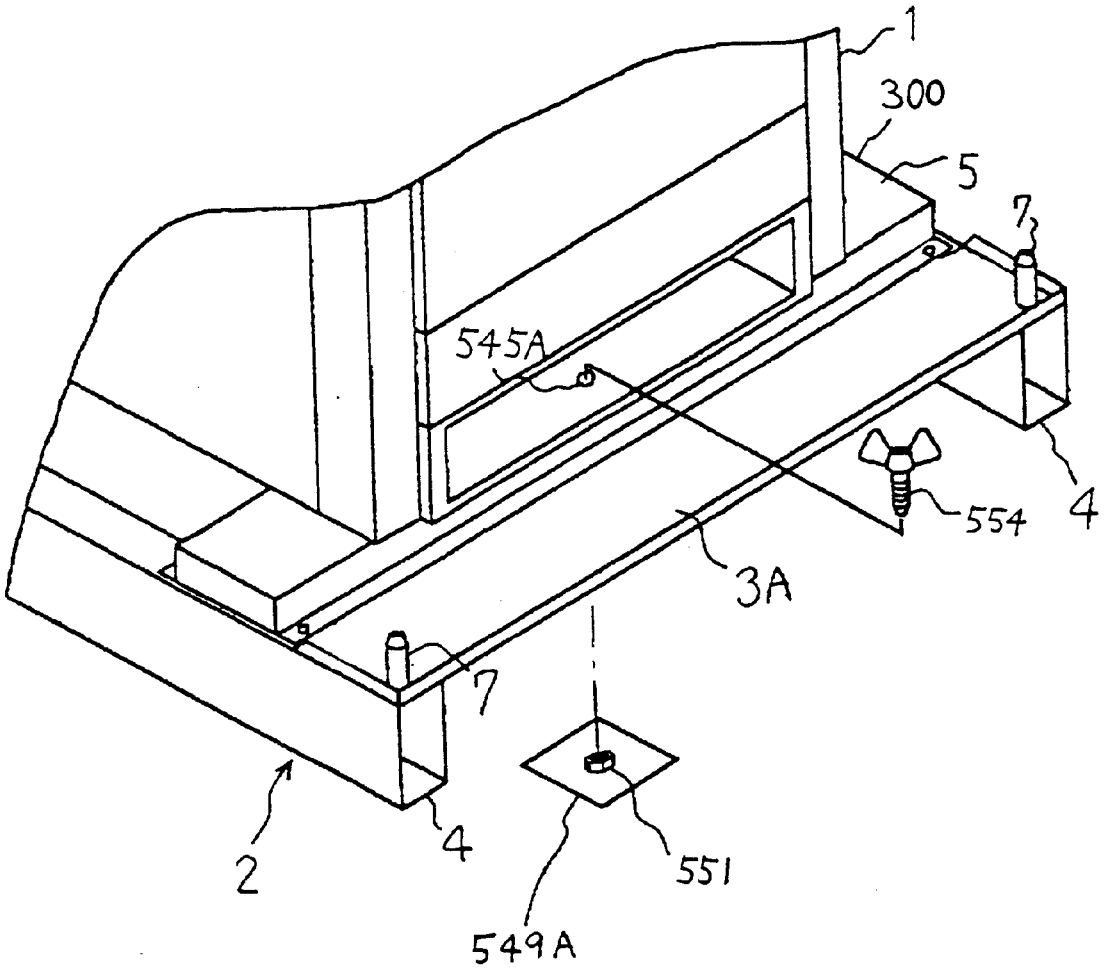
FIG. 91 is a perspective view showing an example in which a nut is fixed to the mounting member.

In the article transporting/storing apparatus shown in FIG. 91, the fixing unit has a fixing member comprising a nut 551 and a bolt 554 screwed into the nut 551, and also the nut 551 is fixed to the mounting member 549A. A throughhole is formed in a section of the mounting member 549A corresponding to a central hole of the nut 551, and a hole not shown herein is formed also in the base member 300 of the pallet 2, and a hole 545A formed in the article 1 placed on the pallet 2 is aligned to the hole formed in the pallet 2. In this state, the mounting member 549A is contacted to the base member 300 from the bottom side (See FIG. 94) to align a central hole of the nut 551 with the hole of the pallet 2 as well as with the hole 545A of the article 1, and a bolt is inserted into these holes with the nut 551 set thereon, and the bolt 545 is tightened.

Figure 92:
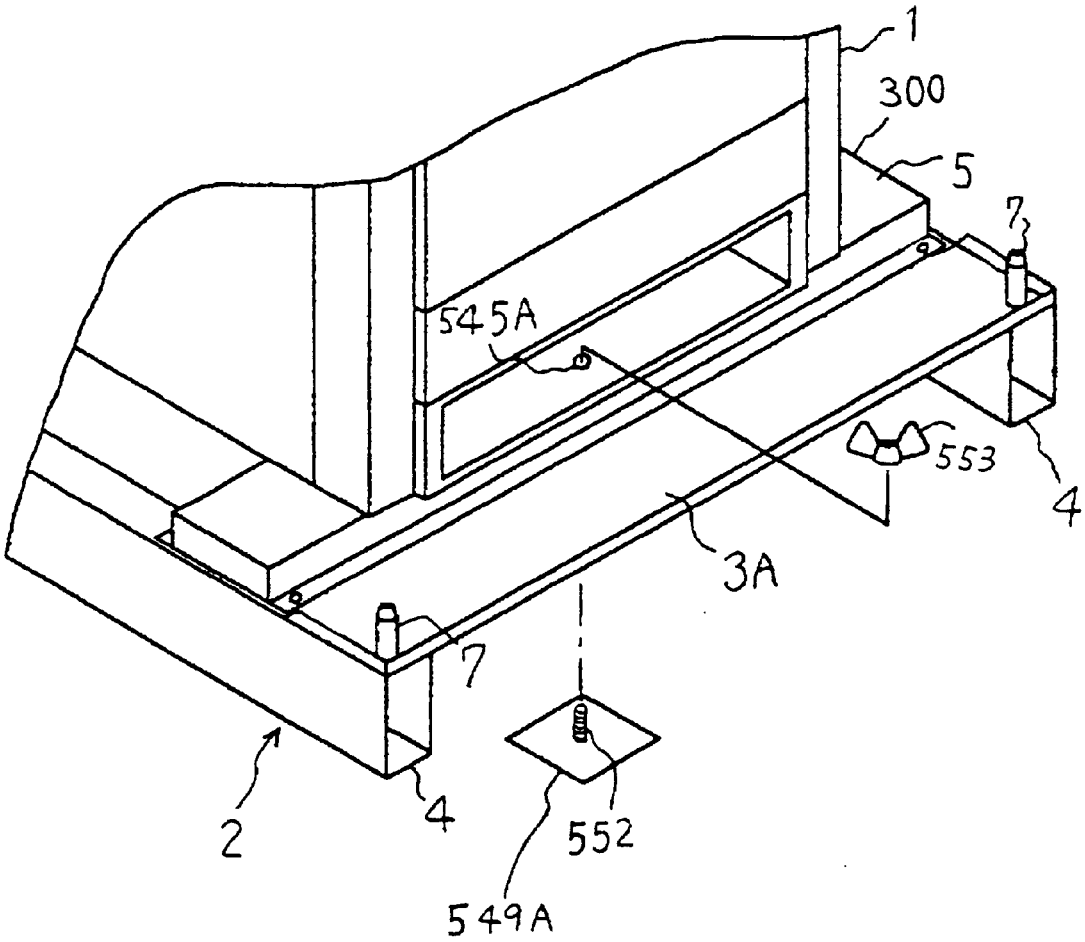
FIG. 92 is a perspective view showing an example in which a bolt is fixed to the mounting member.

The configuration shown in FIG. 92 is allowable in which a fixing member comprising a bolt 552 is tightly set to the mounting member 549A, the bolt 552 is inserted into the hole of the pallet 2 as well as into the hole 545A of the article 1 aligned therewith from the down side, and the nut 553 is set on the bolt 552 and tightened.

As described above, in the article transporting/storing apparatus shown in FIG. 91 and FIG. 92 the fixing unit has a fixing member for fixing the article 1 placed on the pallet 2 to the pallet 2, namely the but 551 or bolt 552, and the fixing member is set to the mounting member 549A mounted to the pallet 2. Therefore, like in the example shown in FIG. 90, when a strong external force is loaded to the article transporting/storing apparatus or to the article 1, not the pallet 2 but the mounting member 549A is damaged or permanently deformed, and with this feature, the economical loss caused by the accident as described above can be suppressed to the minimum level.

Figure 93:
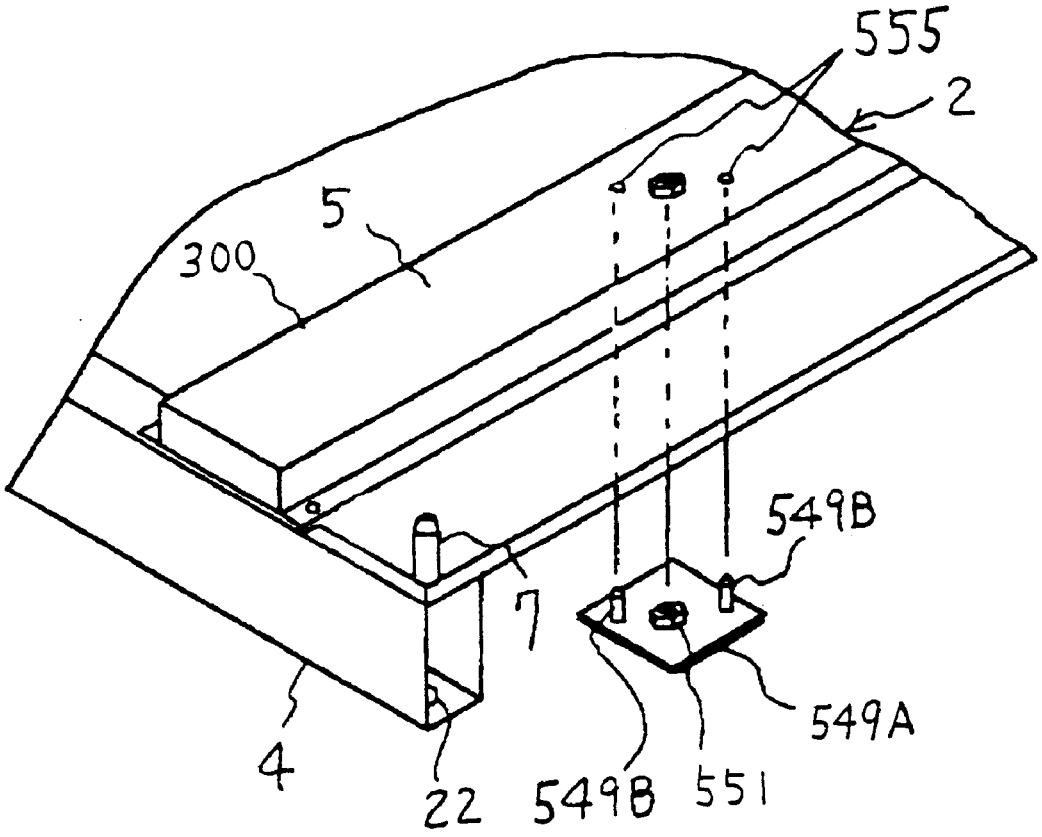
FIG. 93 is a perspective view showing an example in which positioning pins are provided on the mounting member.
Figure 94:
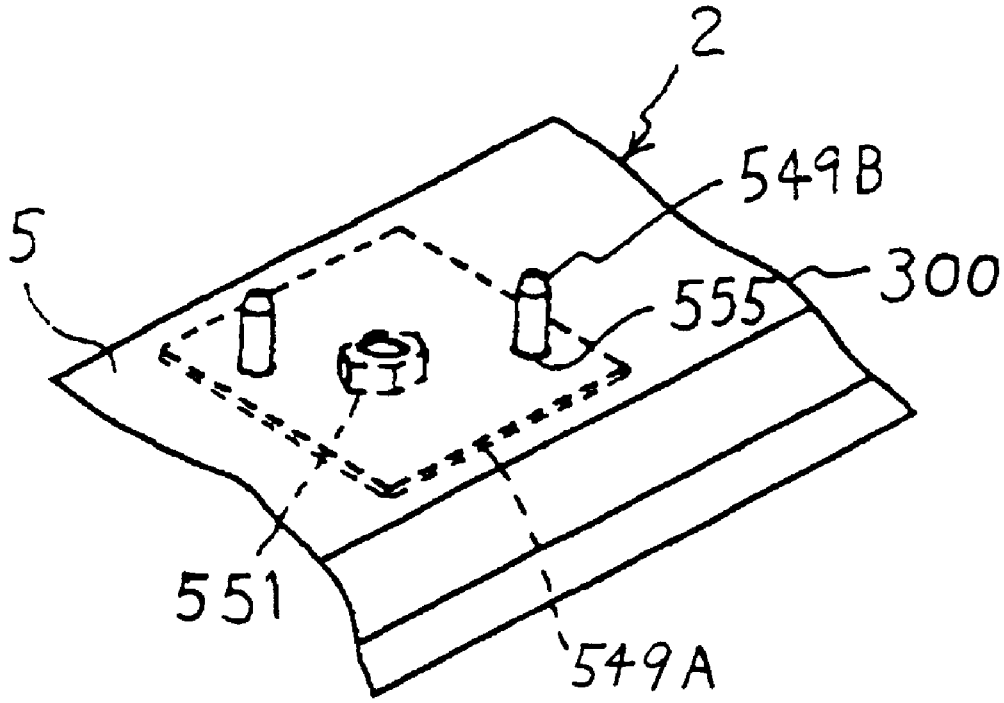
FIG. 94 is a perspective view showing a situation in which the mounting member shown in FIG. 93 is set to the pallet.

Further, the configuration shown in FIG. 93 and FIG. 94 is allowable in which a plurality of pins 549B for positioning are provided each in a protecting form on the mounting member 549A and the pins 549B are engaged with holes 555 for positioning formed in the base member 300 when the mounting member 549 is contacted to the base member 300 from the down side. Although not shown in the figures, pins for positioning may be provided each in a projecting form in the pallet 2, and positioning may be made by engaging the pins in the holes for positioning formed in the mounting member 549A for positioning the mounting member 549A. As described above, by providing a positioning unit for positioning the mounting member 549A against the pallet 2, the mounting member 549 can easily be positioned against the pallet 2.

Figure 90:
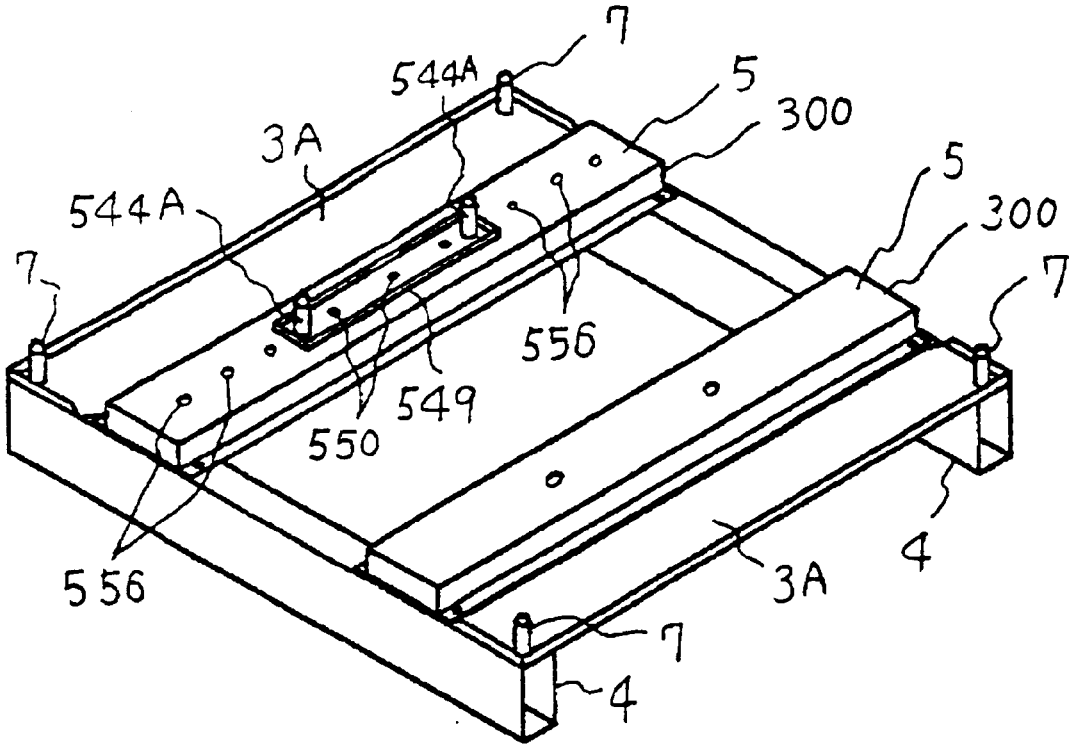
FIG. 90 is a perspective view showing an example in which the positioning pin is fixed to a mounting member.

The configuration is applicable in which the bolt 552 is used as shown in FIG. 92, and is further applicable to the mounting member 549 shown in FIG. 90.

When the mounting members 549, 549A are position-adjustably attached to the pallet 2, relative positions of the positioning pin 544A, nut 551, and bolt 552 against the pallet 2 can be changed, and various types of article 1 having holes 545 and 545A at different positions can be positioned against or fixed to the pallet 2. For instance, as shown in FIG. 90, a number of screw holes 556 are formed in the base member 300, appropriate screw holes 556 are selected according to positions of the holes 545 of the article 1 (See FIG. 89), and screws 556 are set in the screw holes 556 to fix the mounting member 549 to the pallet 2. Also the mounting member 549 shown in FIG. 91 to FIG. 94 can be attached to the pallet 2 by selecting appropriate mounting positions.

Figure 95:
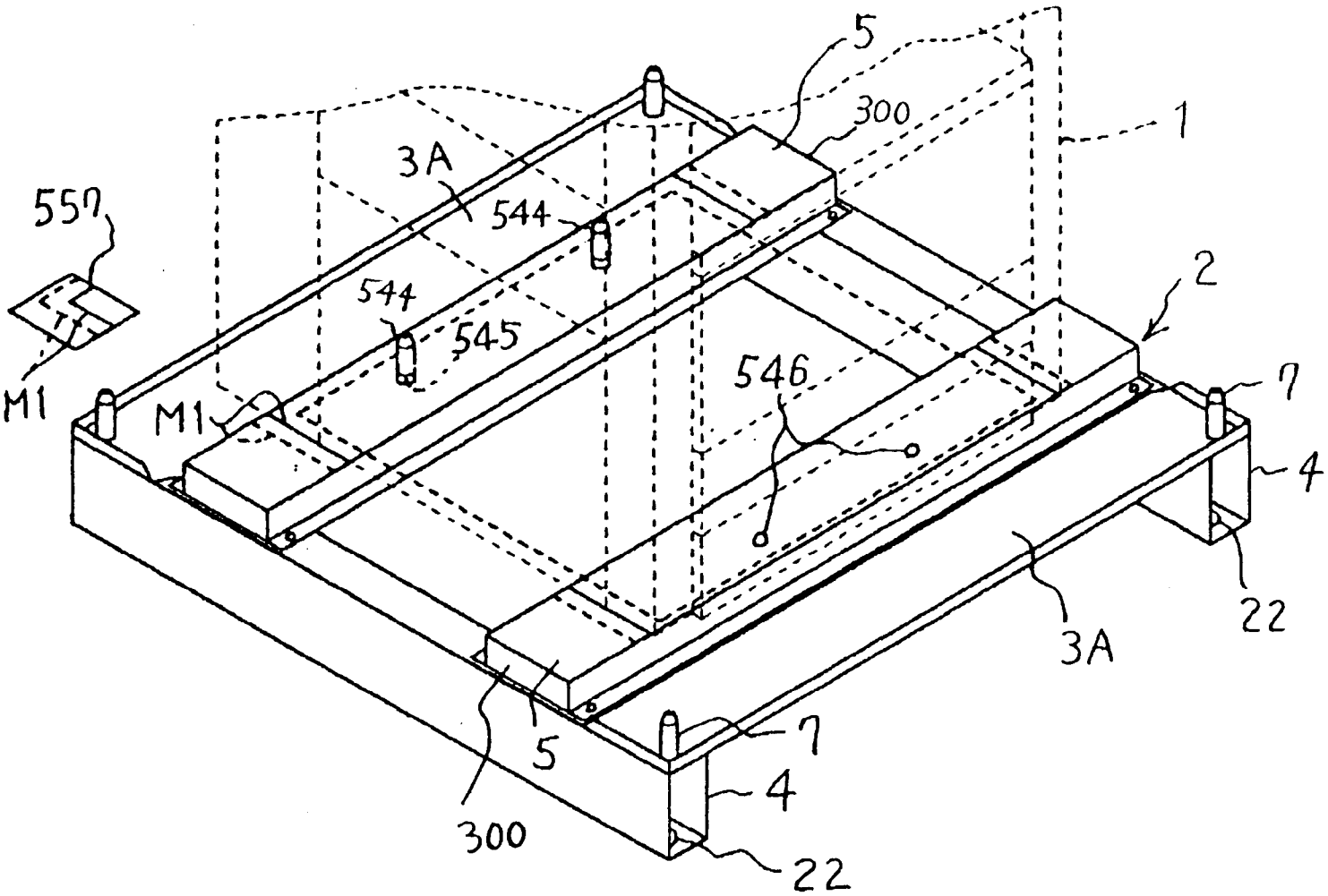
FIG. 95 is a view showing a situation in which a copying machine indicated by dashed line is attached to the pallet shown in FIG. 88.

FIG. 95 is a perspective view showing with a dashed line the article 1 placed on the pallet 2 shown in FIG. 88, and when the article 1 is placed on the pallet 2, usually the positioning pins 544 and screw holes 546 are located at positions under the article 1, so that a worker can not visually check the pins or holes, and the work for loading an article is difficult.

To solve the problem, when a marker M1 as a reference for placing the article 1 on the pallet 2 is provided on the pallet 2, the work for placing thereon the pallet can be carried out quite easily. For instance, when solid lines and a marker M1 drawn with a dashed line are prepared according to a size of the article 1 to be transported on the base member 300 of the pallet 2 as shown in FIG. 95, the article 1 is aligned to the marker M1 corresponding to a size of the article 1. FIG. 95 shows a situation in which an edge of the article 1 has been aligned to the solid line marker. With this, the article 1 can easily and correctly be placed on the pallet 2 with the positioning pins 544 automatically engaged with the holes 545 of the article 1 and also the screw holes of the pallet 2 automatically aligned to the holes 545A of the article 1.

Further in place of forming the marker M1 directly on the pallet 2, the marker M1 may be formed on a marker member 557 such as a plate, a sheet, or a film, and the marker member 557 may be fixed to the pallet 2, for instance, by adhering to the pallet 2 as shown in FIG. 95.

When the article 1 is loaded onto the pallet 2 not manually but automatically by, for instance, a robot, the configuration is allowable in which the marker M1 is detected by a sensor not shown in the figure and the robot is operated according to the detected information to correctly place the article 1 on the pallet 2.

Configuration relating to the marker M1 can be applied to all of the configurations described above.

The base member 300 of the pallet 2 can be fixed to specified section of the two leg sections 4, but when the base member 300 is position-adjustably set to the leg sections 4, articles 1 having various sizes can be placed on the base member 300.

Figure 96:
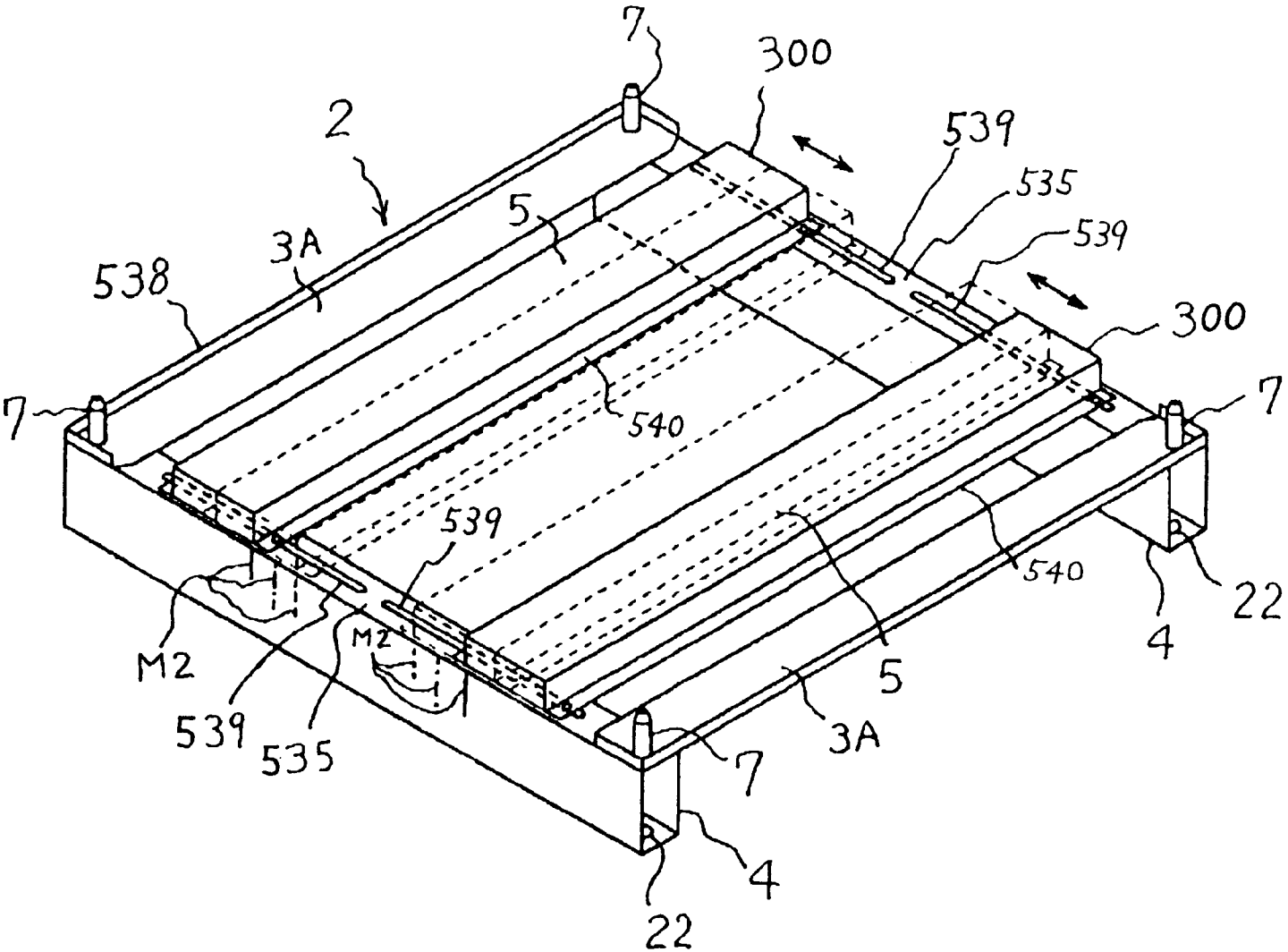
FIG. 96 is a perspective view showing an example in which a base member is position-adjustably fixed to the main body of the pallet.
Figure 97:
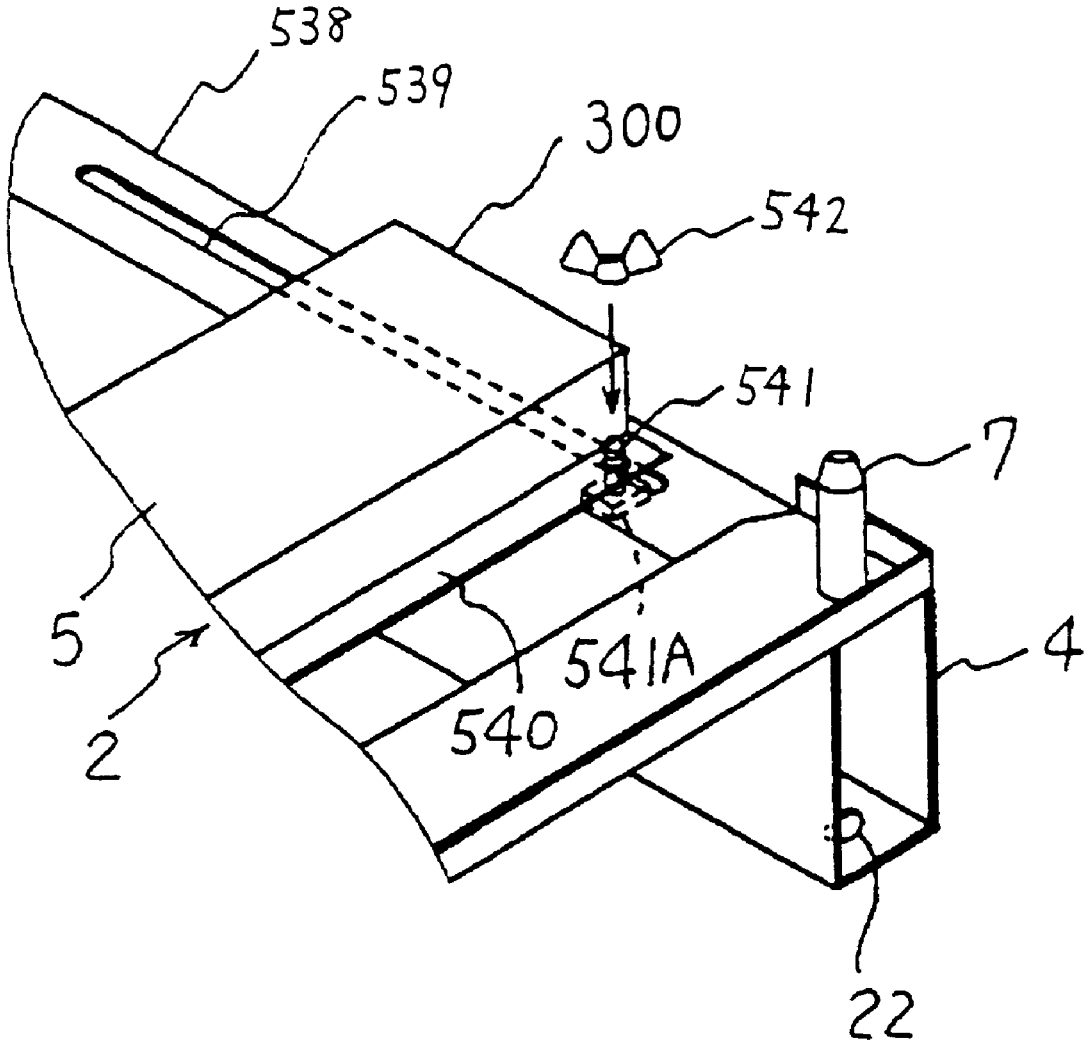
FIG. 97 is a partially enlarged view of the pallet shown in FIG. 96.

FIG. 96 and FIG. 97 shows examples of the configuration, and the basic configuration of the pallet 2 shown in these figures is not different from that of the pallet 2 shown in FIG. 57, but is different in the following points.

Assuming herein that a section of the pallet other than the base member 300 of the pallet 2 shown in FIG. 96 and FIG. 97 is a main body 538 of the pallet 2, the pallet 2 has the main body 538 and the base member 300 position-adjustably fixed to the main body 538 of the pallet. In this example, long holes 539 each extending in the longitudinal direction are formed on upper walls of the leg sections 4, and as clearly shown in FIG. 97, bolts 541 are inserted into throughholes formed at four positions in a flange section of each base member 539 so that the bolts can move in the longitudinal direction of the long hole 539, and a nut 542 is set on each of the bolts 541. A head section of each bolt 541 is positioned inside the leg sections 4, and width of the head section 541A is larger than that of the long hole 539.

When each nut 542 is loosened, the base member 300 can be moved against the main body 538 of the pallet in the direction indicated by the arrow in FIG. 96. After the base member 300 is moved to a desired position, for instance, to a position indicated by a dashed line in FIG. 96, by tightening the nuts, the base member 300 can be fixed to the main body 538 of the pallet at the position.

With this configuration, a position of the base member 300 against the main body 538 of the pallet can be adjusted according to a size of an article to be placed on the article-loading surface, and articles having various sizes can efficiently be loaded on the article-loading surface 5.

Further marker M2 indicating a position may be formed for instance in the leg sections so that a position of the base member 300 can easily and correctly be decided. In the example shown in the figure, marker M2 drawn with a dashed line, a dot and dash line, and a solid line are formed in the leg sections, and when a size of the article 1 is large, the base member 300 is positioned according to, for instance, the solid line position, and is fixed to the leg section. When a size of the article 1 is small, the base member 300 may be positioned according to a position of the dashed line. Also in this case, like in the example shown in FIG. 95, the marker M2 may be formed on a marker member, and the marker member may be fixed to the pallet 2.

As described above, by providing the marker M2 as a reference when the base member 300 position-adjustably attached to the main body 538 of the pallet is fixed to the basic body 538 of the pallet, the base member 300 can easily be positioned against the main body 538 of the pallet. Also the configuration with the position-adjustable base member 300 and marker M2 can be applied to any of the configurations described above.

Description was made above for a number of examples of a positioning unit and a fixing unit for the article transporting/storing apparatus according to the present invention, the positioning unit positions the article 1 against the pallet 2 in cooperation with an article-side positioning unit such as leg sections 534 or holes 545 provided in the article 1. Similarly, the fixing unit fixed the article 1 to the pallet 2 in cooperation with the article-side fixing unit such as the holes 545A provided in the article 1. Namely, the article 1 transported with each of the article transporting/storing apparatuses described above has at least either one of an article-side positioning unit for positioning the article 1 against the pallet 2 in cooperation with the positioning unit described above and an article-side fixing unit for fixing the article 1 to the pallet 2 in cooperation with the fixing unit described above.

In the article 1 shown in FIG. 87, the article-side positioning unit comprises, as described above, the leg section 543 in a lower section of the article which can be engaged with the engagement section (throughholes 533 in FIG. 87) constituting the positioning unit provided on the pallet 2. The leg sections 543 are originally provided in industrial products such as a copying machine, and by using the leg sections 543 as the article-side positioning unit, the necessity of providing any specific article-side positioning unit for deciding a position of the article against the pallet 2, which is useful in suppression of the product cost.

When the article 1 is an electric equipment such as a copying machine, a printer, a facsimile machine, a television, a washing machine, a refrigerator or the like, if a space between leg sections is set to a common distance in at least two different types of industrial products, there is provided the advantage that different types of industrial products can be positioned similarly to a pallet having the same form and transported in the state.

Figure 98:
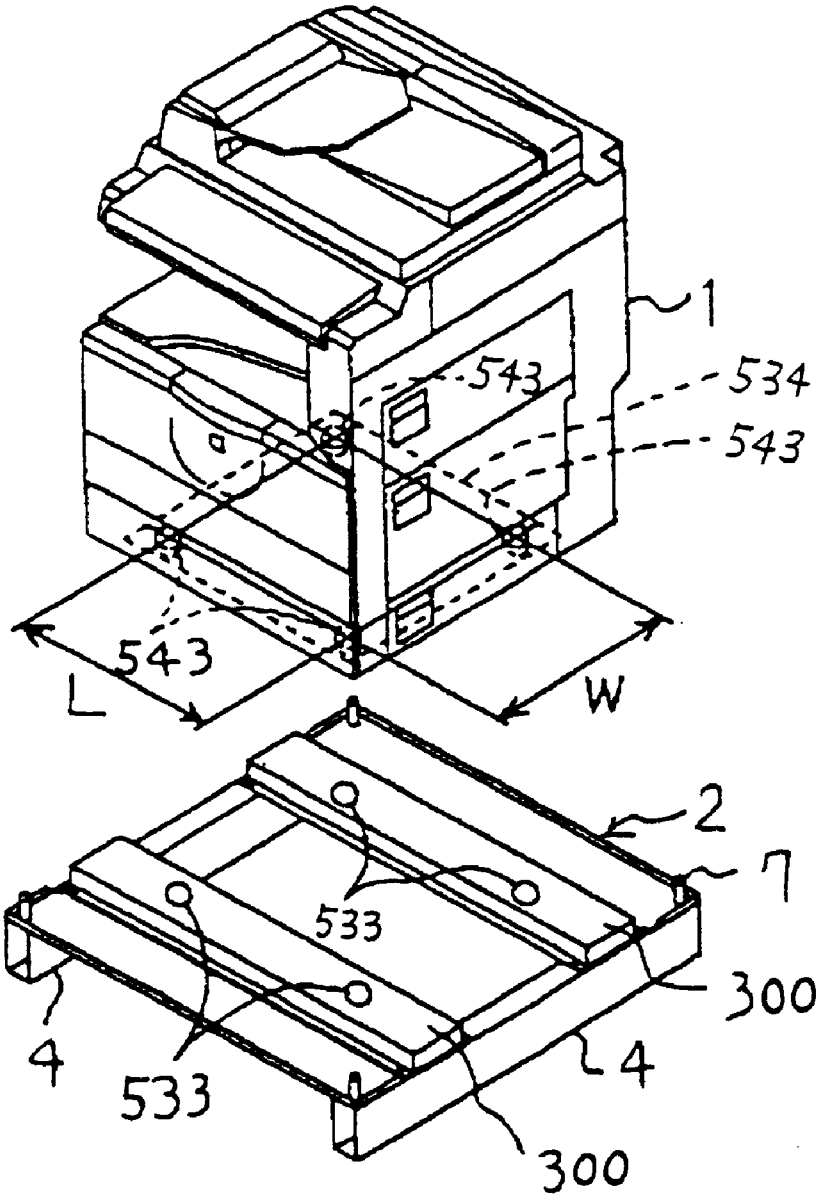
FIG. 98 is a perspective view showing a relation between a large-sized copying machine and the pallet.

FIG. 98 and FIG. 99 shows a specific example of the configuration. Herein it is assumed for convenience of description that the article 1 comprising a copying machine shown in FIG. 98 is larger than that shown in FIG. 99, and that types of the two copying machines are different from each other. Four legs 543 are provided on bottom plates of the copying machines respectively. The distance L and W between two adjoining legs of the large-size copying machine shown in FIG. 98 are equal to spaces L1 and W1 between two adjoining leg sections of the smaller-size copying machine shown in FIG. 99 (L=L1, and W=W1). Thus, distances L and W between two adjoining leg sections of a copying machine and distances L1 and W1 between two adjoining leg sections of another type of copying machine are equal to each other respectively. Because of this construction, either type of copying machine can be positioned on the same pallet 2 with an appropriate distance between the throughholes and can be transported in this state under stable conditions. Thus, it is not necessary to prepare a pallet with a space between the throughhoes 533 suited to a type of industrial product, which enables reduction in the cost of production of the pallet, and further it becomes possible to reduce cost of production of industrial products themselves such as a copying machine.

Figure 100:
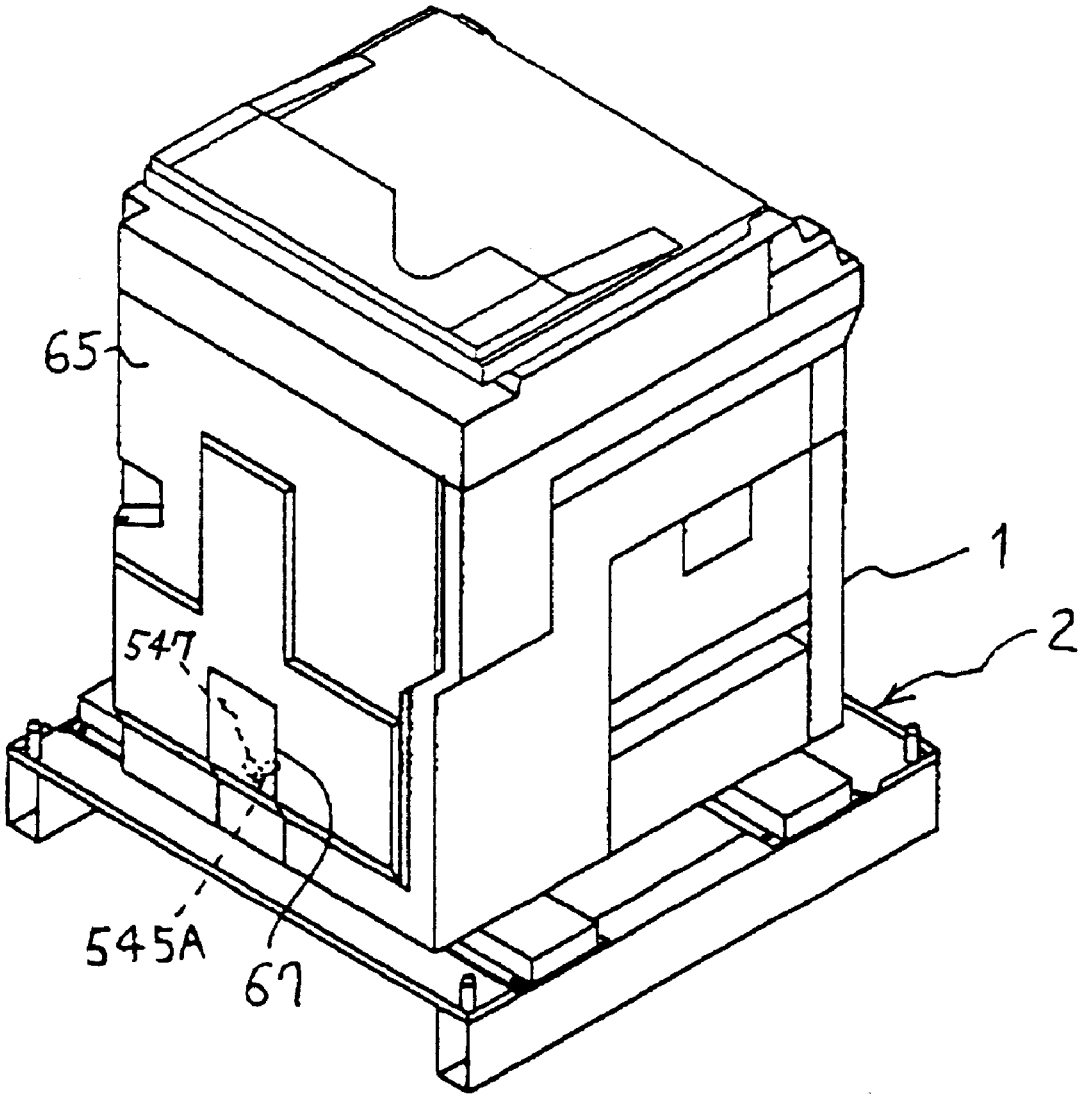
FIG. 100 is a perspective view showing an example in which a cover is provided at the back of the copying machine.

In the copying machine shown in FIG. 100, like in the copying machine shown in FIG. 89, holes 545A are formed in a bottom plate of the main body of the copying machine, and the article 1 comprising the copying machine is fixed to the pallet 2 by inserting the bolts 547 into the holes 545 and also into screw holes (not shown in FIG. 100) formed in the pallet 2. The holes 545A provide an example of the article-side fixing unit. In the example shown in FIG. 89, the holes 545A are formed in the front side of the copying machine, a paper feed cassette (not shown) is pulled out as described above, hands are inserted from a space in the front side of the copying machine to set the bolts 547 in the holes 545A, and thus the work for screwing the bolts into the screw holes 546 can be carried out easily. However, the holes 545A shown in FIG. 100 are located in far inside of the main body of the copying machine, so that it is impossible to insert hands therein from the front side of the copying machine to insert the bolts 547 in the holes 545A and screw the bolts into the screw holes. By removing the cover 65 at the rear side of the copying machine, the bolts 547 can be screwed into the screw holes 545A, but it is very troublesome to remove the cover 65 each time the coupling member is transported.

Figure 101:
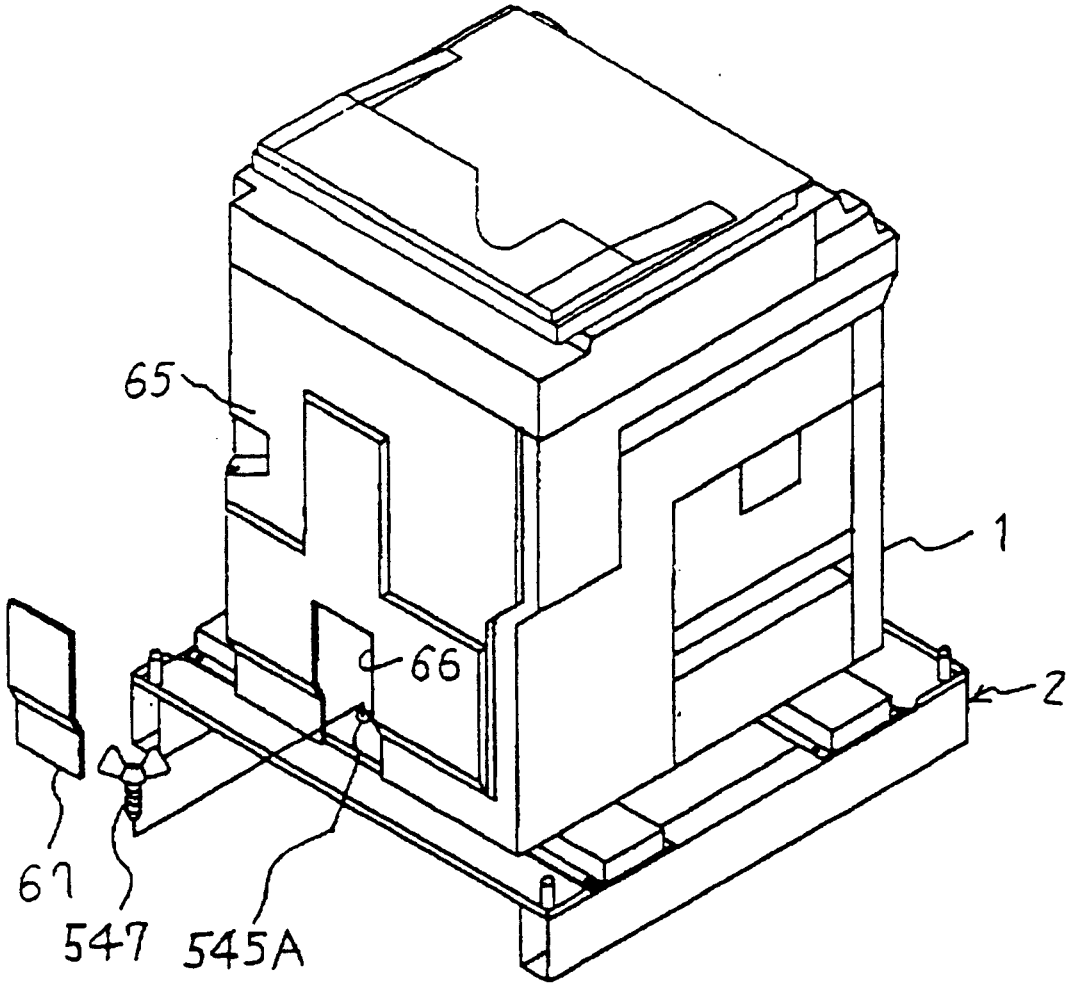
FIG. 101 is a perspective view showing a situation in which the cover shown in FIG. 100 is opened.

To overcome this problem, an opening 66 is formed in the outer cover 65 of the copying machine in the example shown in FIG. 100 and FIG. 101 with a cover 67 attached to this opening 66 so that the cover 67 can be opened or closed, and the holes 545A constituting an article-side fixing unit are located inside in the inner side from the cover 67. The cover 65 is usually kept closed as shown in FIG. 100 and the opening 66 is closed. When the copying machine is fixed to the pallet 2, the cover 67 is removed from the main body of the copying machine as shown in FIG. 101, and the opening 66 is opened. Thus, as the hole 545A is located at a position close to the opening 66, the bolt 547 can be passed through the hole 545A and screwed into the screw hole of the pallet 2. When this work is finished, the cover is put back to close the opening 66. The bolt 547 can be removed by executing a similar work. This configuration can also be applied to the article comprising an industrial product other than a copying machine.

As described above, in the example shown in FIG. 100 and FIG. 101, the holes 545A as an example of the article-side fixing unit are within the main body of the article and is located in the inner side from the cover 67 attached to the opening 66 of the main body of the article so that the cover can be opened or closed according to the necessity. With the configuration, the holes 545A can easily be accessed by hands by opening the cover 65.

However, as understood from the above description, the holes 545 and holes 545A shown in FIG. 89, FIG. 91, FIG. 92, FIG. 100, and FIG. 101 form an article-side positioning unit and an article-side fixing unit respectively, but the holes 545 and 545A are formed in an article as holes mainly for positioning or fixing the article to the pallet. In contrast, when holes used for application other than fixing the article 1 to the pallet 2 as the holes 545 and 545A are used as the holes 545 and 545A, the production cost of the article can be reduced.

Figure 102:
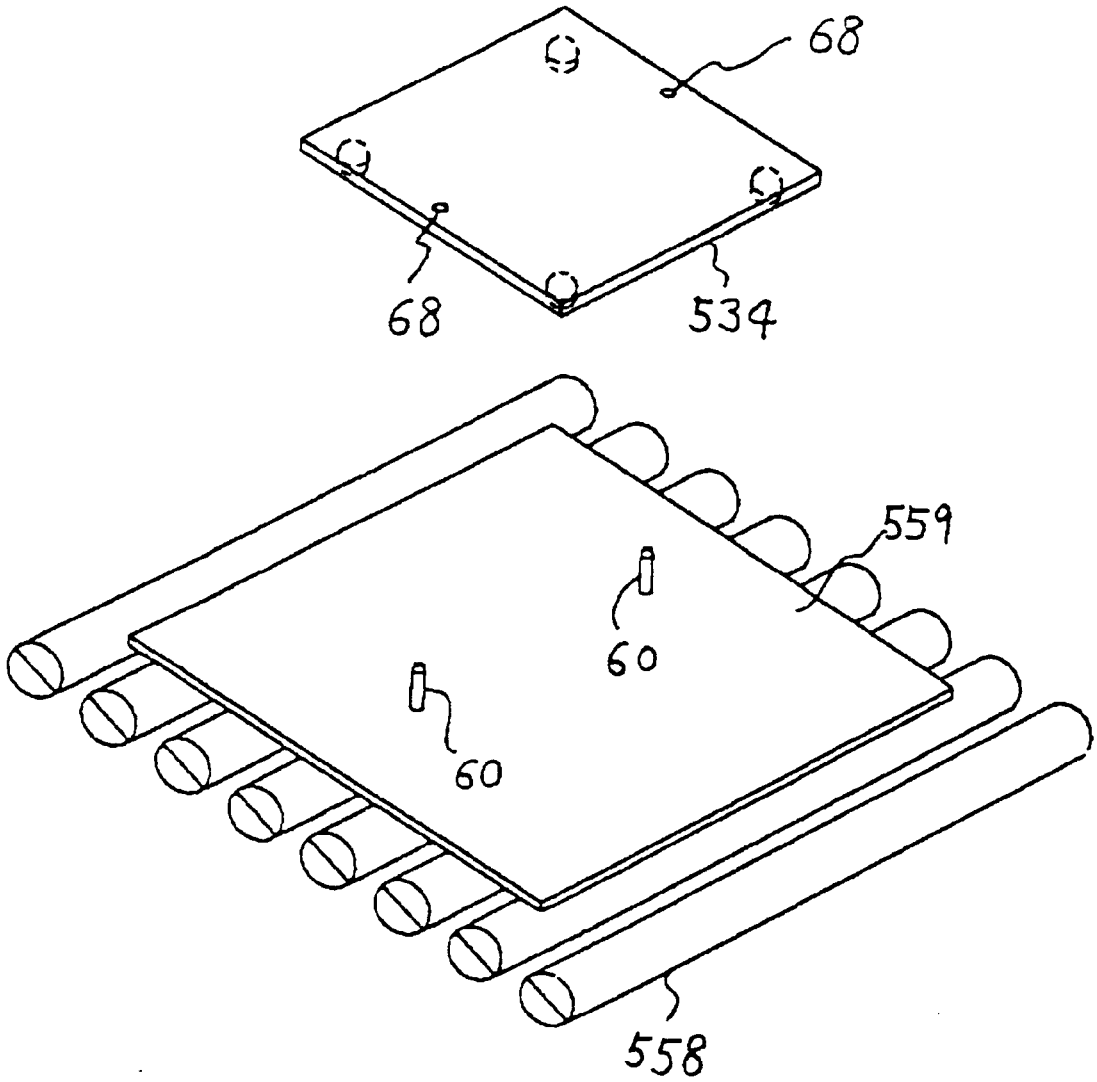
FIG. 102 is a perspective view showing a tool plate on a conveyor and a bottom plate of a copying machine.
Figure 103:
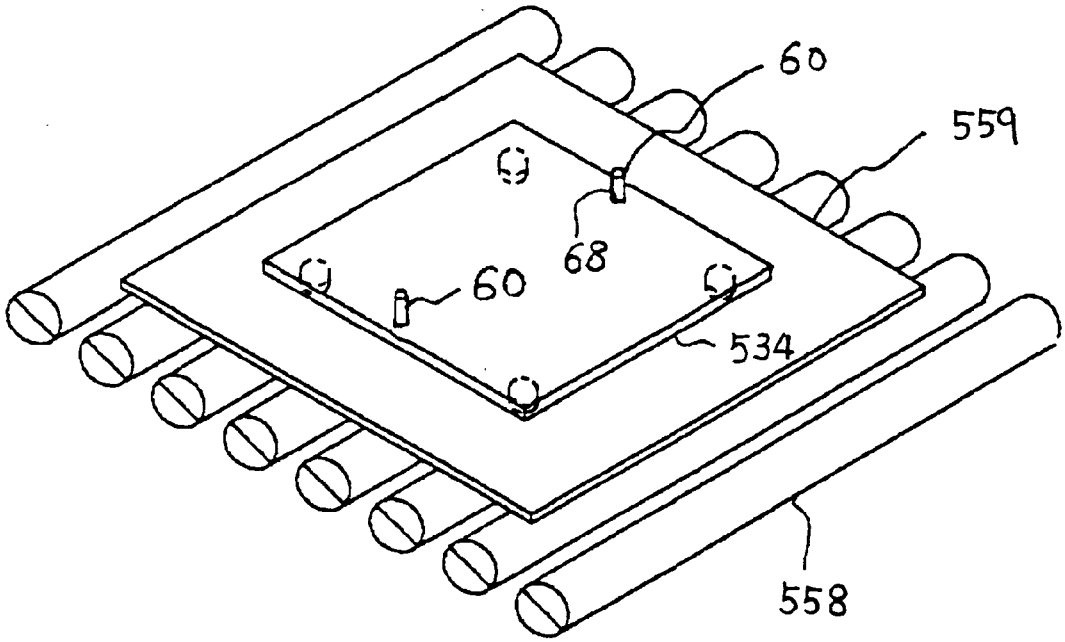
FIG. 103 is a perspective view showing a situation in which the bottom plate is set on the tool plate.

FIG. 102 and FIG. 103 are explanatory views each showing a situation when a copying machine is manufactured, and in this situation, a tool plate 559 is placed on a conveyor 558 in the production line, and two positioning pins 60 are provided each in the projecting form on the tool plate 559. A bottom plate 534 is placed on this tool plate 559, and the pins 60 of the tool plate 559 are engaged with the positioning holes 68 formed in the bottom plate 534, thus the bottom plate 534 being positioned against the tool plate 559. Other components of the copying machine are assembled to this bottom plate 534.

As described above, positioning holes used when a copying machine is manufactured are the holes 545 for positioning or the holes 545A for fixing shown in FIG. 89, FIG. 91, FIG. 92, FIG. 100 and FIG. 101. Thus, it is not necessary to provide holes mainly used for positioning or fixing the article 1 to the pallet 2, which allows reduction of the production cost of the pallet.

Figure 104:
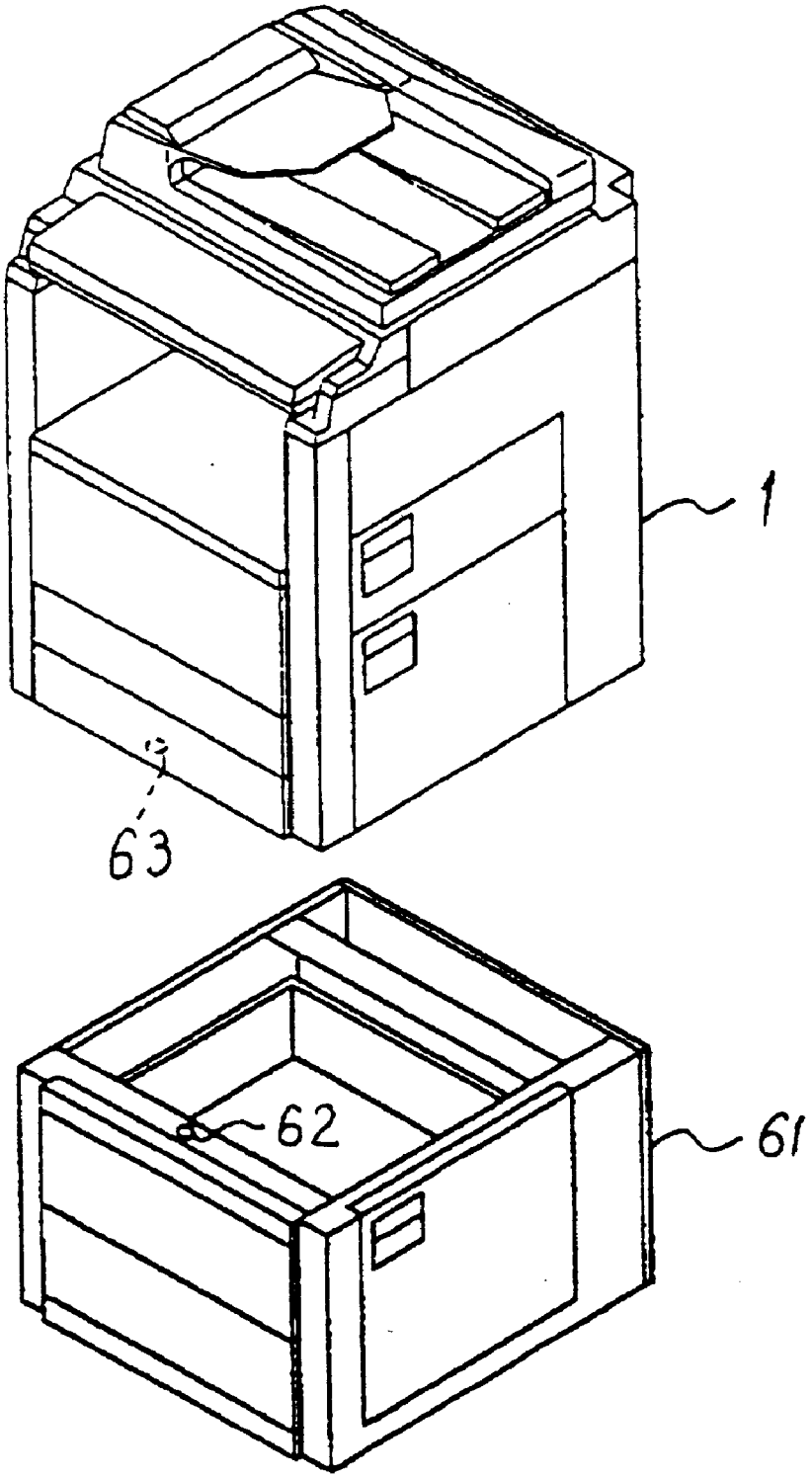
FIG. 104 is a perspective view showing a copying machine and a paper feed tray.
Figure 105:
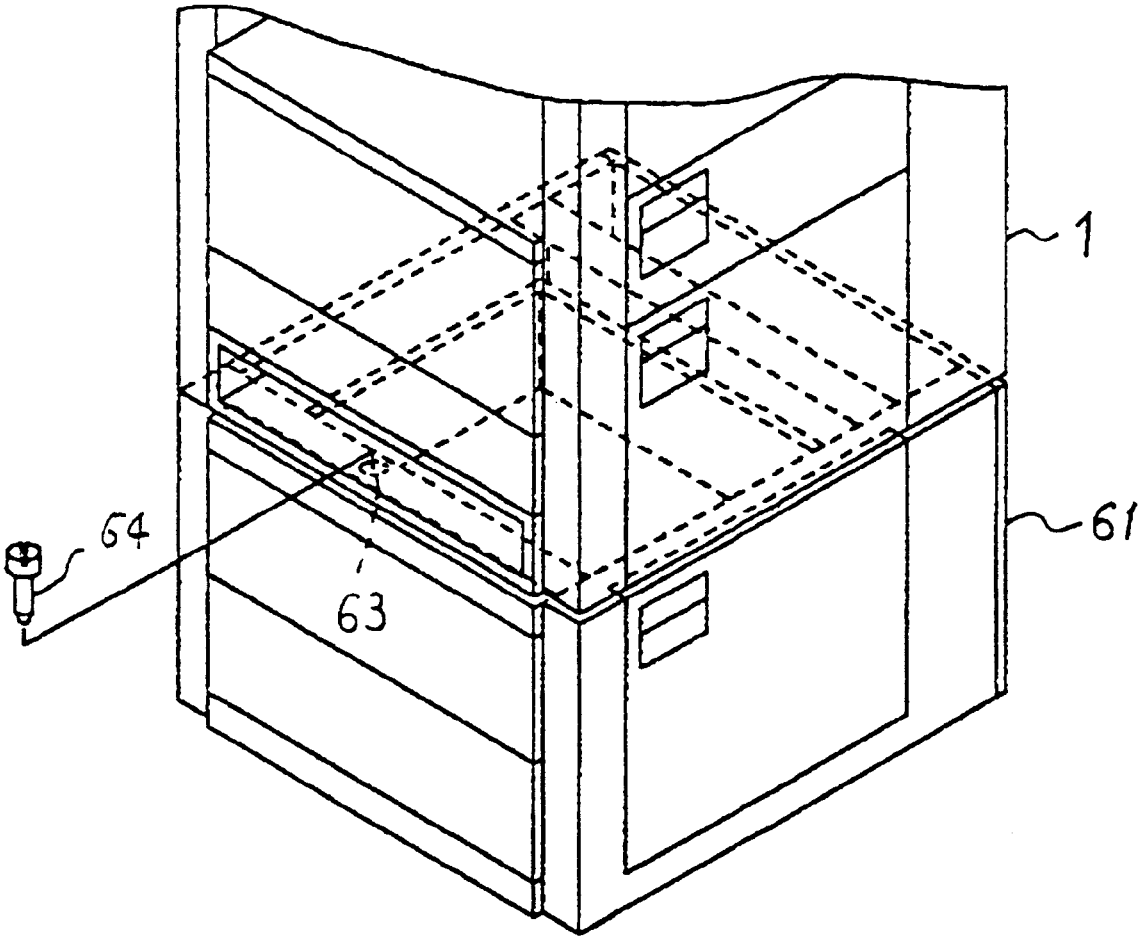
FIG. 105 is a perspective view showing a situation in which the copying machine shown in FIG. 104 and the paper feed tray are piled up on each other.

FIG. 104 and FIG. 105 each show the article 1 comprising a copying machine and a paper feed tray device 61 connected to a lower section thereof in use, and screw holes 62 are formed in this paper feed device 61, while mounting holes 63 are formed in the copying machine. When the copying machine and paper feed tray device 61 each having the configuration as described above are used under control by a user, the copying machine and paper feed tray device 61 are piled up as shown in FIG. 104 with the screws 64 screwed into the mounting holes 63, and also the screws 64 are screwed into the screw holes 62 to attach the copying machine and paper feed tray device 61 to each other.

When the article 1 comprising the copying machine as described above is positioned against the pallet 2, the mounting holes 63 described above are used as the holes 545 shown, for instance, in FIG. 89, and the positioning pins 544 are engaged in the mounting holes 63. When the article comprising the copying machine shown in FIG. 104 is fixed to the pallet 2, the mounting holes 63 are used as the holes 545A shown in, for instance, in FIG. 89, the bolts 547 are inserted into the mounting holes 63 and screwed into the screw holes 546 of the pallet 2 to fix the article to the pallet. By using the screws 64 shown in FIG. 105 as the bolts 547 for fixing the copying machine to the pallet 2, efficiency in use of the screws can be improved. When it is necessary to increase the fixing strength in fixing the article 1 comprising a copying machine to the pallet 2, the screws 64, mounting holes 63 and screw holes 62 with the screws 64 inserted therein are made with a large diameter respectively so that the required strength in fixing the article 1 to the pallet 2 can be obtained.

As described above, when the article-side positioning unit comprises the holes 63 used for various purposes other than fixing an article to the pallet 2 and the article-side fixing unit comprises the holes 63 used for various purposes other than fixing the article to the pallet 2, there is provided the advantage that increase of production cost for the article can be suppressed. Also this configuration can be applied to each of the configurations, and especially to those relating to the cover 67 shown in FIG. 100 and FIG. 101.

Various embodiments of the present invention were described above, but the article transporting/storing apparatus or the article transported with the article transporting/storing apparatus can be constructed by combining the various types of configuration described above according to the necessity. Also the present invention can be applied to substantially any types of article transporting/storing apparatus for various products other than the articles described above including cars, parts thereof such as an engine, furniture, and construction materials.

With the invention, a space between two adjoining supports can be adjusted, so that an article having any size can efficiently be transported or stored.

With the invention, a degree in freedom of adjusting a space between two adjoining supports can be improved.

With the present invention, an article can easily be loaded on or unloaded from a pallet by removing the first and second coupling members from the joints.

With the present invention, even if vibrations are applied to the article transporting/storing apparatus from the outside, it is possible to prevent the article transporting/storing apparatus from violently vibrating.

With the present invention, cost of the joint fixing member can be reduced.

With the present invention, loss of the joint fixing member can be prevented.

With the present invention, a space above the article transporting/storing apparatus can efficiently be utilized.

With the present invention, it is possible to prevent an article on a ceiling plate from falling.

With the present invention, supports having been removed from a pallet can be accommodated in a compact form.

With the present invention, the trouble that an external matter contacts an article on the pallet can be suppressed.

With the present invention, a plurality of article transporting/storing apparatuses can be piled up on each other without fail.

With the present invention, components of the article transporting/storing apparatus can easily be exchanged for new ones or disposed.

With the present invention, the support unit removed from a pallet can be stored or transported in a compact form.

With the present invention, the trouble that fingers of a worker are held when the support unit is folded can be prevented.

With the present invention, a space between two adjoining supports can be adjusted, an article having any size can efficiently be transported or stored. In addition, an article on the pallet can be protected with a cover, and information concerning the article is displayed on the cover, so that any special member for providing the display is not required.

With the present invention, a freedom in adjusting a space between supports can be improved.

With the present invention, supports removed from the pallet can be folded into the compact form and stored in the state.

With the present invention, an article can be protected with a simple cover.

With the present invention, a plurality of article transporting/storing apparatuses can accurately be piled up on each other and stored or transported in the state.

With the present invention, a space between two adjoining supports can be adjusted, so that an article having any size can efficiently be transported or stored. In addition, in the state where the supports are attached to the pallet, a space between two adjoining supports can be restricted by coupling the upper sections of the supports, so that the supports are stabilized and in addition another article transporting/storing apparatus can be loaded onto the article transporting/storing apparatus easily.

With the present invention, an article transporting/storing apparatus can be loaded onto another article transporting/storing apparatus especially easily.

With the invention, displacement of an upper article transporting/storing apparatus with respect to the lower article transporting/storing apparatus can be prevented.

With the present invention, the supports can easily be folded by removing restricting unit from the supports.

With the present invention, the restricting unit having been removed from the support does not disturb worker's operations, and the restricting unit can easily be transported with the pallet with the supports having been therefrom.

With the present invention, as a space between two adjoining supports can be adjusted, an article having any size can efficiently be transported or stored. In addition, an article can smoothly be loaded on or unloaded from the pallet with an article holding section of an article loading/unloading device without giving any large impact to the article.

With the present invention, the folded support unit can be accommodated in the pallet, and when the article transporting/storing apparatus is not in use, the support unit and pallet can be stored in a compact form or transported in the state.

With the present invention, a support unit can be accommodated in the pallet, and additionally the pallets are piled up on each other and transported in the state.

With the present invention, an article having various sizes can efficiently be loaded onto the article-loading surface.

With the present invention, it is possible to construct an article transporting/storing apparatus in which a space between two adjoining supports can easily be adjusted.

With the present invention, the support unit can be stored in the erected state without fail, and the trouble that the support unit falls during transportation of the pallet can be prevented.

With the present invention, a space having a specified form can correctly be defined within piled-up pallets, and the support unit can be accommodated in the space without fail.

With the present invention, the trouble that, when an article is loaded on the article-loading surface of the pallet, the article is inclined can be prevented.

With the present invention, a support unit holding plate can be attached only to a pallet requiring an opening through which the support unit is inserted, and cost reduction as well as weight reduction of the pallet can be realized.

With the present invention, when piled-up pallets are raised, also the support units stored in the pallets are raised, and the pallets can easily be transported.

With the present invention, the state where the ends of the support unit does not exist on a pallet in the bottom layer of the pallets piled up into multiple layers, and the pallet can easily be transported with a cargo-handling machine or the like, and further support unit can efficiently be accommodated inside the piled-up pallets.

With the present invention, pallets corresponding to a number of openings formed in each pallet can be piled up to optimize a number of pallets piled up as described above.

With the present invention, the pallets piled up as described above can efficiently be loaded into or unloaded from the article accommodating space, and additionally the article-accommodating space can effectively be utilized.

With the present invention, the article transporting/storing apparatus can efficiently be loaded into or unloaded from the article-loading space, and further the article-accommodating space can effectively be utilized.

With the present invention, a state of the support unit stored inside piled-up pallets can visually be checked from outside of the piled-up pallets.

With the present invention, even when there is only one pallet, support units can be accommodated in the pallet.

With the present invention, a section for accommodating a support unit can be shared by leg sections of the pallet.

With the present invention, as a space between two adjoining supports can be adjusted, an article having any size can efficiently be transported or stored. In addition, an article placed on a pallet can be positioned against and fixed to the pallet, so that the article can be transported or stored in the further stable state. Furthermore, the work for fixing the article onto the pallet is simplified.

With the present invention, damage or permanent deformation of the pallet itself which may occur when a large external force is loaded to the article transporting/storing apparatus or the article can be prevented, hence economical loss can be suppressed to the minimum level.

With the present invention, various types of articles can be positioned against or fixed to a pallet having the same form.

With the present invention, an article can be loaded at a correct position on the pallet.

With the present invention, as a base member with an article placed thereon can be positioned against a main body of the pallet, articles having various sizes can be loaded on a pallet having the same form.

With the present invention, the base member can easily and correctly be attached to the pallet.

With the present invention, leg sections of an article also play a role of an article side positioning unit, so that it is possible to prevent construction of the article from becoming complicated.

With the present invention, various types of industrial products can be loaded on and transported with a common pallet.

With the present invention, an article can be fixed to the pallet by manually operating the article-side fixing unit.

With the present invention, it is possible to prevent construction of an article from becoming complicated.

Although the invention has been described with respect to a specific embodiment for a complete and clear disclosure, the appended claims are not to be thus limited but are to be construed as embodying all modifications and alternative constructions that may occur to one skilled in the art which fairly fall within the basic teaching herein set forth.

What is claimed is:

1. An article transporting/storing apparatus comprising:

a pallet having an article loading-surface on which an article is to be placed;

a plurality of supports detachably attached to said pallet to surround the article and to extend substantially vertically with respect to said article loading-surface; and a coupling unit which couples two adjoining supports to be parallely movable with each other so that a distance between the two adjoining supports is adjustable.

2. An article transporting/storing apparatus according to claim 1; wherein the coupling unit is constructed so as to correlatively adjust a space between the two adjoining supports so that the spaces between all adjoining two supports is changed at the same rate.

3. An article transporting/storing apparatus according to claim 1; wherein the coupling unit is constructed so as to correlatively adjust a space between the two adjoining supports so that the space between the two adjoining supports and that between other two adjoining supports located at opposite positions to the former adjoining two supports respectively are changed at the same rate.

4. An article transporting/storing apparatus according to claim 1 further comprising:

a ceiling plate detachably placed on said supports.

5. An article transporting/storing apparatus according to claim 4; wherein said ceiling plate has a drop-preventing unit for the article placed thereon.

6. An article transporting/storing apparatus according to claim 4; wherein an accommodation hole for accommodating said supports detached from said pallet and the coupling units for the supports or the coupling members each constituting the coupling unit is formed in said ceiling plate.

7. An article transporting/storing apparatus according to claim 1 further comprising:

a protecting unit for shielding at least a portion of a space between two adjoining supports.

8. An article transporting/storing apparatus according to claim 1; wherein said pallet has a coupling section for an upper section of other article transporting/storing apparatus detachably coupled thereto on the side opposite of the article-loading surface thereof.

9. An article transporting/storing apparatus according to claim 1 comprising:

first to fourth supports detachably attached to said pallet each in the substantially erected state against said article-loading surface of said pallet;

wherein said coupling unit comprises first to third joints attached to each of said first to fourth supports respectively, and first and second coupling members connecting the first and second supports, second and third supports, third and fourth supports, and fourth and first supports each located side by side to each other; and when said four supports are attached to said pallet, said second and third joints are located under said first joint and at the same time said second joint is located under said third joint and said first and second coupling members cross each other;

said first and second coupling members provided between said first and second supports located side by side have one edges thereof in the longitudinal direction rotatably connected to said first joints attached to said first and second supports respectively and at the same time has the other edges thereof in the longitudinal direction rotatably connected to said second joints attached to said second and first supports respectively;

said first and second coupling members provided between said second and third supports located side by side have one edges thereof in the longitudinal direction rotatably connected to said first joints attached to said second and third supports respectively and at the same time has the other edges thereof in the longitudinal direction rotatably connected to said third joints attached to said third and second supports respectively;

said first and second coupling members provided between said third and fourth supports located side by side have one edges thereof in the longitudinal direction rotatably connected to said first joints attached to said third and fourth supports respectively and at the same time the other edges thereof in the longitudinal direction rotatably connected to said second joints attached to said fourth and third supports respectively;

said first and second coupling members provided between said fourth and first supports located side by side have one edges thereon in the longitudinal direction rotatably connected to said first joints attached to said fourth and first supports respectively and at the same time have the other edges thereof in the longitudinal direction rotatably connected to said third joints attached to said first and fourth supports respectively;

and at least said second and third joints of the first to third joints are assembled to the respective supports so that the joints can be moved in the longitudinal direction.

10. An article transporting/storing apparatus comprising:

a pallet having an article loading-surface on which an article is to be placed;

a plurality of supports detachably attached to said pallet to surround the article and to extend substantially vertically with respect to said article loading-surface;

a coupling unit which couples two adjoining supports to be parallely movable with each other so that a distance between the two adjoining supports is adjustable; and a cover with information regarding the article displayed thereon and covering at least a portion of the article.

11. An article transporting/storing apparatus according to claim 10; wherein the coupling unit is constructed so as to correlatively adjust a space between two adjoining supports so that all spaces between two adjoining supports along the four edges of the pallet are changed at the same rate.

12. An article transporting/storing apparatus according to claim 10; wherein the coupling unit is constructed so as to adjust a space between two adjoining supports so that the space between two adjoining supports along one edge and that along an edge opposite to the former edge are changed at the same rate, and also so that the space between two adjoining supports on another edge and that on still another edge opposite to the another edge are changed at the same rate.

13. An article transporting/storing apparatus according to claim 10; wherein said supports detachably attached to said pallet and said coupling member coupling two adjoining supports to each other form a support unit foldable when detached from the pallet.

14. An article transporting/storing apparatus according to claim 10; wherein said cover comprises a flexible bag enveloping the article.

15. An article transporting/storing apparatus according to claim 10; wherein said cover comprises at least two flexible bags each enveloping the article.

16. An article transporting/storing apparatus according to claim 10; wherein said pallet has a coupling section for an upper section of another article transporting/storing apparatus detachably connecting thereto in the side contrary to said article-loading surface thereof.

17. An article transporting/storing apparatus comprising:

a pallet having an article loading-surface on which an article is to be placed;

four supports detachably attached to four corners of said pallet each in an erected state on the article-loading surface of said pallet;

a coupling unit which couples the two adjoining supports to be parallely movable with each other so that a distance between the two adjoining supports is adjustable; and a cover with information regarding the article displayed thereon and covering at least a portion of the article.

18. An article transporting/storing apparatus according to claim 17; wherein the coupling unit is constructed so as to correlatively adjust a space between two adjoining supports so that all spaces between two adjoining supports along the four edges of the pallet are changed at the same rate.

19. An article transporting/storing apparatus according to claim 17; wherein said supports detachably attached to said pallet and said coupling member coupling two adjoining supports to each other form a support unit foldable when detached from the pallet.

20. An article transporting/storing apparatus according to claim 17; wherein said cover comprises a flexible bag enveloping the article.

21. An article transporting/storing apparatus according to claim 17; wherein said cover comprises at least two flexible bags each enveloping the article.

22. An article transporting/storing apparatus according to claim 17; wherein said pallet has a coupling section for an upper section of another article transporting/storing apparatus detachably connecting thereto in the side contrary to said article-loading surface thereof.

23. An article transporting/storing apparatus comprising:

a pallet for placing an article thereon;

a plurality of supports detachably attached to said pallet so that said supports surround said article placed on said pallet; and a coupling unit for coupling two adjoining supports so that a space between the two adjoining supports can be adjusted;

wherein the plurality of supports and said coupling unit form a support unit foldable when the supports are removed from said pallet, and an opening is formed in said pallet so that, when the plurality of pallets with said support unit removed therefrom respectively are piled on each other, a space for accommodating said folded support unit therein can be formed.

24. An article transporting/storing apparatus according to claim 23 further comprising a positioning unit for positioning said pallets when said support unit are removed therefrom and a plurality of said pallets are piled on each other.

25. An article transporting/storing apparatus according to claim 23; wherein said opening is formed with a size allowing maintenance of the state where said support unit inserted therein is erected.

26. An article transporting/storing apparatus according to claim 23; wherein position, area, and form of said opening are so set that, when said support unit are removed therefrom and a plurality of said pallets are piled on each other, said opening of said pallets are aligned and opposite to each other.

27. An article transporting/storing apparatus according to claim 23; wherein said opening is formed in a section of said pallet other than the article-loading surface thereof.

28. An article transporting/storing apparatus according to claim 23; wherein said opening is formed on a support unit holding plate detachably attached to a main body of said pallet.

29. An article transporting/storing apparatus according to claim 23; wherein a portion of said support unit is formed with a size larger as compared to that of said opening, and this portion of said support unit having a larger size can be engaged with a periphery of said opening.

30. An article transporting/storing apparatus according to claim 23; wherein one end of said support unit is formed with a size larger than that of said opening, this end of said support unit having a larger size can be engaged with a periphery of said opening, and assuming that N is an integer of 2 or more, T is the thickness of said pallet, and L is a full length of one support unit, the values of T and L are set according to the equation $(N-1)\times T=L$.

31. An article transporting/storing apparatus according to claim 30; wherein a number of said opening formed in said pallet is set to N.

32. An article transporting/storing apparatus according to claim 30; wherein, assuming that n is an integer of 1 or more, a value of $n\times N\times T$ is not more than a value obtained by subtracting 3 cm from a height of an article inlet port of a space for accommodating article therein in a transporting device and further values of N and T are set to a value larger not less than a value obtained by subtracting 10 cm from a height of said article inlet port.

33. An article transporting/storing apparatus according to claim 23; wherein, assuming that, when an article transporting/storing apparatus is assembled with one unfolded support unit assembled thereto, a total height of said pallet and support unit is H and also that n is an integer of 1 or more, a value of H×n is not more than a value obtained by subtracting 3 cm from a height of an article-inlet port of a space for accommodating article therein in a transport device, and a value of H is set to a value not less than a value obtained by 10 cm from a height of said article-inlet port.

34. An article transporting/storing apparatus according to claim 23; wherein, assuming that the thickness of said pallet is T and m is an integer of 2 or more, a value of T is set so that a value of m×T is not more than a value obtained by subtracting 3 cm from a height of an article inlet port of a space for accommodating article therein in a transporting apparatus and not less than a value obtained by subtracting 10 cm from a height of said article inlet port.

35. An article transporting/storing apparatus according to claim 23; wherein said opening is formed at a position closer to a side edge of said pallet than to a center thereof.

36. An article transporting/storing apparatus according to claim 23 further comprising:

four supports detachably attached to said pallet each in the substantially erected state against an article-loading surface of said pallet; wherein said coupling unit is constructed so as to correlatively adjusts a space between the two adjoining supports so that the spaces between the two adjoining supports is changed at the same rate.

37. An article transporting/storing apparatus according to claim 23 further comprising:

four supports detachably attached to said pallet each in the substantially erected state against an article-loading surface of said pallet; wherein said coupling unit is constructed so as to correlatively adjusts a space between two adjoining supports so that a space between two adjoining supports and that between other two adjoining supports located at opposite positions to the former two adjoining supports respectively are changed at the same rate.

38. An article transporting/storing apparatus according to claim 23 further comprising:

four supports detachably attached to said pallet each in the substantially erected state against an article-loading surface of said pallet; wherein said coupling unit has first and second joints attached to each support in the longitudinal direction, and first and second coupling members each for coupling two adjoining supports; wherein, when said four supports are attached to said pallet, said second joint is located under said first joint, and said first and second coupling members cross each other;

each of said first coupling members has one edge thereon in the longitudinal direction rotatably connected to said first joint attached to one of the two adjoining supports located side by side and at the same time has the other edge thereof in the longitudinal direction rotatably connected to said second joint attached to the other one of the two adjoining supports;

each of said second coupling member has one edge thereof in said longitudinal direction rotatably connected to said first joint attached to the other one of the two adjoining supports and at the same time has the other edge thereof in the longitudinal direction rotatably connected to said second joint attached to the one (former) support of the two adjoining supports; and at least one of said first and second joints is assembled with the respective support so that said joint can be moved in the longitudinal direction thereof.

39. An article transporting/storing apparatus according to claim 23 comprising:

said first to fourth supports detachably attached to said pallet each in the substantially erected state against an article-loading surface of said pallet;

wherein said coupling unit has, first to third joints attached to each of said first to fourth supports along the longitudinal direction, and first and second coupling members each for coupling, said first and second supports, second and third supports, third and fourth supports, and fourth and first supports each located side by side to each other;

where said four supports are attached to said pallet, said second and third joints are located under said first joint, said second joint is located at said third joint, and said first and second coupling members cross each other;

said first and second coupling members provided between two adjoining supports have one edges thereof in the longitudinal direction rotatably connected to said first joints attached to said first and second supports respectively and at the same time has the other edges thereof in the longitudinal direction rotatably connected to said second joint attached to said second and first supports respectively;

the first and second coupling members provided between said second and third supports located side by side have one edges thereof in the longitudinal direction rotatably connected to said first joints attached to said second and third supports respectively and at the same time have the other edges thereof in the longitudinal direction rotatably connected to said third joints attached to said third and second supports respectively;

the first and second coupling members provided between said third and fourth supports located side by side have one edges thereof in the longitudinal direction rotatably co ected to said first joints attached to said third and fourth supports respectively and at the same time ave the other edges thereof in the longitudinal direction rotatably connected o said second joints attached to said fourth and third supports respectively;

the first and second coupling members provided between said fourth and first supports located side by side have one edges thereon in the longitudinal direction rotatably connected to said first joints attached to said fourth and first supports respectively and at the same time have the other edges thereof in the longitudinal direction rotatably connected to said third joints attached to said first and fourth supports respectively; and at least said second and third joints of said first to third joints are assembled to the respective support so that said joints can be moved in the longitudinal direction thereof.

40. An article transporting/storing apparatus comprising:

a pallet for placing an article thereon;

a plurality of supports detachably attached to said pallet such that they surround the article;

a coupling unit for coupling two adjoining supports to each other so that a space between the two adjoining supports can be adjusted; and a ceiling plate detachably placed on said supports and having a drop-preventing unit for the article placed thereon.

41. An article transporting/storing apparatus comprising:

a pallet for placing an article thereon;

a plurality of supports detachably attached to said pallet such that they surround the article;

a coupling unit for coupling two adjoining supports to each other so that a space between the two adjoining supports can be adjusted; and a ceiling plate detachably placed on said supports, wherein an accommodation hole for accommodating said supports detached from said pallet and the coupling units for the supports or the coupling members each constituting the coupling unit is formed in said ceiling plate.

42. An article transporting/storing apparatus comprising:

a pallet for placing an article thereon;

a plurality of supports detachably attached to said pallet such that they surround the article;

a coupling unit for coupling two adjoining supports to each other so that a space between the two adjoining supports can be adjusted; and a protecting unit for shielding at least a portion of a space between two adjoining supports.

43. An article transporting/storing apparatus comprising:

a pallet for placing an article thereon;

a plurality of supports detachably attached to said pallet such that they surround the article; and a coupling unit for coupling two adjoining supports to each other so that a space between the two adjoining supports can be adjusted, wherein said pallet has a coupling section for an upper section of other article transporting/storing apparatus detachably coupled thereto on a side opposite to the article-loading surface thereof.

44. An article transporting/storing apparatus comprising:

a pallet for placing an article thereon;

first to fourth supports detachably attached to said pallet each in the substantially erected state against said article-loading surface of said pallet; and a coupling unit for coupling two adjoining supports to each other so that a space between the two adjoining supports can be adjusted, wherein said coupling unit comprises first to third joints attached to each of said first to fourth supports respectively, and first and second coupling members connecting the first and second supports, second and third supports, third and fourth supports, and fourth and first supports each located side by side to each other; and when said four supports are attached to said pallet, said second and third joints are located under said first joint and at the same time said second joint is located under said third joint and said first and second coupling members cross each other;

said first and second coupling members provided between said first and second supports located side by side have one edges thereof in the longitudinal direction rotatably connected to said first joints attached to said first and second supports respectively and at the same time has the other edges thereof in the longitudinal direction rotatably connected to said second joints attached to said second and first supports respectively;

said first and second coupling members provided between said second and third supports located side by side have one edges thereof in the longitudinal direction rotatably connected to said first joints attached to said second and third supports respectively and at the same time has the other edges thereof in the longitudinal direction rotatably connected to said third joints attached to said third and second supports respectively;

said first and second coupling members provided between said third and fourth supports located side by side have one edges thereof in the longitudinal direction rotatably connected to said first joints attached to said third and fourth supports respectively and at the same time the other edges thereof in the longitudinal direction rotatably connected to said second joints attached to said fourth and third supports respectively;

said first and second coupling members provided between said fourth and first supports located side by side have one edges thereon in the longitudinal direction rotatably connected to said first joints attached to said fourth and first supports respectively and at the same time have the other edges thereof in the longitudinal direction rotatably connected to said third joints attached to said first and fourth supports respectively;

and at least said second and third joints of the first to third joints are assembled to the respective supports so that the joints can be moved in the longitudinal direction.

* * * * *